US010557402B2

(12) United States Patent
Le Roy et al.

(10) Patent No.: US 10,557,402 B2
(45) Date of Patent: Feb. 11, 2020

(54) NOISE SUPPRESSION SYSTEMS

(71) Applicant: Kohler Co., Kohler, WI (US)

(72) Inventors: Tyler W. Le Roy, Plymouth, WI (US); Todd A. Baumann, Howards Grove, WI (US); Dale T. Snyder, Oshkosh, WI (US); Amy Adams, Elkhart Lake, WI (US); Robert J. Danforth, III, Sheboygan Falls, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 16/057,121

(22) Filed: Aug. 7, 2018

(65) Prior Publication Data

US 2018/0340463 A1 Nov. 29, 2018

Related U.S. Application Data

(63) Continuation of application No. 15/623,913, filed on Jun. 15, 2017, now Pat. No. 10,077,707, which is a (Continued)

(51) Int. Cl.
*F01P 11/12* (2006.01)
*F04D 29/66* (2006.01)

(Continued)

(52) U.S. Cl.
CPC ..... *F01P 11/12* (2013.01); *F04D 29/424* (2013.01); *F04D 29/4213* (2013.01); *F04D 29/582* (2013.01); *F04D 29/665* (2013.01)

(58) Field of Classification Search
CPC .... F01P 11/12; F04D 29/4213; F04D 29/424; F04D 29/582; F04D 29/665

(Continued)

(56) References Cited

U.S. PATENT DOCUMENTS 2,270,546 A * 1/1942 Neuland ..... F01P 5/08 123/41.64
3,147,814 A * 9/1964 Suhre ..... B60K 11/06 123/41.65

(Continued)

FOREIGN PATENT DOCUMENTS

CN 2151261 12/1993
CN 2787715 6/2006

(Continued)

OTHER PUBLICATIONS

Corresponding European Search Report for Application No. 14187406.5 dated Feb. 27, 2018. EP.

(Continued)

*Primary Examiner* — J. Todd Newton
(74) *Attorney, Agent, or Firm* — The Belles Group, P.C.

(57) ABSTRACT

An apparatus or system includes a component that generates or transfers noise having a frequency within a noise frequency range. The component may include a boundary. The apparatus or system may be an engine in some examples. The engine may additionally include a micro-perforated sheet positioned a distance from the boundary. The micro-perforated sheet may include a plurality of micro-perforated holes, and may be configured to absorb sound within an absorption frequency range based on parameters of the micro-perforated sheet. The parameters may include the distance from the boundary and dimensions of the micro-perforated holes, and may be set such that the absorption frequency range overlaps the noise frequency range.

22 Claims, 88 Drawing Sheets

Related U.S. Application Data continuation of application No. 14/045,657, filed on Oct. 3, 2013, now Pat. No. 9,752,494, which is a continuation-in-part of application No. 13/839,907, filed on Mar. 15, 2013, now Pat. No. 9,388,731.

(51) Int. Cl.
*F04D 29/42* (2006.01)
*F04D 29/58* (2006.01)

(58) Field of Classification Search
USPC ..... 415/119
See application file for complete search history.

(56) References Cited

U.S. PATENT DOCUMENTS 3,249,172 A 5/1966 De Lorean
3,521,726 A * 7/1970 Fritz ..... F02B 77/13 123/195 C
3,530,840 A * 9/1970 Fritz ..... F02B 77/13 123/195 C
3,601,101 A * 8/1971 Thien ..... F01P 1/02 123/41.62
3,618,691 A * 11/1971 Honda ..... F01P 1/02 123/41.6
3,693,602 A * 9/1972 Thien ..... F02B 77/13 123/195 C
3,695,386 A * 10/1972 Thien ..... F02B 77/13 123/195 C
3,734,234 A 5/1973 Wirt
3,762,497 A * 10/1973 Hatz ..... F01P 11/12 181/204
3,794,377 A * 2/1974 Wachsmuth ..... F04B 39/0033 181/287
3,796,277 A * 3/1974 Gordon ..... A01D 34/81 165/135
3,856,439 A * 12/1974 Moehrbach ..... F04B 39/0038 181/204
3,884,322 A 5/1975 Nemschoff
3,949,727 A * 4/1976 Thien ..... F02B 77/13 123/198 E
3,951,228 A * 4/1976 Schnell ..... G10K 11/16 181/200
3,963,094 A * 6/1976 Nowikas ..... E04B 1/8218 181/198
3,964,462 A * 6/1976 Thien ..... F02B 77/13 123/198 E
3,978,919 A * 9/1976 Fachbach ..... F01P 11/10 165/135
3,996,913 A * 12/1976 Hamparian ..... F02F 7/008 123/198 R
4,077,383 A * 3/1978 Hatz ..... F02B 77/13 123/195 C
4,137,888 A * 2/1979 Allan ..... F02B 77/13 123/198 E
RE29,923 E * 3/1979 Thien ..... F02B 77/13 123/198 E
4,142,502 A * 3/1979 Nakano ..... F02B 67/00 123/195 A
4,183,344 A * 1/1980 Kirchweger ..... F02B 77/13 123/195 A
4,211,058 A * 7/1980 Larsen ..... A01D 34/82 56/17.5
4,222,360 A * 9/1980 Fujikawa ..... F01P 1/02 123/195 C
4,231,447 A 11/1980 Chapman
4,241,806 A 12/1980 Metzger
4,291,080 A 9/1981 Ely et al.
4,312,421 A 1/1982 Pioch
4,324,208 A * 4/1982 Danckert ..... F02B 77/13 123/195 C
4,369,744 A * 1/1983 Kubozuka ..... F02F 7/008 123/195 C
4,412,516 A * 11/1983 Hayashi ..... F02B 77/13 123/195 C
4,421,201 A 12/1983 Nelsen et al.
4,608,946 A * 9/1986 Tanaka ..... F01N 13/002 123/2
4,622,923 A * 11/1986 Nishimura ..... F02B 63/04 123/198 E
4,733,750 A * 3/1988 Poirier ..... F02B 63/04 181/202
4,836,123 A * 6/1989 Grinde ..... B63J 3/04 114/382
4,850,093 A 7/1989 Parente
4,871,922 A * 10/1989 Heinrich ..... F02B 63/04 290/1 B
4,899,526 A 2/1990 Harris
5,113,819 A 5/1992 Murakawa et al.
5,297,517 A * 3/1994 Brandt ..... F02B 77/13 123/198 F
5,672,052 A * 9/1997 Ishida ..... F04C 29/066 181/202
5,850,061 A * 12/1998 Klompenhouwer .. E04B 1/8218 181/202
5,899,174 A * 5/1999 Anderson ..... F02B 63/04 123/2
5,929,394 A * 7/1999 Westerbeke, Jr. .... E04B 1/8218 181/202
6,167,976 B1 1/2001 O'Neill et al.
6,194,052 B1 2/2001 Knipstein
6,290,022 B1 9/2001 Wolf et al.
6,358,106 B1 * 3/2002 Herrera ..... F02B 61/045 181/204
6,358,590 B1 3/2002 Blair et al.
6,449,934 B1 * 9/2002 Reimers ..... A01D 69/02 181/204
6,617,002 B2 9/2003 Wood
6,793,465 B2 * 9/2004 Stallings ..... F04B 39/0033 417/312
6,805,219 B2 * 10/2004 Yasuda ..... F02F 7/006 123/198 E
6,875,066 B2 * 4/2005 Wolaver ..... F01N 1/24 181/204
6,918,740 B2 7/2005 Liu
7,201,254 B2 * 4/2007 Redmann ..... G10K 11/161 181/204
7,482,705 B2 * 1/2009 Piercey, III ..... F02B 77/11 290/1 A
7,490,697 B1 * 2/2009 Williamson, Jr. ..... B60P 3/36 181/200
7,540,354 B2 6/2009 Morin et al.
7,635,048 B2 * 12/2009 Copley ..... F02B 77/13 181/200
7,677,359 B2 3/2010 Vigran et al.
7,874,400 B2 * 1/2011 Teisseyre ..... F04D 29/669 181/200
7,902,705 B2 * 3/2011 Gravlin ..... B62B 3/02 290/1 A
7,963,362 B2 * 6/2011 Lidoine ..... F02C 7/045 181/214
8,136,626 B1 * 3/2012 Aliev ..... F24F 13/24 181/198
8,232,660 B2 * 7/2012 Ito ..... F02B 63/04 290/1 A
8,336,804 B2 * 12/2012 Hoetzeldt ..... B32B 3/08 181/288
8,408,358 B1 4/2013 Hermiller et al.
8,408,359 B2 4/2013 Lu et al.
8,544,596 B2 * 10/2013 Dupont ..... F02C 7/20 181/203
8,601,772 B2 * 12/2013 Turpin ..... F01N 1/00 181/204
8,651,233 B2 * 2/2014 Ayle ..... G10K 11/172 181/292
8,702,378 B2 * 4/2014 Foster ..... F02K 1/822 415/119
8,872,361 B2 * 10/2014 Janscha ..... F02B 63/04 290/1 A

(56) References Cited

U.S. PATENT DOCUMENTS

| | | | | |
|---|---|---|---|---|
| 9,252,640 | B2 * | 2/2016 | Gillett | F02B 63/044 |
| 9,404,417 | B2 * | 8/2016 | Norrick | F02B 63/044 |
| 9,514,734 | B1 * | 12/2016 | Jones | G10K 11/172 |
| 9,546,602 | B2 * | 1/2017 | Julliard | B64D 33/06 |
| 9,641,043 | B1 * | 5/2017 | Leedy | E06B 7/08 |
| 9,752,494 | B2 | 9/2017 | Le Roy et al. | |
| 9,759,447 | B1 * | 9/2017 | Mathur | F24F 13/24 |
| 10,024,483 | B2 * | 7/2018 | Leonhard | B23Q 11/0891 |
| 2001/0007292 | A1 | 7/2001 | Yabf | |
| 2003/0141144 | A1 * | 7/2003 | Wilson | B32B 3/20 181/292 |
| 2004/0083701 | A1 | 5/2004 | Brower | |
| 2005/0117970 | A1 | 6/2005 | Gaertner et al. | |
| 2005/0191169 | A1 * | 9/2005 | Cuvelier | F02C 7/045 415/119 |
| 2006/0103171 | A1 | 5/2006 | Blomeling et al. | |
| 2006/0108813 | A1 * | 5/2006 | Goebert | B62D 25/10 293/115 |
| 2006/0144637 | A1 * | 7/2006 | Swartz | F01C 21/10 181/198 |
| 2006/0169532 | A1 * | 8/2006 | Patrick | F02C 7/045 181/210 |
| 2006/0185931 | A1 * | 8/2006 | Kawar | G06F 1/18 181/202 |
| 2007/0034446 | A1 | 2/2007 | Proscia et al. | |
| 2008/0053746 | A1 | 3/2008 | Albert et al. | |
| 2008/0056882 | A1 | 3/2008 | Clay et al. | |
| 2008/0108032 | A1 | 5/2008 | Tuhy et al. | |
| 2008/0128201 | A1 * | 6/2008 | Yamaguchi | B32B 3/266 181/286 |
| 2008/0152480 | A1 | 6/2008 | Ishikawa et al. | |
| 2008/0185217 | A1 | 8/2008 | Baude | |
| 2008/0295518 | A1 | 12/2008 | Reba et al. | |
| 2009/0044930 | A1 * | 2/2009 | Hazelton | F02B 77/11 165/136 |
| 2010/0212999 | A1 | 8/2010 | Marion et al. | |
| 2011/0002775 | A1 | 1/2011 | Ma et al. | |
| 2011/0139542 | A1 * | 6/2011 | Borroni | B32B 3/266 181/290 |
| 2011/0147117 | A1 | 6/2011 | Seibt et al. | |
| 2011/0159797 | A1 | 6/2011 | Beltman et al. | |
| 2012/0267191 | A1 | 10/2012 | Danner et al. | |
| 2014/0027198 | A1 | 1/2014 | Abram et al. | |
| 2014/0034416 | A1 | 2/2014 | Liu | |
| 2014/0151000 | A1 | 6/2014 | Havel | |
| 2014/0271132 | A1 * | 9/2014 | Le Roy | F04D 29/582 415/119 |
| 2014/0271134 | A1 * | 9/2014 | Le Roy | F01P 11/12 415/119 |
| 2016/0281559 | A1 | 9/2016 | Gommans | |
| 2017/0204881 | A1 | 7/2017 | Mahalatkar et al. | |
| 2017/0241311 | A1 | 8/2017 | Bogard et al. | |

FOREIGN PATENT DOCUMENTS

| | | | | |
|---|---|---|---|---|
| CN | 1903639 | | 1/2007 | |
| CN | 2918755 Y | * | 7/2007 | F02B 77/13 |
| CN | 101205937 | | 6/2008 | |
| CN | 201502421 | | 6/2010 | |
| CN | 101769189 A | | 7/2010 | |
| CN | 201730658 U | | 2/2011 | |
| CN | 202073641 U | * | 12/2011 | F02B 77/13 |
| CN | 202413939 | | 9/2012 | |
| CN | 102044239 B | | 1/2013 | |
| CN | 205206909 U | | 5/2016 | |
| CN | 205689271 U | | 11/2016 | |
| CN | 103670602 B | | 1/2017 | |
| DE | 3120888 | | 12/1982 | |
| DE | 102010039463 A1 | * | 2/2012 | G10K 11/162 |
| EP | 1172059 | | 1/2002 | |
| GB | 880194 | | 10/1961 | |
| JP | H1193670 | | 4/1999 | |
| JP | 2003022077 | | 1/2003 | |
| JP | 2004229561 | | 8/2004 | |
| NL | 1029313 | | 12/2006 | |
| WO | 8103201 | | 11/1981 | |
| WO | 2008148443 | | 12/2008 | |

OTHER PUBLICATIONS

Tao, Z., et al., "Prediction of Sound-Absorbing Performance of Micro-Perforated Panels using the Transfer Matrix Method," University of Kentucky, 2005, pp. 1-4, Society of Automotive Engineers, Inc.

Liu, J., et al., "Enhancing micro-perforated panel attenuation by partitioning the adjoining cavity," Applied Acoustics 71 (2010), pp. 120-127.

Blanks, Joseph, "Optimal Design of an Enclosure for a Portable Generator," Virginia Polytechnic Institute and State University, Feb. 7, 1997, pp. 1-84, Blacksburg, VA.

Maa, Dah-You, "Potential of Microperforated Panel Absorber," J. Acoust. Soc. Am., 104 (5), Nov. 1998, pp. 2861-2866.

"Sound-Micro Noise Enclosures," Acoustical Surfaces, Inc., Chaska, MN.

Schultz, Theodore, "Acoustical Uses for Perforated Metals: Principles and Applications," Industrial Perforators Association, Inc., 1986, pp. 1-81.

"The new generation in sound absorbing", DeAmp Product Catalog, pp. 1-13, Norway.

Bolton, J Stuart; Lee, Seungkyu; and Martinson, Paul A., "Design of Multi-Chamber Silencers with Microperforated Elements",(2014). Publications of the Ray W. Herrick Laboratories. Paper 106.

Allam et al., "A New Type of Muffler Based on Microperforated Tubes", (2011 ). Journal of vibration and acoustics• Mar. 2011.

Tan et al., "Analysis of exhaust muffler with microperforated panel", (2013). Journal of Vibroengineering. June 2013. vol. 15, Issue 2. ISSN 1392-8716.

* cited by examiner

NOISE SUPPRESSION SYSTEMS

CROSS-REFERENCE TO RELATED APPLICATIONS

The present application is a continuation of U.S. patent application Ser. No. 15/623,913 filed Jun. 15, 2017, which is a continuation of U.S. patent application Ser. No. 14/045,657 filed Oct. 3, 2013 (now U.S. Pat. No. 9,752,494), which is a continuation-in-part of U.S. patent application Ser. No. 13/839,907 filed Mar. 15, 2013 (now U.S. Pat. No. 9,388,731); the entireties of which are incorporated herein by reference.

BACKGROUND OF THE INVENTION

The present invention generally relates to sound or noise suppression, and more particularly to systems and methods (hereinafter "systems") for reducing sound from various noisy components.

SUMMARY OF THE INVENTION

An engine includes a component that generates or transfers noise having energy within a specific frequency range. The component may include a boundary. The engine may additionally include a micro-perforated sheet positioned a distance from the boundary. The micro-perforated sheet may include a plurality of micro-perforated holes, slots, and/or slits, and may be configured to absorb sound within an absorption frequency range based on parameters of the micro-perforated sheet. The parameters may include the distance from the boundary and dimensions of the micro-perforated holes, and may be set such that the absorption frequency range overlaps the noise frequency range.

In some systems, the component may be or include a blower housing. In some systems, the boundary may be or include a scroll within the blower housing. In some systems, the parameters may be set such that the absorption frequency range overlaps a portion of the noise frequency range consisting of sound between 300-1500 Hz for tonal noise and sound between 800-3000 Hz for flow noise.

In other systems, the component may be an air cleaner. In still other systems, the component may be an engine cylinder. In some of these systems, the micro-perforated sheet may be a part of a cylinder wrap, the cylinder wrap positioned around at least a portion of an outer surface of the engine cylinder. In still other systems, the component may be a closure plate or an intake manifold. Where the component is an intake manifold, the boundary may include an outer surface of the intake manifold, and the micro-perforated sheet may be positioned around, and a distance from, the outer surface of the intake manifold.

Some examples may be directed to an outdoor maintenance machine that includes an internal combustion engine that generates engine sound having a frequency within an engine noise frequency range. The outdoor maintenance machine may additionally include an outdoor maintenance component driven by the internal combustion engine that generates or transmits component sound having a frequency within a component noise frequency range. The machine may also include a micro-perforated sheet that includes a plurality of micro-perforated holes. The micro-perforated sheet may absorb sound within an absorption frequency range based on parameters of the micro-perforated sheet. The parameters may include dimensions of the micro-perforated holes and a distance between the micro-perforated sheet and a boundary. The parameters may be set such that the absorption frequency range overlaps at least one of the engine noise frequency range and the component noise frequency range.

The boundary may include a surface of the internal combustion engine, a surface of the outdoor maintenance component, or a surface of a separate component.

The outdoor maintenance component may be or include a lawn mower blade. Alternatively, the outdoor maintenance component may be or include a snow blower blade, a tiller blade, or a chainsaw blade.

Some examples may be directed to a water transportation system that includes a component that generates or transfers noise within a specific frequency range, the component including a boundary. The water transportation system may additionally or alternatively include a micro-perforated sheet positioned a distance from the boundary and having a plurality of micro-perforated holes. The micro-perforated sheet may absorb sound within an absorption frequency range based on parameters of the micro-perforated sheet. The parameters may include the distance from the boundary and dimensions of the micro-perforated holes. The parameters may be set such that the absorption frequency range overlaps the noise frequency range.

The component may be or include a water tank of a toilet. Alternatively, the component may be or include a shower wall, and the boundary may be an outer surface of the shower wall. Alternatively, the component may be or include an electrical or water pump system for a whirlpool bathtub. Alternatively, the component may be or include a water drain, and wherein the boundary comprises a bottom surface of the water drain.

In some systems, the component may be a muffler. In one aspect, the muffler may include: a body including a first end, an opposing second end, and an internal cavity; a first micro-perforated end cap affixed to the first end, the first micro-perforated end cap comprising a first micro-perforated sheet having a plurality of micro-perforated holes, the first micro-perforated sheet configured to absorb sound within an absorption frequency range based on parameters of the first micro-perforated sheet; and a second end cap affixed to the second end.

In another aspect, the muffler may include: a body including a first end, an opposite second end, and an internal cavity; a first end cap affixed to the first end; a second end cap affixed to the second end; and a first micro-perforated baffle positioned in the internal cavity of the body between the first and second ends, the first micro-perforated baffle comprising a first micro-perforated sheet having a plurality of micro-perforated holes configured to absorb sound within an absorption frequency range based on parameters of the micro-perforated sheet.

In some systems, the component may be a generator set. The generator set may include: an internal combustion engine; an enclosure comprising a plurality of exterior walls and an internal space, the engine disposed in the internal space; an openable cover attached to enclosure that provides access to the internal space; and a micro-perforated interior cover barrier attached to the cover, the interior cover barrier comprising a micro-perforated sheet having a plurality of micro-perforated holes configured to absorb sound within an absorption frequency range based on parameters of the micro-perforated sheet.

BRIEF DESCRIPTION OF THE DRAWINGS

The features of the preferred embodiments will be described with reference to the following drawings where like elements are labeled similarly, and in which.

Figure 1A:
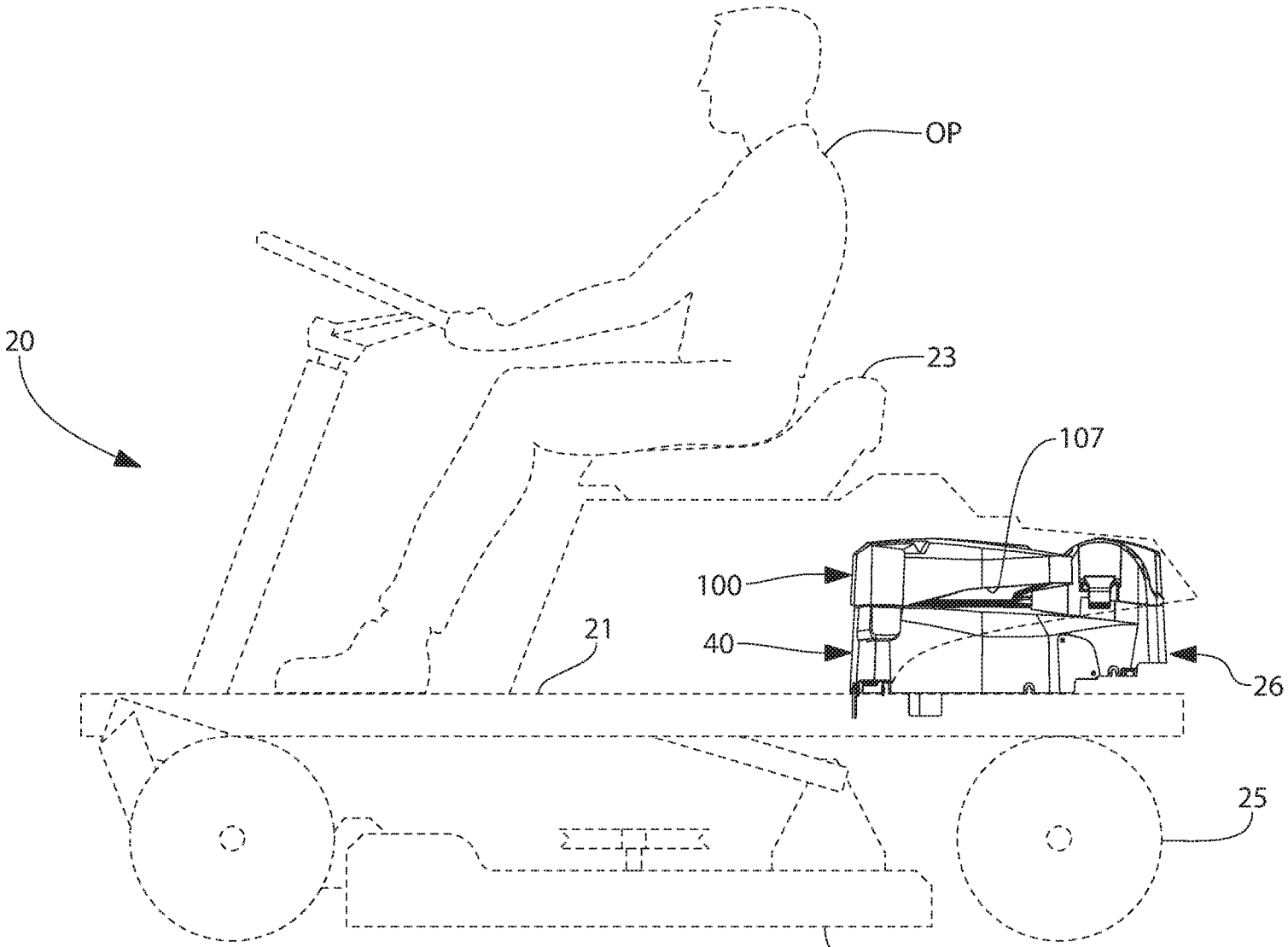
FIGS. 1A and 1B are side elevation and top plan views respectively of power equipment having an engine incorporating a noise suppression system according to the present disclosure.

All drawings are schematic and not necessarily to scale.

DETAILED DESCRIPTION OF EMBODIMENTS

The features and benefits of the present disclosure are illustrated and described herein by reference to exemplary embodiments. This description of exemplary embodiments is intended to be read in connection with the accompanying drawings, which are to be considered part of the entire written description. Accordingly, the present disclosure expressly should not be limited to such embodiments illustrating some possible non-limiting combination of features that may exist alone or in other combinations of features; the scope of the claimed invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "coupled," "affixed," "connected," "interconnected," and the like refer to a relationship wherein structures are secured or attached to one another either directly or indirectly through intervening structures, as well as both movable or rigid attachments or relationships, unless expressly described otherwise. The terms "sound" and "noise" may be used interchangeably herein unless specifically noted to the contrary.

Figure 1B:
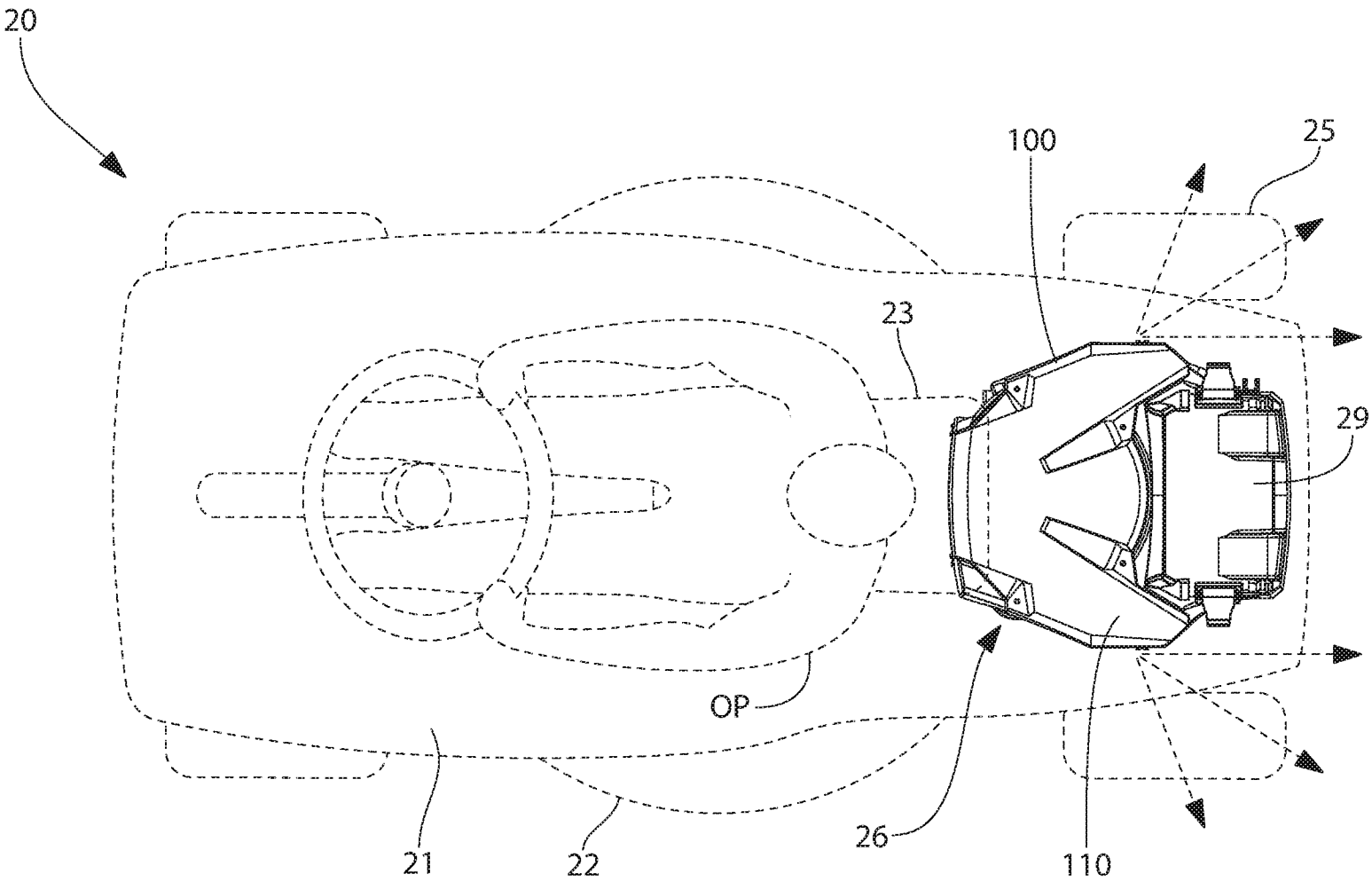
Figure 2:
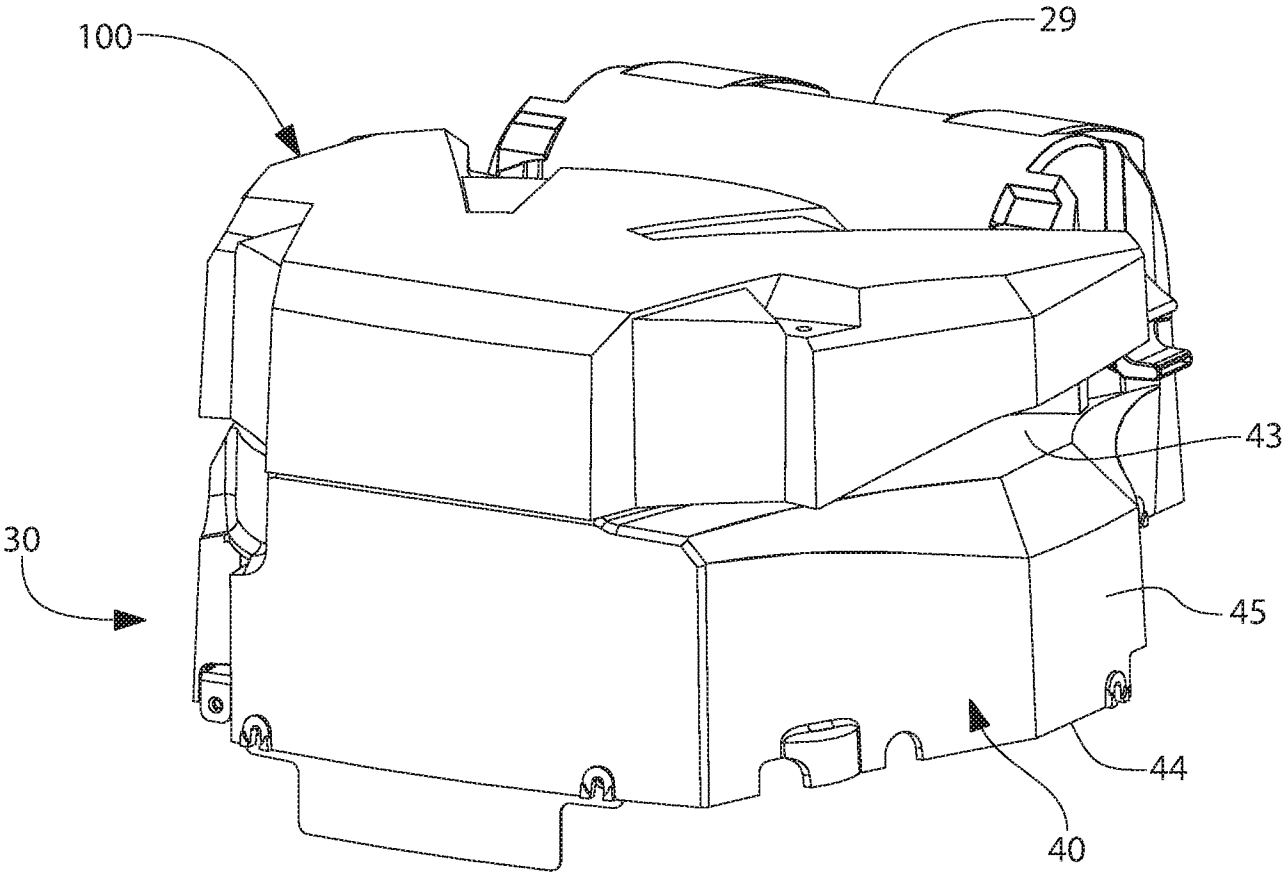
FIG. 2 is a front top perspective view of the cooling air blower of FIGS. 1A and 1B with noise suppression shroud.
Figure 3:
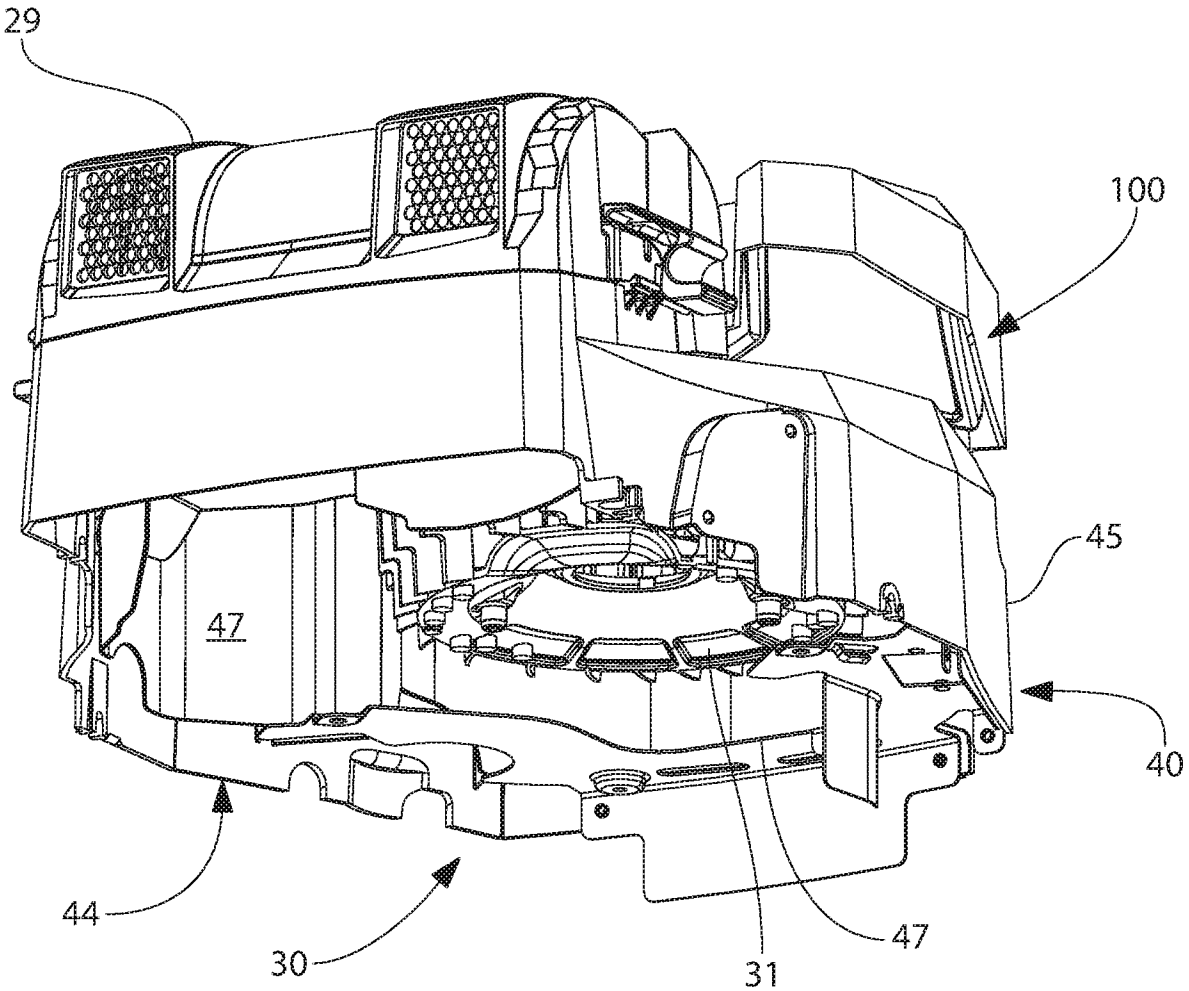
FIG. 3 is bottom front perspective thereof.
Figure 4A:
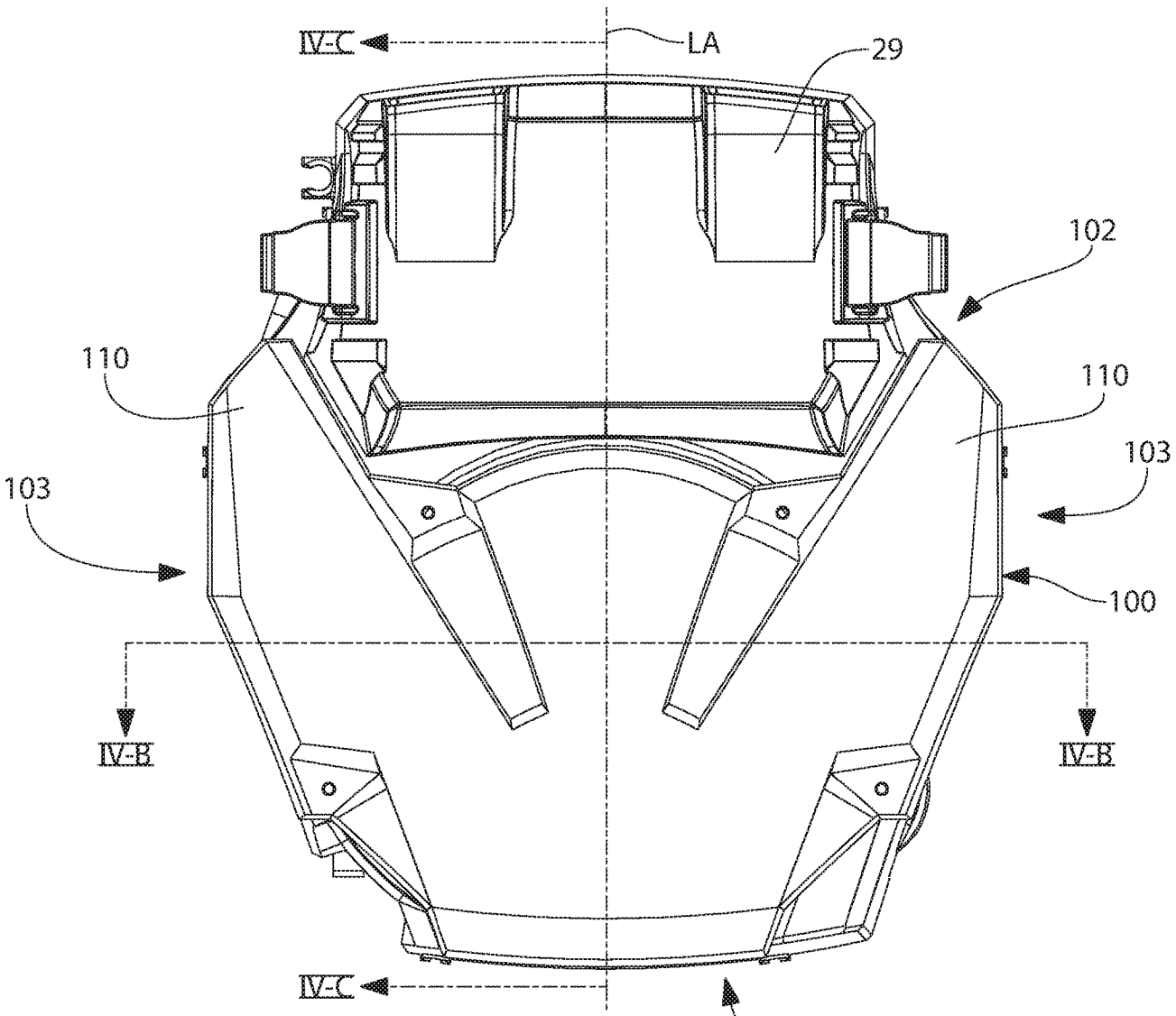
FIG. 4A is top plan view thereof.
Figure 4B:
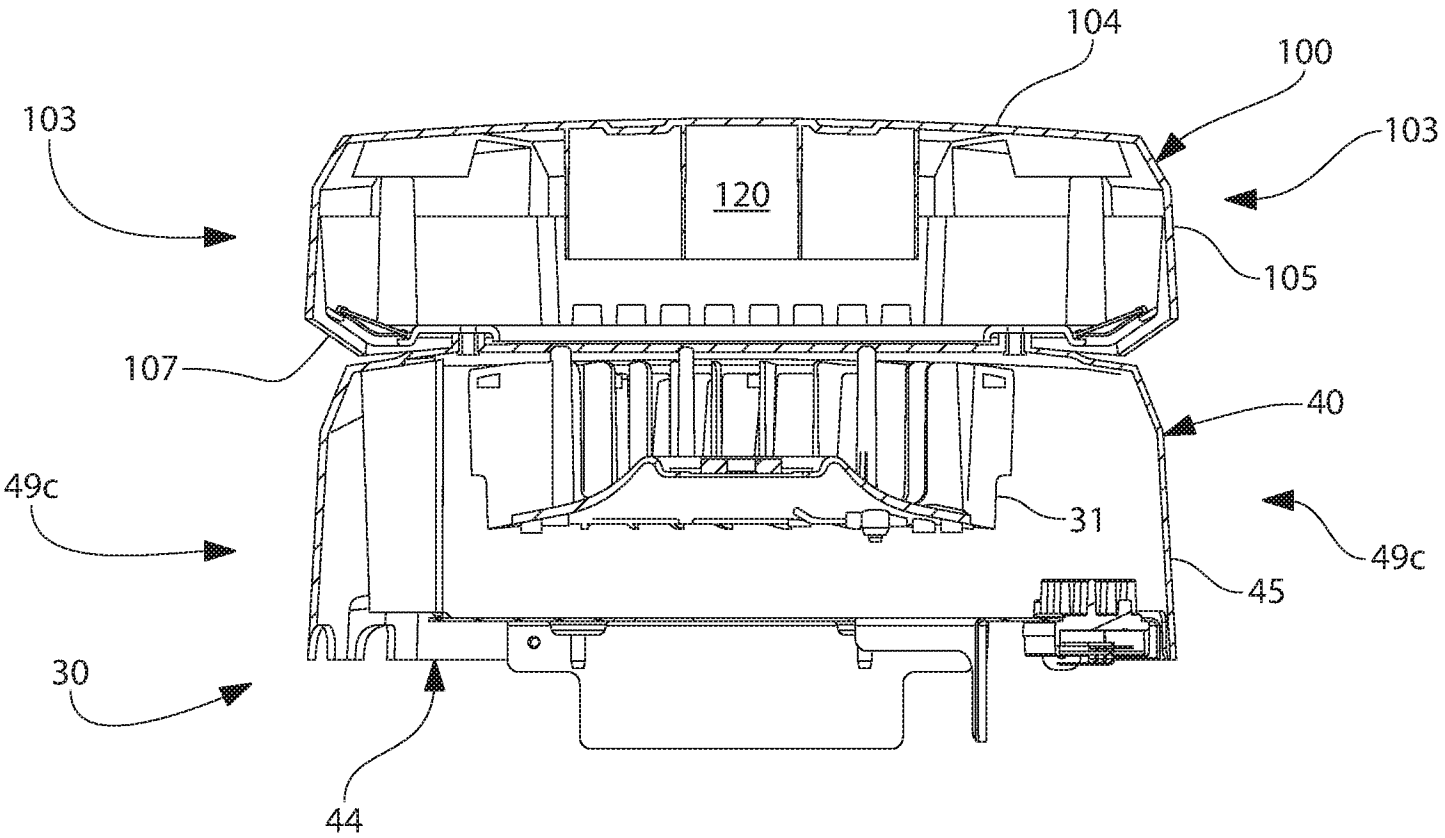
FIG. 4B is a transverse front cross-sectional view thereof.
Figure 4C:
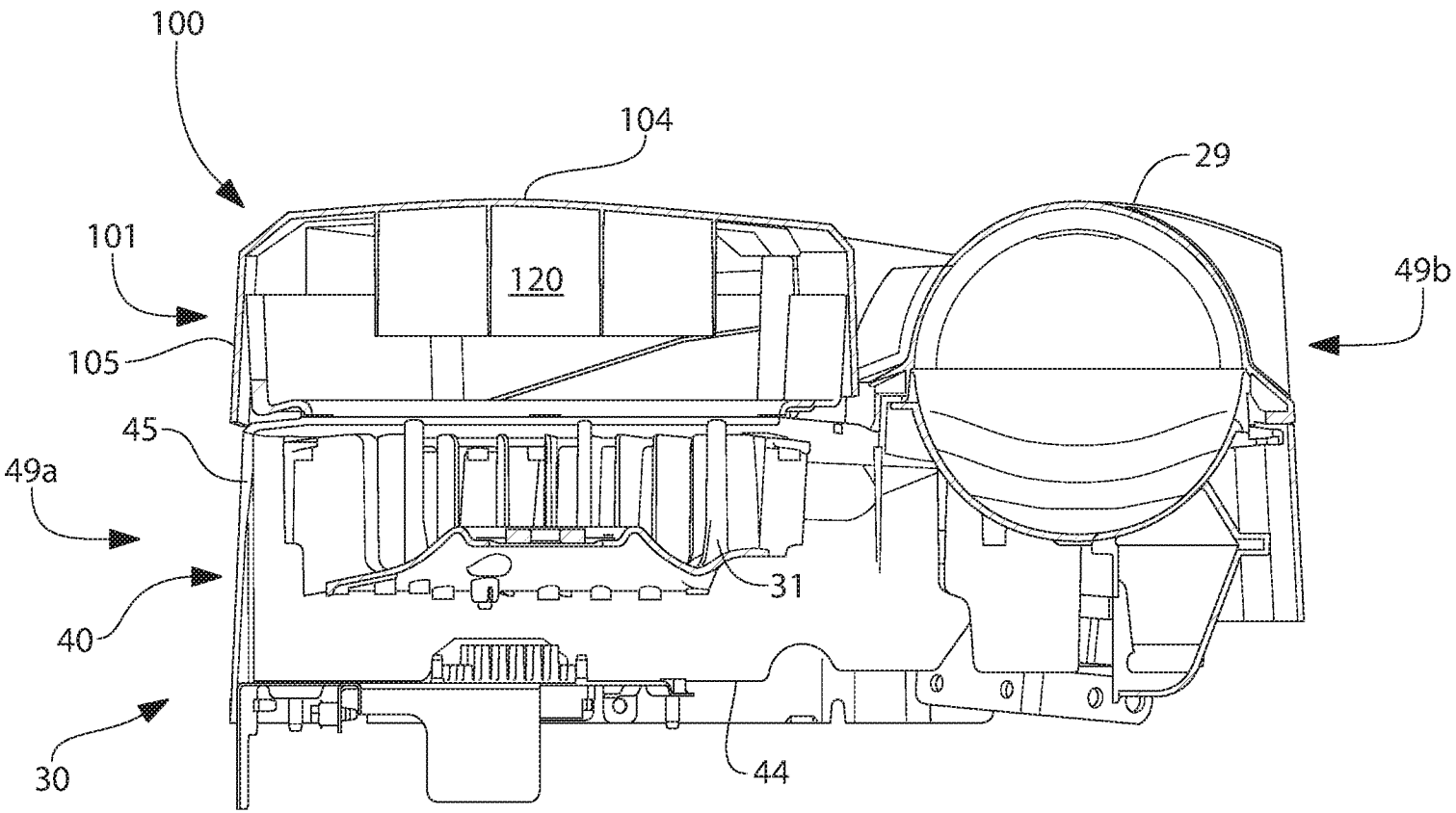
FIG. 4C is a longitudinal side elevation cross-sectional view thereof.
Figure 5:
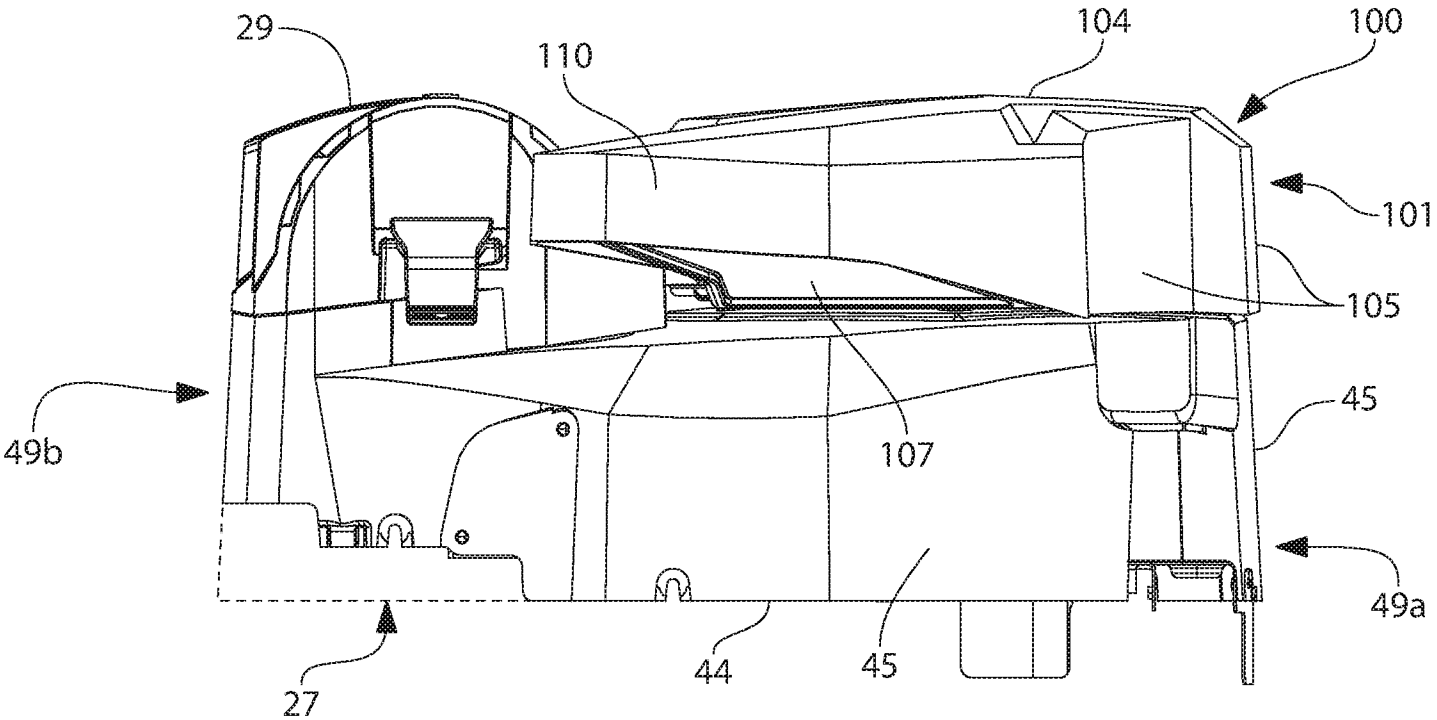
FIG. 5 is side elevation view thereof.
Figure 6:
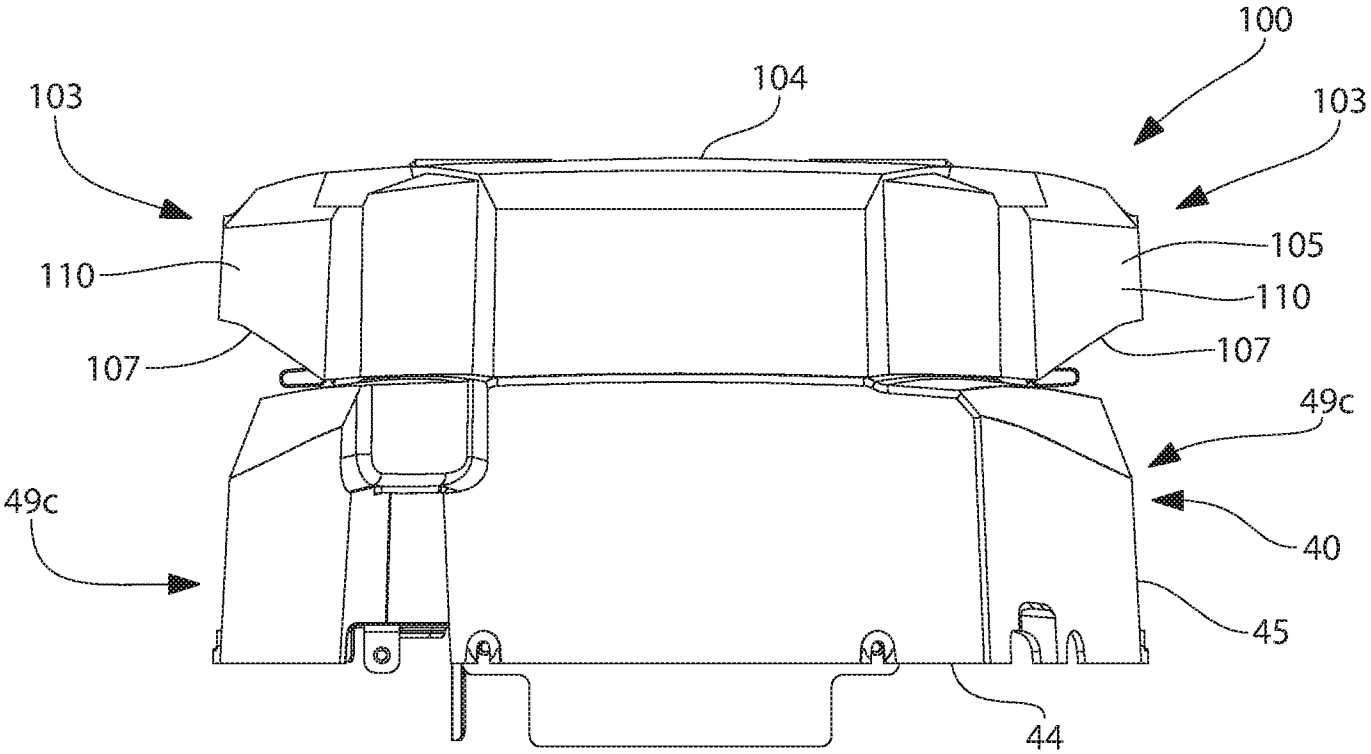
FIG. 6 is front elevation view thereof.
Figure 7:
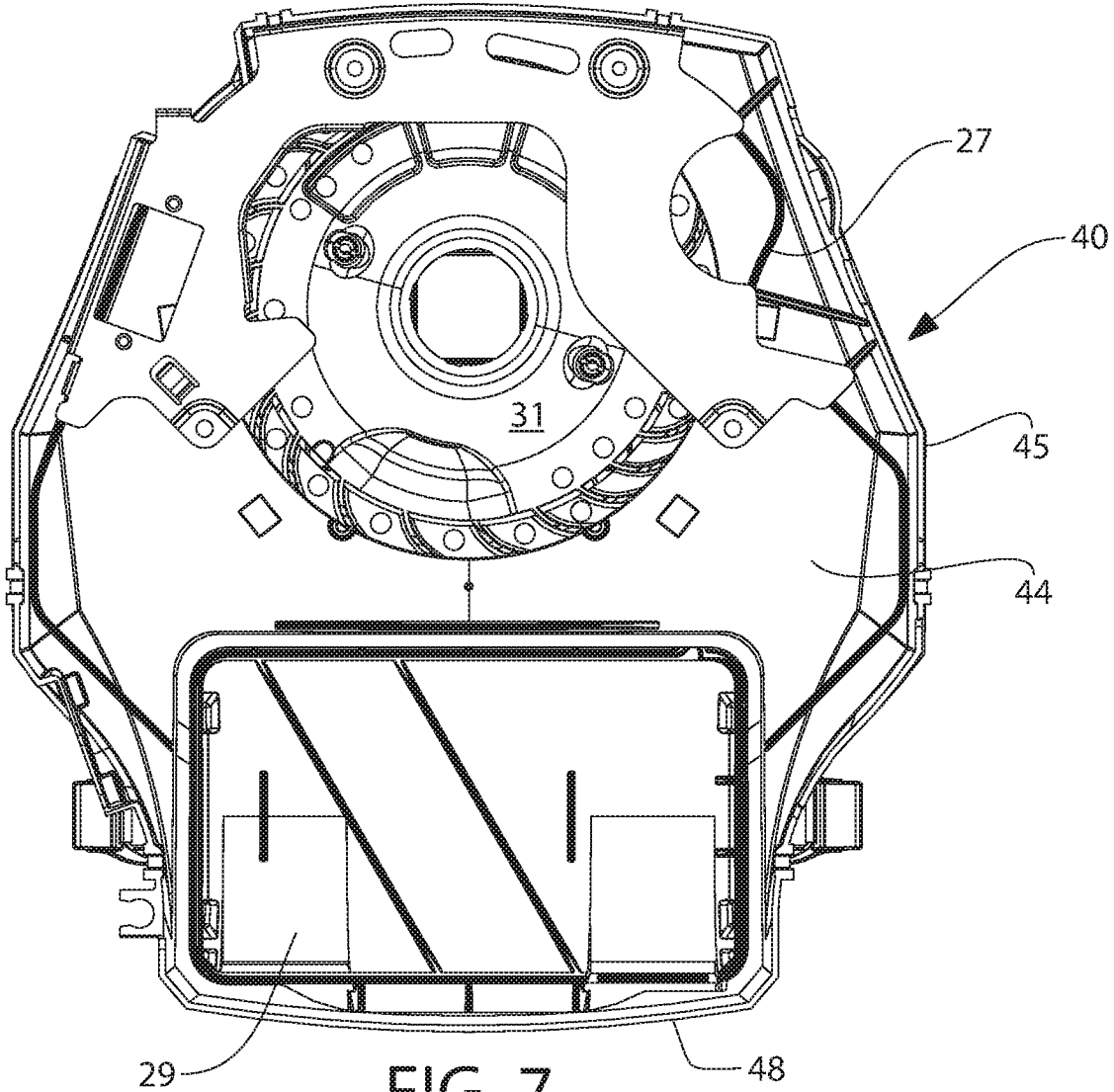
FIG. 7 is a bottom plan view thereof.
Figure 8:
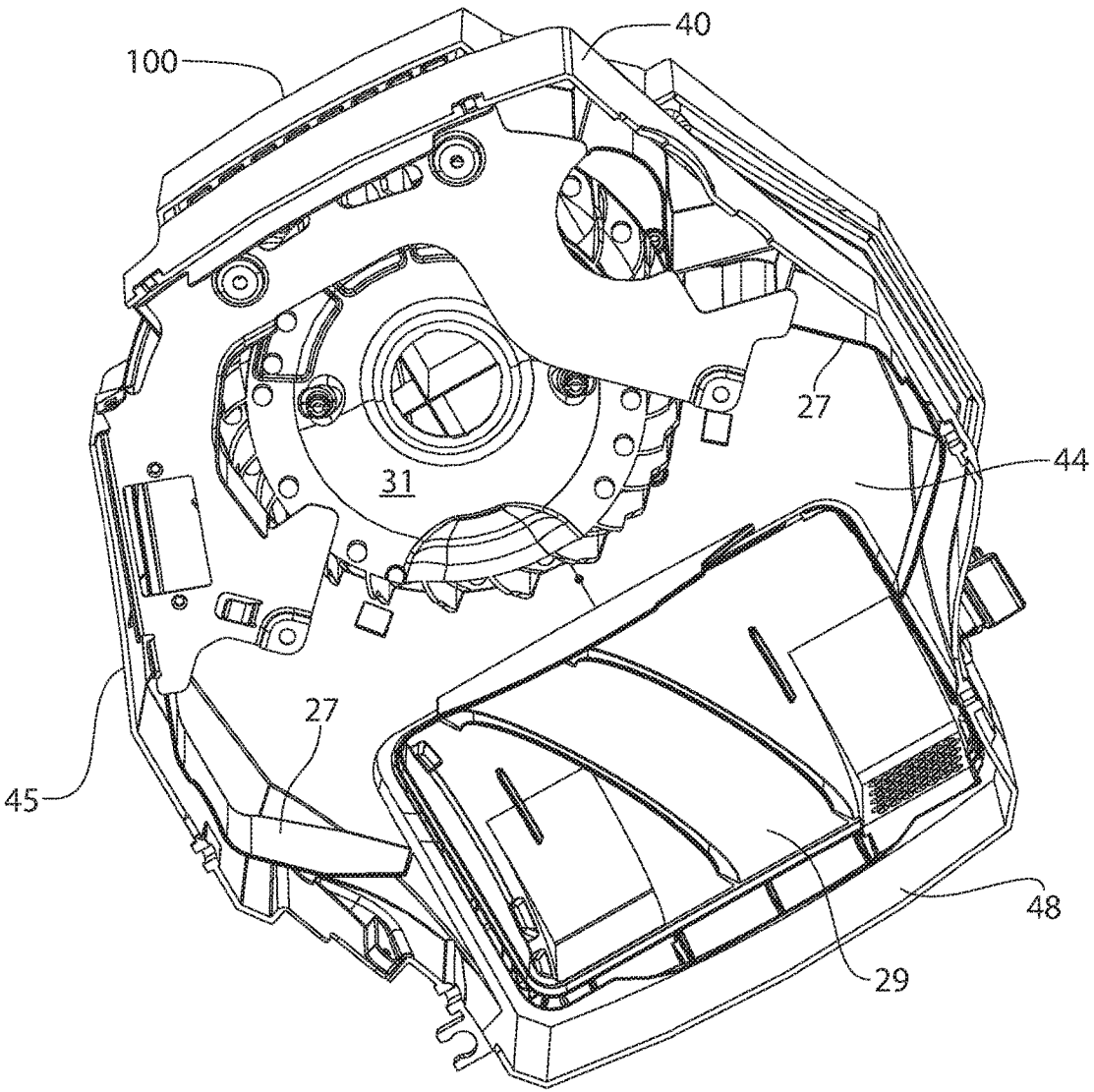
FIG. 8 is a bottom perspective view thereof.

FIGS. 1A and 1B show an exemplary piece of power equipment which may include a noise suppression system according to the present disclosure. In this non-limiting example, the power equipment may be a riding mower 20 comprised of a frame 21 with mowing deck 22, a seat 23 for an operator OP, wheels 25, and an engine 26 which provides the motive force to propel the mower along a surface and operate a rotating mowing blade (not shown) housed in the mowing deck. In this type of power equipment, the operator 25 may be positioned forward of the engine. The engine 26 may be any type of internal combustion engine operated on gasoline, diesel, or another suitable liquid or gaseous fuel source. While the engine 26 is shown in one orientation with inlet passages 110 directed away from an operator OP, in other systems, the engine 26 may be rotated about a vertical axis such that the inlet passages 110 may be positioned in other ways. Additionally or alternatively, in other systems, the engine 26 may be used with various other power equipment or systems, such as walk-behind lawn mowers, generators, pressure washers, or air compressors.

Referring to FIGS. 2-8, the engine 26 may be an air cooled engine including a fan (or blower) 30 and blower housing 40. The fan 30 and/or blower housing 40 may be mounted with (such as on top of) the engine (not shown in these figures for clarity). These figures show the fan 30, associated appurtenances, and a noise suppression shroud 100 to be further described herein.

The fan 30 may include, or be housed within, a blower housing 40. The blower housing 40 may be configured and dimensioned to receive and support a rotatable impeller 31 of the fan 30 comprised of a plurality of blades 32 which operates to draw in ambient air and distribute the cooling air flow over the engine 26. The housing 40 may define a longitudinal axis LA, front 49*a*, rear 49*b*, sides 49*c*, and an interior space 41 configured to house impeller 31 and may include portions sized at least slightly larger than the outside diameter of impeller 31 in the horizontal/lateral direction to define an airflow path, which will become apparent upon further description herein. The impeller 31 may rotate inside the housing 40 and be powered by a mechanical coupling to the drive shaft of engine 26. The blower housing 40 may be mounted directly onto the top of the engine 26 such as with threaded fasteners or another suitable coupling system. An air cleaner unit 29 may be provided which in some units may be positioned to the rear of the blower housing 40.

Any suitable type of fan impeller 31 may be provided. FIGS. 31-34 shows fan impeller 31 in the configuration of a mono-pitch design having blades 32 which are equally spaced around the circumference of the impeller. Fan impeller 31 with equally spaced blades 32 may generate or otherwise create fan noise that is concentrated over a small band of frequencies. FIGS. 35-38 shows an alternative embodiment of a fan impeller 33 in the configuration of a modulated design having blades 32 which are unequally spaced around the circumference of the impeller and have different sinusoidal modulations in the blade spacing. One impeller 33 design may have three different sinusoidal modulations in the blade spacing. Fan impeller 33 with blades 32 of different spacings may generate or otherwise create fan noise that is less concentrated than the mono-pitched fan impeller 31, but over a wider band of frequencies. Other impellers may have more or less sinusoidal modulations in blade spacing or non-sinusoidal modulations in blade spacing.

Fan impellers 31 and 33 may each include an annular or ring-shaped body having circumferentially extending lateral sides 34, a top 35, a mounting flange 38, and a bottom 36 which is positioned closest to engine 26 when the blower housing 40 is mounted thereon. Blades 32 may extend axially between the top and bottom 35, 36 at the periphery of the impellers 31, 33. The blades 32 may extend radially outwards from a hub 37 defining an axis of rotation. The lateral sides 34 may be substantially open as shown. In operation, cooling air may be drawn downwards through the top 35 of the impeller 31 or 33 and discharged radially outwards through lateral sides (outer diameter) 34 of the impellers by the blades 32 at least partially within the confines of the blower housing 40. A circumferentially extending gap 42 may be formed in interior space 41 of the blower housing 40 between impellers 31 or 33 and the inside of the housing which define an outlet air flow pathway for receiving cooling air from the fan 30, as further described herein.

Hereafter, reference will be made only to impeller 31 for convenience and brevity recognizing that impeller 33 may alternatively be used unless explicitly mentioned otherwise.

Figure 9:
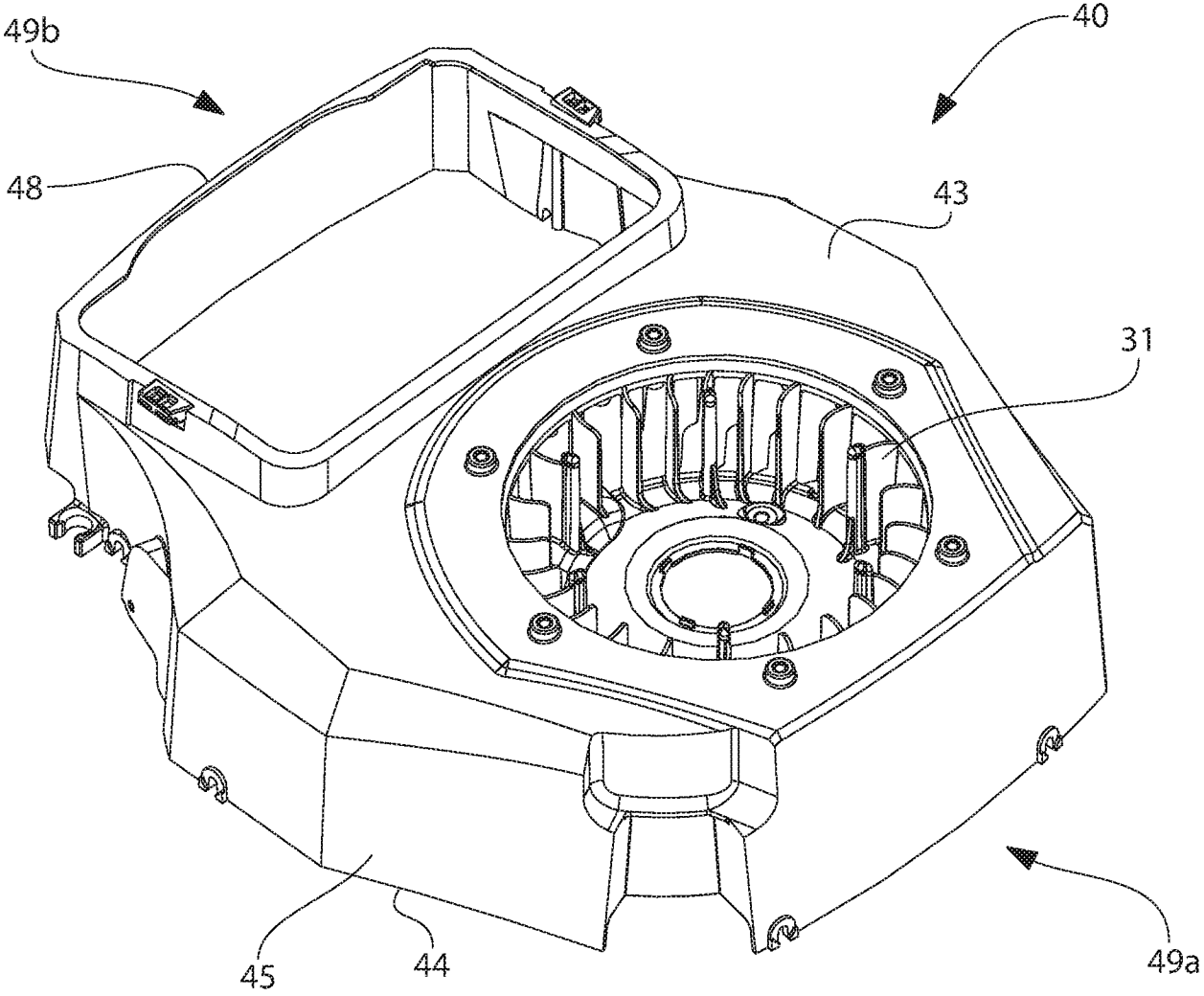
FIG. 9 is a top perspective view of the blower housing with shroud removed.
Figure 10:
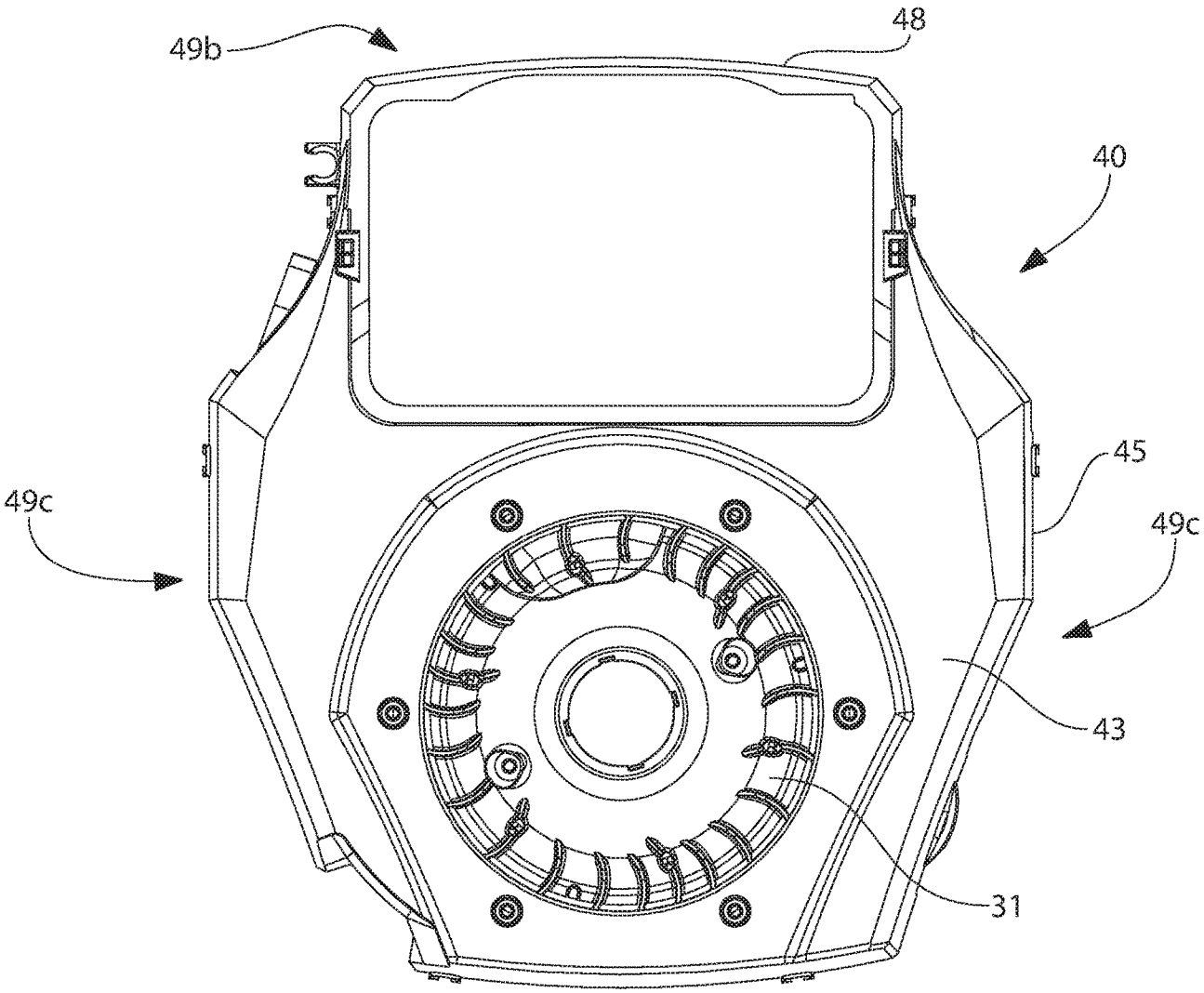
FIG. 10 is a top plan view thereof.
Figure 11:
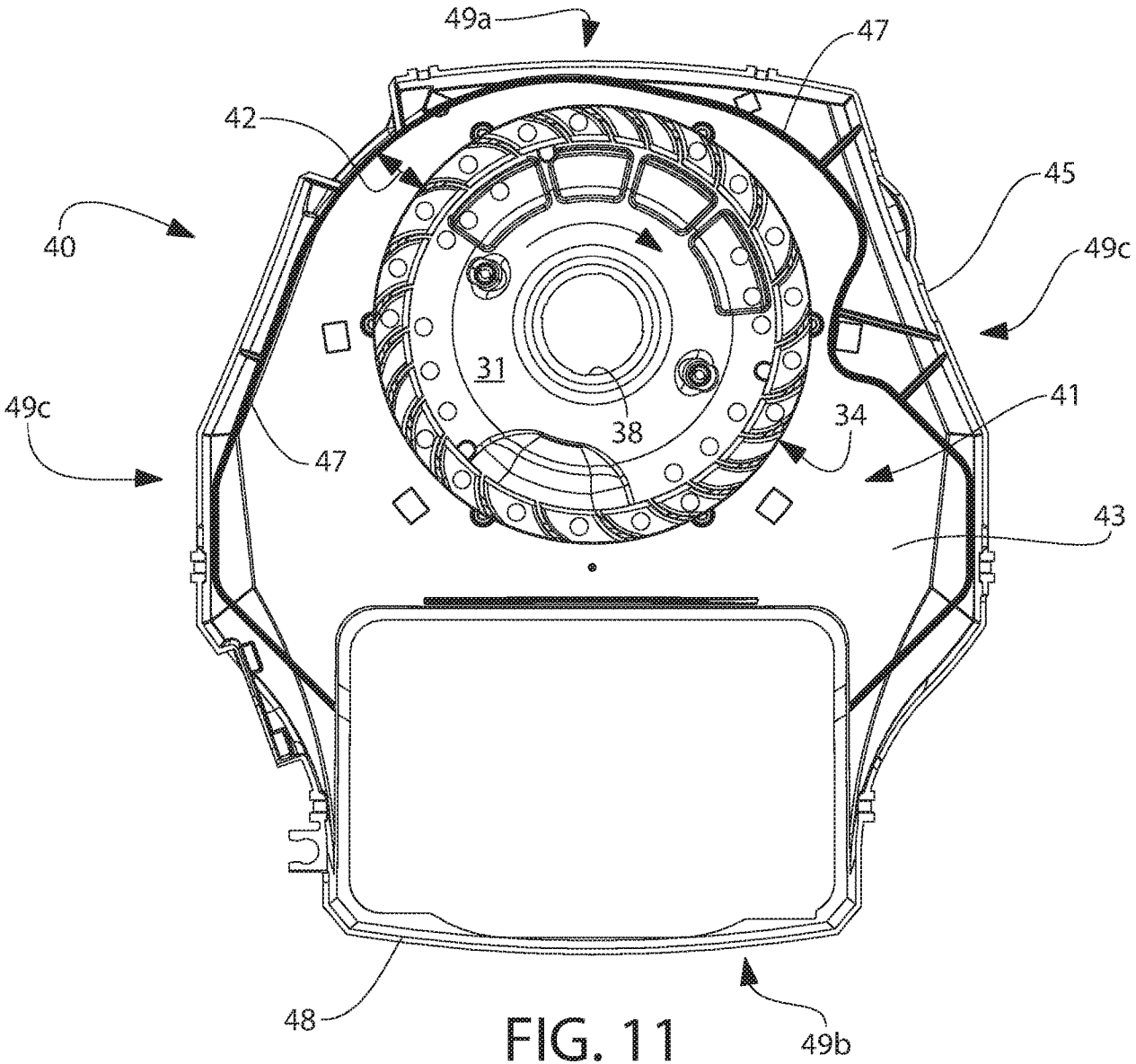
FIG. 11 is a bottom plan view thereof.
Figure 12:
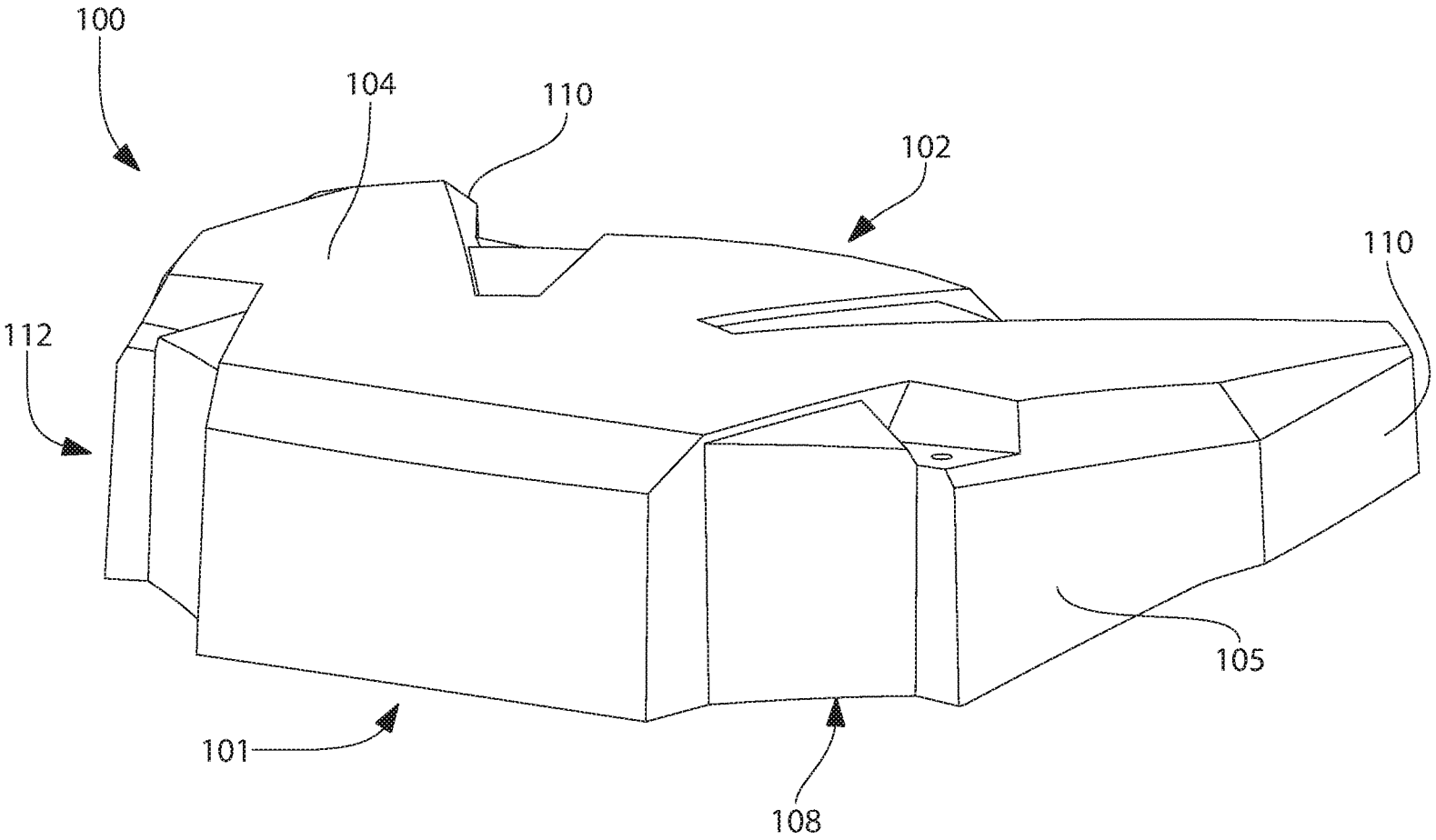
FIG. 12 is a front perspective view of the shroud.
Figure 13:
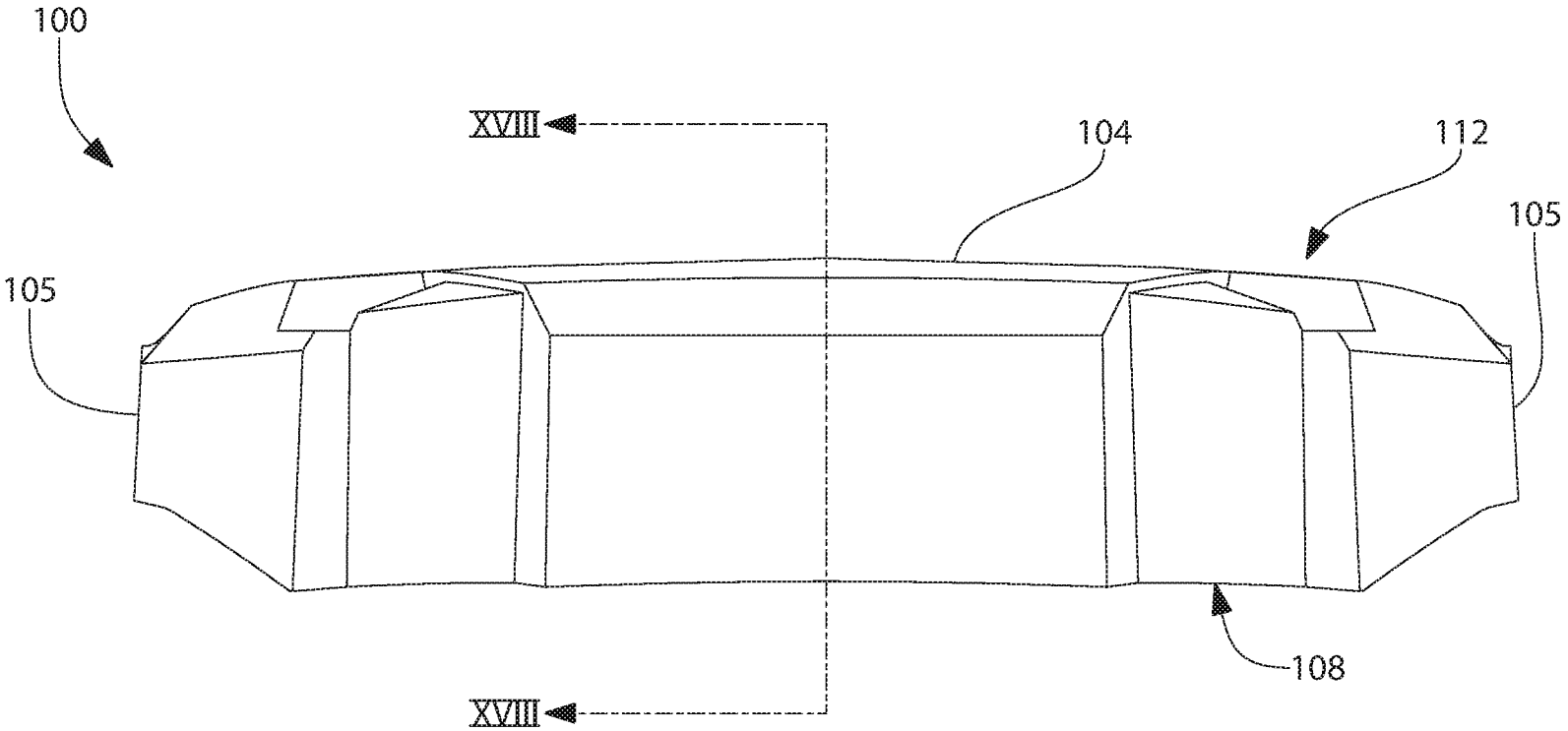
FIG. 13 is a front view thereof.

FIGS. 9-11 show the blower housing 40 and impeller 31 alone without noise suppression shroud 100.

Blower housing 40 further includes a top 43, at least partially open bottom 44, and peripheral sidewalls 45 extending vertically between the top and bottom which terminate at a bottom edge 46. Top 43 and sidewalls 45 define the interior space 41 in which impeller 31 is disposed. Some blower housings 40 may have a somewhat overall trapezoidal shape in top plan view to generally complement and conform to the shape of the engine 26. In the non-limiting example of the engine 26 described herein, the engine may be an air cooled vertical shaft, V-twin cylinder arrangement of any suitable horsepower (HP) for the intended application. Accordingly, the engine cylinders 27 may be disposed horizontally and at an angle to each other wherein the blower housing 40 may be provided with a substantially conforming configuration as shown.

In some blower housings 40, an open-centered air cleaner frame 48 may be provided at the rear of the housing which receives at least partially therein a portion of the air cleaner 29. The frame 48 may be configured to complement the shape of the air cleaner.

Blower housing 40 may further include an airflow scroll shield 47 disposed in interior space 41 of the housing. The scroll shield 47 assists with developing a desired air flow path within the blower housing from impeller 31 to optimize engine cooling. Scroll shield 47 is affixed to the blower housing and positioned between interior portions of the sidewalls 45 and impeller 31 depending on which impeller is used. Scroll shield 47 is spaced apart from the lateral sides 34 of the impeller in the lateral/horizontal direction. In one blower housing 40, scroll shield 47 extends circumferentially around the impeller 31 from the front portion of the impeller rearwards beyond the impeller. The scroll shield 47 may be configured in a horizontally undulating configuration being unequally spaced from the impeller to direct cooling air from the impeller rearwards and downward to the two cylinders 27 (shown schematically in dashed lines in FIG. 5) of the engine 26. The cooling air flows through cooling fins on each cylinder to dissipate heat generated by operation of the engine.

According to one aspect of the present disclosure, a noise suppression system is provided to attenuate sound produced by cooling fan 30, the associated cooling air system, and other engine noise propagating through the blower housing 40. The noise suppression system may include a noise suppression shroud 100 which is configured and operable to attenuate and reduce noise emissions from the fan and cooling system (and other engine components) during operation of engine 26, as further described herein. While the description may refer to attenuating, damping, and reducing noise emissions from the fan 30 and cooling system, it should be recognized that the noise suppressions shroud 100 also operates to attenuate, damp, or reduce various other noise emissions (such as engine noise emissions) that exist or propagate through the blower housing 40 or the noise suppression shroud 100.

FIGS. 12-30 show shroud 100 and various appurtenances, as further described herein.

Shroud 100 may have a three-dimensional shell-shaped body and generally include a front 101, rear 102, and opposing lateral sides 103. Shroud 100 may be removably mounted on top of blower housing 40 by any suitable method or combinations of methods including without limitation fasteners, snap fit, frictional fit, adhesives, welding, brazing, etc. The shroud 100 may have a complementary shape which generally conforms to the shape of housing 40. Shroud 100 may further include a top wall 104 and sidewalls 105 on the front 101, rear 102, and sides 103 extending downwards from the top wall. The sidewalls 105 may be generally vertical or may have different shapes, positions, or dimensions. The bottom edges of sidewalls 105 may define an open bottom 108 of the shroud 100 and corresponding downwardly open internal cavity 106 designed for noise suppression, and for holding additional noise suppression features and to define a cooling air inflow path to the fan 30, as further described herein.

The top wall 104 of the shroud 100 may, in some systems, be generally horizontal. In other systems, the top wall 104 may be slightly curved, domed or convex shaped to varying degrees, as shown by the dashed top wall 104' in FIG. 18. In some configurations, this slightly rounded side profile of the top wall may provide better acoustic sound attenuation performance that a flat top wall 104.

The dome-shaped shroud 100 and top wall 104, as well as the cavity 106 that it forms, provide noise attenuation. Due to the construction and configuration of the top wall 104, acoustic cancelation occurs as sound/noise waves reflect from surfaces and are re-directed back towards matching waves. Sound waves in opposite directions with equal or close frequencies will tend to cancel each other (attenuation). Accordingly, a domed or slightly curved top wall 104 may be useful in providing noise reduction for the system. The domed or slightly curved top wall 104 may additionally provide increased structural support and integrity to the top of the shroud 100, which may increase durability of the shroud 100.

The body of the shroud 100 may be a two-piece unit comprised of a lower portion such as mounting base 113 configured for attachment onto air blower housing 40 and an upper portion such as cover 112 configured for attenuating sound. Mounting base 113 may be attached to blower housing 40 by any suitable method or combinations of methods including without limitation fasteners, snap fit, frictional fit, adhesives, welding, brazing, etc. Cover 112, in turn, may be removably attached to mounting base 113 by the same foregoing methods or others. The cover 112 may be configured and dimensioned in some shrouds to be at least partially insertable into the mounting base 113. Mounting base 113 may be vertically shorter in height than at least some portions of the cover 112. Mounting base 113 includes a perimeter frame 115 which may have an overall shape in top plan view which substantially conforms with the corresponding shape of the cover 112 of shroud 100.

Figure 21:
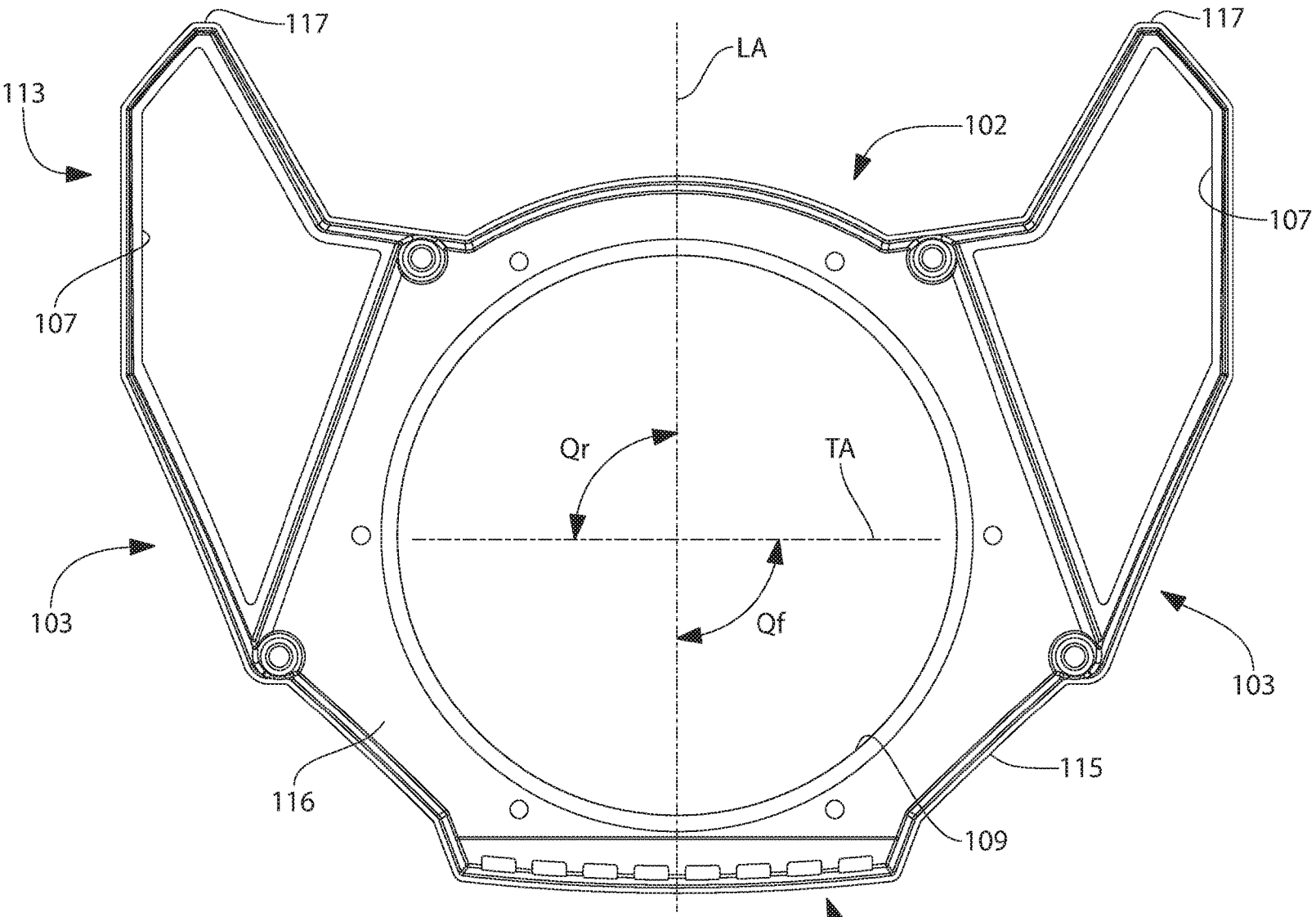
FIG. 21 is a top plan view thereof.
Figure 22:
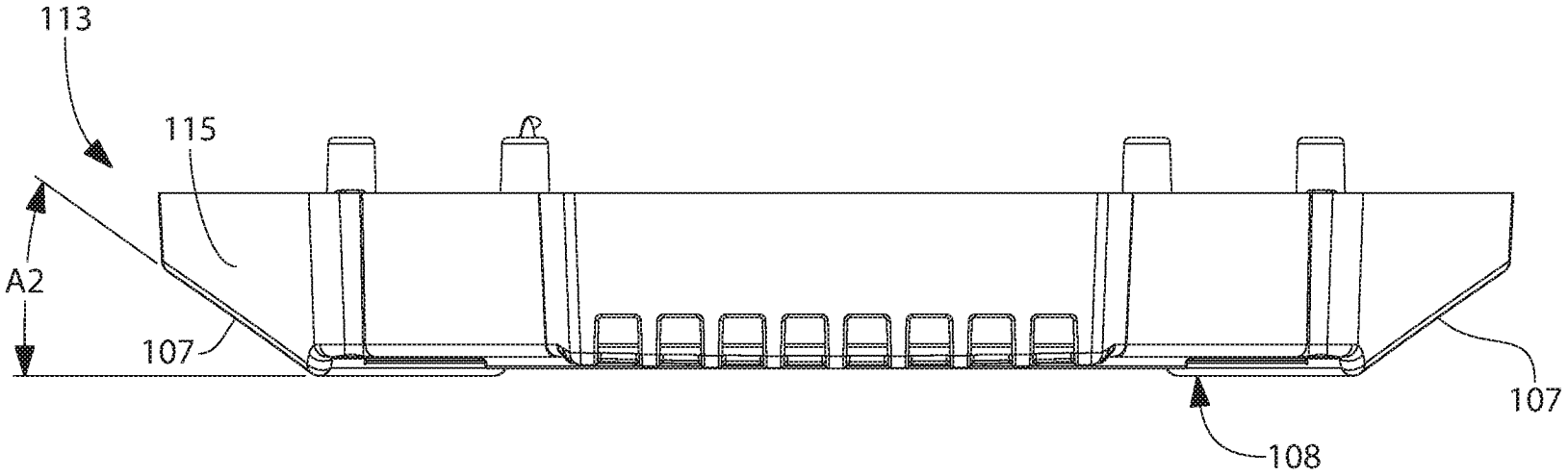
FIG. 22 is a front elevation view thereof.
Figure 23:
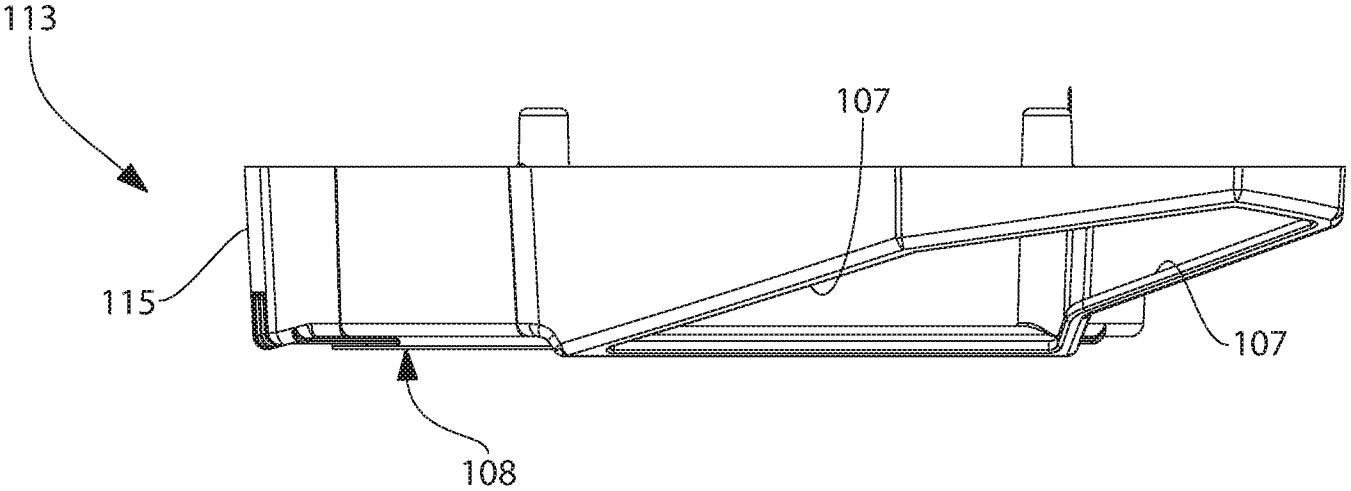
FIG. 23 is a side elevation view thereof.
Figure 24:
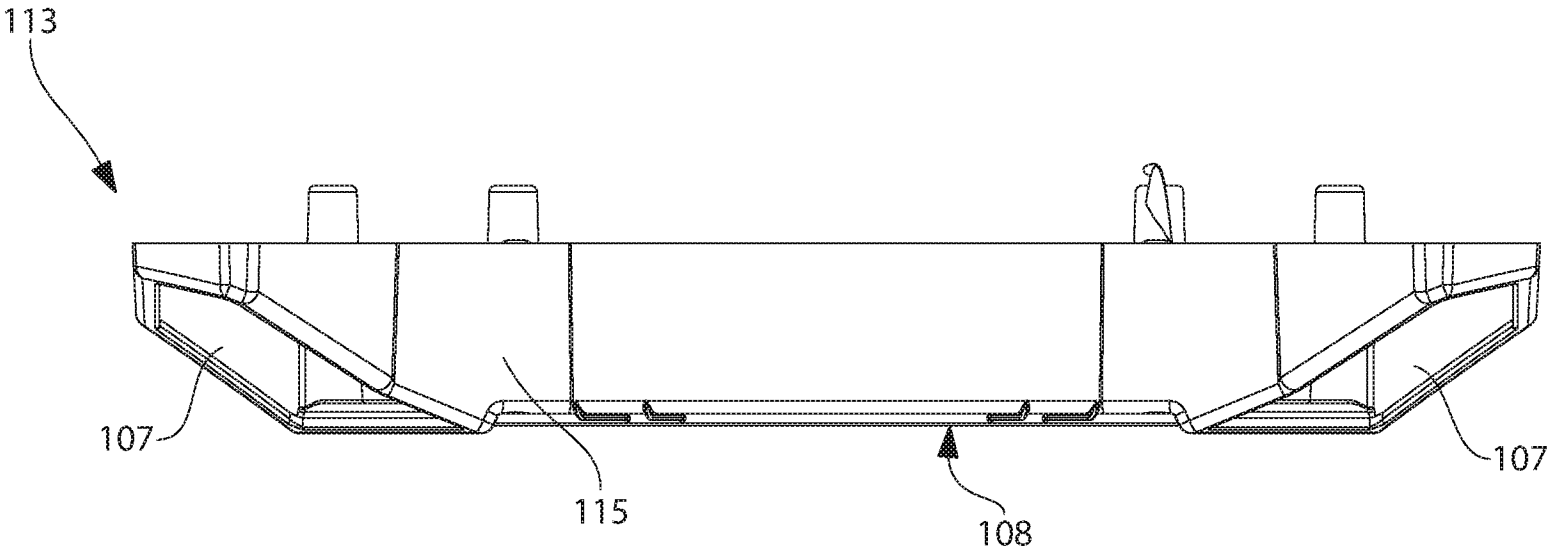
FIG. 24 is a rear elevation view thereof.
Figure 25:
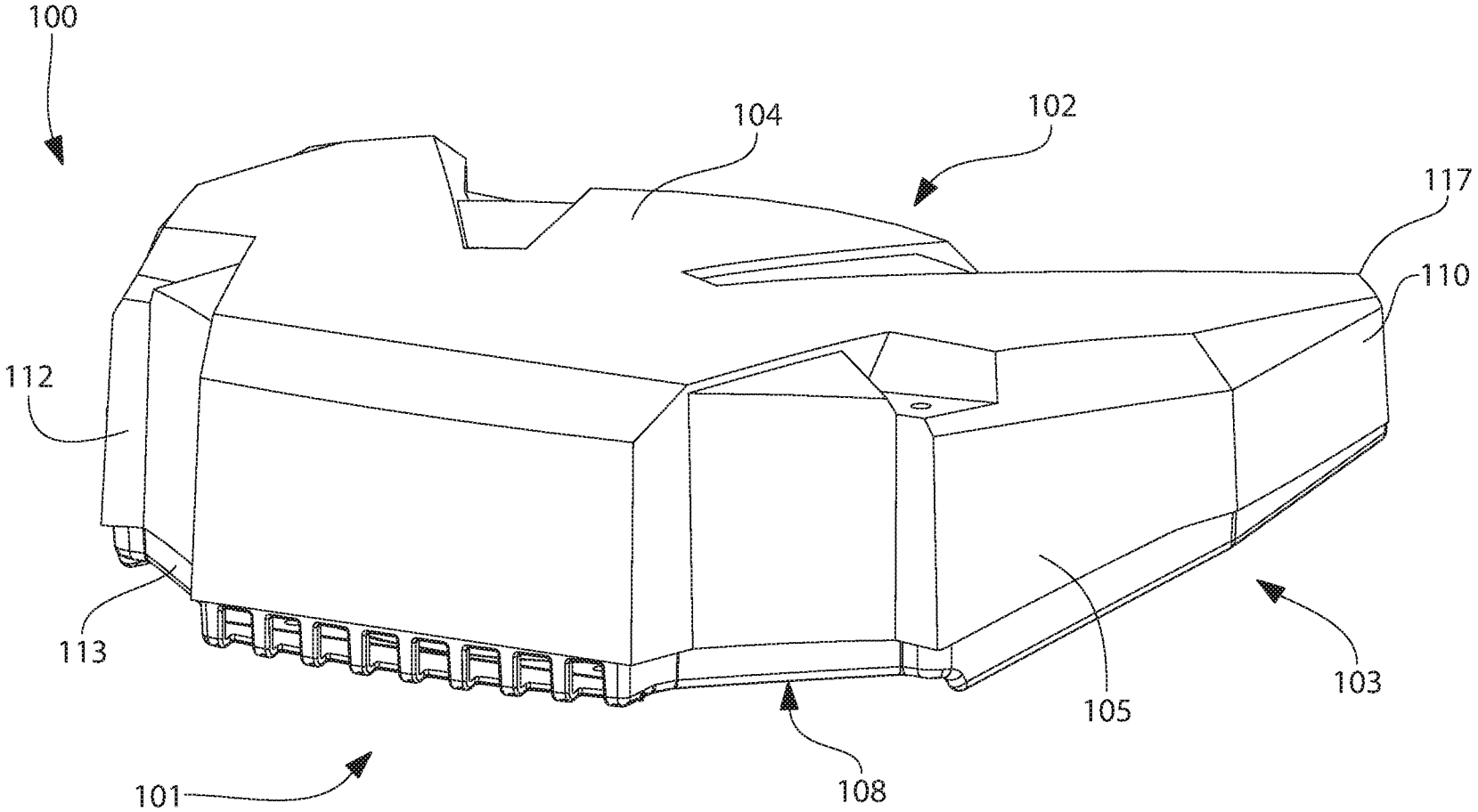
FIG. 25 is a front perspective view of the shroud base and cover assembly.

The bottom 108 of shroud 100 may include open areas and closed areas. Shroud 100 may therefore further include a horizontal partition wall 116. In two-piece constructions of the shroud 100 described above, the horizontal front wall 116 may be formed in lower mounting base 113. In some shrouds, partition wall 116 may define a generally circular shaped central aperture 109 (in top plan view) which is configured and dimensioned to be concentrically aligned with a rotational axis of fan impeller 31 when the shroud 100 is mounted on the blower housing 40. In some shrouds, central aperture 109 may have a diameter which is at least the same or larger than a diameter or outer side 34 of the impeller 31 so as to not impede inlet cooling air flow into impeller 31. The circular aperture 109 with its center positioned at the intersection of the longitudinal axis LA and a transverse axis TA as shown in FIG. 21 may be considered to define two front quadrants Qf and two rear quadrants Qr of the shroud 100 for convenience of reference in describing additional features of the shroud hereafter.

Shroud 100 may further include at least two enlarged and horizontally elongated air inlet passages 110 and associated air inlet ports 107. The air inlet passages 110 are configured and operable to attenuate fan noise. In addition to sound attenuation, the air inlet passages 110 and ports 107 are further operable via rotation of the fan impeller 31 to draw outside ambient cooling air underneath the shroud and inwards towards the impeller 31.

Air inlet passages 110 and ports 107 collectively define corresponding horizontally elongated openings which may be formed from rear portions of the shroud peripheral sidewalls 105, adjoining closed top wall 104, and the downwardly open bottom 108 of the shroud 100. The air inlet passages 110 may have a generally inverted U-shape in cross-section taken transversely to the inlet air flow path.

The peripheral sidewalls 105 of the shroud 100 may define a plurality of angled interior surfaces **105*a* which are acoustically configured, designed, and placed to induce internal reflection and capture of noise produced by the fan 30. The interior surfaces 105*a* within the air inlet passages 110 may form adjoining multi-faceted angled surfaces intended to reduce the amount of noise which escapes through the air inlet ports 107. In one shroud, the angled interior surfaces 105 of the shroud 100 are designed to direct a majority of the sound waves generated by the fan impeller 131** back towards the center of the shroud.

In one configuration of the shroud 100, a majority portion of each air inlet passage 110 may be positioned primarily in one of the two opposing rear quadrants Qr of the shroud (e.g. rear of the transverse axis TA) proximate to the rear 102 of the shroud body and adjoining rearward portions of sides 103 in each of these quadrants. The air inlet passages 110 may be located at these rear side portions of shroud 110 which correspond to low (or in some cases the lowest) sound pressure wave positions in comparison to other portions of the shroud, as determined by computer aided modeling. Accordingly, escaping noise levels from the cooling air system fan 30 from beneath the shroud 100 are at their lowest at the air inlet ports 107 in these rear quadrant positions.

As shown in FIGS. 19-24, air inlet ports 107 may be angled to face in a generally downwards and outwards direction towards the rear 102 of shroud 100 for radiating noise generated by fan 30 (or other engine components) rearwards away from the operator generally seated forward of the engine 26 in some outdoor riding equipment configurations (see, e.g. FIGS. 1A and 1B). The directional sound arrows in FIG. 1B show a general emission direction of the fan noise escaping the shroud through the air inlet ports 107 (radiated noise is very complete in this frequency range; these arrows are meant for general illustration purposes).

In some systems, one or more fins, dividers, or separating barriers may be placed within the air inlet ports 107, the air inlet passages 110, or both to serve multiple functions. For example, the fins may act to direct or guide the inlet air into the blower housing 40. The fins may guard the air inlet ports 107 from receiving grass or other debris into the housing 40. The fins may also or alternatively be constructed or engineered to force noise wave propagation in a certain direction out of the shroud 100. Other variations are possible.

Figure 15:
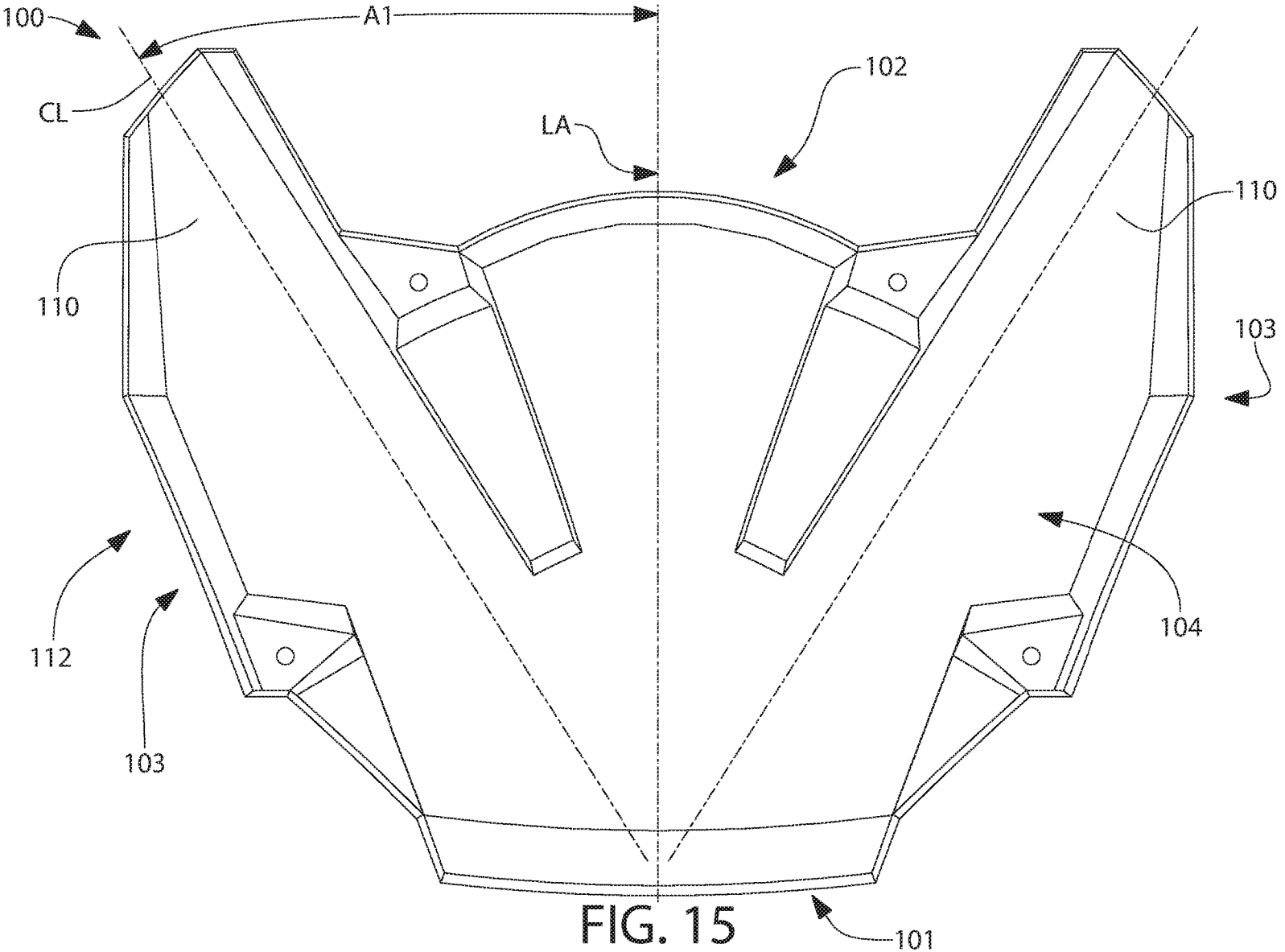
FIG. 15 is a top plan view of the shroud.
Figure 16:
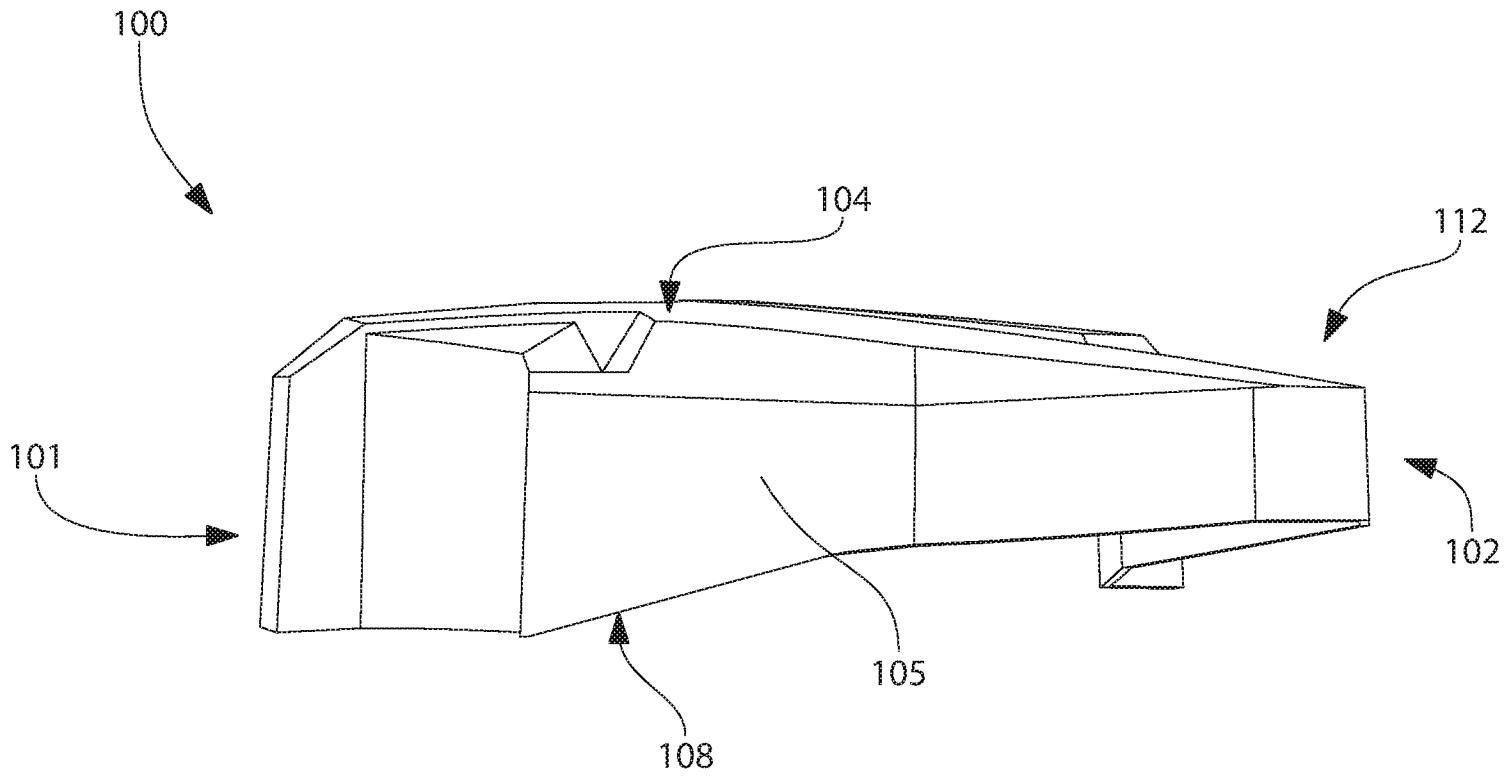
FIG. 16 is a side elevation thereof.

The air inlet passages 110 each may define a respective centerline CL extending along the greatest length of the passages from a common point of intersection (origin) proximate to the front 101 of shroud 100 to the rear of the passages as shown in FIG. 15. The air inlet passages 110 may be disposed at an angle A1 with respect to the longitudinal axis LA extending from front 101 to back 102 of shroud 100. In some shrouds, angle A1 may be without limitation between 0 and 90 degrees. Accordingly, the air inlet passages 110 may be angled and swept rearwards on shroud 100 having a somewhat wing-like configuration in top plan view. The air inlet passages 110 may be laterally spaced apart from each other by an angle equivalent to two times angle A1. The air inlet ports 107 associated with air inlet passages 110 may further be disposed at an angle A2 to the horizontal plane defined by the bottom 108 of the shroud 100 (see, e.g. FIG. 22) to direct fan noise not only downward but also outwards from the rear of the engine 26. In some shrouds, angle A2 may be without limitation between 0 and 90 degrees.

Air inlet passages 110 may be horizontally elongated from front to rear in the direction of the longitudinal axis LA and extend rearward by a distance farther a central rear portion of the rear 102 of the shroud closest to central aperture 109 than the terminal ends 117 of each as shown. The air inlet passages 110 are shaped to direct emitted fan noise from the fan 30 rearwards and generally downwards away from the operator's ears. In addition, the noise from the fan is directed by and within the air inlet passages 110 along the same pathway as the inlet cooling air drawn inwards towards the fan 30, but in the opposite direction to the incoming air. The drawing of intake air inwards in a direction opposite the direction of propagating sound waves may attenuate, damp, or otherwise reduce a level (or volume) of noise which is emitted through the air inlet ports 107.

It should further be noted that the placement and configuration of the horizontal partition wall 116 is intended to preclude cooling air intake into the shroud 100 and blower housing 40 at shroud locations which are more proximate to the operator (see, e.g. FIGS. 1A and 1B), and hence correspondingly which provide a possible directional pathway for fan noise to escape in the direction towards and reach the operator's ears. Accordingly, cooling air inflow into the shroud 100 may be restricted to each of the two air inlet ports 107 located at the distal rear end 102 of the shroud by partition wall 116 (see, e.g. FIGS. 19-24) rather than proximal portions of the shroud closer to the operator. Cooling system noise emissions may therefore be substantially restricted to the two rear quadrants Qr of shroud 100.

The foregoing partially enclosed configuration, elongated shape, and geometry of surfaces inside each air inlet passages 110 collectively helps induce internal reflection of the sound waves generated by fan 30 within each air inlet passages 110, thereby capturing a portion of the sound to reduce the overall noise level (e.g. measured in decibels or dBA) emitted from the air inlet passages that reaches the operator. The placement of the air inlet passages 110 in the two rear quadrants Qr of the shroud 100 most distal to an operator and directional angled positioning of the air inlet ports 107 described above substantially directs a significant amount of the fan noise escaping from the inlet air passages away from the operator positioned generally forward of the engine 26, as shown in FIGS. 1A and 1B. This reduces the overall cooling air system (and other engine component) sound level at the operator's ears. The placement of the air inlet passages 110 and associated air inlet ports 107 as described herein provides maximum attenuation of sound pressure waves in a direction away from the operator.

It will be appreciated that the shroud 100 could be located and positioned at various other locations with respect to or covering the entrance of a cooling system for the engine. Accordingly, the shroud is not limited to the placement and orientation shown and described herein by way of the non-limiting examples presented.

In other possible configurations of shroud 100, it will be appreciated that the shroud body may one-piece of unitary construction with an integral cover 112 and mounting base 113 which is attachable to the blower housing 40.

In some variations of the shroud, noise insulating material such as sound damping fibrous material may be applied inside cavity 106 of shroud 100 to increase overall noise reduction performance of shroud 100. The sound damping fibrous material may, for example, be a fiberglass absorptive material, a foam material such as melamine, damping felt, or various other materials. The sound damping fibrous material may be applied to various areas within the cavity 106, such as on the underside of the top wall 104 and/or inside of vertical peripheral sidewalls 105. Other variations are possible.

According to another aspect of the present disclosure, the noise suppression shroud 100 may include one or more quarter wave resonator 120. Quarter wave resonators 120 may further reduce the level of noise emitted by the engine cooling air system to the ambient environment. Quarter wave resonators (QWR) may attenuate sound via acoustic wave cancellation, which in the present case may be noise frequencies generated by the fan 30 or other engine components.

Figure 14:
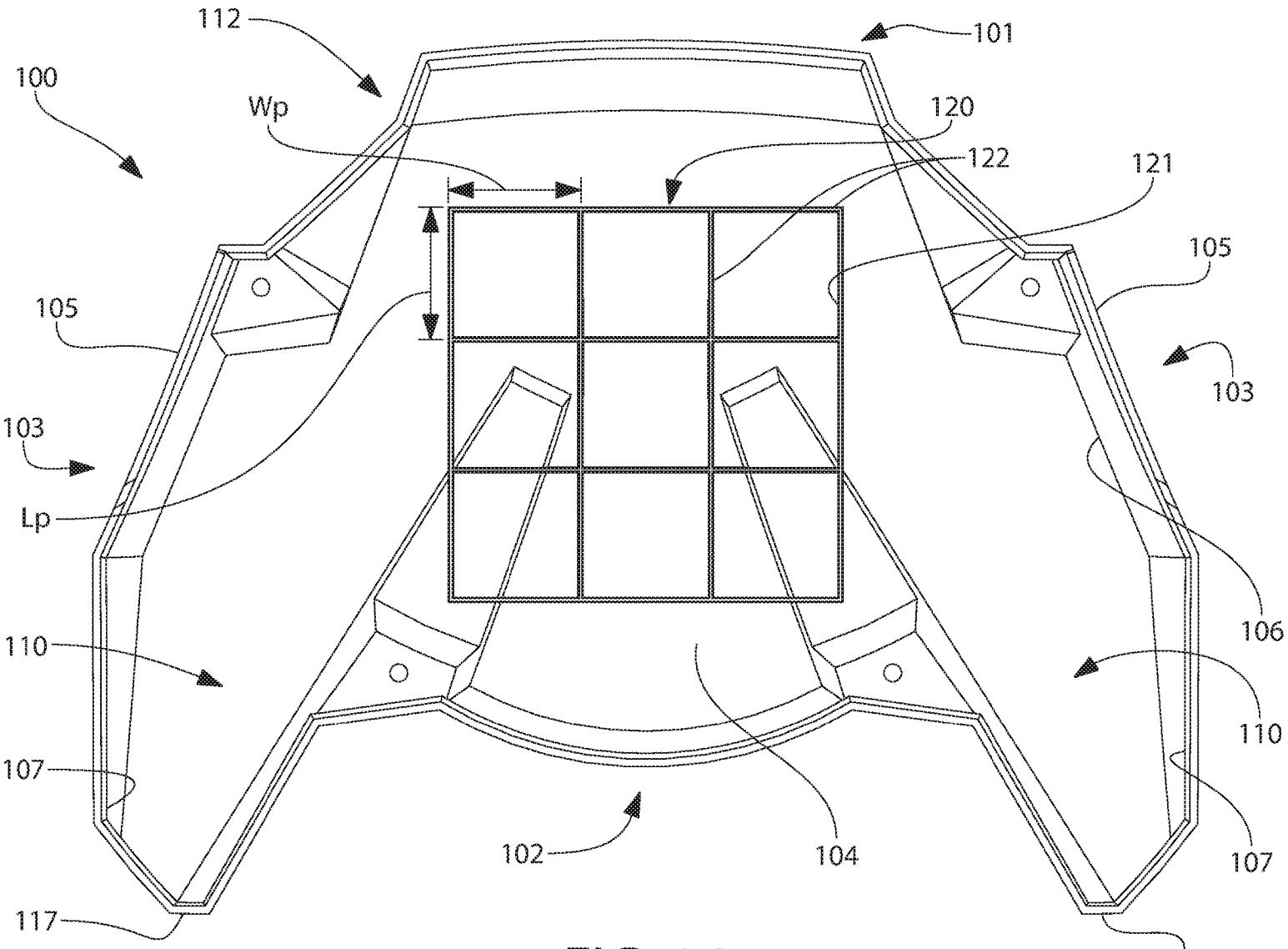
FIG. 14 is a bottom plan view thereof showing a quarter wave resonator inside the shroud.
Figure 17:
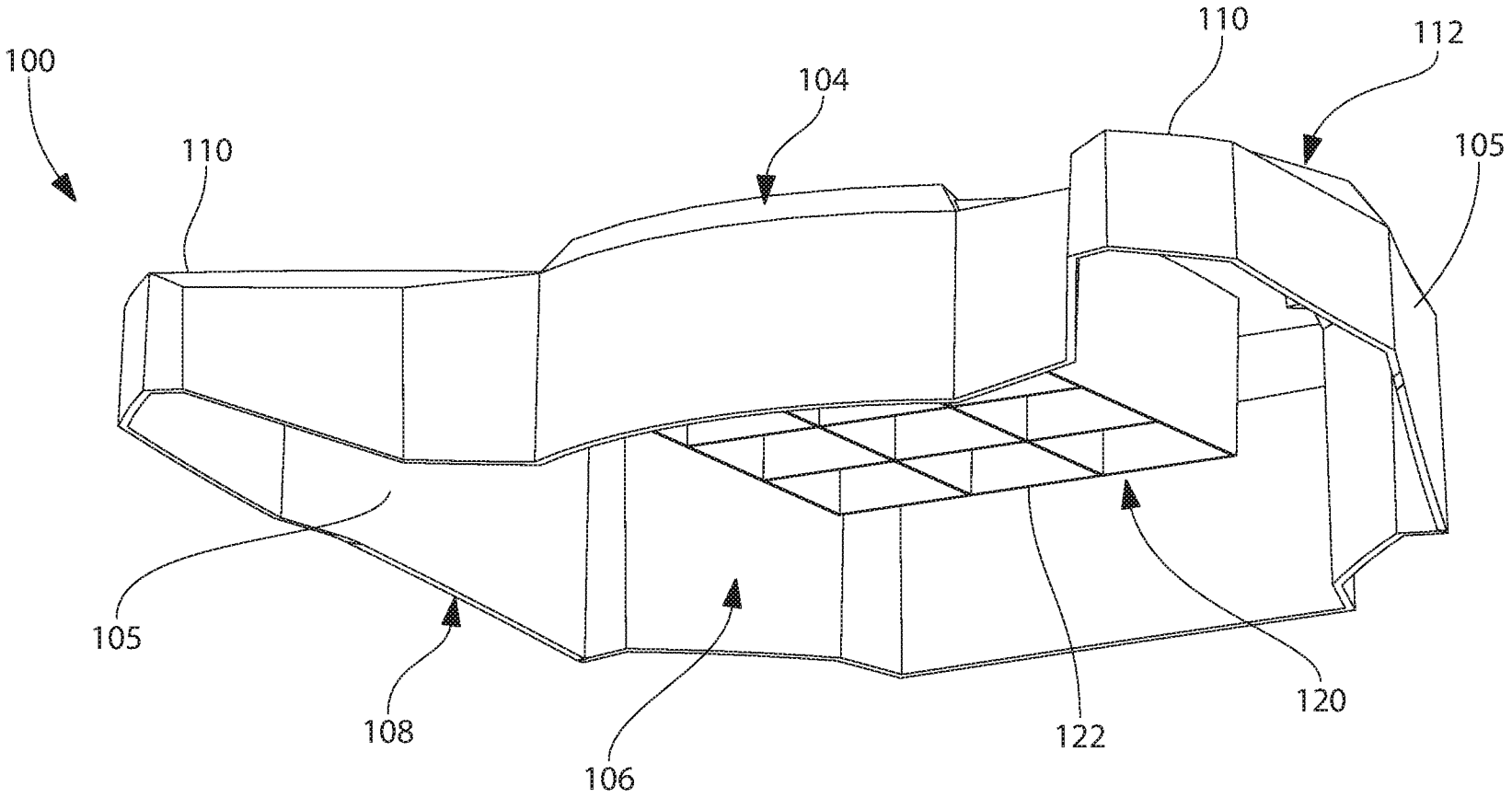
FIG. 17 is bottom rear perspective view thereof.
Figure 18:
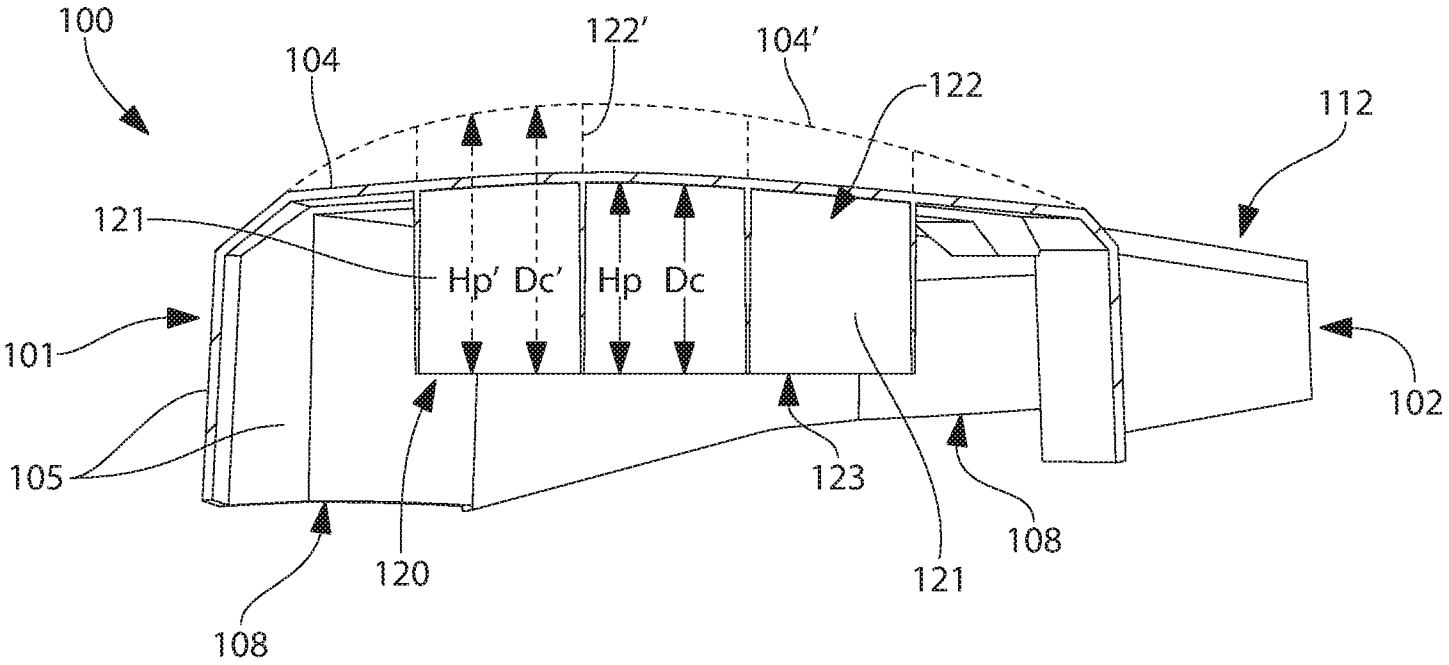
FIG. 18 is a longitudinal side elevation cross-sectional view thereof.
Figure 19:
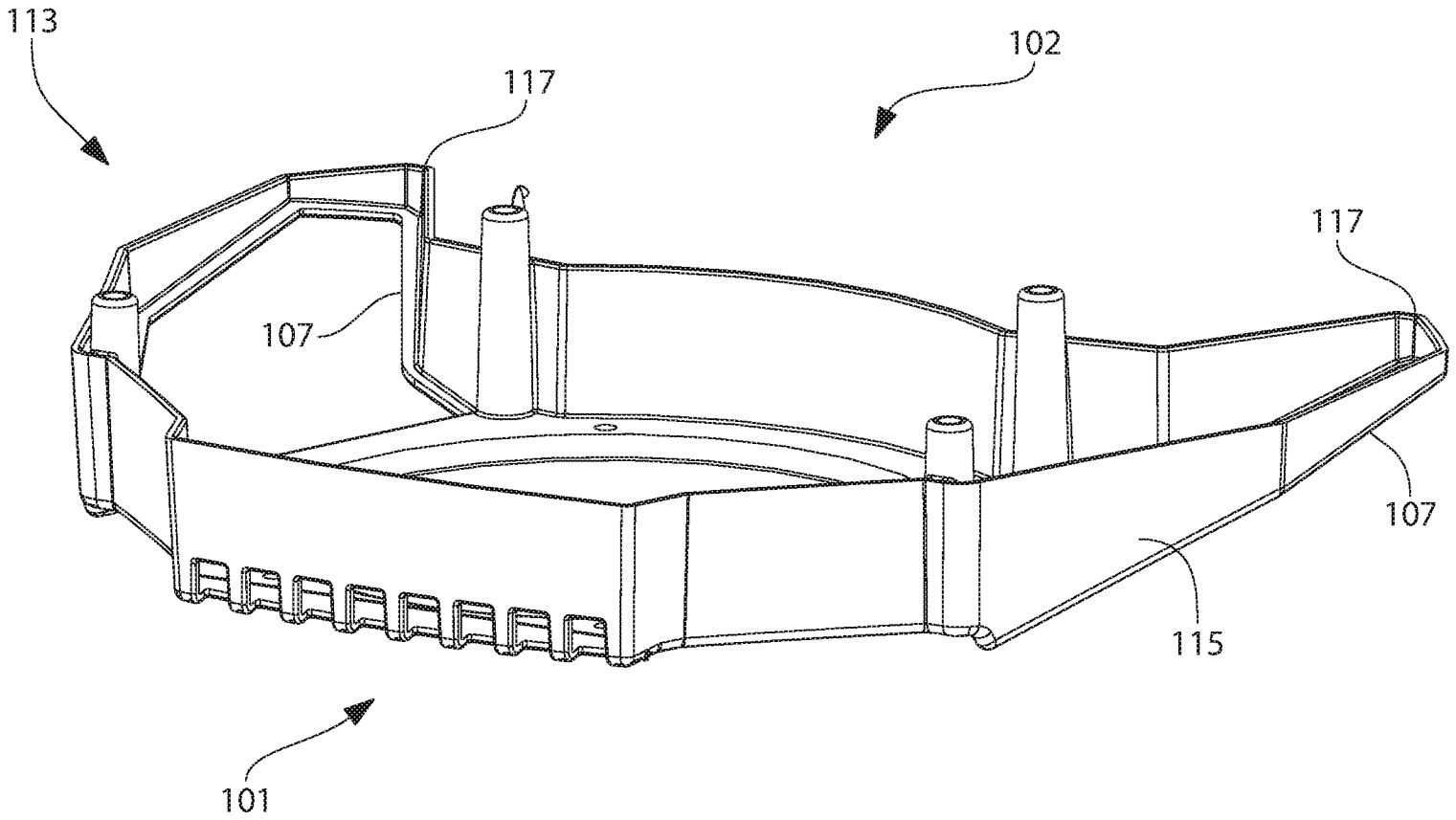
FIG. 19 is a front perspective view of a shroud base.
Figure 20:
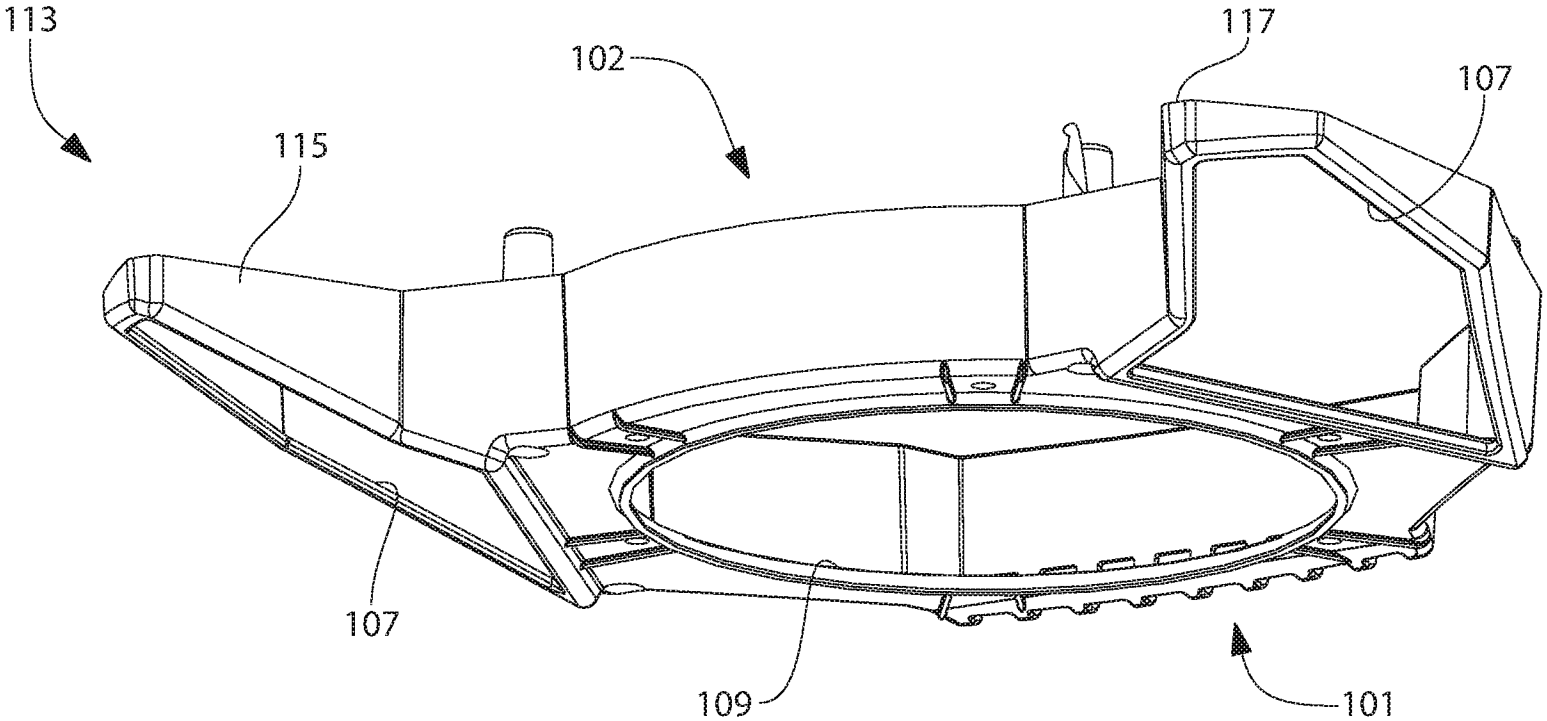
FIG. 20 is a bottom rear perspective view thereof.

Referring primarily to FIGS. 14, 17, and 18, quarter-wave resonator 120 in one shroud includes an array of multiple cells 121 formed by adjoining and/or intersecting grid partition members 122. Partition members 122 may be disposed inside internal cavity 106 of shroud 100. In some shroud configurations, the partition members 122 may be formed integrally with the shroud 100 as a unitary structural part of the shroud top wall 104 and/or vertical peripheral sidewalls 105. In instances where the shroud 100 may be formed of a polymer or plastic, partition members 122 may be integrally molded with the shroud. In other shroud configurations, partition members 122 may be separate elements which are insertable into and attachable to the shroud 100 as either a preassembled unit or as individual partition members 122 each separately attachable to the shroud. The partition members 122 may be attached to shroud 100 by any suitable method or combinations of methods including without limitation fasteners, snap fit, frictional fit, adhesives, welding, brazing, etc.

The partition members 122 may be configured and arranged to form corresponding cells 121 having any suitable polygonal or other shape desired (in bottom plan view), including for example without limitation square (as shown), rectangular, triangular, hexagon, octagon, circular, honeycomb, and others. Partition members 122 may have any suitable dimensions in both length Lp and width Wp (in bottom plan view), and in height Hp (in side elevation view) as shown for example in FIG. 14. The height Hp forming a distance between the bottom edge 123 and inside of top wall 104 of the shroud 100 defines a corresponding cell depth Dc for cells 121 (see, e.g. FIG. 18). In one shroud, the partition members 122 may have height Hp selected so that the bottom edge 123 of the partition members 122 is spaced vertically apart from the top 43 of the blower housing 40 to form a gap that avoids impeding the inflow of cooling air into the impeller 131.

The height Hp of partition members 122 may be different in various portions on the underside of shroud top wall 105 so that the cells 121 may have different depths Dc. This may be accomplished by configuring the top wall 104 differently in various areas of the shroud to decrease/increase the, or alternatively by adding intermediate horizontal walls (not shown) in various areas beneath the shroud. For example, in systems where the top wall 104 is slightly curved, the curved nature of the top wall 104 may create cells 121 with different depths Dc. Accordingly, in some shrouds, the partition member 122 height Hp and corresponding cell depth Dc may be either non-uniform or uniform depending on the intended sound frequencies to be attenuated by the quarter wave resonator 120.

The frequency of noise that may be reduced (by wave cancellation) through the use of quarter wave resonators 120 (and cells 121) may depend, at least in part, on the depth Dc of the cells 121. The depth Dc of the cell 121 may be tuned to reduce (or cancel) noise at a certain frequency (or frequency band). In some quarter wave resonators 120, some cells 121 may be configured to have different depths Dc such that some cells 121 may reduce (or cancel) noise at different frequencies than other cells 121. For example, as discussed, in systems where the top wall 104 is slightly curved (or otherwise not strictly horizontal), the cells 121 below the top wall 104 may have difference depths Dc. As such, the aggregate result may be that the quarter wave resonator 120 may be used to reduce (or cancel) noise at a wider range of frequencies.

Figure 27:
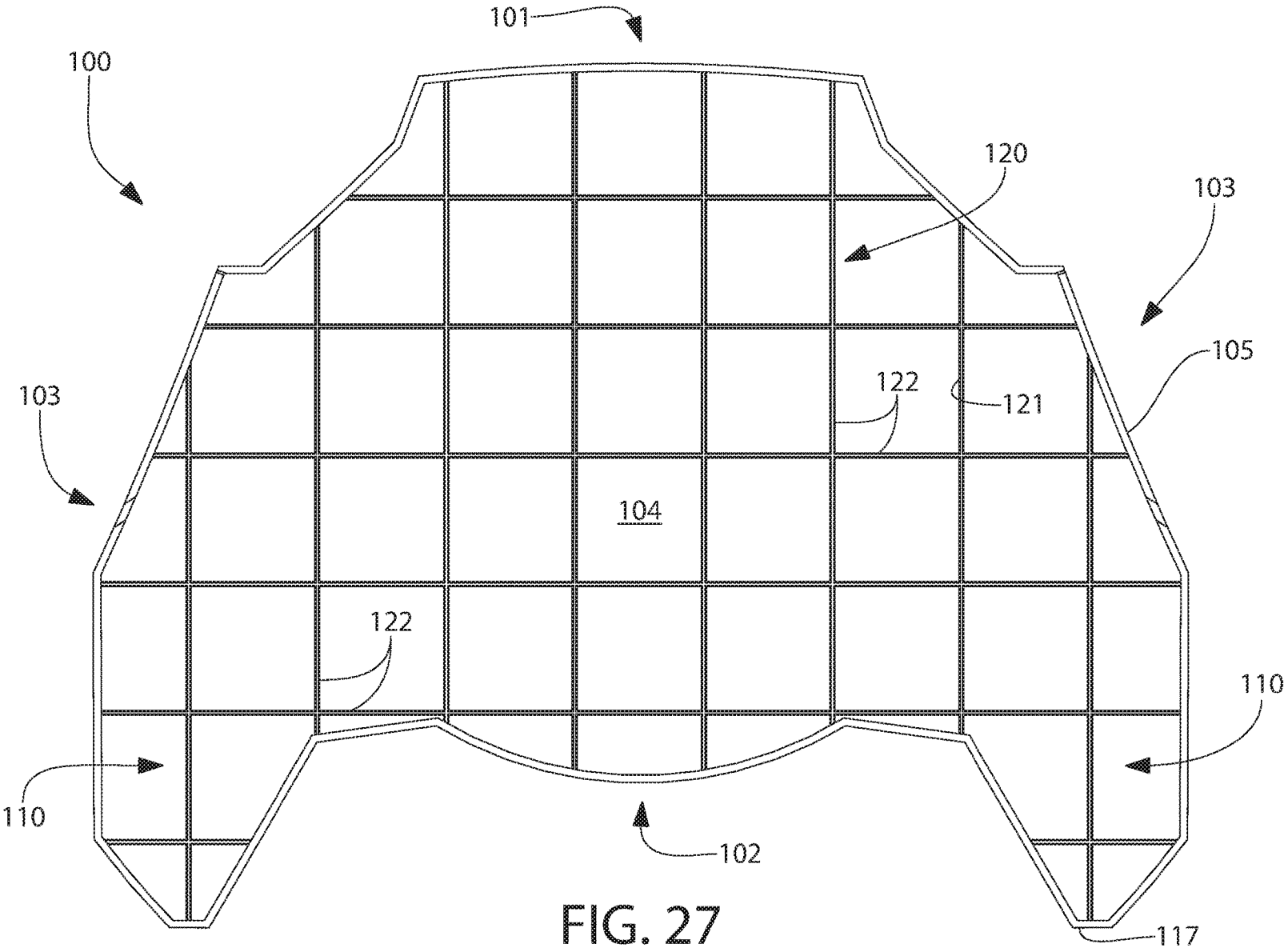
FIG. 27 is a bottom plan view of the shroud with a second configuration of a quarter wave resonator.

At least a portion of shroud 100 may include the quarter wave resonator 120 with associated partition members 122. In some shrouds, the partition members 122 may be concentrated towards the geometric center of the shroud 100 opposite the fan impeller 131 to attenuate noise emitted from the impeller. In other shrouds, various discrete portions of the cavity 106 within shroud 100 may include quarter wave resonators 120 with partition members 122 (e.g. opposite impeller, in portions of air inlet passages 110, etc.). In yet other shroud configurations, as shown in FIG. 27, substantially the entire cavity 106 may be filled by the quarter wave resonator 120 and partition members 122 to the extent permitted by the shroud geometry.

The quarter wave resonator 120 may be tuned for abating cooling air system noise within a specific range or band of frequencies by varying design parameters such as without limitation the extent of the shroud 100 which includes a quarter wave resonator 120, shape of the cells 121 formed by the partition members 122, depth of cells Dc, and materials of construction of the partition members 122. The sound attenuation performance of the shroud 100 may therefore be optimized by such tuning to compensate for and reduce the specific noise generation frequencies of a given engine system. Accordingly, the quarter wave resonator 120 may be configured and tuned to remove a narrow band or a broad band of noise frequencies.

Figure 26:
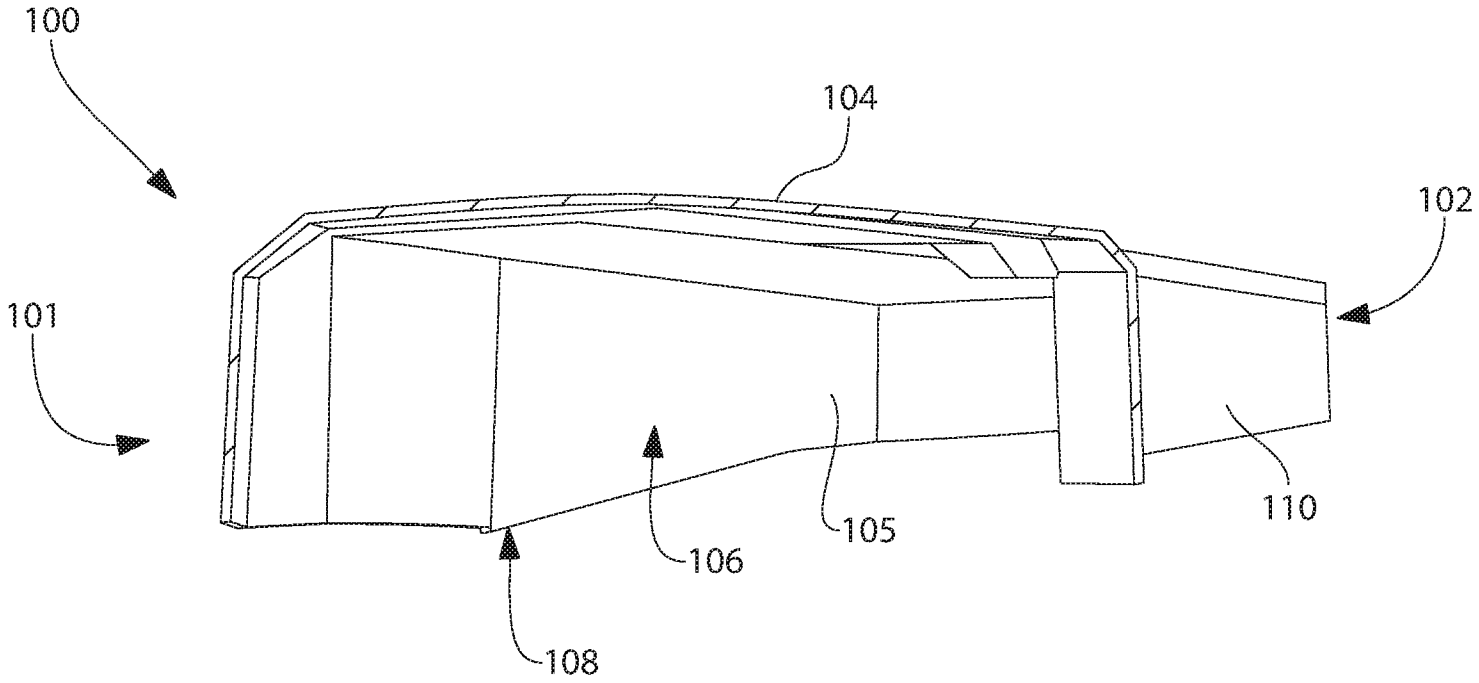
FIG. 26 is a side elevation cross-sectional view of the shroud.

In some shrouds, the quarter wave resonator 120 may be omitted as shown in FIG. 26 and the shroud 100 may rely on the air inlet passages 110 to attenuate system noise.

The shroud 100 (including base 113 and cover 112) and quarter wave resonator 120 may be made of any suitable metallic or non-metallic materials, including without limitation metals such as steel or aluminum, polymers/plastics (e.g. polyvinylchloride, acrylic, etc.), fiberglass, and others. In one example, the shroud 100 may be made of 20% glass filled polypropylene. The quarter wave resonator 120 partition members 122 may be made of the same or different material. The blower housing 40 in one example may be made of the same 20% glass filled polypropylene or another suitable material. Accordingly, the shroud, quarter wave resonator, and blower housing are not limited by materials of construction which are selected to provide the desired sound absorption characteristics and other performance factors as appropriate to suit a particular application.

Figure 28:
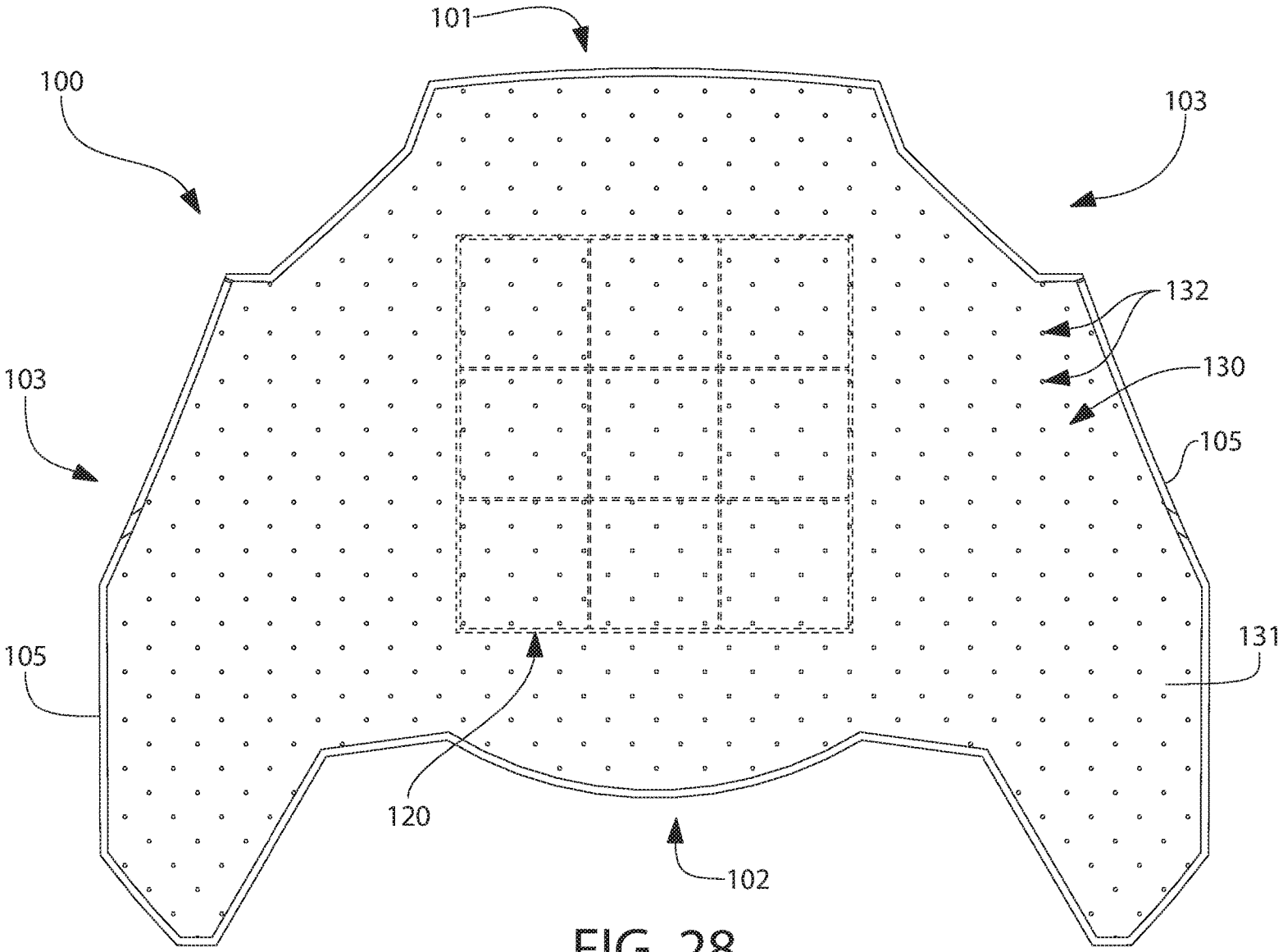
FIG. 28 is a bottom plan view of the shroud with a micro-perforated panel.
Figure 29:
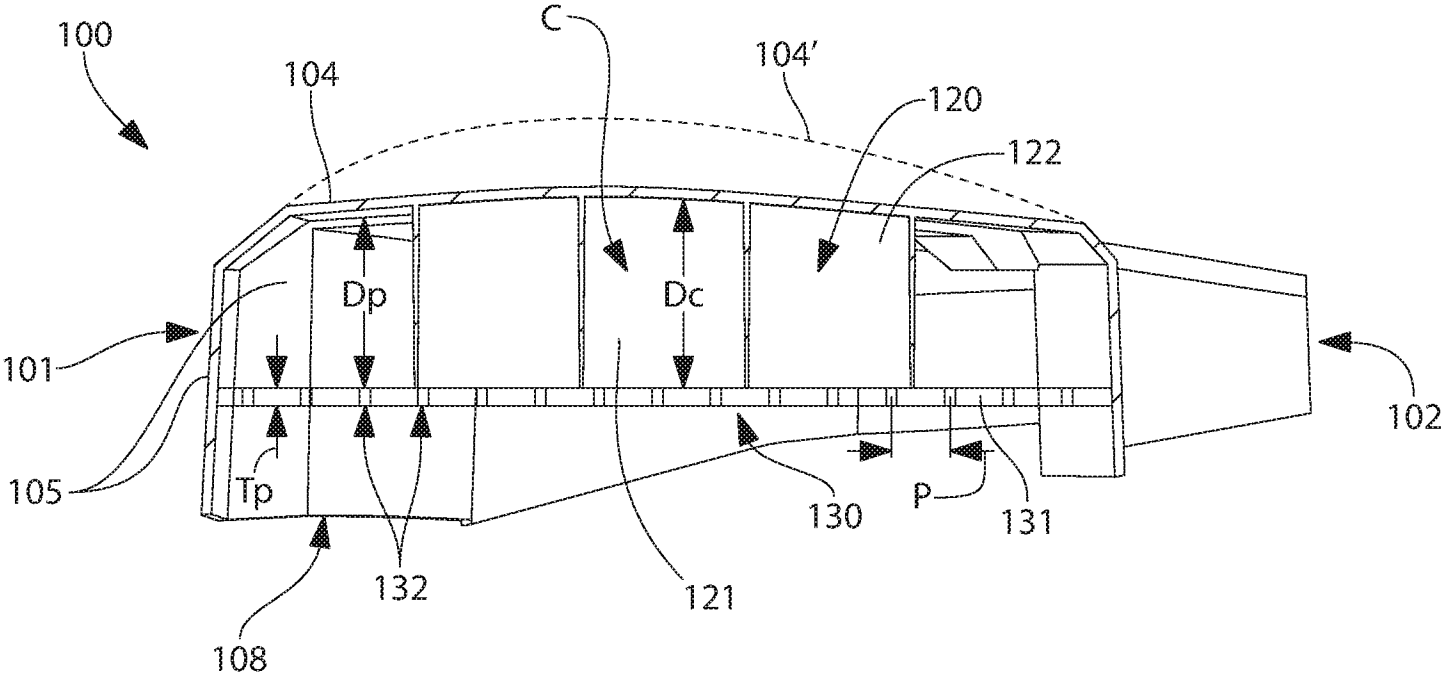
FIG. 29 is a longitudinal side elevation cross-sectional view thereof.

According to another aspect of the present disclosure, the noise suppression shroud 100 may include a micro-perforated panel (MPP) 130 for sound absorption in addition to or instead of quarter wave resonator 120. FIGS. 28 and 29 show a shroud 100 incorporating a micro-perforated panel 130 used in conjunction with a quarter wave resonator 120. The micro-perforated panel may be comprised of a substantially flat sheet 131 of material (e.g. metal) which includes a plurality of regularly spaced apart micro-sized pores or holes 132 of a predetermined diameter and pitch P (spacing between adjacent holes). The holes 132 may have the same diameter or non-uniform diameters, and be any suitable configuration including circular as commonly used or other shapes.

The micro-perforated panel 130 may be positioned at various locations within the shroud 100. The micro-perforated panel 130 may divide the shroud 100 into two or more separate cavities. For example, the micro-perforated panel 130 may be positioned horizontally through the shroud 100, dividing the shroud into a top cavity and a bottom cavity. In some such systems, the micro-perforated panel 130 may be positioned a depth Dp from the top wall 104 that is engineered or tuned to provide wave cancelation of certain undesirable noise frequencies, and/or such that the top wall 104 is positioned at a distance of lowest wave pressure from the micro-perforated plate 130. The micro-perforated panel 130 may be planar, or may have a curved, rippled, bent, or other surface. Other variations are possible.

The micro-perforated panel 130 may be positioned below the quarter wave resonator 120 between the bottom 108 of shroud 100 and the quarter wave resonator. In other shrouds, the micro-perforated panel 130 may be positioned above the quarter wave resonator 120 between top wall 104 of shroud 100 and the quarter wave resonator. An air-space C having a depth Dp may be formed behind the micro-perforated panel 130 below the top wall 104 of shroud 100. In this particular example, the depth Dp of the air space C may be coextensive with the height Hp of the partition members 122 and depth Dc of shroud 100 in the quarter wave resonator 120. Air space C associated with the micro-perforated panel 130 will accordingly be formed from a portion of the overall shroud cavity 106.

In one configuration of shroud 100, the micro-perforated panel 130 may enclose the entire bottom 108 of the shroud as shown. In other possible shrouds, the micro-perforated panel 130 may cover only portions of the bottom 108 of the shroud 100 such as over the areas which include a quarter wave resonator 120, or alternatively areas of the shroud that do not include quarter wave resonators.

Micro-perforated panels are effective for absorbing sound or noise within a predetermined attenuation frequency band or range based on the Helmholtz resonance principle, thereby reducing the resultant reflected sound. The attenuation frequency band may be customized to be narrow or wide by varying the design parameters of the micro-perforated panel. The pore or hole 132 size, spacing or pitch P, thickness Tp of the sheet 131, material of construction of sheet 131, and depth Dp of the air space C behind the sheet all affect the resultant noise cancellation properties of a micro-perforated panel and attenuation frequencies. Accordingly, the inventors have discovered that these parameters can be adjusted to change the noise cancellation characteristics of the micro-perforated panel 130 and tune the micro-perforated panel for filtering out specific fan frequencies to suit a given engine and associated cooling air system at hand. In some shrouds, the depth of Dp of air space C can be increased as desired by making the top wall 104 of the shroud domed or convex shaped as shown by the dashed top wall 104' in FIG. 29. These foregoing parameters may be adjusted to achieve the desired sound frequency filtering and attenuation characteristics for noise reduction.

In some systems, one or more of the hole 132 size, spacing or pitch P, and/or thickness Tp of the sheet 131 may vary within the same micro-perforated panel 130. For example, holes 132 near the center of the micro-perforated panel 130 may be sized differently from the holes 132 a larger radial distance from the center of the micro-perforated sheet 130. In this example, the holes 132 near the center of the micro-perforated panel 130 may enable or cause the micro-perforated panel 130 to absorb noise around a first frequency range (tuned to the parameters of the holes 132 at the center of the micro-perforated panel 130) near the center of the panel 130, while the holes 132 near the perimeter of the micro-perforated panel 130 may enable or cause the micro-perforated panel 130 to absorb noise around a different frequency range (tuned to the parameters of the holes 132 near the outer edges of the micro-perforated panel 130). Other variations are possible.

Referring to FIG. 29, the shroud 100 with micro-perforated panel 130 may also include partitions which in some designs may be configured similarly to the partition members 122 shown provided for the quarter wave resonator 120. The partition members 122 in such shrouds 100 may be constructed, positioned, and/or used to force a certain wave propagation (such as a linear plane wave propagation) between the micro-perforated panel 130 and the top wall 104. The forced wave propagation created by the partitions 122 may increase the noise attenuation and absorption characteristics of the shroud 100. The partitions for the micro-perforated panel 130 may or may not also behave as a quarter wave resonator, tuned for wave cancelation of certain frequencies of noise. The micro-perforated panel 130 may be positioned above, or below, the partition members 122.

Figure 30:
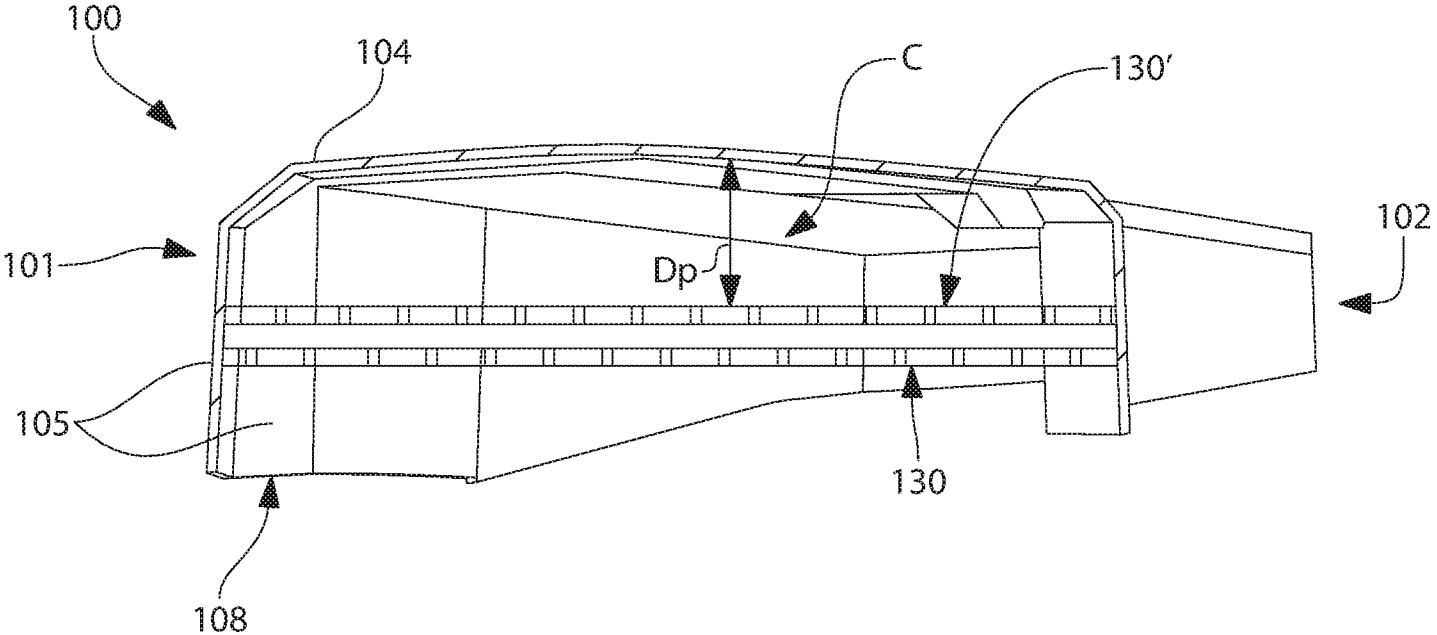
FIG. 30 is longitudinal side elevation cross-sectional view of a shroud having two micro-perforated panels.
Figure 31:
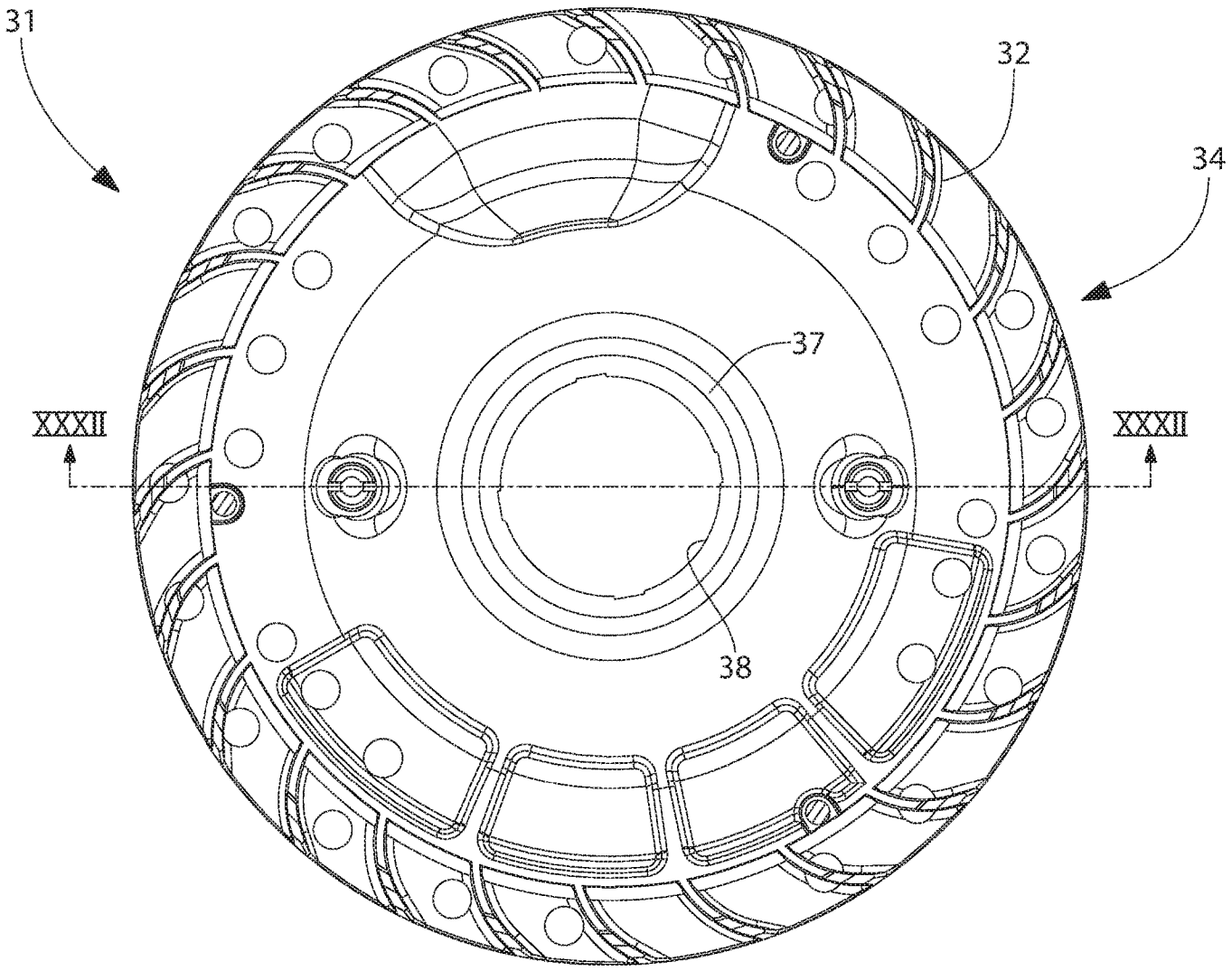
FIG. 31 is top plan view of a mono-pitch air blower impeller usable in the cooling air blower of FIG. 2 having blades which are equally spaced apart.
Figure 32:
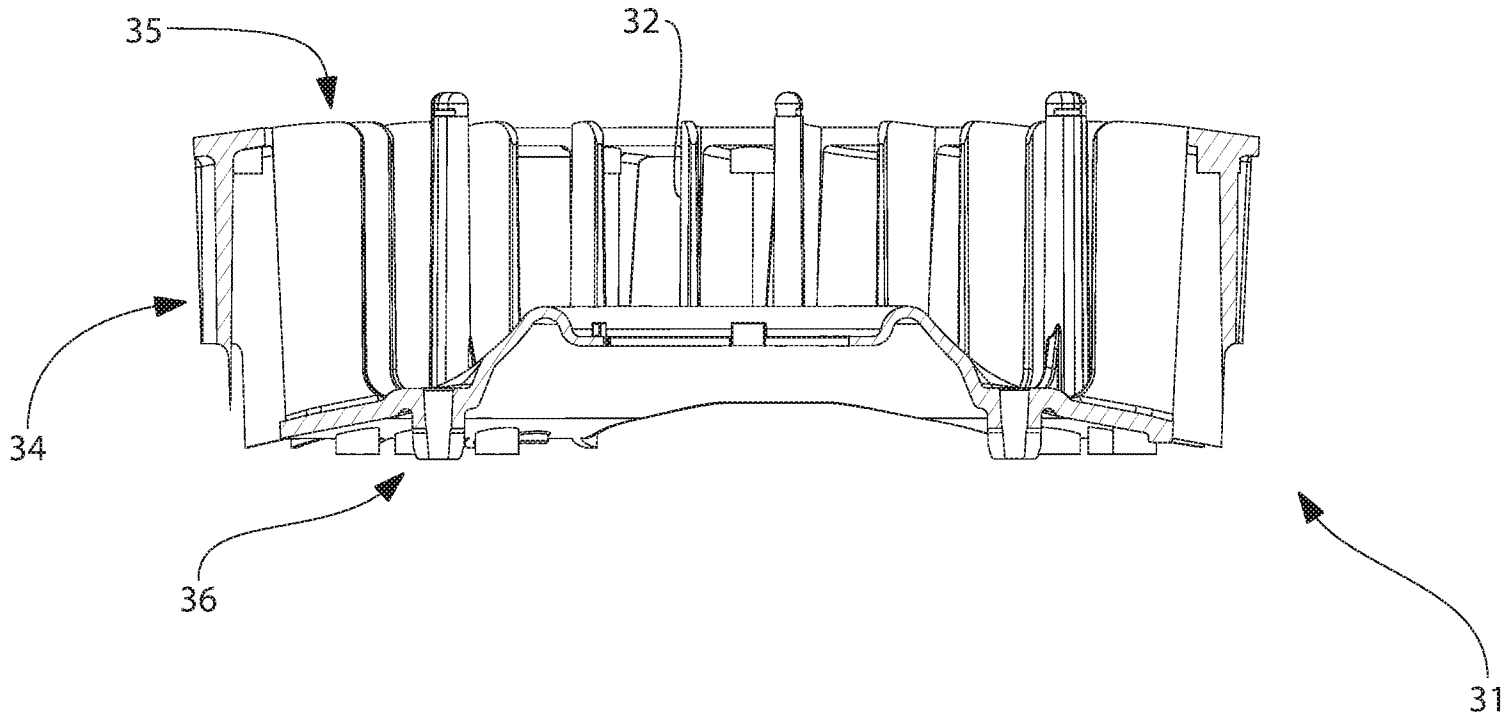
FIG. 32 is a cross-sectional view thereof.
Figure 33:
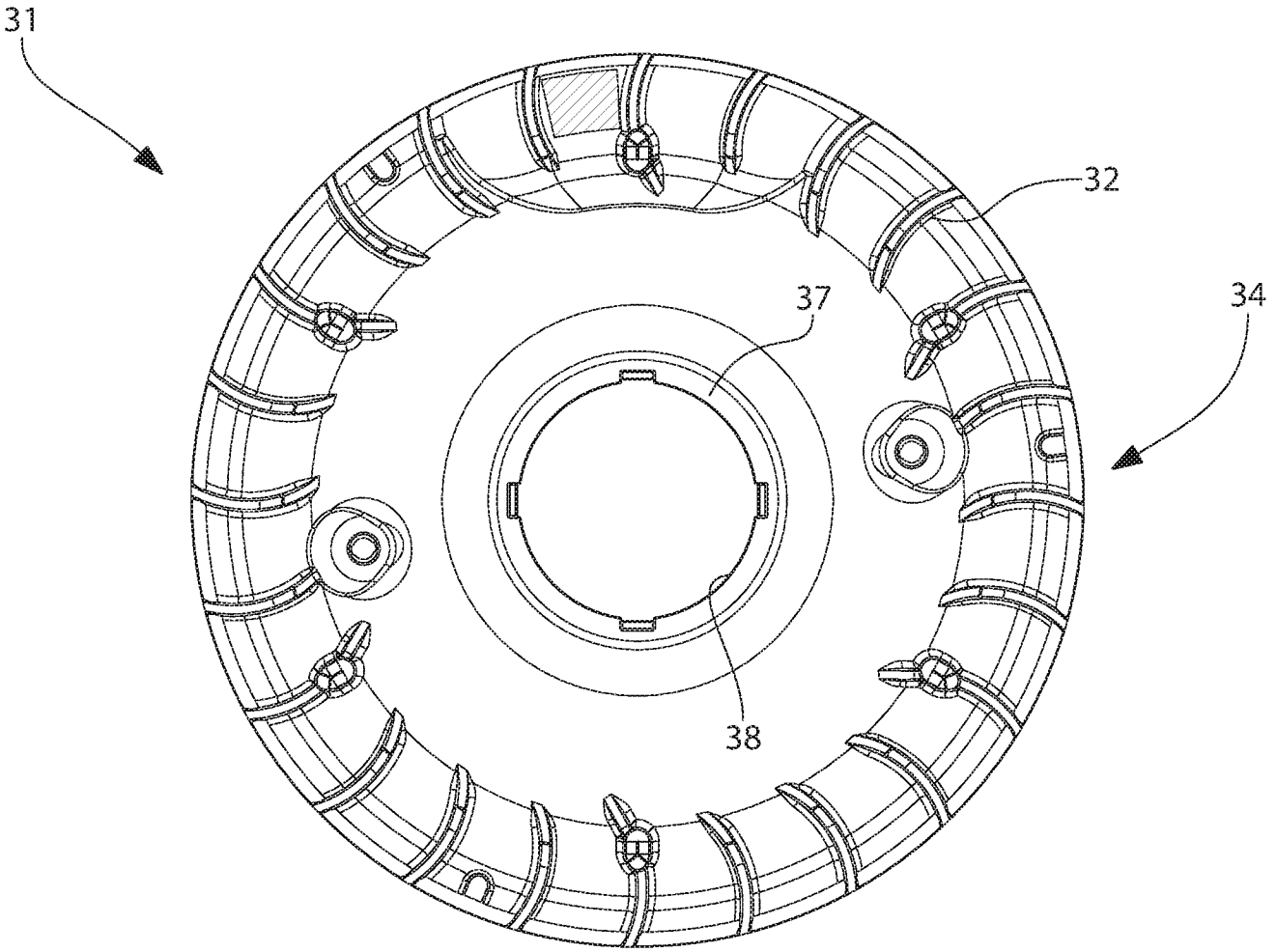
FIG. 33 is a top plan view thereof.
Figure 34:
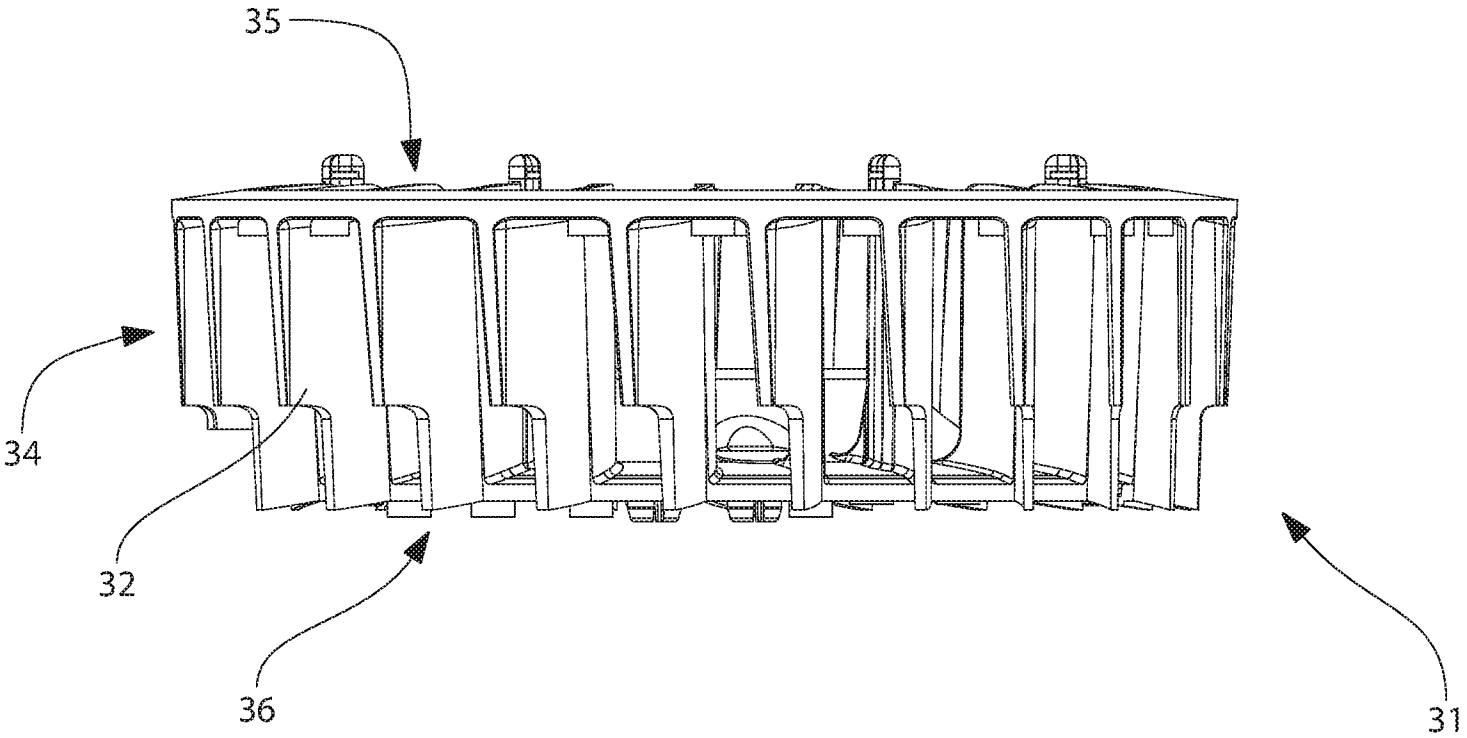
FIG. 34 is a side elevation view thereof.
Figure 35:
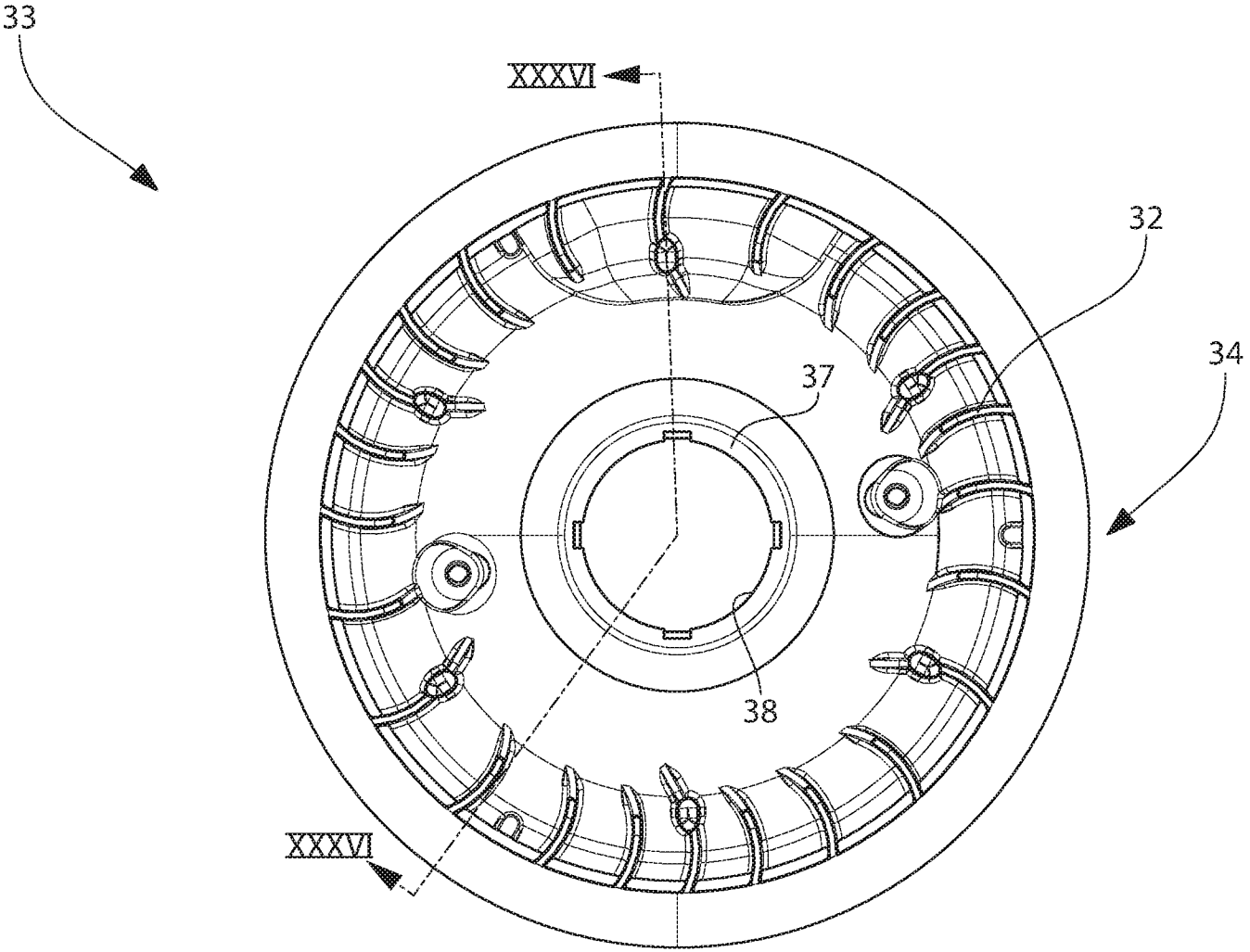
FIG. 35 is a top plan view of a modulated pitch air blower impeller usable in the cooling air blower of FIG. 2 having blades which are unequally spaced apart showing three different sinusoidal modulations.
Figure 36:
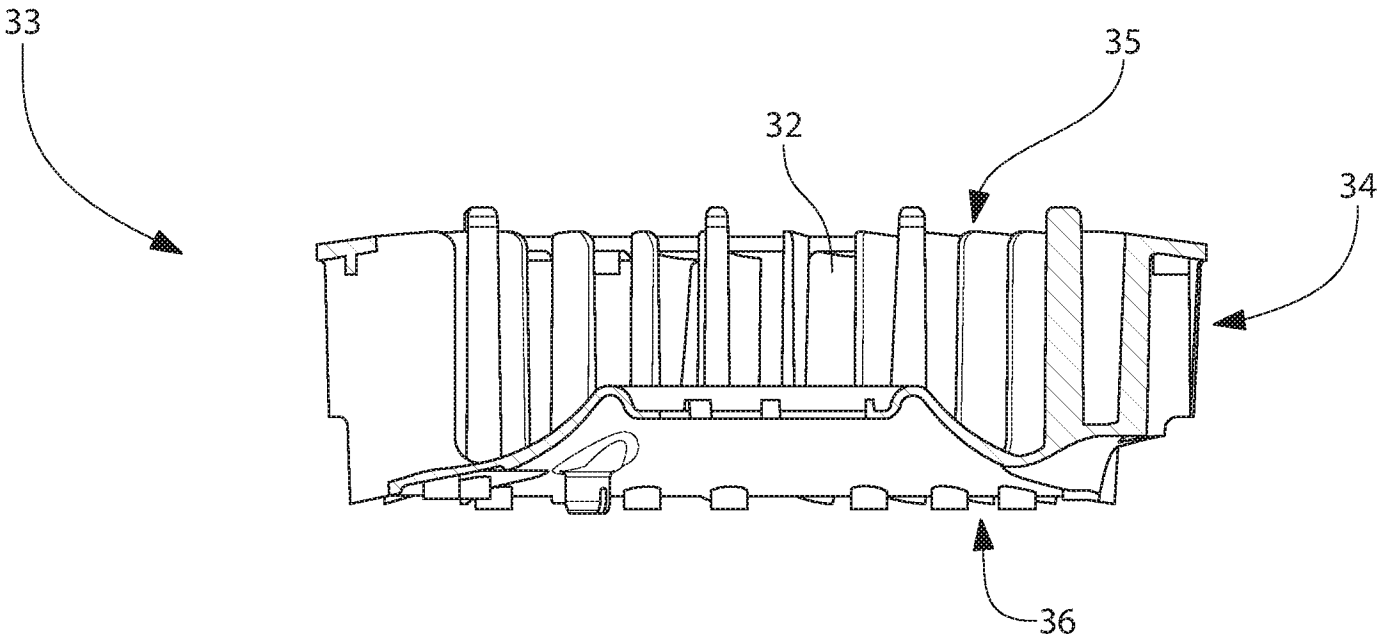
FIG. 36 is a cross-sectional side elevation view thereof.
Figure 37:
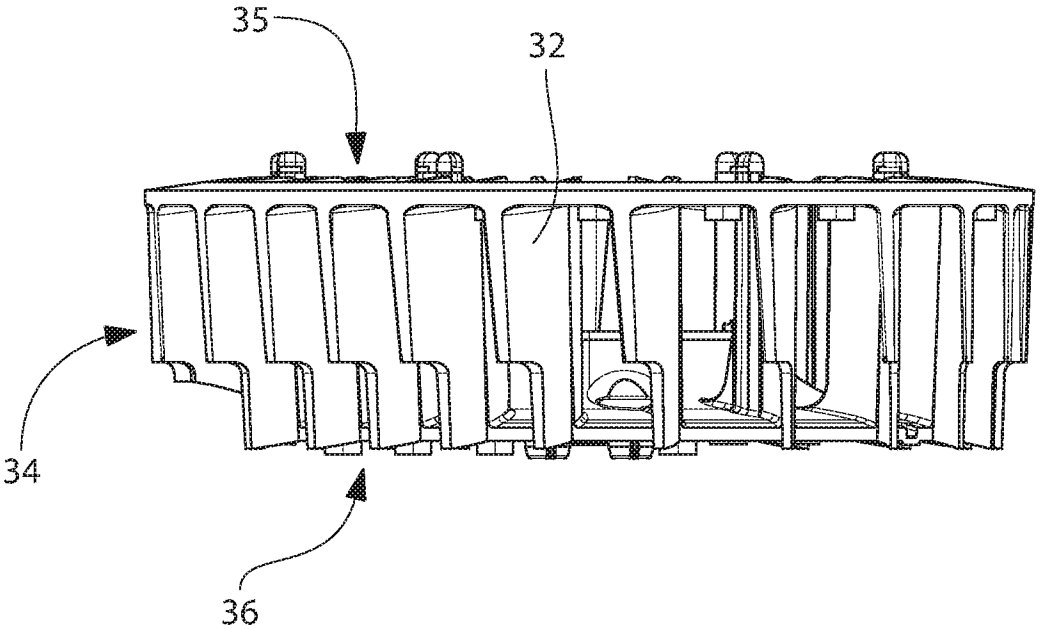
FIG. 37 is a side elevation view thereof.
Figure 38:
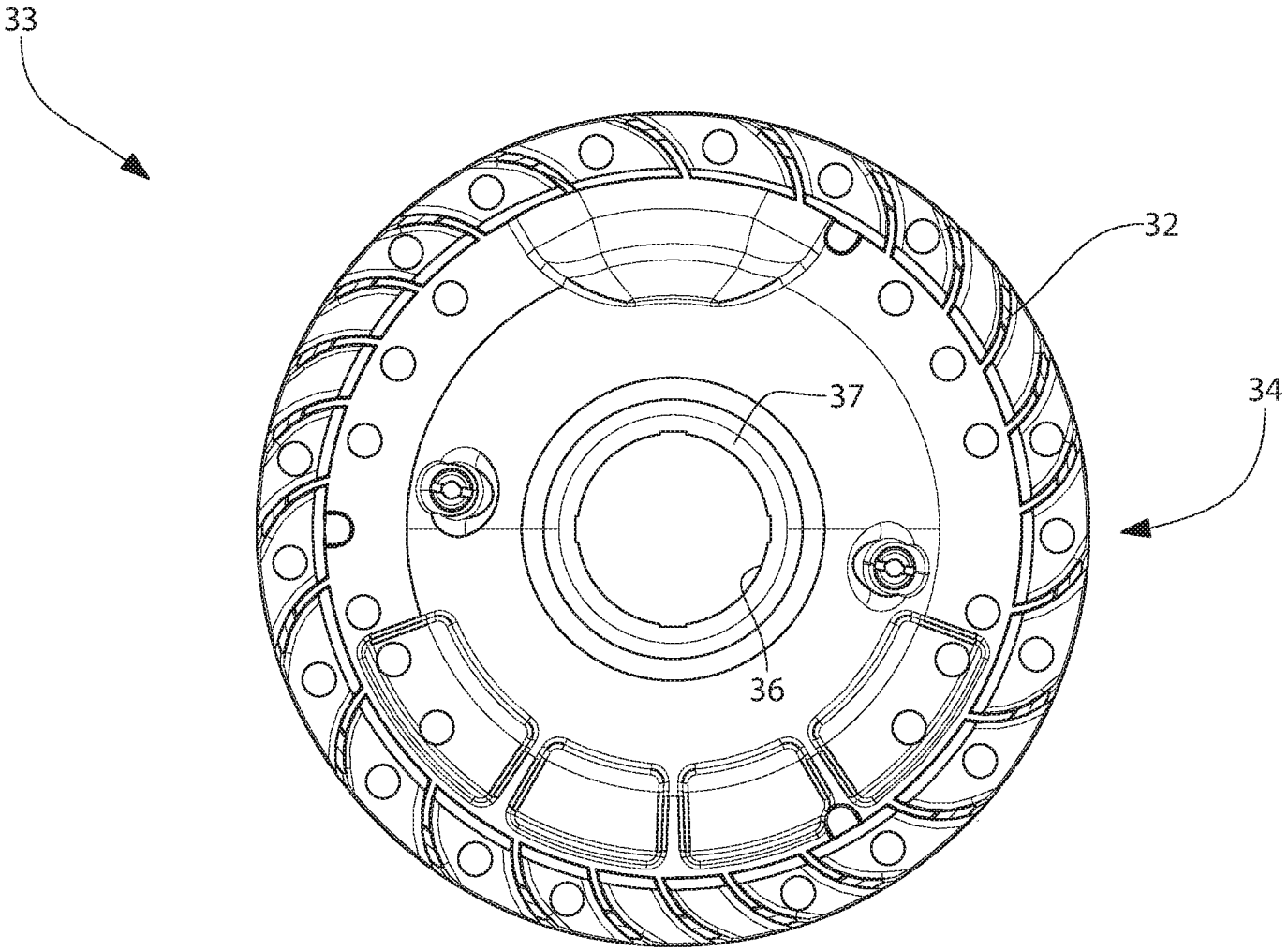
FIG. 38 is a bottom plan view thereof.

As shown in FIG. 30, more than one micro-perforated panel 130 may be used to broaden the range of frequencies absorbed by the panel. In the shroud 100 shown, two micro-perforated panels 130 and 130' are vertically arranged next to each other, and separated by an air gap. In other variations, the two panels 130 and 130' may be stacked together in contact with each other. Each of the panels 130 and 130' may have different sound absorption characteristics by providing different hole 132 size, spacing or pitch P, thickness Tp of the sheet 131, or materials of construction of the sheet for each panel. Accordingly, a system with two panels 130 and 130', each with different sound absorption characteristics, may absorb sound at a wider range of frequencies than a system with only one panel 130. In other variations, the sheets 130 and 130' may be identical. Additionally, the air gap between the two micro-perforated panels 130 and 130' may be constructed such that the distance between the two panels 130 and 130' provides additional wave cancelation and/or low wave pressure properties. Due to the construction and configuration of the spacing, acoustic cancelation may occur as sound/noise waves reflect between the panels 130 and 130' and also are re-directed back towards matching waves. Sound waves in opposite directions with equal or close frequencies will tend to cancel each other (attenuation).

As also shown in FIG. 30 and noted above, one or multiple micro-perforated panels 130, 130', etc. may be used alone without quarter wave resonator 120. It will be appreciated, however, that multiple micro-perforated panels 130 may also be used with a quarter wave resonator 120.

In one example of a micro-perforated panel 130, the holes may have a diameter ranging from and including 0.05 mm to 0.5 mm. The holes may be formed by any suitable method, including without limitation laser cutting or other suitable methods. The micro-perforated panel sheet 131 may be made of any suitable metallic or non-metallic materials, including without limitation metals such as steel or aluminum, polymers/plastics (e.g. polyvinylchloride, acrylic, etc.), fiberglass, and others. Accordingly, micro-perforated panel 130 is not limited by materials of construction which are selected to provide the desired sound absorption characteristics suited for a particular application.

In some variations of a micro-perforated panel, the peripheral edges of micro-perforated panel 130 may be sealed to the inside of shroud 100 along vertical sidewalls 105 to create a substantially air tight air space C between the shroud and panel to minimize reflected sound leakage between the panel edges and the shroud. Reflected noise or sound from air space C behind the panel will therefore only have a pathways back out through the panel holes 132. The edges of micro-perforated panel 130 may be sealed by any suitable method including without limitation caulking or sealants, gaskets, welding (e.g. metal or sonic for plastics depending on the materials used for the shroud and panel), and others.

Figure 39:
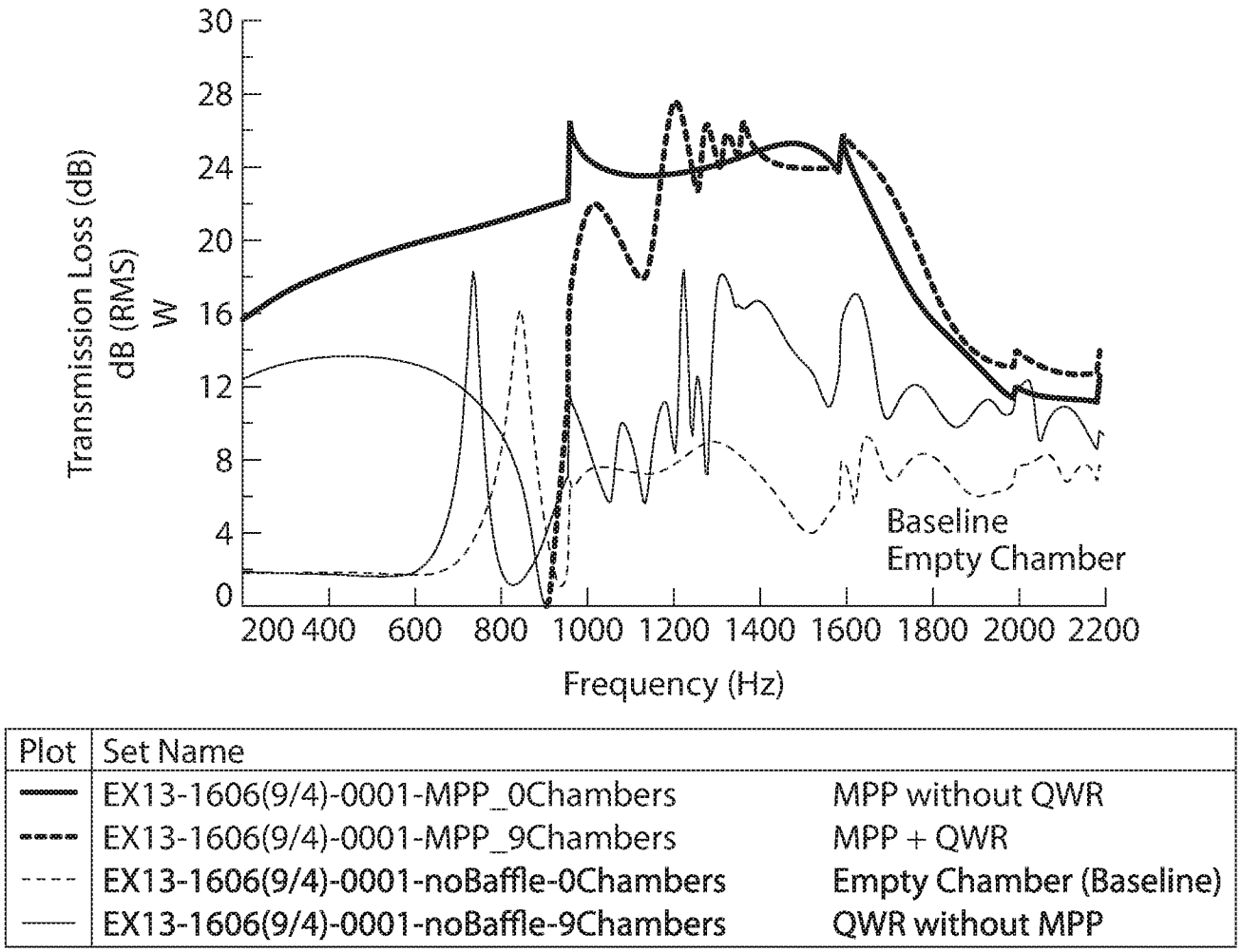
FIG. 39 is a graph showing sound transmission loss predictive modeling results.

The inventors conducted predictive computer modeling of the shroud 100 to determine the potential sound transmission loss which could be achieved by various combinations of a shroud with and without some of the foregoing noise suppression features disclosed herein. The resultant transmission loss curves are shown in FIG. 39. The baseline curve results (light-weight dashed line) represents an empty shroud and air inlet passages 110 without quarter wave resonator or micro-perforated panel, thereby relying on only the cooling air passages and shroud body for sound attenuation. The addition of a quarter wave resonator 120 was modeled having a 9×9 cell array (9 chambers as identified in FIG. 39) as described herein (light-weight sold line curve) to determine its effect on noise suppression performance of the shroud. The effect of adding a micro-perforated panel 130 was modeled both alone in the shroud 100 (heavy-weight solid line curve) and in combination with the 9×9 cell quarter wave resonator 120 (heavy-weight dashed line curve).

As seen in the results of this modeling, the noise suppression performance (i.e. highest decibel sound transmission loss) of a shroud 100 incorporating micro-perforated panel 130 either alone or with quarter wave resonator 120 was generally better over a wide band or range of frequencies than shrouds without the micro-perforated panel. The addition of a quarter wave resonator alone also demonstrated generally better performance than an empty shroud. It will be appreciated, however, that even the empty shroud 100 incorporating the specially configured and positioned air inlet passages 110 provides improved noise reduction and isolation performance, both of which may be even further improved through the use of fibrous absorptive materials. The results of this modeling further demonstrates that the shroud and noise suppression features disclosed herein are each highly customizable from a noise suppression standpoint and may be combined in various combinations to achieve a desired sound attenuation levels at various frequency bands or ranges of interest for a given application.

In view of the foregoing discussion and computer-aided modeling, it will be appreciated that the shroud 100 structure itself with air inlet passages 110 may be considered to provide a baseline noise reduction being tuned to actively reduce fan noise within a certain first frequency range or band and degree of noise reduction (i.e. decibel or sound pressure). A quarter wave resonator 130 or micro-perforated panel 130 may be added which functions to reduce noise in a second frequency range or band which in concert with the air inlet passages 110 have a cumulative noise reduction effect. For systems with micro-perforated panels 130, partitions 122 may be added to provide a forced linear wave propagation that may further reduce noise of the system. The remaining one of the quarter wave resonator 120 or micro-perforated panel 130 not used may, in some systems, be added which functions to reduce noise in a third frequency range or band have a further cumulative noise reduction effect. Any of these systems may also include fibrous absorptive material which may be constructed to provide attenuation over a desired frequency range based on the absorptive coefficient of the fibrous material.

Any of the first, second, or third frequencies ranges may be the same, effecting an increased noise reduction over that frequency range. For example, a shroud may include a micro-perforate panel 130 constructed to absorb sound at a frequency range of 800 Hz to 1000 Hz, while the quarter wave resonators 120 may be constructed with a depth Dc to cancel waves in the same or an overlapping frequency range. In other examples, the first, second, or third frequency ranges may be different to reduce noise over a wider frequency range than either range individually. The combined reduction of fan noise by employing some or all of the foregoing sound reduction features may therefore operate to provide significant or maximum noise reduction over a desired and focused spectrum of frequencies, and/or attenuate sound over a wide spectrum of frequencies thereby providing a high degree of customization to the noise suppression system described herein.

According to another aspect of the prevent disclosure, a micro-perforated panel 130 may be cooperatively designed in conjunction with the type of fan impeller selected to optimize the performance of the shroud noise reduction system. The mono-pitch impeller 31 (equal circumferential blade spacing) or modulated impeller 33 (unequal circumferential blade spacing) designs each have different noise generation characteristics. For example, mono-pitch impellers 31 may typically produce the greatest levels of noise at a narrow (and sometimes higher) frequency bands than the modulated impeller 33 design. With either design, the blade spacing and configuration of the impeller may be selected to intentionally constrain the greatest noise levels to within a predetermined frequency range which coincides with the frequency range for which a micro-perforated panel 130 has been designed to attenuate those same frequencies. For example, an engine 26 may have a mono-pitch (equal blade spacing) impeller 31 which was intentionally designed to generate the greatest level of noise within a first band of frequencies from about 1040 Hz to 1560 Hz. Impeller noise falling outside of this range will be lower and may be at acceptable levels in some instances. The micro-perforated panel 130, through manipulating its design parameters as described above (e.g. hole spacing, pitch, panel thickness, etc.), may then be specifically designed to have the noise suppression characteristic of operably attenuating sound falling within the same band of frequencies as the impeller from about 1040 Hz to 1560 Hz over a given engine speed. The end result is attenuation of impeller noise over a relatively wide range or band of frequencies including minimizing the most offensive peak frequencies of the impeller. Accordingly, while the use of a mono-pitched impeller 31 may otherwise be undesirable due to the increased noise at a narrow frequency band, the use of micro-perforated plates 130 and/or quarter wave resonators 120 tuned to reduce (through absorption or wave cancellation) noise within that frequency may result in a quieter engine than one with a modulated-pitch impeller 33.

A micro-perforated sheet may be a sheet of material (such as a sheet of metal) with small holes, slots, or slits (such as 0.1 to 0.75 mm) cut, etched, rolled, or otherwise manufactured into the sheet. A micro-perforated panel may be a combination of at least one micro-perforated sheet with at least one additional boundary or rigid wall separated from the micro-perforated sheet by a distance Dp (see, for example, the micro-perforated sheet 8005 and micro-perforated panel 8000 in FIG. 80). In some systems, the micro-perforated panel may include more than one micro-perforated sheet and/or more than one micro-perforated additional boundary or wall. In some example systems, a micro-perforated sheet may be positioned adjacent to or near structural or pre-existing walls. In such systems, the combination of the micro-perforated sheet and the structural or pre-existing walls may be a micro-perforated panel.

As a more particular example, the micro-perforated sheet may be positioned adjacent to or near a boundary of a component that generates, transmits, or transfers sound having a frequency within a certain frequency range. For example, as described below, the micro-perforated sheet may be positioned next to an engine component that may itself generate noise (such as a cylinder) or may reflect, transmit, or transfer noise, such as an air intake manifold. Any parts or devices described herein which the micro-perforated sheet may be positioned next to or adjacent to may represent such components.

Micro-perforated sheets and micro-perforated panels may take on various shapes and profiles. For example, micro-perforated sheets and micro-perforated panels may be flat, curved, rounded, bent, corrugated, shaped, formed, or various other shapes. As one example, the micro-perforated panels may be smooth and flat or gently rounded, with micro-perforated circular or oval holes. As another example, the micro-perforated panels may be corrugated with micro-perforated slits. Many other examples are possible. In some systems, micro-perforated sheets and micro-perforated panels may be designed or used to conform to, cover, surround, wrap around, or otherwise enclose a portion of various component of various sizes.

Micro-perforated sheets and/or micro-perforated panels may be effective for absorbing sound or noise within various frequency bands or ranges, reducing the resultant reflected sound. The design parameters of the micro-perforated sheet and/or micro-perforated panel may be customized to tune the frequencies and/or frequency bands that the micro-perforated sheet and/or micro-perforated panel will absorb most effectively. As such, the parameters may be set such that the absorption frequency range of the micro-perforated sheet may overlap with or cancel part or all of the noise generated, transmitted, or otherwise transferred by the component. For example, the size of a pore or hole 132 (such as the diameter d), spacing or pitch P of holes 132 (such as the center-to-center spacing b), thickness Tp of the sheet 131, and depth Dp of the air space C behind the sheet may affect the resultant noise cancellation properties of a micro-perforated sheet or micro-perforated panel and attenuation frequencies (see, e.g., FIGS. 80 and 82). By determining or calculating, setting, adjusting, and/or customizing these parameters, the frequency band of sound absorption of the micro-perforated sheet and/or micro-perforated panel can be designed or otherwise tuned to filter out undesirable frequencies of sound produced by noisy components.

A wide variety of components, machines, and applications may be manufactured with or otherwise include micro-perforated sheets and/or micro-perforated panels to reduce noise or sound produced. In some systems, micro-perforated sheets and/or micro-perforated panels may be used as, and/or referred to as, micro-perforated components, micro-perforated scrolls, micro-perforated covers, micro-perforated top pans, micro-perforated frames, micro-perforated walls, micro-perforated barriers, micro-perforated cylinder wraps, micro-perforated oil pan wraps, micro-perforated muffler wraps, micro-perforated heat guards, micro-perforated enclosures, micro-perforated shields, and micro-perforated blade covers, among other names.

An engine, for example, may have many components that create, amplify, or reflect sound. An engine may include one or more micro-perforated components to minimize the sound of these components.

Figure 40:
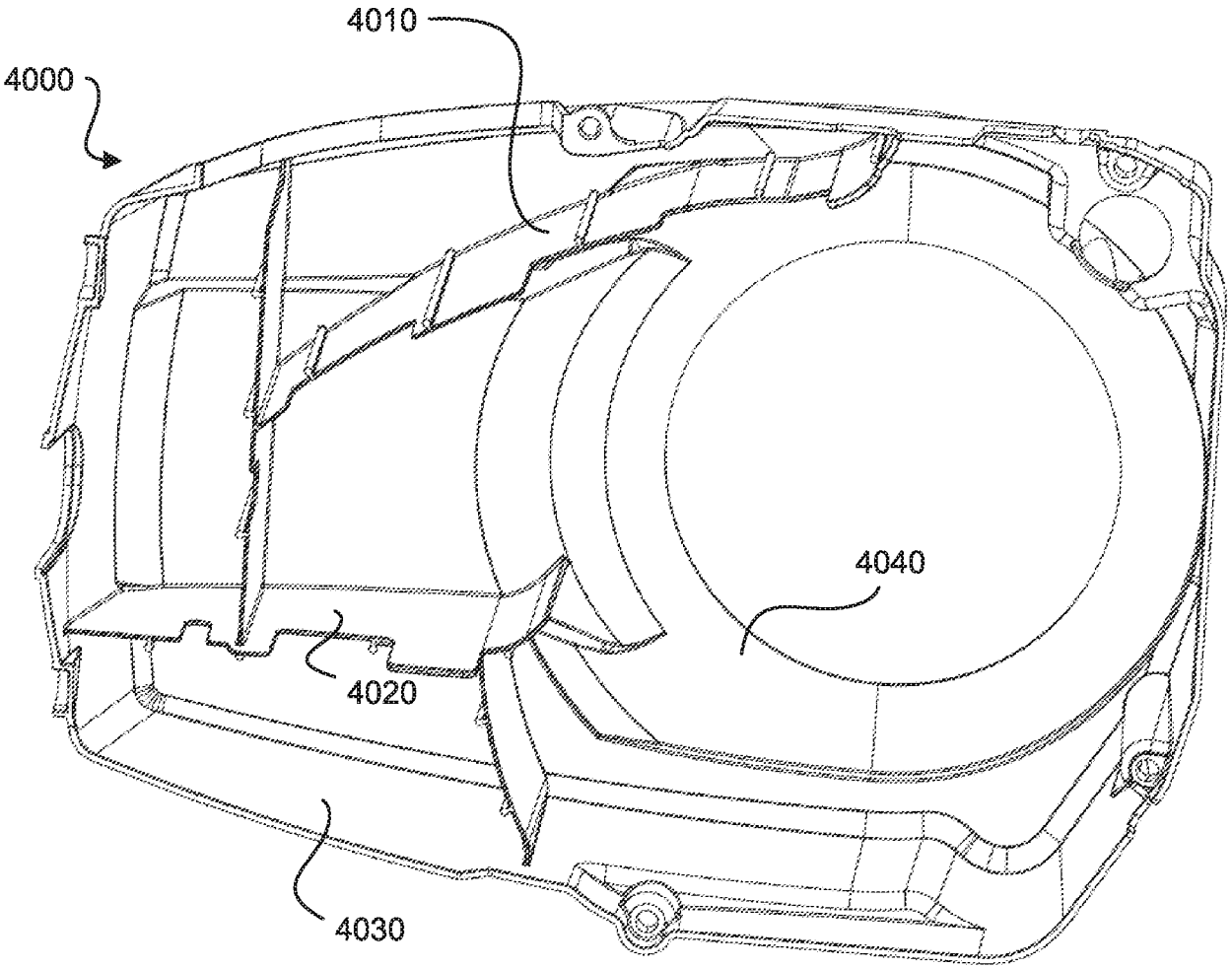
FIG. 40 shows a bottom view of an example blower housing.

In addition to a sound absorbing or attenuating shroud 100, micro-perforated sheets and/or micro-perforated panels may additionally be included within, or as part of, the engine blower housing. FIG. 40 shows a bottom view of an example blower housing 4000. The blower housing 4000 may include one or more micro-perforated components, such as a micro-perforated scroll 4010, which may direct air from the blower fan. In some systems, the blower housing 4000 may additionally or alternatively include one or more micro-perforated interior walls 4020 or micro-perforated exterior walls 4030. The micro-perforated scroll 4010 and micro-perforated dividers 4020, and 4030 may be placed in various positions, such as adjacent to the blower fan or in various other positions.

In some systems, one or more of the micro-perforated scroll 4010 and micro-perforated walls 4020 and 4030 may be micro-perforated panels, which may include a micro-perforated sheet and a boundary wall positioned a distance from the micro-perforated sheet. In some systems, one or more of the micro-perforated scroll 4010 and micro-perforated dividers 4020 and 4030 may be micro-perforated sheets positioned a distance from an additional boundary wall, such as the outer shell of the blower housing 4000 or an interior wall. The micro-perforated walls 4010, 4020, and 4030 may, in some instances, be added in addition to existing structural walls to primarily provide sound attenuation. In other instances, the micro-perforated walls 4010, 4020, and 4030 may replace existing structural walls to provide both sound attenuation and structural support to the blower housing 4000. The micro-perforated walls 4010, 4020, and 4030 may be various shapes. For example, the micro-perforated walls 4010, 4020, and 4030 may be partially rounded or angled shape to direct air in a cyclonic or circular fashion. Other variations are possible.

The parameters of the micro-perforated scroll 4010 and dividers 4020 and 4030 (d, b, Tp, Dp) may be calculated to provide the micro-perforated components with the greatest absorption or attenuation capabilities or effect within the frequency ranges typically generated by the blower fan, the engine, or an engine component. One or more manufacturing techniques, such as a laser, photo etching, or chemical etching, may implement (or be used to implement) micro-perforations having the parameters (d, b) into a base material of a designated thickness (Tp) that provides the micro-perforated scroll 4010 and dividers 4020, and 4030 with the greatest sound absorption or attenuation capability or effect within the frequency ranges generated by the blower fan, the engine, or an engine component. Micro-perforated scroll 4010 and dividers 4020 and 4030 having parameters (d, b, Tp) may be positioned, attached, and/or secured a distance Dp from a boundary which may be part of the micro-perforated scroll 4010 or walls 4020 and 4030 where the micro-perforated scroll 4010 or dividers 4020 and 4030 are micro-perforated panels, and which may be a separate boundary wall where the micro-perforated scroll 4010 or dividers 4020 and 4030 are micro-perforated sheets. The positioning of the micro-perforated component creates a cavity of depth Dp corresponding to an appropriate cavity depth Dp that provides the micro-perforated scroll 4010 and dividers 4020 and 4030 with the greatest sound absorption or attenuation capability or effect within the frequency ranges generated by the blower fan, the engine, or an engine component. As an example, the blower housing may include micro-perforated scrolls 4010 or dividers 4020 and 4030 with parameters (d, b, Tp) positioned with a cavity depth Dp from a boundary wall that enables the micro-perforated scrolls 4010 or dividers 4020 and 4030 to absorb or attenuate sound within typical noise ranges generated or otherwise present in a blower housing, such as between 300-1500 Hz for tonal noise or 800-3000 Hz for flow noise. In other systems, the parameters (d, b, Tp, Dp) of the micro-perforated dividers 4010, 4020, and 4030 may be calculated, and/or micro-perforations with other parameters may be cut, manufactured, or otherwise implemented, providing the micro-perforated dividers 4010, 4020, and 4030 with sound absorption or attenuation of various other frequency ranges.

Figure 41:
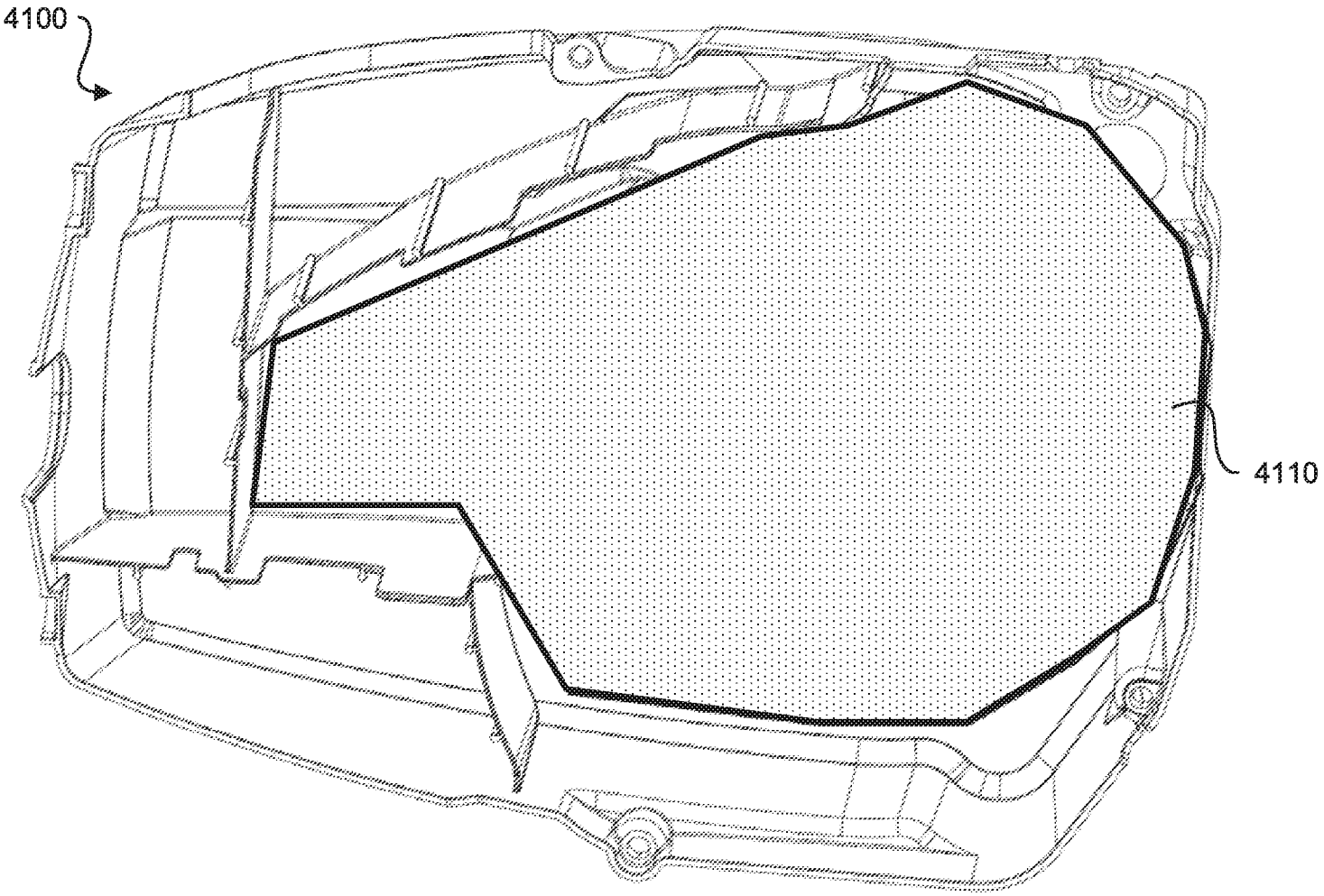
FIG. 41 shows a bottom view of an example blower housing with a micro-perforated panel.

FIG. 41 shows a bottom view of another example blower housing 4100 and a micro-perforated cover 4110. The micro-perforated cover 4110 may be positioned between and/or separate the blower housing 4100 from another component of the engine, such as the engine crankcase. The micro-perforated cover 4110 may be various shapes, such as a shape configured to cover part or all of an air flow chamber within the blower housing.

The parameters of the micro-perforated cover 4110 (d, b, Tp, Dp) may be calculated to provide the micro-perforated cover 4110 with the greatest absorption or attenuation capabilities or effect within the frequency ranges typically generated by the blower fan, the engine, or an engine component. One or more manufacturing techniques may implement (or be used to implement) micro-perforations having the parameters (d, b) into a base material of a designated thickness (Tp). A micro-perforated cover 4110 having parameters (d, b, Tp) may be positioned, attached, and/or secured a distance Dp from a boundary. In some systems, the micro-perforated cover 4110 may be a micro-perforated panel, and may include a micro-perforated sheet and a boundary positioned a distance Dp from the micro-perforated sheet. In other systems, the micro-perforated cover 4110 may be a micro-perforated sheet, which may be positioned a distance from an additional and separate boundary wall, such as the interior top surface 4040 of the blower housing 4000. The positioning of the micro-perforated cover 4110 may create a cavity of depth Dp corresponding to an appropriate cavity depth Dp that provides the micro-perforated cover 4110 with the greatest sound absorption or attenuation capability or effect within the frequency ranges generated by the blower fan, the engine, or an engine component. As an example, the blower housing 4000 may include a micro-perforated cover 4110 with parameters (d, b, Tp) positioned with a cavity depth Dp (such as a depth from a fan, a lower boundary wall, or a top of the blower housing 4040) that enables the micro-perforated cover 4110 to absorb or attenuate sound within typical noise ranges generated or otherwise present in a blower housing 4000, such as between 300-1500 Hz for tonal noise or 800-3000 Hz for flow noise. In other systems, the parameters (d, b, Tp, Dp) of the micro-perforated cover 4110 may be calculated, and/or micro-perforations with other parameters may be cut, manufactured, or otherwise implemented, providing the micro-perforated cover 4110 with sound absorption or attenuation of various other frequency ranges.

Figure 42:
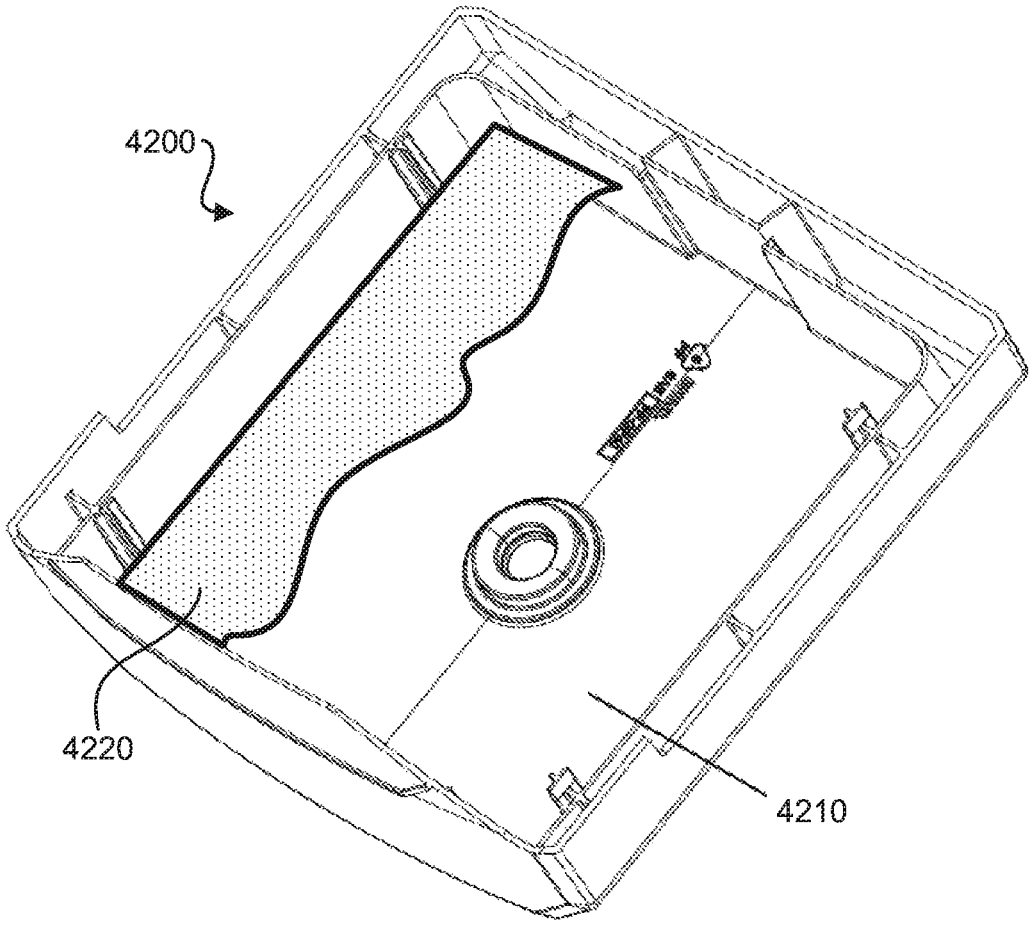
FIG. 42 shows a bottom view of an example air cleaner cover.

FIG. 42 shows an example air cleaner cover 4200 for an air cleaner (or air filter) on an engine. The air cleaner cover 4200 may include a top wall 4210 and a micro-perforated barrier 4220

The micro-perforated barrier 4220 may be various shapes, such as flat, rectangular, bent, a shape that conforms with a boundary on the air cleaner cover, or various other shapes. The micro-perforated barrier 4220 may be positioned in various places, such as over the air cleaner or air filter, next to the top wall 4210, or a distance from the top wall 4210 of the air cleaner cover 4200. The micro-perforated barrier 4220 may be a micro-perforated sheet, which may be positioned a distance Dp from a boundary wall, such as the top wall 4210. Alternatively, the micro-perforated barrier 4220 may be a micro-perforated panel. In some systems where the micro-perforated barrier 4220 is a micro-perforated panel, the micro-perforated barrier 4220 may replace the top wall 4210. Other variations are possible.

The parameters of the micro-perforated barrier 4220 (d, b, Tp, Dp) may be calculated to provide the micro-perforated barrier 4220 with the greatest absorption or attenuation capabilities or effect within the frequency ranges typically generated by the air cleaner, the blower fan, the engine or an engine component. One or more manufacturing techniques may implement (or be used to implement) micro-perforations having the parameters (d, b) into a base material of a designated thickness (Tp). A micro-perforated wall 4220 having parameters (d, b, Tp) may be positioned, attached, and/or secured a distance Dp from a boundary which may be part of the micro-perforated barrier 4220 where the micro-perforated barrier 4220 is a micro-perforated panel, and which may be a separate boundary wall (such as the top wall 4210) where the micro-perforated barrier 4220 is a micro-perforated sheet. The positioning of the micro-perforated barrier 4220 may create a cavity of depth Dp corresponding to an appropriate cavity depth Dp that provides the micro-perforated barrier 4220 with the greatest sound absorption or attenuation capability or effect within the frequency ranges generated by the air cleaner, the blower fan, the engine or an engine component. As an example, the air cleaner cover 4200 may include a micro-perforated barrier 4220 with parameters (d, b, Tp) positioned with a cavity depth Dp (such as a depth from the top wall 4210) that enables the micro-perforated barrier 4220 to absorb or attenuate sound within typical noise ranges generated or otherwise present in an air cleaner, such as between 300-800 Hz. In other systems, the parameters (d, b, Tp, Dp) of the micro-perforated barrier 4220 may be calculated, and/or micro-perforations with other parameters may be cut, manufactured, or otherwise implemented, providing the micro-perforated barrier 4220 with sound absorption or attenuation of various other frequency ranges.

Figure 43:
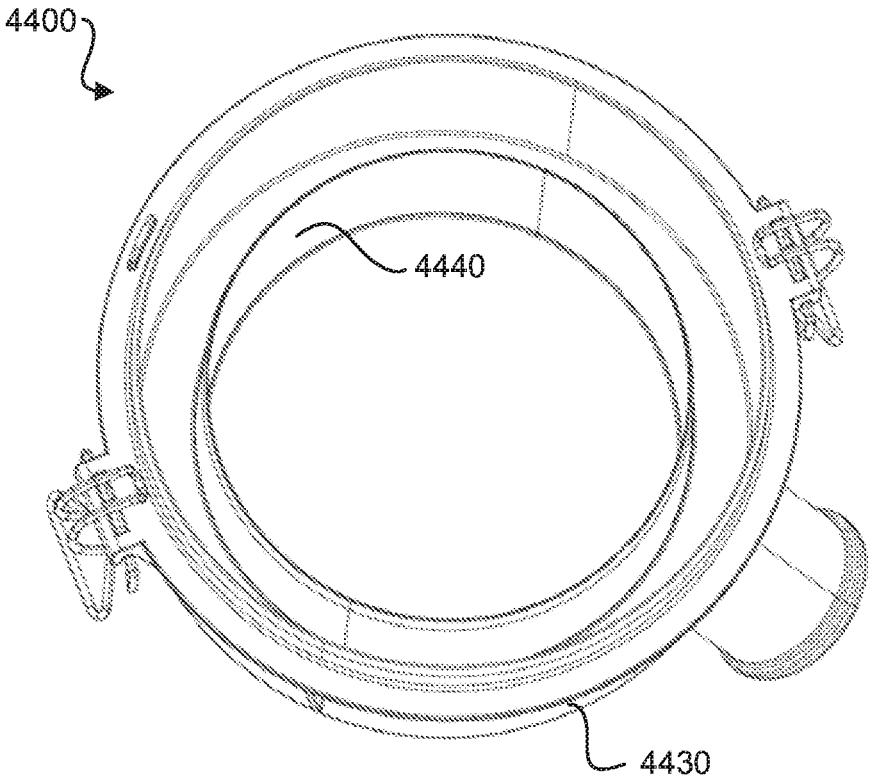
FIG. 43 shows a perspective view of an example air cleaner housing.
Figure 44:
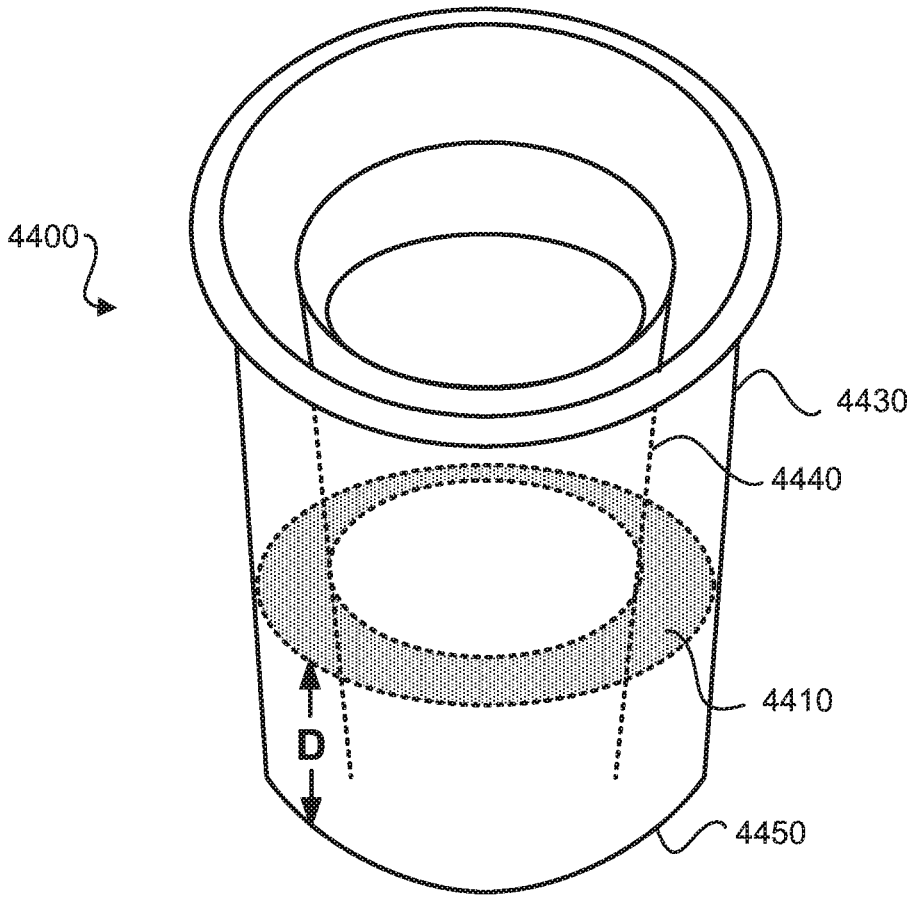
FIG. 44 shows a transparent view of an example air cleaner cap.

FIG. 43 shows an example of an air filter cap 4400 for an air filter in an engine. FIG. 44 shows a transparent view of the air filter cap 4400. The air filter cap 4400 may include one or more micro-perforated interior components 4410. The micro-perforated interior components 4410 of the air filter cap 4400 may be generally annular or ring shaped, cylindrical, conical, frusto-conical, or various other shapes. The micro-perforated interior components 4410 may be positioned within an air filter providing sound attenuation for the air filter. In some systems, the micro-perforated interior components 4410 may be positioned approximately perpendicular to and between one or more air-directing walls 4430 and 4440 of the air filter cap. In other systems, the micro-perforated interior components 4410 may be positioned parallel with and/or replace one or more of the air-directing walls 4430 and 4440. In some of these systems, the micro-perforated interior components 4410 of the air filter cap 4400 may be positioned to direct air passing through the air filter in various directions, such as in a helical or circular manner. In some systems, the air filter cap 4400 may include two or more micro-perforated interior components 4410 that have different parameters, such that the micro-perforated interior components 4410 may be configured to absorb sound in different frequency ranges. In still other examples, one or more micro-perforated components 4410 may be positioned outside, around, and/or a distance from an exterior surface of the air filter cap 4400. Other variations are possible.

The parameters of the micro-perforated components 4410 (d, b, Tp, Dp) may be calculated to provide the micro-perforated components 4410 with the greatest absorption or attenuation capabilities or effect within the frequency ranges typically generated by the air filter, the blower fan, the engine or an engine component. One or more manufacturing techniques may implement (or be used to implement) micro-perforations having the parameters (d, b) into a base material of a designated thickness (Tp). The micro-perforated components 4410 may be a micro-perforated sheet, which may be positioned a distance D from a boundary wall such as the bottom (or top) surface 4450 of the air filter cap. In other systems, the micro-perforated components 4410 may be a micro-perforated panel, which may include micro-perforated sheet and a boundary wall positioned a distance from the micro-perforated sheet. The positioning of the micro-perforated components 4410 may create a cavity of depth Dp corresponding to an appropriate cavity depth Dp that provides the micro-perforated components 4410 with the greatest sound absorption or attenuation capability or effect within the frequency ranges generated by the air filter, the blower fan, the engine or an engine component. In other systems, the parameters (d, b, Tp, Dp) of the micro-perforated components 4410 may be calculated, and/or micro-perforations with other parameters may be cut, manufactured, or otherwise implemented, providing the micro-perforated components 4410 with sound absorption or attenuation of various other frequency ranges.

Figure 45:
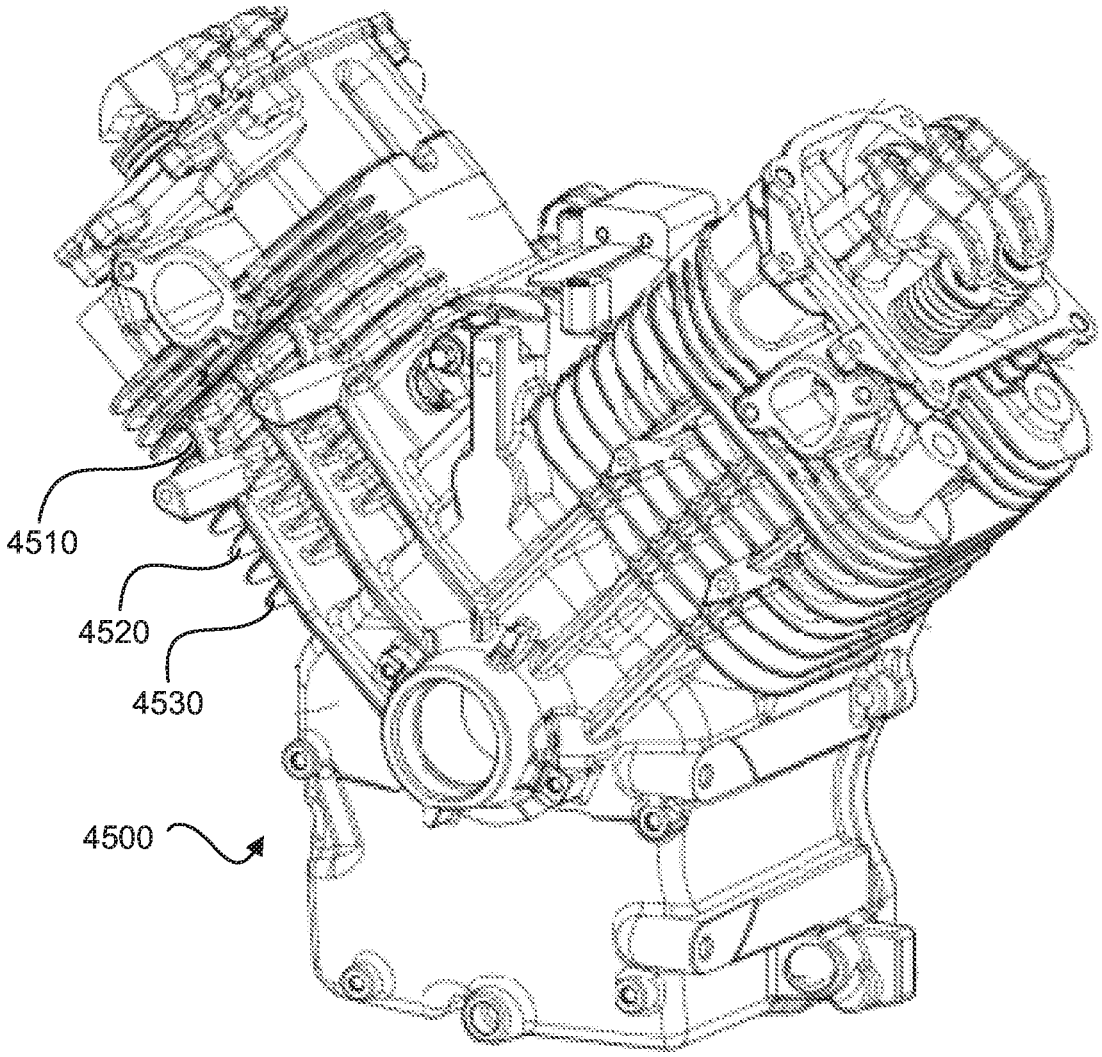
FIG. 45 shows a perspective view of an example portion of an engine.

FIG. 45 shows an example of a portion of an engine 4500 with at least one cylinder 4510. The cylinder 4510 may include one or more cooling fins (or cylinder fins) 4520 and 4530. The cooling fins 4520 and 4530 may be surrounded or wrapped by a micro-perforated cylinder wrap.

Figure 46:
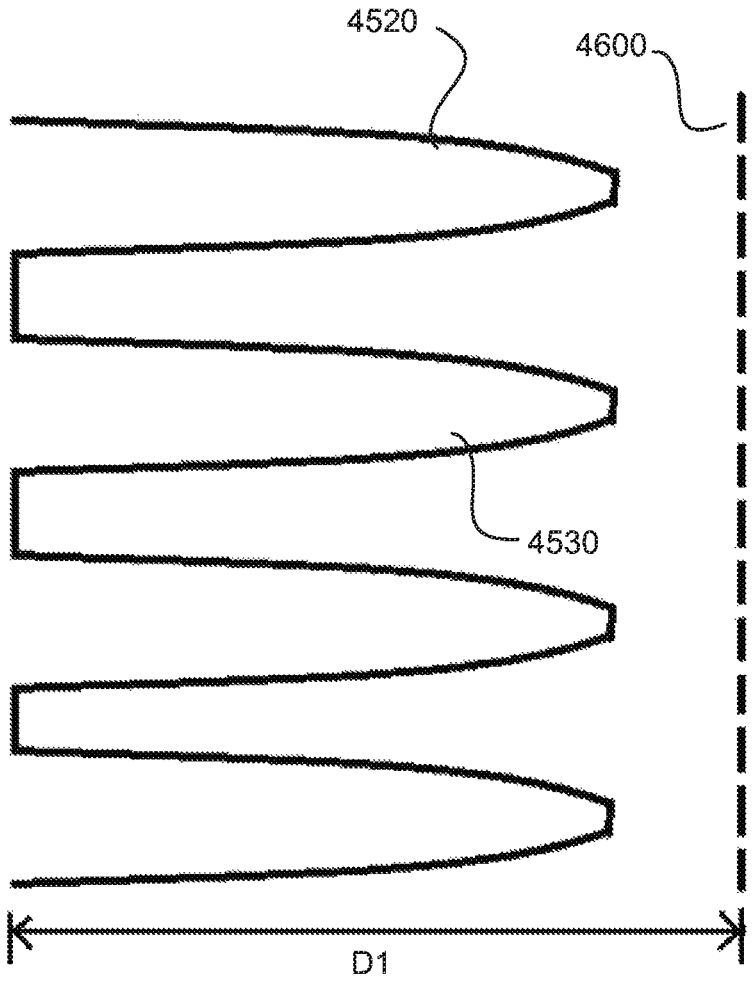
FIG. 46 shows a cross-sectional view of an example cylinder wrap for a cylinder of an engine.

FIG. 46 shows an example micro-perforated cylinder wrap 4600 positioned around cooling fins 4520 and 4530 of the cylinder 4510. The micro-perforated cylinder wrap 4600 may be positioned adjacent to, around an outside of, wrapped around, placed on or a distance from a side of a cylinder 4510, or in various other positions. As an example, the micro-perforated cylinder wrap 4600 may be positioned a distance D1 away from an interior surface (within the cooling fins 4230 and 4530 of the cylinder 4510. In some systems, the micro-perforated cylinder wrap 4600 may be generally flat. In other systems, the micro-perforated cylinder wrap 4600 may have a shape that conforms to a shape of a portion of the cylinder 4510. Various other shapes of micro-perforated cylinder wraps 4600 are possible. The micro-perforated cylinder wrap 4600 may have parameters that are tuned to enable the cylinder wrap to attenuate or absorb sound from the engine or cylinder.

Figure 47:
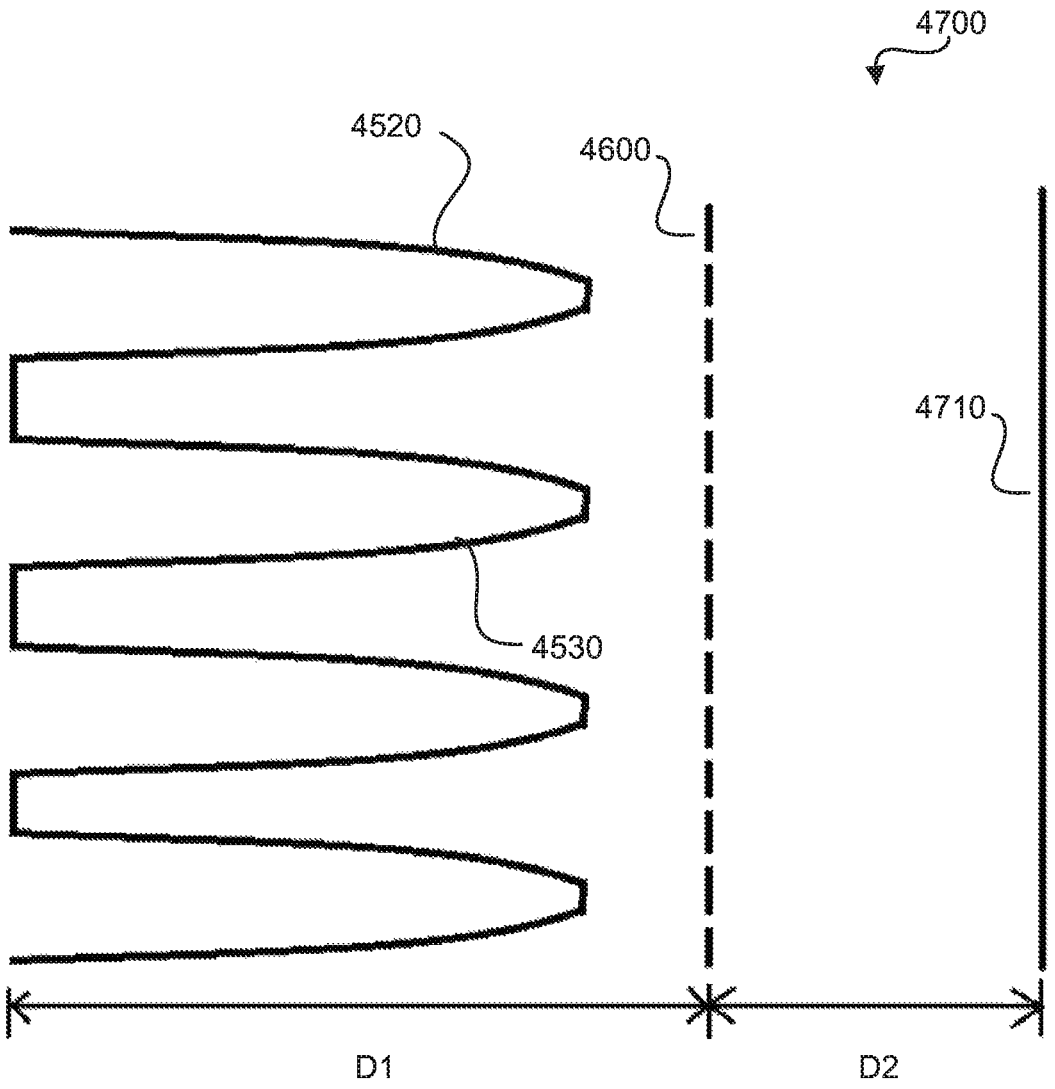
FIG. 47 shows a cross-sectional view of another example cylinder wrap for a cylinder of an engine.

In some instances, the micro-perforated cylinder wrap 4600 may be the outer-most layer of the cylinder 4510. In other instances, the micro-perforated cylinder wrap 4600 may be positioned between the cylinder and a baffle or baffle component. FIG. 47 shows an example of a sound attenuation system 4700 that includes both a micro-perforated cylinder wrap 4600 and a baffle 4710. The baffle 4700 may be positioned, attached, and/or secured next to, or a distance D2, from the micro-perforated cylinder wrap 4600, which itself may be positioned a distance D1 from an interior wall of the cylinder 4510. The baffle 4700 may be made of various materials, such as sheet metal or other materials. The micro-perforated cylinder wraps may additionally or alternatively direct an air flow past the cooling fins of the cylinder, enhancing the cooling capabilities of the cylinder. In other variations, micro-perforated sheets or micro-perforated panels may be positioned between the cooling fins 4520 and 4530. Other variations are possible.

The micro-perforated cylinder wrap 4600 in either FIG. 46 or 47 may be a micro-perforated sheet, which may be positioned a distance Dp from a boundary or boundary wall. For example, the micro-perforated cylinder wrap 4600 may be a micro-perforated sheet and the distance D2 may equal or nearly equal the distance Dp. In this example, the combination micro-perforated cylinder wrap 4600 and the baffle 4700 may constitute a micro-perforated panel. As another example, the micro-perforated cylinder wrap 4600 may be a micro-perforated sheet and the distance D1 (or a distance from an intermediate point between the cooling fins 4520 and 4530 and the micro-perforated cylinder wrap 4600) may equal or nearly equal the distance Dp. In other systems, the micro-perforated cylinder wrap 4600 may be a micro-perforated panel, which may include a boundary wall positioned a distance Dp from the micro-perforated sheet. Other examples are possible.

The parameters of the micro-perforated cylinder wrap 4600 (or a micro-perforated cooling fin) (d, b, Tp, Dp) may be calculated to provide the micro-perforated cylinder wrap 4600 with the greatest absorption or attenuation capabilities or effect within the frequency ranges typically generated by an engine component, such as noise from a piston impact, noise from cylinder fin ringing or vibrations, aeroacoutsic flow noise, or other noise. One or more manufacturing techniques may implement (or be used to implement) micro-perforations having the parameters (d, b) into a base material of a designated thickness (Tp), and the micro-perforated sheet may be positioned, attached, and/or secured a distance from a boundary, creating a cavity of depth Dp corresponding to an appropriate cavity depth Dp that provides the micro-perforated cylinder wrap 4600 with the greatest sound absorption or attenuation capability or effect within the frequency ranges generated by the air filter, the blower fan, the engine or an engine component. As an example, the micro-perforated cylinder wrap 4600 may have parameters (d, b, Tp) and/or be positioned with a cavity depth Dp (such as a depth D1 from the interior of the cylinder 4510 or a depth D2 from the baffle 4710) that enables the micro-perforated cylinder wrap 4600 to absorb or attenuate sound within typical noise ranges generated by the engine or otherwise present around the cylinder, such as between 120-4000 Hz. In other systems, the parameters (d, b, Tp, Dp) of the micro-perforated cylinder wrap 4600 may be calculated, and/or micro-perforations with other parameters may be cut, manufactured, or otherwise implemented, providing the micro-perforated cylinder wrap 4600 with sound absorption or attenuation of various other frequency ranges. Other variations are possible.

Figure 48:
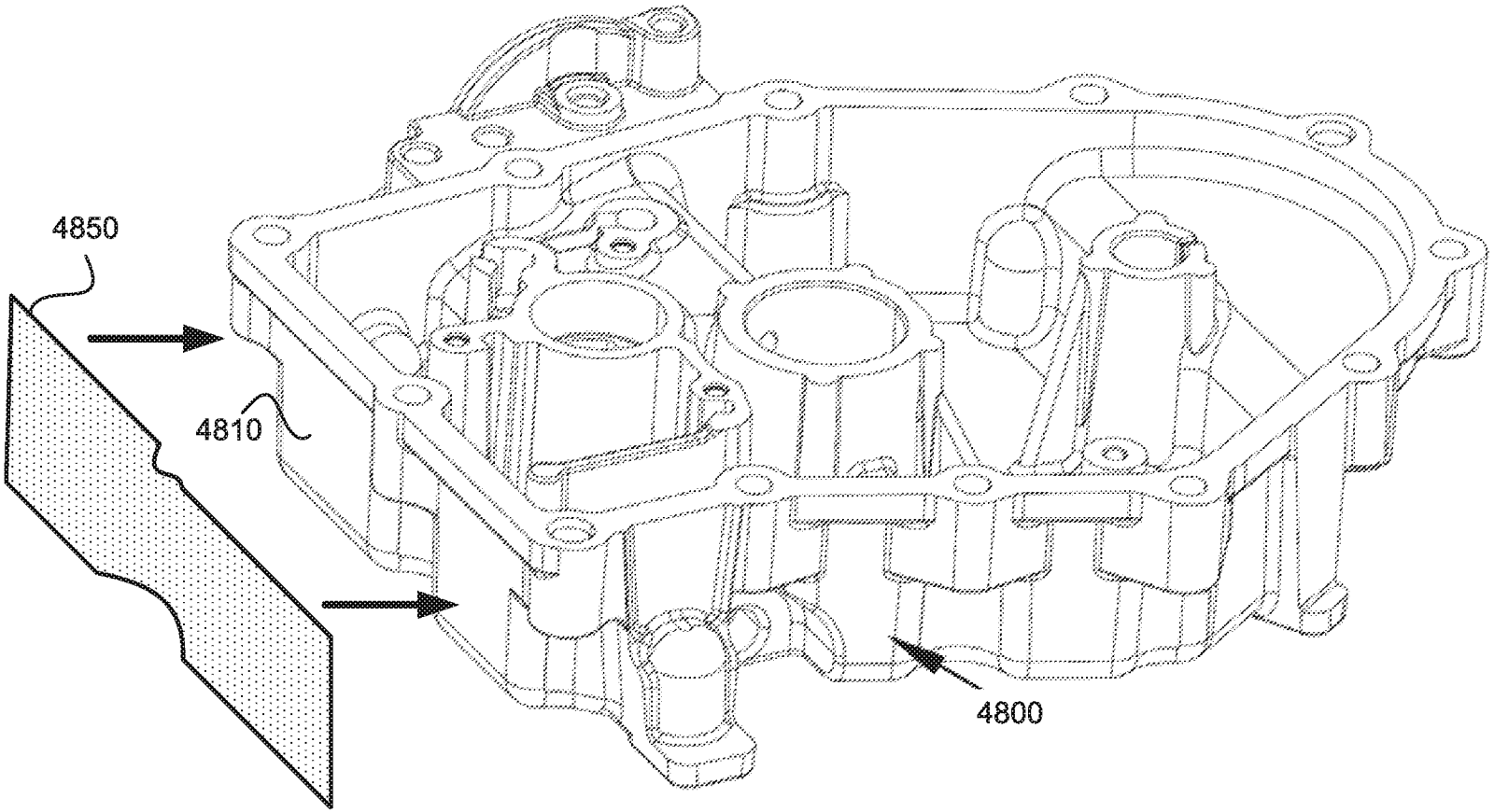
FIG. 48 shows a perspective view of an example oil pan.

FIG. 48 shows an example of a closure plate 4800. The closure plate 4800 may include one or more exterior walls, such as side wall 4810, which may be attached or connected with a crankcase. The exterior walls may include side walls 4810 and one or more bottom wall. The closure plate 4800 may additionally or alternatively include one or more micro-perforated closure plate wraps 4850. The micro-perforated closure plate wrap 4850 may be positioned near or attached a distance from a surface of a exterior wall of the closure plate, or in various other positions. As an example, the micro-perforated closure plate wrap 4850 may be positioned next to, around, or a distance from an exterior surface of the side wall 4810 of the closure plate 4800. The micro-perforated closure plate wrap 4850 may have a same or similar general shape that conforms to part or all of an closure plate 4800 or the exterior walls of the closure plate 4800, or may be various other shapes. The micro-perforated closure plate wrap 4850 may be positioned so as to avoid affecting a flow of oil to or from the closure plate. In some systems, such as in a vertical shaft engine, the closure plate 4800 may be an oil pan.

While the micro-perforated closure plate wrap 4850 is shown as bounding only one side wall 4810 of the closure plate 4800, it should be appreciated that one or more micro-perforated closure plate wraps 4850 may be configured and/or positioned to different, more, or all exterior surfaces of the closure plate 4800. In some instances, the closure plate wrap 4850 may include multiple micro-perforated components that may each fit over part or all of each of the surfaces 4810. In other instances, the closure plate wrap 4850 may be a unitary wrap that may cover one or multiple surfaces 4810 of the closure plate 4800.

The micro-perforated closure plate 4850 may be a micro-perforated sheet, which may be positioned a distance Dp from a boundary wall, such as the exterior surface of a side wall 4810. In other systems, the micro-perforated closure plate 4850 may be a micro-perforated panel, which may include a micro-perforated sheet and a boundary wall positioned a distance Dp from the micro-perforated sheet. In any of the above examples, the micro-perforated closure plate wrap 4850 may additionally or alternatively include one or more walls or baffles positioned on an exterior surface of the micro-perforated closure plate wrap 4850. Many other variations are possible.

The parameters of the micro-perforated closure plate wrap 4850 (d, b, Tp, Dp) may be calculated to provide the micro-perforated closure plate wrap 4850 with the greatest absorption or attenuation capabilities or effect within the frequency ranges typically generated by a blower fan, engine, or engine component. One or more manufacturing techniques may implement (or be used to implement) micro-perforations having the parameters (d, b) into a base material of a designated thickness (Tp). A micro-perforated closure plate wrap 4850 having parameters (d, b, Tp) may be positioned, attached, and/or secured a distance from a boundary, which may be part of the micro-perforated closure plate 4850 where the micro-perforated closure plate 4850 is a micro-perforated panel, and which may be a separate boundary wall where the micro-perforated closure plate 4850 is a micro-perforated sheet. The positioning of the micro-perforated closure plate 4850 creates a cavity of depth Dp corresponding to an appropriate cavity depth Dp that provides the micro-perforated closure plate wrap 4850 with the greatest sound absorption or attenuation capability or effect within the frequency ranges generated by a blower fan, engine, or engine component. As an example, the micro-perforated closure plate wrap 4850 may have parameters (d, b, Tp) and/or be positioned with a cavity depth Dp (such as a distance from an exterior surface of the side wall 4810) that enables the micro-perforated closure plate wrap 4850 to absorb or attenuate sound within typical noise ranges generated or otherwise present in or near the closure plate, such as between 500-1800 Hz. In other systems, the parameters (d, b, Tp, Dp) of the micro-perforated closure plate wrap 4850 may be calculated, and/or micro-perforations with other parameters may be cut, manufactured, or otherwise implemented, providing the micro-perforated closure plate wrap 4850 with sound absorption or attenuation of various other frequency ranges.

Figure 49:
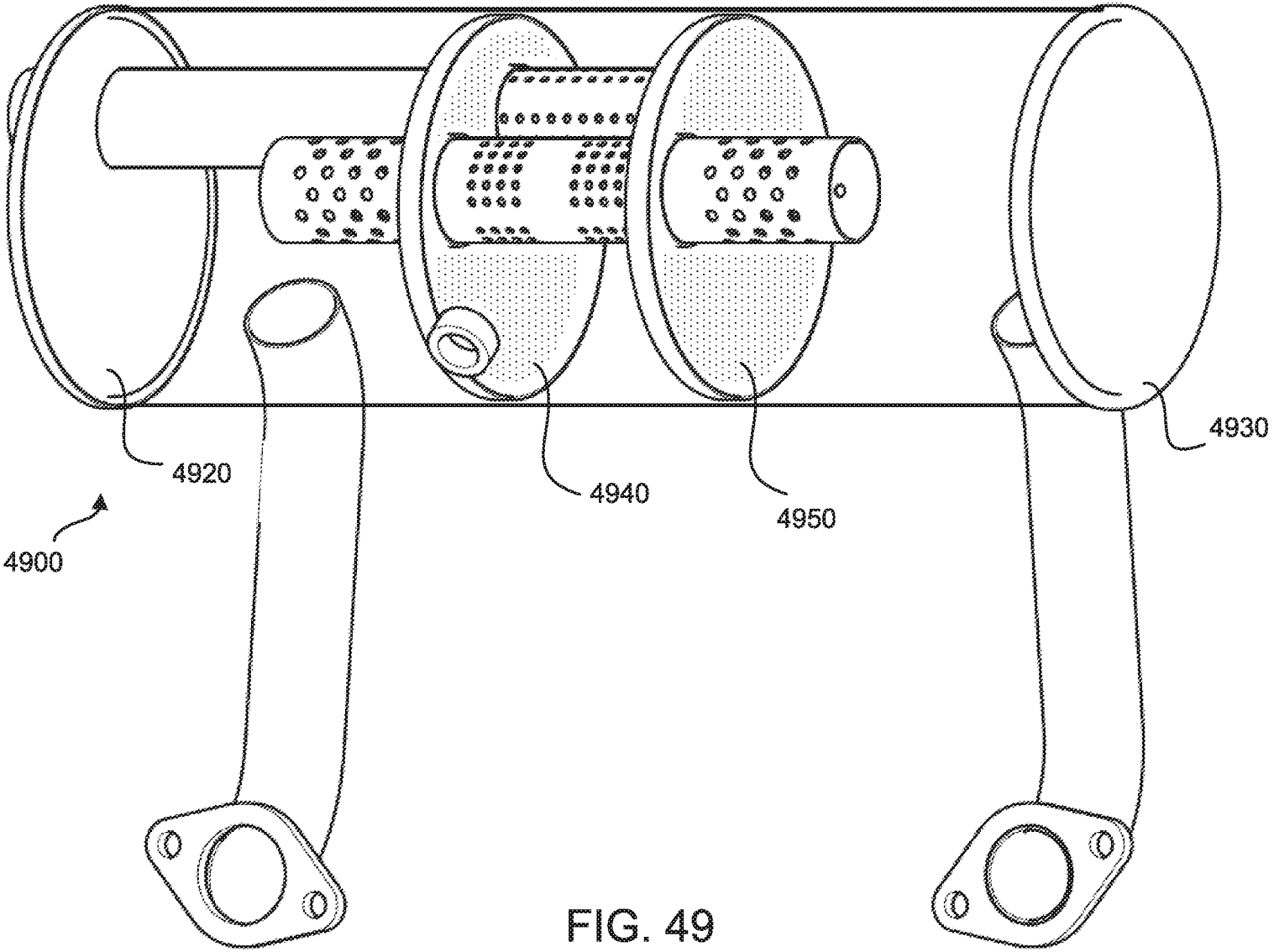
FIG. 49 shows a perspective view of an example muffler.

FIG. 49 shows an example muffler 4900. The muffler 4900 may include one or more micro-perforated end caps 4920 and 4930, and/or one or more micro-perforated baffles 4940 and 4950. One or more of the micro-perforated end caps 4920 and 4930 and micro-perforated baffles 4940 and 4950 may be a micro-perforated sheet, which may be positioned a distance Dp from a boundary wall, such as an end wall of the muffler 4900 or another micro-perforated component. In other systems, one or more of the micro-perforated end caps 4920 and 4930 and micro-perforated baffles 4940 and 4950 may be a micro-perforated panel, which may include a boundary wall positioned a distance Dp from the micro-perforated sheet. For example, a micro-perforated end cap 4920 may include a solid muffler end wall positioned a distance Dp from a micro-perforated end cap sheet. In some systems, the micro-perforated baffles 4940 and 4950 and/or the micro-perforated end caps 4920 and 4930 may replace other baffles or end caps on the muffler 4900. Other examples are possible.

The micro-perforated end caps 4920 and 4930 and micro-perforated baffles 4940 and 4950 may be shaped to correspond to a shape of a cross-section of the muffler. The micro-perforated end caps 4920 and 4930 may be positioned on an end or exterior portion of the muffler 4900. The micro-perforated baffles 4940 and 4950 may be positioned within the muffler 4900, such that the micro-perforated baffles 4940 and 4950 may divide the muffler 4900 into one or more chambers when placed within the muffler 4900. The micro-perforated end caps 4920 and 4930 and/or micro-perforated baffles 4940 and 4950 may, in some instances, be positioned at various distances apart within or bounding the muffler 4900 creating chambers with dimensions sized to correspond to, and attenuate, typical frequency ranges of noise produced by the engine. In some systems, the dimensions of the chambers may be set increase the sound attenuation of the micro-perforated end caps 4920 and 4930 or micro-perforated baffles 4940 and 4950. In other examples, the micro-perforated end caps 4920 and 4930 and micro-perforated baffles 4940 and 4950 may be in various other positions. In some instances, the muffler 4900 may additionally or alternatively include a micro-perforated cylindrical (or otherwise rounded) wrap that may extend along the length of the muffler 4900. Other variations are possible.

The parameters of the micro-perforated end caps 4920 and 4930 and/or micro-perforated baffles 4940 and 4950 (d, b, Tp, Dp) may be calculated to provide the micro-perforated components with the greatest absorption or attenuation capabilities or effect within the frequency ranges typically generated by or existing in the muffler 4900. One or more manufacturing techniques may implement (or be used to implement) micro-perforations having the parameters (d, b) into a base material of a designated thickness (Tp). A micro-perforated end cap or baffle having parameters (d, b, Tp) may be positioned, attached, and/or secured a distance from a boundary, which may be part of the micro-perforated end cap or baffle where the micro-perforated end cap or baffle is a micro-perforated panel, and which may be a separate boundary wall (such as an adjacent micro-perforated end cap or baffle or a muffler end wall) where the micro-perforated end cap or baffle is a micro-perforated sheet. The positioning of the micro-perforated end cap or baffle may create a cavity of depth Dp corresponding to an appropriate cavity depth Dp that provides the micro-perforated end cap or baffle with the greatest sound absorption or attenuation capability or effect within the frequency ranges generated by or existing in the muffler 4900. As an example, the muffler 4900 may include a micro-perforated end cap or baffle with parameters (d, b, Tp) and/or positioned with a cavity depth Dp (such as a depth between micro-perforated components) that enables the micro-perforated component to absorb or attenuate sound within typical noise ranges generated or otherwise present in or near the muffler, such as between 200 and 800 Hz for tonal noise and between 800 and 4000 Hz for flow noise. In other systems, the parameters (d, b, Tp, Dp) of the micro-perforated end cap or baffle may be calculated, and/or micro-perforations with other parameters may be cut, manufactured, or otherwise implemented, providing the micro-perforated component with sound absorption or attenuation of various other frequency ranges.

Figure 50:
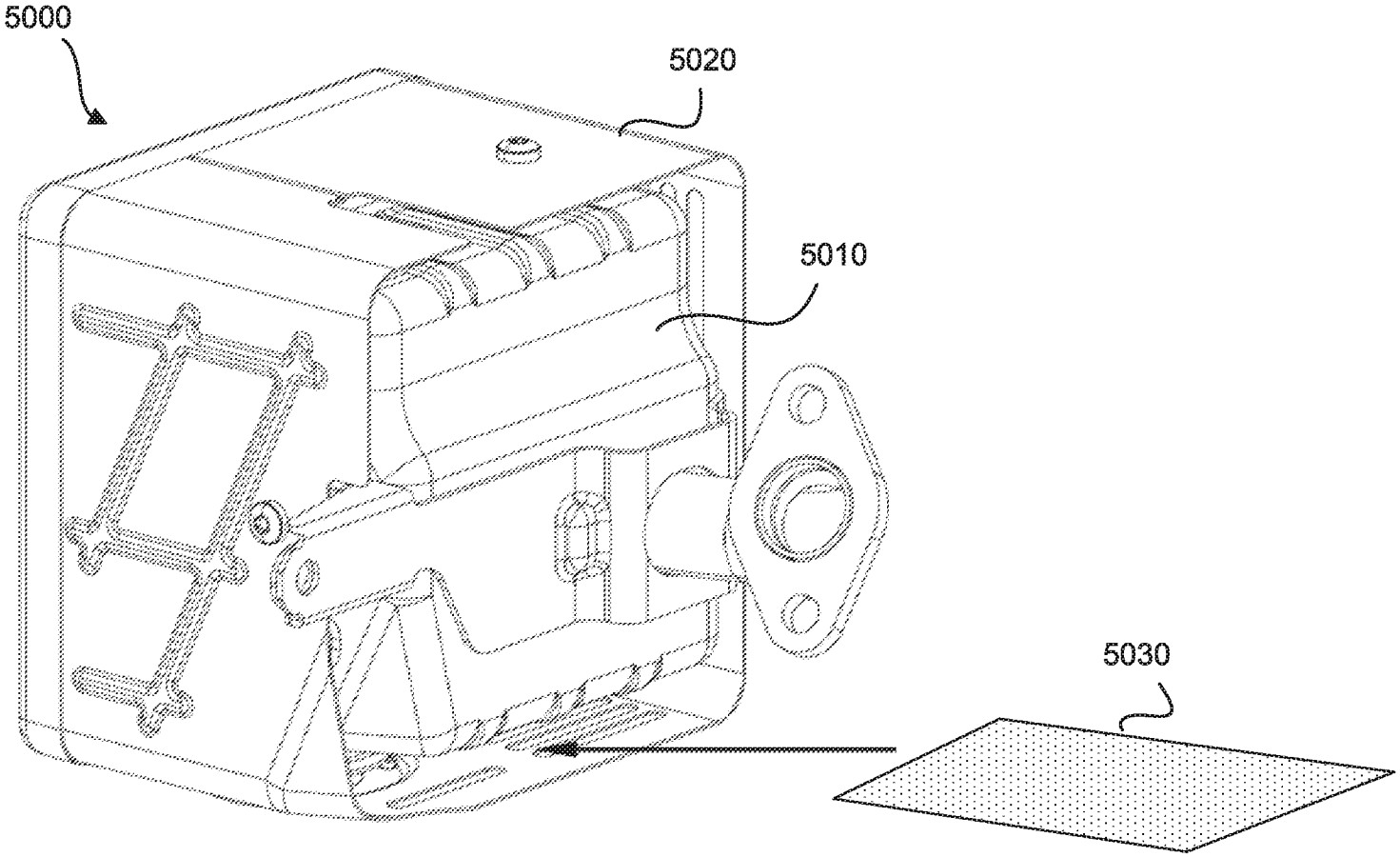
FIG. 50 shows a perspective view of an example muffler assembly.

FIG. 50 shows an example of a muffler assembly 5000 that includes a muffler 5010 and a heat guard 5020. The heat guard 5020 may be spaced apart from the muffler 5010 and may protect other engine components and users from interacting with the muffler 5010 when hot. The heat guard 5020 itself may be a micro-perforated heat guard, positioned around part or the entire muffler. In other systems, a separate micro-perforated muffler wrap 5030 may be positioned around part or all of the muffler 5010, and between the muffler 5010 and the heat guard 5020. The micro-perforated muffler wrap 5030 may be or include one or more flat or rounded micro-perforated sheets, which may individually or jointly be positioned around part or all of the muffler 5010. In either case, the micro-perforated heat guard 5020 or micro-perforated muffler wrap 5030 may be shaped to surround and/or correspond to a shape of part or all of the muffler 5010. The micro-perforated heat guard 5020 and/or the micro-perforated muffler wrap 5030 may additionally or alternatively include one or more larger air holes or vents to allow sufficient amounts of cooling air to pass by the muffler 5010 for temperature regulation or other purposes.

One or more of the micro-perforated heat guard 5020 or the micro-perforated muffler wrap 5030 may be a micro-perforated sheet, which may be positioned a distance Dp from a boundary or boundary wall. For example, the micro-perforated muffler wrap 5030 may be a micro-perforated sheet positioned a distance Dp from a non-micro-perforated heat guard 5020. In this example, the combination micro-perforated muffler wrap 5030 and the heat guard 5020 may constitute a micro-perforated panel. In other systems, one or more of the micro-perforated heat guard 5020 or the micro-perforated muffler wrap 5030 may be a micro-perforated panel, which may itself include a micro-perforated sheet and a boundary wall positioned a distance Dp from the micro-perforated sheet. Other examples are possible.

The parameters of the micro-perforated heat guard 5020 and/or the micro-perforated muffler wrap 5030 (d, b, Tp, Dp) may be calculated to provide the micro-perforated components with the greatest absorption or attenuation capabilities or effect within the frequency ranges typically generated by or existing in the muffler 5010. One or more manufacturing techniques may implement (or be used to implement) micro-perforations having the parameters (d, b) into a base material of a designated thickness (Tp). A micro-perforated heat guard or muffler wrap having parameters (d, b, Tp) may be positioned, attached, and/or secured a distance from a boundary wall, creating a cavity of depth Dp corresponding to an appropriate cavity depth Dp that provides the micro-perforated heat guard 5020 or muffler wrap 5030 with the greatest sound absorption or attenuation capability or effect within the frequency ranges generated by or existing in the muffler 5010. As an example, the muffler 5010 may include a micro-perforated muffler wrap 5030 with parameters (d, b, Tp) and/or positioned with a cavity depth Dp (such as a depth from the heat guard 5020) that enables the micro-perforated muffler wrap 5030 to absorb or attenuate sound within typical noise ranges generated or otherwise present in or near the muffler 5010, such as shell "ringing" noise between 800 and 3000 Hz, tonal noise between 200 and 800 Hz, and flow noise between 800 and 4000 Hz. In other systems, the parameters (d, b, Tp, Dp) of the micro-perforated heat guard or muffler wrap may be calculated, and/or micro-perforations with other parameters may be cut, manufactured, or otherwise implemented, providing the micro-perforated component with sound absorption or attenuation of various other frequency ranges. Other variations are possible.

Figure 51:
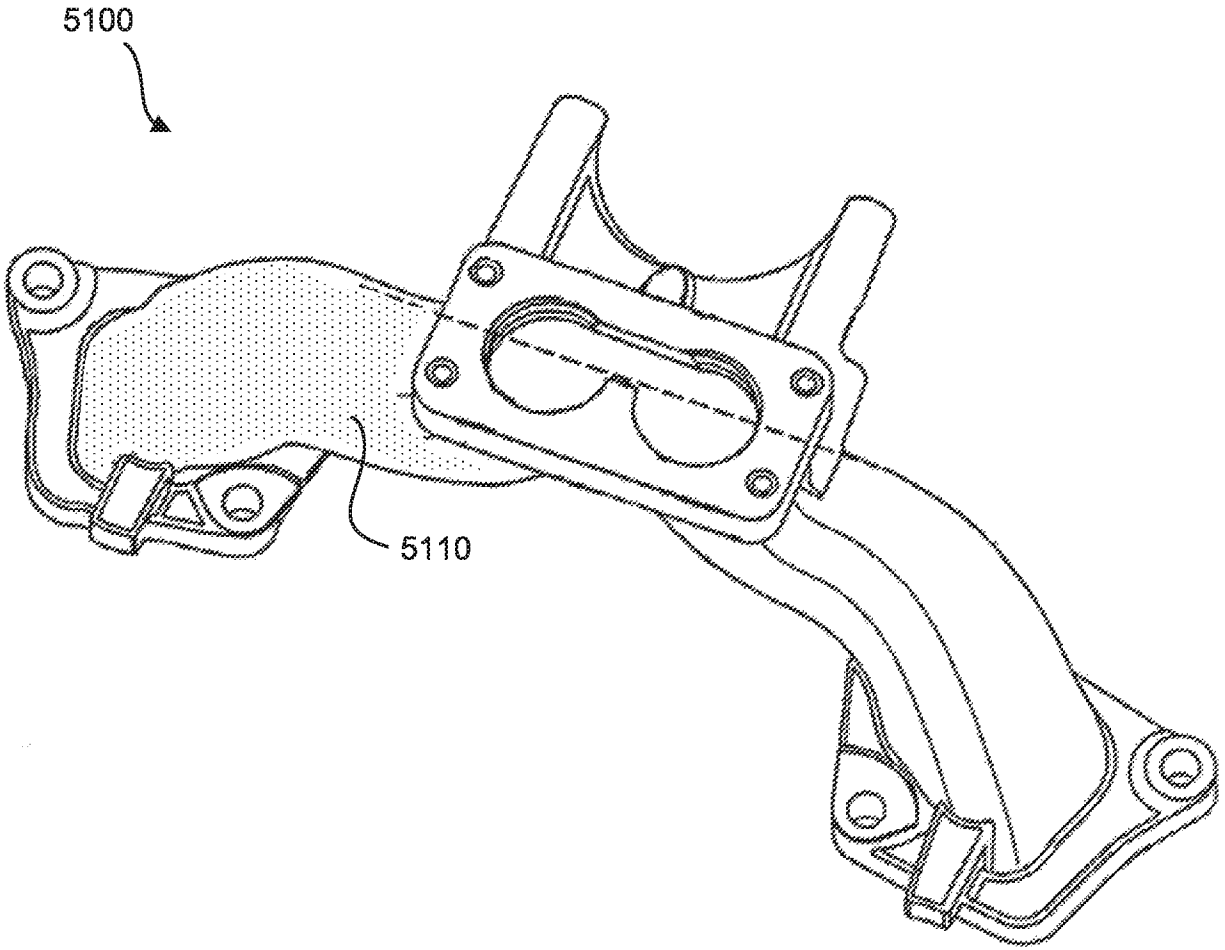
FIG. 51 shows a perspective view of an example intake manifold.

FIG. 51 shows an example of an intake manifold 5100 for an engine. The intake manifold 5100 may include one or more micro-perforated manifold wraps 5110.

The micro-perforated manifold wraps 5110 may be positioned adjacent to, around, or surrounding the intake manifold 5100 of the engine. For example, the micro-perforated manifold wraps 5110 may be positioned adjacent to or outside an external surface of the intake manifold 5100, or may be positioned adjacent to or inside an interior surface of the intake manifold 5100. The micro-perforated manifold wraps 5110 may be shaped to correspond to a shape of the intake manifold 5100, and in some examples may be wrapped around the intake manifold 5100. The micro-perforated manifold wrap 5110 may be a micro-perforated sheet, which may be positioned a distance Dp from a boundary wall, such as an the exterior surface of the intake manifold 5100. In other systems, the micro-perforated manifold wrap 5110 may be a micro-perforated panel, which may include a micro-perforated sheet and a boundary wall positioned a distance Dp from the micro-perforated sheet. Other examples are possible.

The parameters of the micro-perforated manifold wraps 5110 may be set or controlled during manufacturing, or adjusted, to absorb or otherwise attenuate sound within the frequency ranges typically generated by the intake manifold or engine, or various other frequency ranges. In alternative examples, a micro-perforated wrap may be positioned with, as part of, around, and/or a distance from an intake plenum. In still other examples, micro-perforated wraps may be positioned adjacent to, around, or surrounding an exhaust manifold of an engine. Other variations are possible.

Various other components of an engine may use or incorporate micro-perforated components or parts. Any of the micro-perforated walls within the engine may be or include multiple micro-perforated sheets or micro-perforated panels. For example, two micro-perforated sheets may be placed together, or separated by a distance that correspond to a Dp. Each of the multiple micro-perforated sheets or micro-perforated panels may have parameters which are identical, to improve the absorption over a certain frequency range. For example, where a fan generates a significant level of noise over a small frequency range, the addition of an identical sheet of micro-perforated metal a determined distance from a first sheet of micro-perforated metal may provide additional absorption to reduce the noise of the fan over the small frequency range. Alternatively or additionally, one or more of the multiple micro-perforated sheets or micro-perforated panels may have parameters which are different to absorb noise at different frequency ranges. For example, where an engine generates noise over a wide frequency range, or in two (or more) frequency ranges, a micro-perforated wall may include two (or more) sheets of micro-perforated metal, with each sheet configured to absorb noise over a different portion of the wide frequency range, or over different frequency ranges. Other variations are possible.

Figure 52:
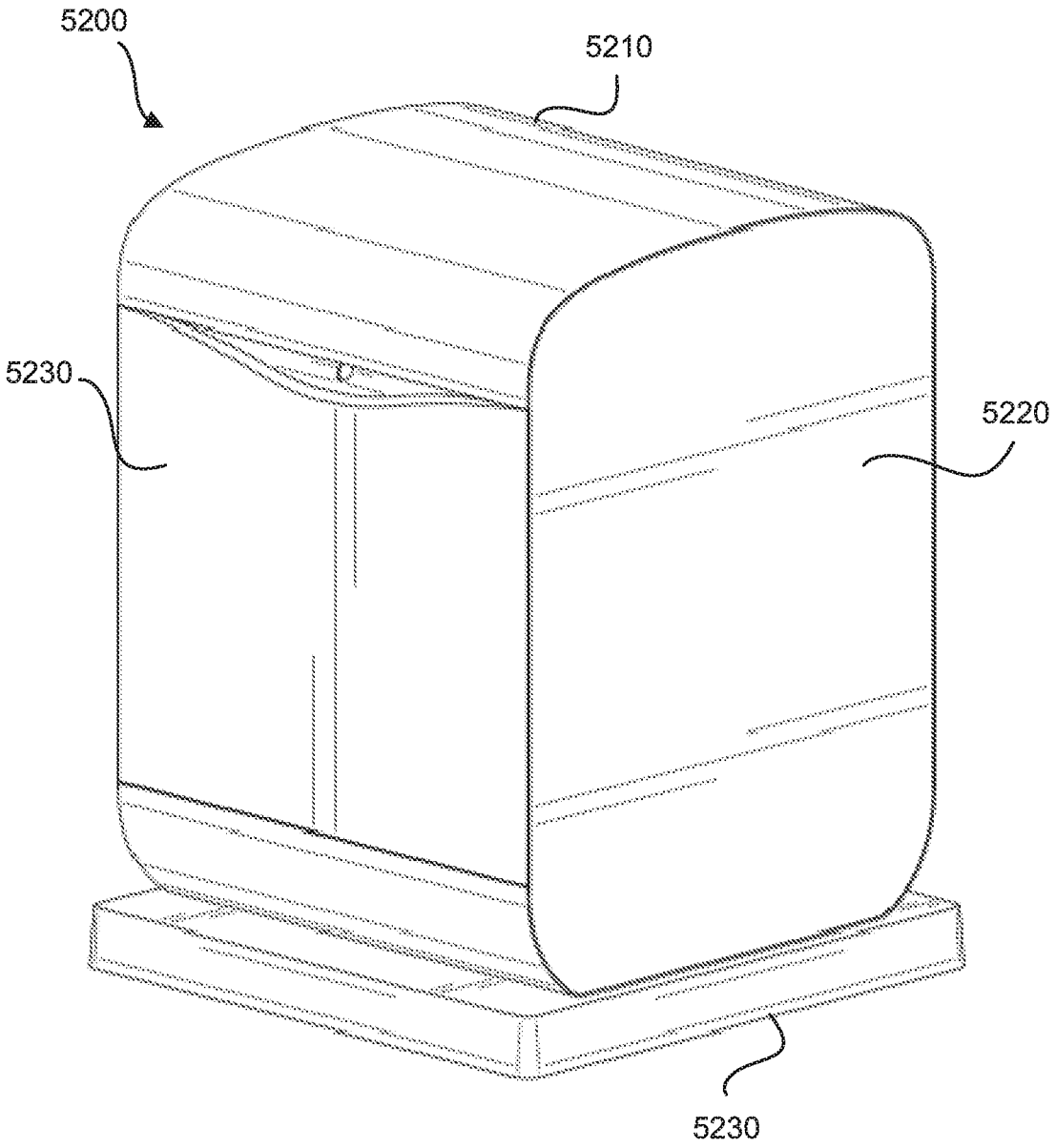
FIG. 52 shows a perspective view of an example generator enclosure.
Figure 53A:
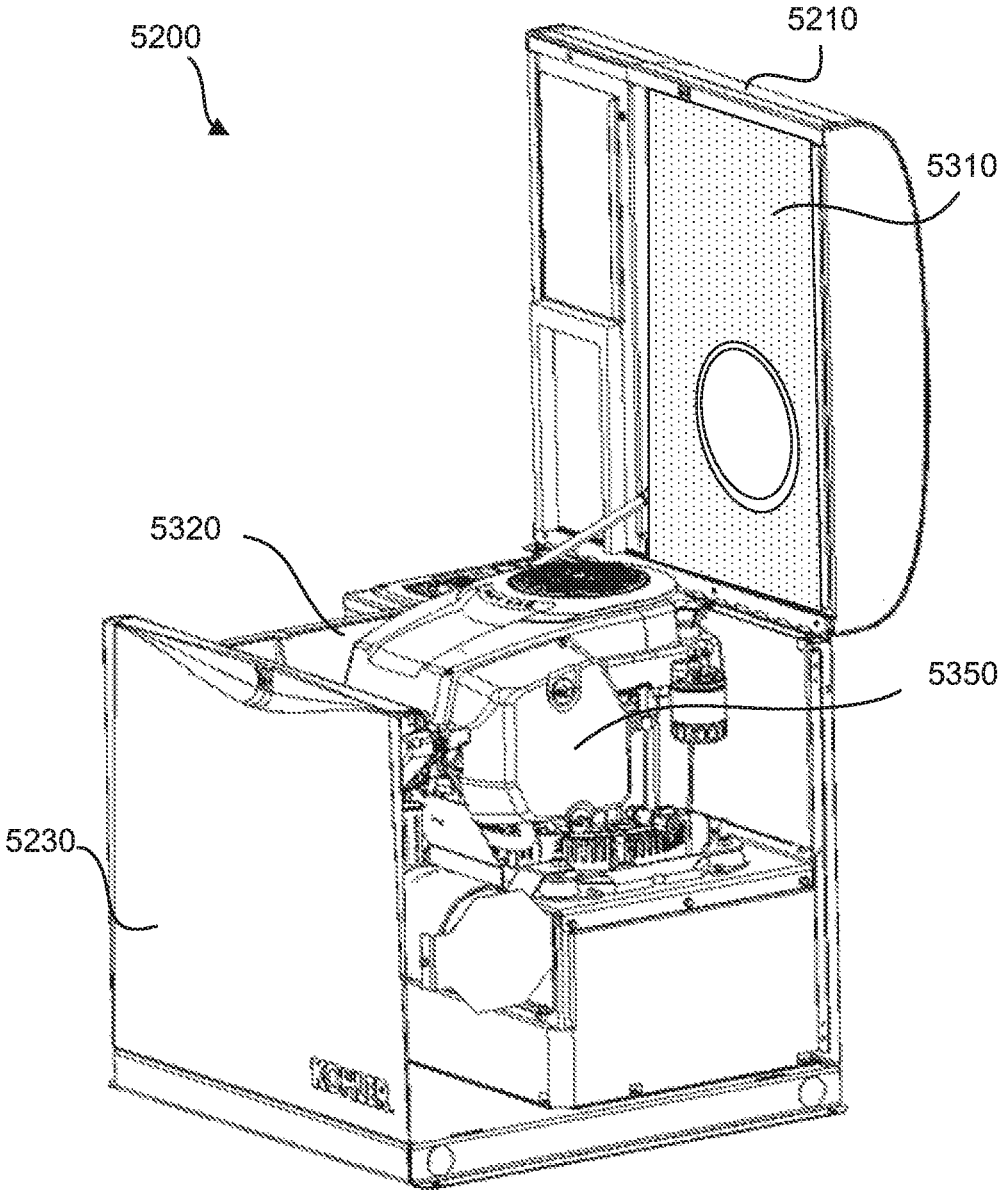
FIGS. 53*a-b* show perspective views of a generator set and portion of a generator set enclosure.
Figure 53B:
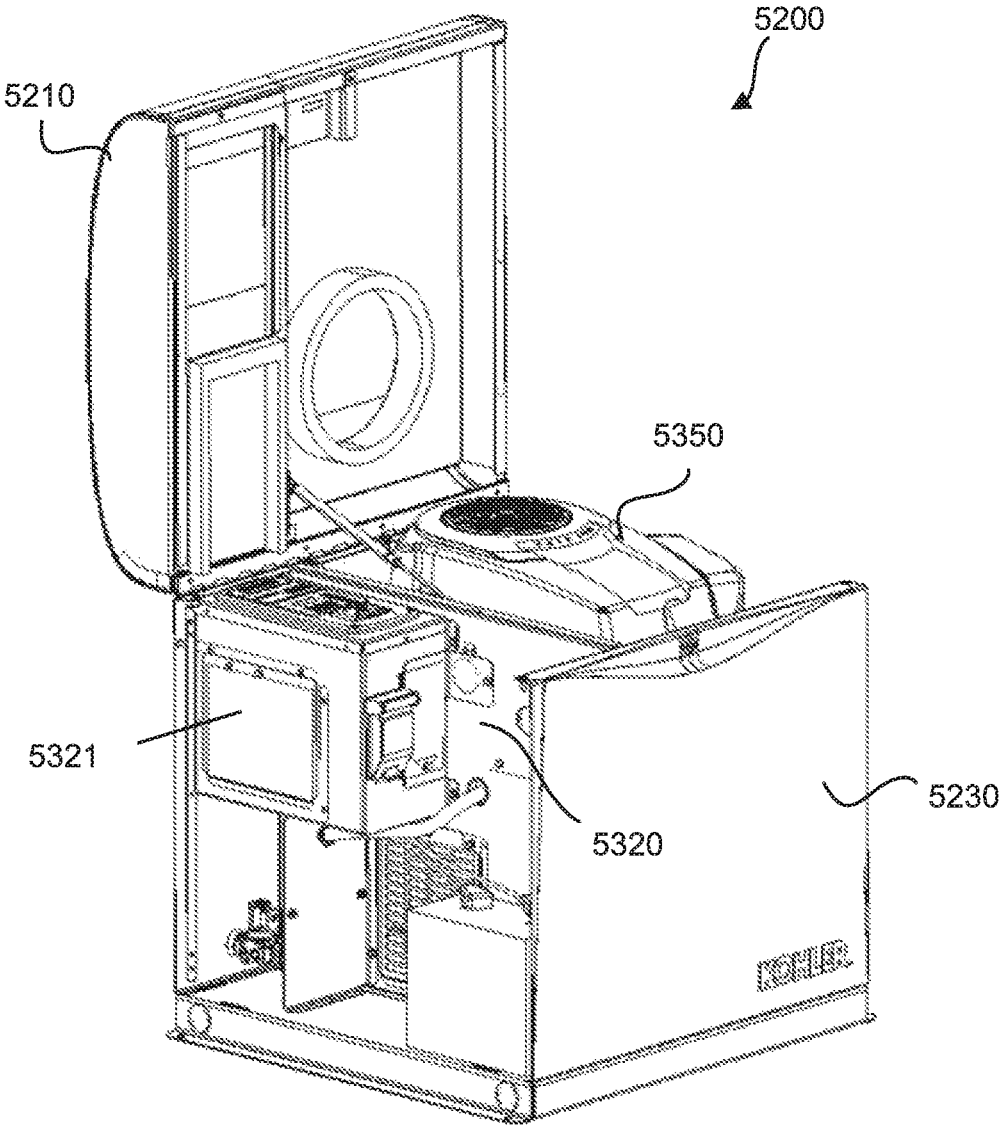

FIG. 52 shows an example of a generator set enclosure 5200 that may house or enclose a generator set. FIGS. 53*a* and 53*b* shows additional views of the example generator set enclosure 5200 that may house a generator set, with a cover 5210 of the enclosure 5200 opened.

The generator set may include one or more of an engine 5350, an alternator, an inverter, an air intake, a muffler, a fan, and various other components. The engine 5350 may be an internal combustion engine that may produce mechanical energy, and the alternator may convert the mechanical energy to electrical energy, which may be provided for various uses. The generator set enclosure 5200 may be used to enclose a residential, industrial, or marine generator set. In other alternatives, the enclosure 5200 may merely enclose the engine, alternator, inverter, or other component. Other variations are possible.

The generator set enclosure may include one or more micro-perforated exterior barriers 5220 and 5230. Micro-perforated exterior barriers 5220 and 5230 may refer to micro-perforated sheets or micro-perforated panels that are positioned generally outside of or around the enclosed generator set (as opposed to interior barriers which may be positioned between components or a top cover of the generator set). As such, micro-perforated exterior barriers 5220 and 5230 may be and refer to (1) a micro-perforated sheet which may be positioned adjacent to and/or inside of an outermost wall of the enclosure 5200 in some systems, such as where the micro-perforated exterior barriers 5220 is positioned a distance Dp inside the outermost enclosure wall 5200, to provide sound attenuation; and (2) a micro-perforated panel that includes a combination of a micro-perforated sheet and an outermost wall of the enclosure 5200.

The micro-perforated exterior barriers 5220 and 5230 may surround or enclose part of all of the generator set, and/or may make up part or all of an enclosure. The micro-perforated exterior barriers 5220 and 5230 may be flat, rounded, rippled, vented, or include one or more vents. The micro-perforated exterior barriers 5220 and 5230 may be generally square or rectangular, circular, or any other shape.

The micro-perforated exterior barriers 5220 and 5230 may be or include a micro-perforated sheet with micro-perforates having parameters which are tuned to reduce certain noise frequencies generated by generator components. For example, a fixed or continuous speed generator set may include an engine that usually operates at a constant speed (such as 1500 RPM, 1800 RPM, 3000 RPM, or 3600 RPM), and therefore generate noise at predictable levels and within predictable ranges. The parameters of the micro-perforates in the micro-perforated exterior barriers 5220 and 5230 may thus be calculated and/or implemented through manufacturing or adjustment to absorb or otherwise attenuate the predictable noise from the constant speed engine.

The generator set enclosure 5200 may alternatively enclose a variable speed generator. The parameters of the micro-perforates in the micro-perforated exterior barriers 5220 and 5230 in these examples may be calculated and/or implemented through manufacturing or adjustment to absorb or otherwise attenuate common frequencies encountered during use of the variable speed generator (such as frequencies of sound generated when the generator set runs at ¼, ½, or full load, for example). In other examples, the micro-perforated exterior barriers 5220 and 5230 may be configured to reduce noise produced by other components of the generator set, such as the fans, alternator, or muffler, or noise or sound at any other frequency. Various other examples are possible.

The enclosure 5200 may have two or more different micro-perforated exterior barriers 5220 and 5230. For example, in some systems, the generator set may have components that may generate sound within different frequency ranges, such as an engine that may generate a significant amount of sound within a first frequency band and a fan that may generate a significant amount of sound within a second frequency band. In such systems, the enclosure 5200 may have a first micro-perforated exterior barrier positioned adjacent to an engine and manufactured with micro-perforate parameters tuned so that the micro-perforated exterior barrier absorbs noise in the frequencies typically generated by the engine. In this example, the enclosure 5200 may have a second micro-perforated exterior barrier positioned adjacent to an air intake or fan, with the second micro-perforated exterior barrier being manufactured with micro-perforate parameters tuned so that the micro-perforated exterior barrier absorbs noise in the frequencies typically generated at or by the air intake or fan. As another example, the enclosure 5200 may have one micro-perforated exterior barrier with a first portion having micro-perforate parameters tuned to absorb noise in the frequencies typically generated by the engine and a second portion having parameters tuned to absorb noise in the frequencies typically generated by the fan (such as the micro-perforated sheet 8200 in FIG. 82). Many other variations are possible.

In some systems, an enclosure may include both micro-perforated exterior barriers and non-micro-perforated exterior walls. As an example, a first end wall of the enclosure may be or include a micro-perforated exterior barrier, while a wall opposite the first end wall may not be a micro-perforated exterior barrier. Other variations are possible.

The generator set may additionally or alternatively include one or more micro-perforated interior barriers 5310 and 5320. Micro-perforated interior barriers 5310 and 5320 may refer to micro-perforated sheets or micro-perforated panels that are positioned generally between components or a top cover of the generator set (as opposed to exterior barriers with are positioned around or enclosing the generator set). As such, micro-perforated interior barriers 5310 and 5320 may be and refer to (1) a micro-perforated sheet which may be positioned adjacent to interior structural walls of the enclosure 5200, such as where the micro-perforated interior barrier 5310 is positioned a distance Dp from the structure wall to provide sound attenuation; and (2) a micro-perforated panel that includes a combination of a micro-perforated sheet and a separate boundary wall of the enclosure 5200, to replace a stand-alone boundary wall. The micro-perforated interior barriers 5310 and 5320 may be flat, rounded, rippled, vented, or include one or more vents. The micro-perforated interior barriers 5310 and 5320 may be generally square or rectangular, circular, or any other shape. The micro-perforated interior barriers 5310 and 5320 may be partially or completely within the enclosure or a frame of the generator set.

The micro-perforated interior barriers 5310 and 5320 may divide part or all of the enclosure, and may additionally or alternatively separate some or all of the components of the generator set. For example, a generator set enclosure 5200 may have micro-perforated interior barrier 5310 which may separate an intake or exhaust compartment from an engine 5350 or alternator (or engine or alternator compartment). As another example, a generator set may have micro-perforated interior barrier 5310 which may separate an engine 5350 or alternator (or engine or alternator compartment) from a top or cover 5210 compartment. As another example, a generator set enclosure 5200 may have micro-perforated interior barriers 5310 and 5320 which may separate a control unit (or control unit compartment) from other compartments in the generator set. As another example, the generator set enclosure 5200 may include one or more micro-perforated interior barriers 5310 and 5320 that may divide (or connect) an engine or engine compartment from (or with) an alternator or alternator compartment. As yet another example, microperforated interior barrier 5320 may separate the engine 5350 from other equipment 5321 inside the enclosure as shown in FIG. 53*b*.

The micro-perforated interior barriers 5310 and 5320 may have micro-perforates with parameters calculated and/or implemented to reduce certain noise frequencies generated by generator components. For example, the parameters of a micro-perforates in the micro-perforated interior barriers 5310 and 5320 adjacent to an engine may be calculated and/or implemented to tune the micro-perforated interior barrier for absorbing predictable noise of the engine. As another example, the parameters of a micro-perforated interior barriers 5310 and 5320 adjacent a fan and separating a top or cover compartment from other generator components may be set or adjusted to tune the micro-perforated interior barrier for absorbing the predictable noise of the fan. Many other variations are possible.

An enclosure 5200 may have two or more different micro-perforated interior barriers 5310 and 5320. For example, the enclosure 5200 may have a first micro-perforated interior barrier 5310 positioned adjacent to an engine and manufactured with parameters tuned so that the micro-perforated interior barrier 5310 absorbs noise in the frequencies typically generated by the engine, as well as a second micro-perforated interior barrier 5320 positioned adjacent to an air intake or fan, with the second micro-perforated interior barrier 5320 being manufactured with parameters tuned so that the micro-perforated interior barrier 5320 absorbs noise in the frequencies typically generated at or by the air intake or fan. In some systems, the generator set enclosure 5200 may include both micro-perforated interior barriers and non-micro-perforated interior barriers. Many other variations are possible.

In some systems, one or more of the micro-perforated barriers (interior or exterior) 5220, 5230, 5310, 5320 may have micro-perforates with parameters which are not consistent, and/or change, throughout the surface of the barrier. For example, a micro-perforated barrier that may be positioned adjacent to an engine as well as a fan may be have a first portion of the surface configured to absorb sound in a frequency range corresponding to engine noise, and a second portion of the surface configured to absorb sound in a different frequency range corresponding to fan noise. Other variations are possible.

In some systems, the generator set enclosure 5200 may include both micro-perforated interior barriers 5310 and 5320 and micro-perforated exterior barriers 5220 and 5230. The micro-perforated interior barriers 5310 and 5320 may absorb sound in the same, similar, or different frequency ranges as the micro-perforated exterior barriers 5220 and 5230. Other variations are possible.

Any of the micro-perforated barriers 5220, 5230, 5310, 5320 of the generator set enclosure 5200 may be or include multiple micro-perforated sheets or micro-perforated panels. For example, a micro-perforated exterior barrier 5220 or 5230 of the generator set may include two separate sheets of micro-perforated material. The two sheets may be placed together, or separated by a distance. The two sheets may have parameters which are identical to improve the absorption over a certain frequency range. For example, where a fan generates a significant level of noise over a small frequency range, the addition of an identical sheet of micro-perforated metal may provide additional absorption to reduce the noise of the fan over the small frequency range. Alternatively or additionally, the two sheets may have parameters which are different to absorb noise at different frequency ranges. For example, where an engine generates noise over a wide frequency range, or in two (or more) frequency ranges, a micro-perforated wall may include two (or more) sheets of micro-perforated metal, with each sheet configured to absorb noise over a different portion of the wide frequency range, or over different frequency ranges.

The parameters of the any of the micro-perforated barriers (d, b, Tp, Dp) may be calculated to provide the micro-perforated barriers with the greatest absorption or attenuation capabilities or effect within the frequency ranges typically generated by the generator set or components of the generator set. One or more manufacturing techniques may implement (or be used to implement) micro-perforations having the parameters (d, b) into a base material of a designated thickness (Tp). A micro-perforated sheet having parameters (d, b, Tp) may be positioned, attached, and/or secured a distance from a boundary, which may be part of the micro-perforated barrier where the micro-perforated barrier is a micro-perforated panel, and which may be a separate boundary wall (such as an engine wall, a support wall, or otherwise) where the micro-perforated barrier is a micro-perforated sheet. The positioning of the micro-perforated barrier may create a cavity of depth Dp corresponding to an appropriate cavity depth Dp that provides the micro-perforated barrier with the greatest sound absorption or attenuation capability or effect. In other systems, the parameters (d, b, Tp, Dp) of the micro-perforated barriers may be calculated, and/or micro-perforations with other parameters may be cut, manufactured, or otherwise implemented, providing the micro-perforated component with sound absorption or attenuation of various other frequency ranges. Other variations are possible.

As another example, an alternator junction box may include one or more micro-perforated sheets or panels. The micro-perforated sheets or panels may be positioned within or outside of the junction box at various positions. The micro-perforated sheets or panels of the junction box may be rectangular, box-shaped, cylindrical, or may be various other shapes. The parameters of the any of the micro-perforated sheets or panels (d, b, Tp, Dp) may be calculated to provide the micro-perforated sheets or panels with the greatest absorption or attenuation capabilities or effect within the frequency ranges typically generated by the engine, alternator, fans, or other generator components. One or more manufacturing techniques may implement (or be used to implement) micro-perforations having the parameters (d, b) into a base material of a designated thickness (Tp). A micro-perforated sheet or having parameters (d, b, Tp) may be positioned, attached, and/or secured a distance from a boundary (such as a distance from an interior or exterior wall of the junction box), creating a cavity of depth Dp corresponding to an appropriate cavity depth Dp that provides the micro-perforated sheet or panel with the greatest sound absorption or attenuation capability or effect within the frequency ranges typically generated by the engine, alternator, fans, or other generator components. In other systems, the parameters (d, b, Tp, Dp) of the micro-perforated sheets or panels may be calculated, and/or micro-perforations with other parameters may be cut, manufactured, or otherwise implemented, providing the micro-perforated component with sound absorption or attenuation of various other frequency ranges. Other variations are possible.

Figure 54:
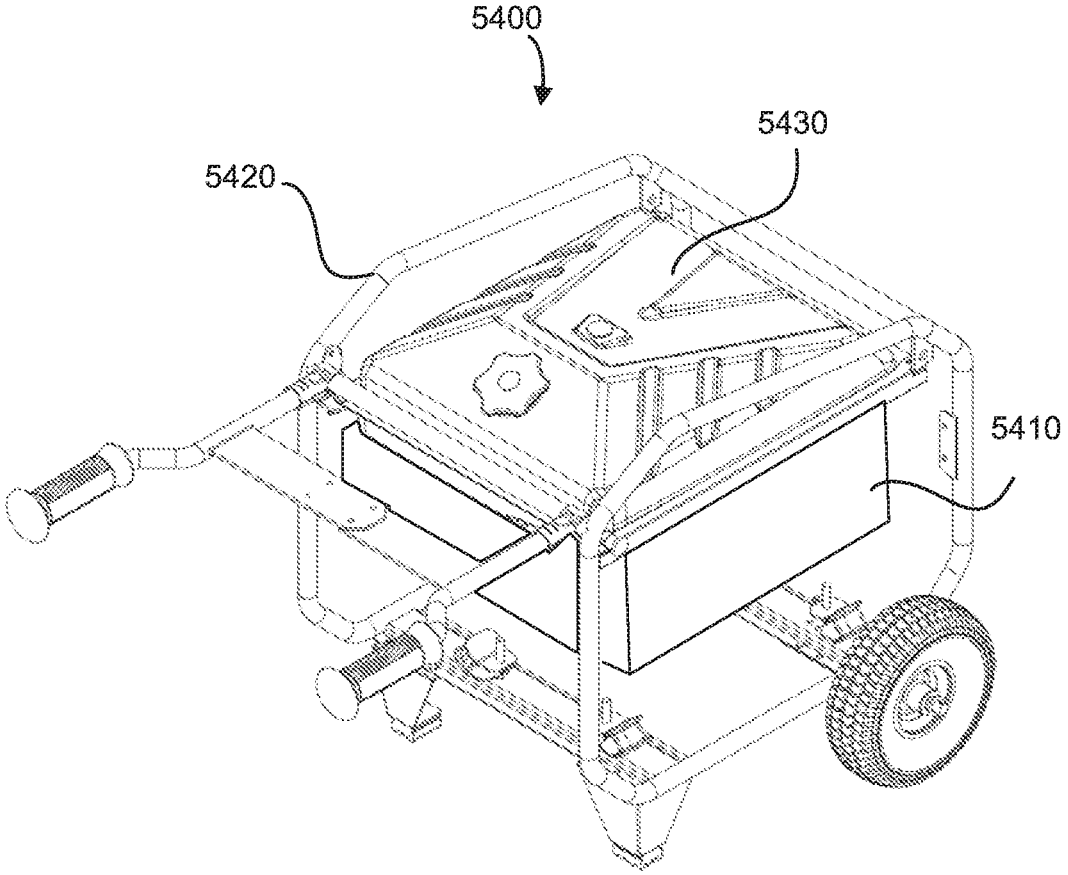
FIG. 54 shows a perspective view of a portable generator.
Figure 55:
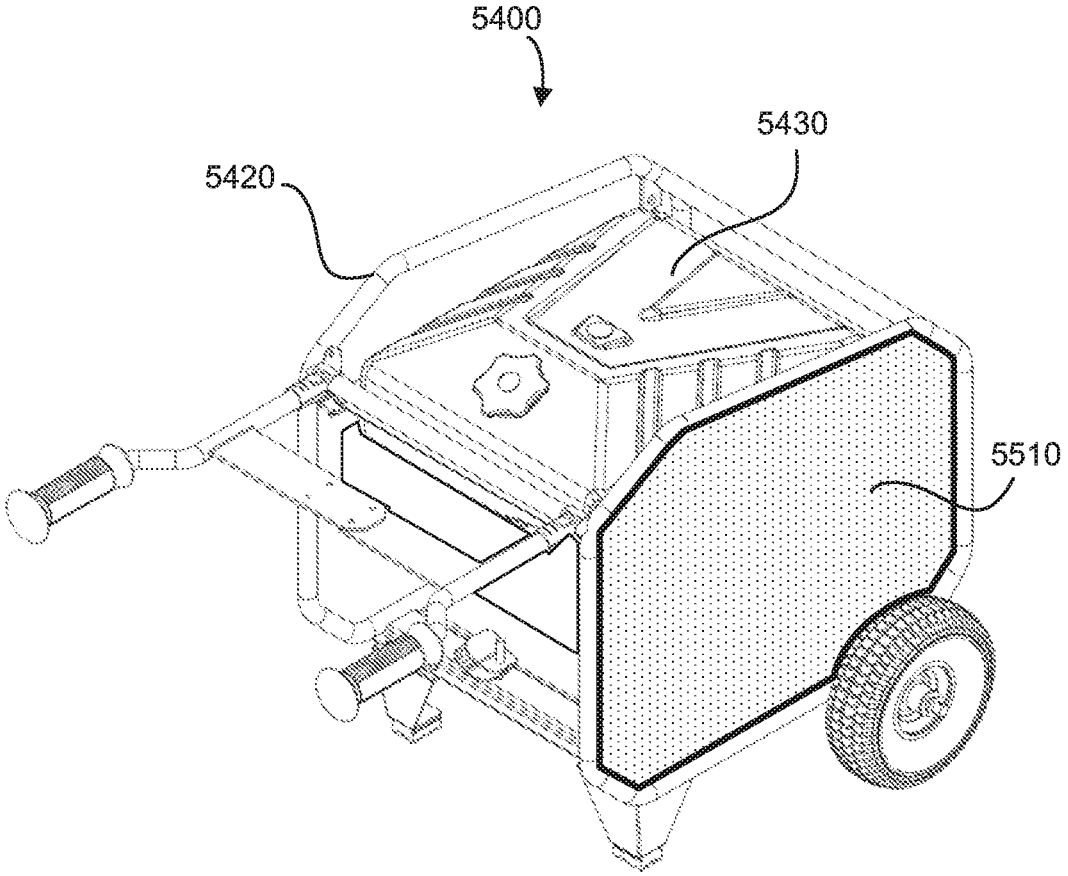
FIG. 55 shows a perspective view of a portable generator with a micro-perforated side panel.

FIGS. 54 and 55 shows an example of a portable generator set 5400. The portable generator set 5400 may include a portable generator 5410 and a frame 5420 that may surround and/or attach to the portable generator 5410. In some example systems, the portable generator 5410 may additionally be connected with a fuel tank 5430 which may provide fuel to run the portable generator 5410.

The portable generator set 5400 may include one or more micro-perforated enclosure plates 5510. For example, one or more micro-perforated enclosure plates 5510 may be attached to, or placed within, the frame 5420 of the portable generator set 5400. In some examples, the frame 5420 of the portable generator set 5400 and/or the micro-perforated enclosure plates 5510 may be configured to easily be connected (such as by snapping together) or disconnected as desired by the end user.

Some example portable generator sets 5400 may additionally or alternatively include a micro-perforated interior barrier positioned between one or more components of the portable generator 5410. For example, in some portable generator sets 5400, a micro-perforated interior barrier may be positioned between a fuel tank 5430 and an engine. In some example portable generator sets 5400, a micro-perforated fuel tank wrap may be manufactured integrally with, or positioned around, part or all of a fuel tank 5430 of the portable generator 5410. Additionally or alternatively, in some example portable generator sets 5400, the frame 5420 of the portable generator may be composed of micro-perforated metals or another micro-perforated panel. Many other variations are possible.

One or more of the micro-perforated enclosure plates 5510 or other micro-perforated components may be a micro-perforated sheet, which may be positioned a distance Dp from a boundary wall, such as a surface of the engine or fuel tank. In other systems, one or more of the micro-perforated enclosure plates 5510 or other micro-perforated components may be a micro-perforated panel, which may include a micro-perforated sheet and a boundary wall positioned a distance Dp from the micro-perforated sheet. Other examples are possible.

The parameters of the any of the micro-perforated components (d, b, Tp, Dp) in the portable generator set 5400 may be calculated to provide the micro-perforated components with the greatest absorption or attenuation capabilities or effect within the frequency ranges typically generated by the engine, alternator, fans, or other portable generator components. One or more manufacturing techniques may implement (or be used to implement) micro-perforations having the parameters (d, b) into a base material of a designated thickness (Tp). A micro-perforated sheet having parameters (d, b, Tp) may be positioned, attached, and/or secured a distance from a boundary, which may be part of the micro-perforated components where the micro-perforated component is a micro-perforated panel, and which may be a separate boundary wall (such as a fuel tank or generator) where the micro-perforated component is a micro-perforated sheet. The positioning of the micro-perforated component may create a cavity of depth Dp corresponding to an appropriate cavity depth Dp that provides the micro-perforated component with the greatest sound absorption or attenuation capability or effect within the frequency ranges typically generated by the engine, alternator, fans, or other generator components. In other systems, the parameters (d, b, Tp, Dp) of the micro-perforated components may be calculated, and/or micro-perforations with other parameters may be cut, manufactured, or otherwise implemented, providing the micro-perforated component with sound absorption or attenuation of various other frequency ranges.

Figure 56:
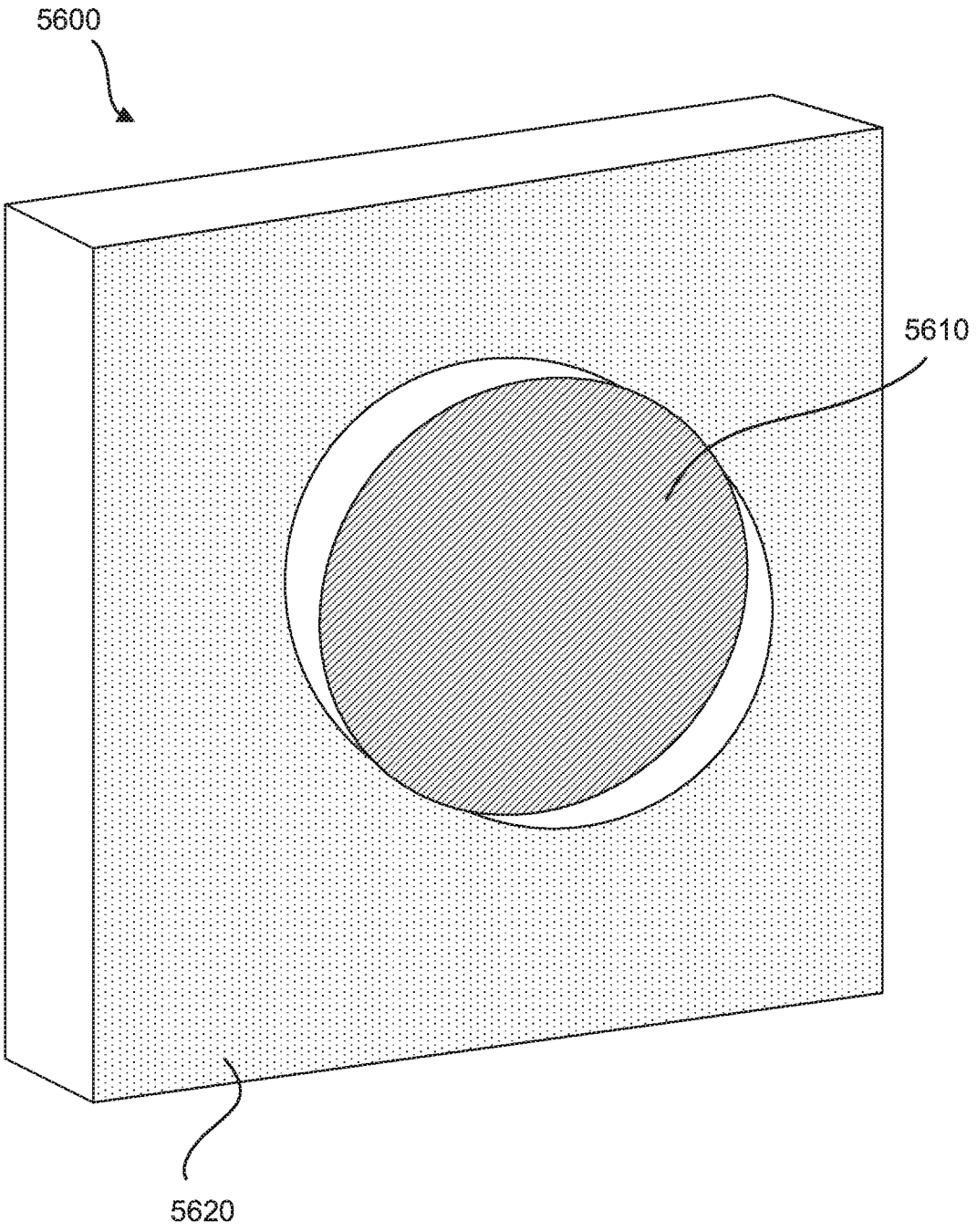
FIG. 56 shows a front perspective view of a radiator shroud.

FIG. 56 shows an example of a radiator system 5600 with a radiator 5610 and a micro-perforated radiator shroud 5620. The micro-perforated radiator shroud 5620 may be positioned around part or all of a radiator 5610. The micro-perforated radiator shroud 5620 may be rectangular, box-shaped, cylindrical, or may be various other shapes, and/or may correspond to a shape of the radiator 5610. The micro-perforated radiator shroud 5620 may be a micro-perforated sheet, which may be positioned a distance Dp from a boundary wall, such as the radiator 5610. In other systems, the micro-perforated radiator shroud 5620 may be a micro-perforated panel, which may include a micro-perforated sheet and a boundary wall positioned a distance Dp from the micro-perforated sheet.

The parameters of the micro-perforated radiator shroud 5620 (d, b, Tp, Dp) may be calculated to provide the micro-perforated radiator shroud 5620 with the greatest absorption or attenuation capabilities or effect within the frequency ranges typically generated by the radiator or an engine. One or more manufacturing techniques may implement (or be used to implement) micro-perforations having the parameters (d, b) into a base material of a designated thickness (Tp). A micro-perforated radiator shroud 5620 having parameters (d, b, Tp) may be positioned, attached, and/or secured a distance from a boundary, which may be part of the micro-perforated radiator shroud 5620 where the micro-perforated radiator shroud 5620 is a micro-perforated panel, and which may be a separate boundary wall (such as the radiator 5610) where the micro-perforated radiator shroud 5620 is a micro-perforated sheet. The positioning of the micro-perforated radiator shroud 5620 may create a cavity of depth Dp corresponding to an appropriate cavity depth Dp that provides the micro-perforated radiator shroud 5620 with the greatest sound absorption or attenuation capability or effect within the frequency ranges typically generated by the radiator or the engine. As an example, a radiator system 5600 may include micro-perforated radiator shroud 5620 with parameters that enable the micro-perforated radiator shroud 5620 to absorb or attenuate sound within typical noise ranges generated or otherwise present in or near the radiator, such as between 120 and 4000 Hz. In other systems, the parameters of the micro-perforates may be calculated, and/or micro-perforates with other parameters may be cut, manufactured, or otherwise implemented, to provide the micro-perforated radiator shroud 5620 with sound absorption or attenuation of various other frequency ranges. Other variations are possible.

Micro-perforated sheets and/or micro-perforated panels may be used with a wide variety of outdoor maintenance machines, such as tractors, lawn mowers, snow throwers, tillers, lifts, chainsaws, wood chippers, stump grinders, wood splitters, edgers, trimmers, and a wide variety of other devices. Such outdoor maintenance machines may include an engine, and one or more outdoor maintenance components driven by the engine. Some non-limiting examples of outdoor maintenance components may include grass cutting blades for a lawn mower, a chainsaw blade for a chainsaw, and rotating blades for a snow thrower or tiller.

Figure 57:
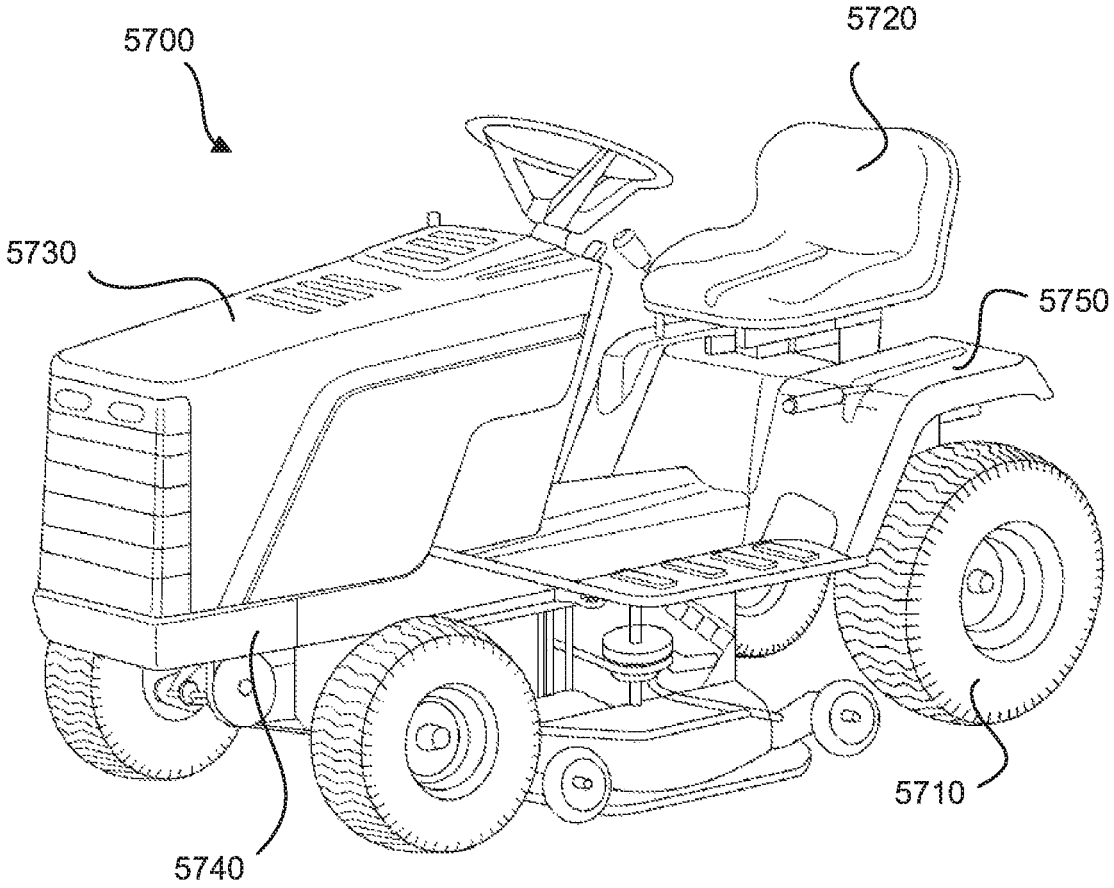
FIG. 57 shows a perspective view of an example tractor.
Figure 58:
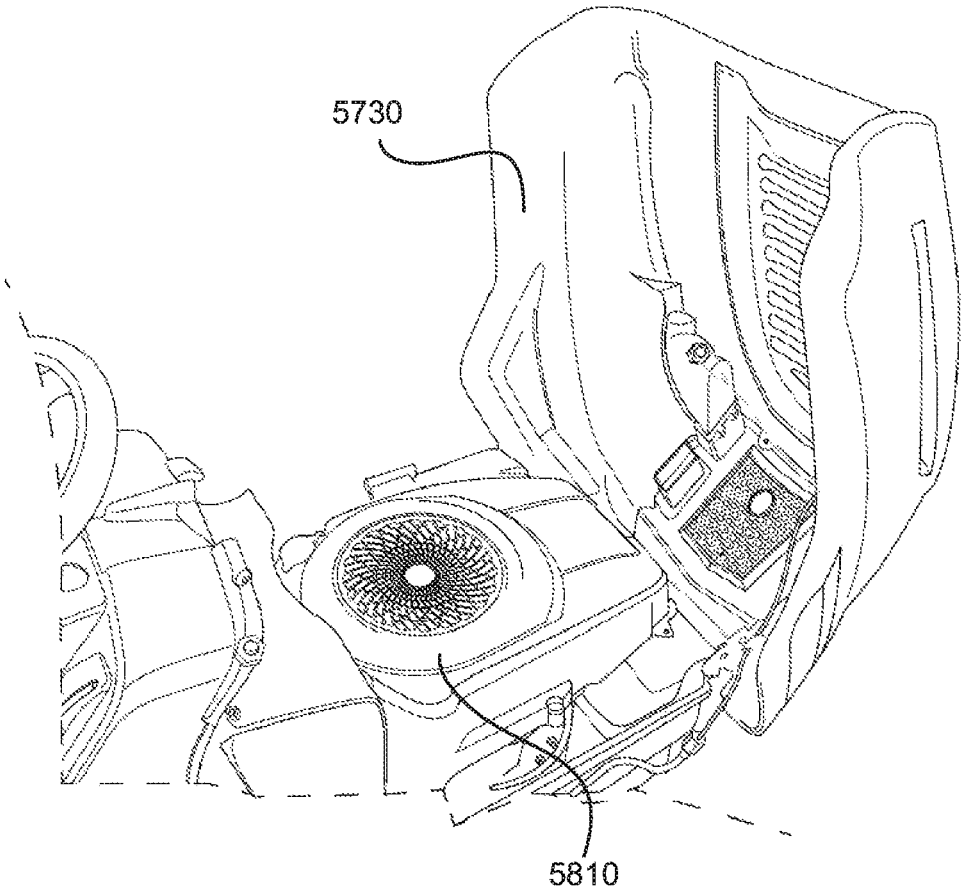
FIG. 58 shows an example tractor.

FIGS. 57 and 58 show an example tractor 5700 that may include one or more micro-perforated components.

The tractor 5700 may include one or more of an engine 5810, an air intake, a muffler, a fan, wheels 5710, and various other components that may generate, reflect, or resonate noise. The operating components of the tractor 5700, such as the engine 5810, may be positioned in front of, under, to a side, or behind a seat 5720 on the tractor 5700, or in some combination. The tractor 5700 may include one or more micro-perforated hoods, shrouds, enclosures, or other components which may enclose or be positioned near some or all of the operating components of the tractor.

The tractor 5700 may, for example, include a hood 5730 that is made of or includes a micro-perforated sheet or panel. The hood 5730 itself may be a micro-perforated panel and may be referred to as a micro-perforated hood, or may have a micro-perforated sheet positioned on an interior or exterior surface of the hood 5730. Additionally or alternatively, the tractor 5700 may include one or more micro-perforated side segments 5740 or other portions that additionally enclose part or all of the tractor engine or components. The parameters (d, b, Tp, Dp) of the micro-perforated hood 5730 and/or the micro-perforated side segments 5740 may be calculated to provide the micro-perforated component with the greatest absorption or attenuation capabilities or effect within the frequency ranges typically generated by tractor or tractor components. One or more manufacturing techniques may implement (or be used to implement) micro-perforations having the parameters (d, b) into a base material of a designated thickness (Tp). A micro-perforated hood 5730 or side segment 5740 having parameters (d, b, Tp) may be positioned, attached, and/or secured a distance from a boundary, which may be part of the micro-perforated hood 5730 and/or side segments 5740 where the micro-perforated hood 5730 and/or side segments 5740 is a micro-perforated panel, and which may be a separate boundary wall where the micro-perforated hood 5730 and/or side segments 5740 is a micro-perforated sheet. The positioning of the micro-perforated hood 5730 and/or the micro-perforated side segments 5740 may create a cavity of depth Dp corresponding to an appropriate cavity depth Dp that provides the micro-perforated component with the greatest sound absorption or attenuation capability or effect within the frequency ranges typically generated by the tractor. As an example, the micro-perforated hood 5730 may be configured with holes of a certain size, spacing, and depth so as to absorb significant sound in a frequency range that overlaps or includes the frequency range of sound generated by an engine 5810 at full throttle (or at another throttle level) during normal operation. As another example, a tractor 5700 may include micro-perforated components (such as a hood 5730 or walls 5740) with parameters that enable the micro-perforated component to absorb or attenuate sound within typical noise ranges generated or otherwise present in or near the tractor hood, such as between 300 and 1500 Hz for tonal noise and 800 and 3000 Hz for flow noise. In other systems, the parameters of the micro-perforates may be calculated, and/or micro-perforates with other parameters may be cut, manufactured, or otherwise implemented, to provide the micro-perforated components with sound absorption or attenuation of various other frequency ranges. Other variations are possible.

The tractor 5700 may additionally or alternatively have micro-perforated components in other locations or positions. For example, the tractor may have micro-perforated components at, near, surrounding, or otherwise incorporated with the engine in the ways discussed herein. As another example, the tractor 5700 may include a micro-perforated wheel cover 5750 with micro-perforates designed to enable the wheel cover 5750 to absorb sound from the tires 5710 and mowing noise of the tractor 5700. As another example, portions of the seat 5720 of the tractor 5700 may include micro-perforated sheets or panels, to absorb the sound of the tractor 5700 operating components below the seat 5720. One or more of the micro-perforated components of the tractor 5700 may be sized differently so as to absorb sound at different frequencies. The micro-perforated components of the tractor 5700 may have parameters that change over the surface of the wall. For example, the micro-perforated hood 5730 of the tractor 5700 may have micro-perforations matching a first parameter set at the top of the hood 5730 near the driver seat 5720 or engine 5810, and may have perforations matching a second parameter set along the sides or in the front or back of the hood.

Some or all of the micro-perforated components (such as the hood 5730 and/or the side segments 5740) of the tractor 5700 may be a micro-perforated sheet. In other systems, some or all of the micro-perforated components of the tractor 5700 may be a micro-perforated panel, which may include a micro-perforated sheet and a boundary wall positioned a distance Dp from the micro-perforated sheet. Other variations are possible.

Figure 59:
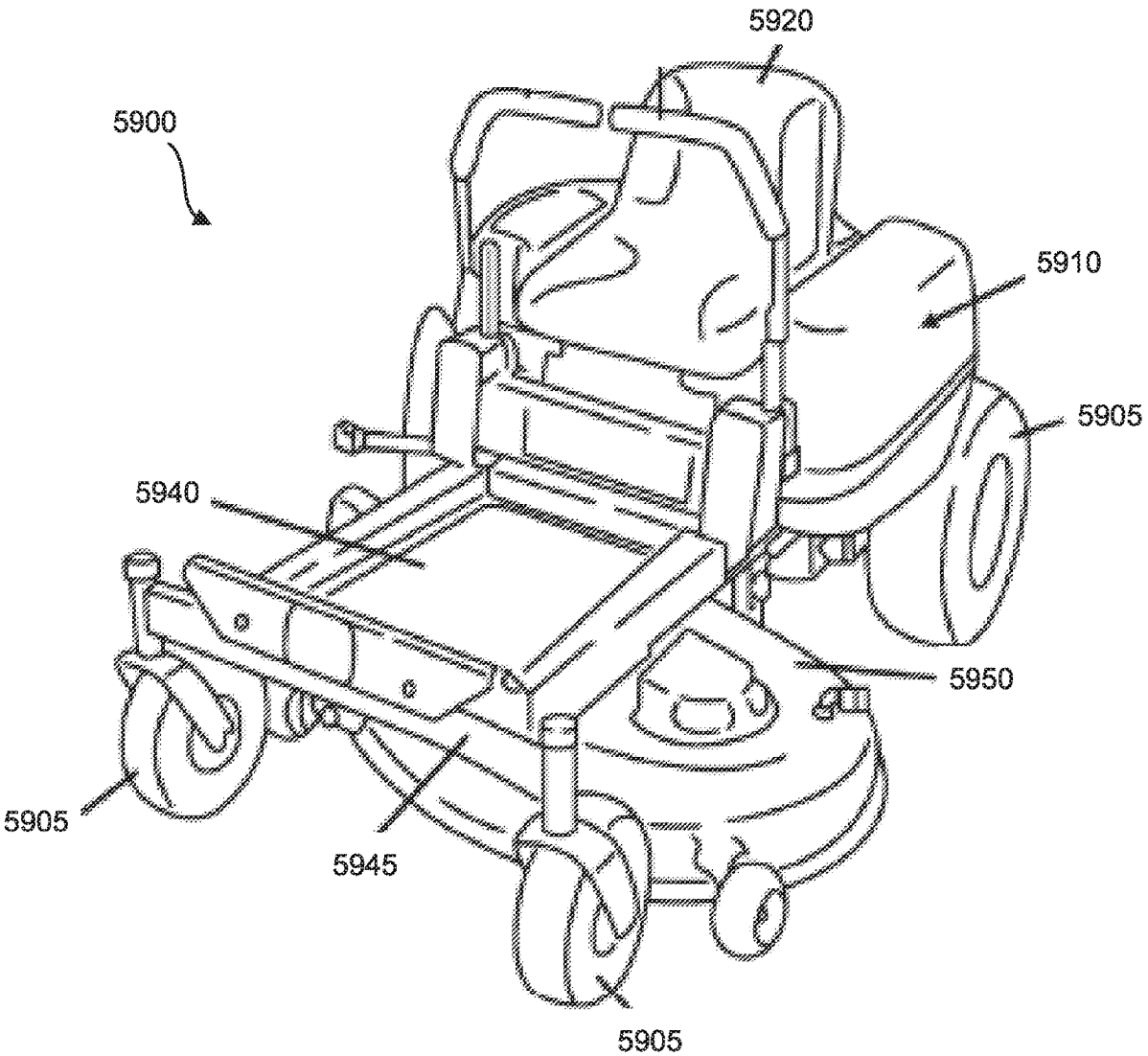
FIG. 59 shows an example riding lawn mower.

Similar micro-perforated sheets or panels may be incorporated with or part of similar features of a riding lawn mower (or zero-turn-radius mower), all-terrain vehicle (ATV), golf cart, or other riding vehicle. For example, FIG. 59 shows an example riding lawn mower 5900 that may include wheels 5905, a micro-perforated hood 5910, micro-perforated side segments, micro-perforated seat components 5920, or micro-perforated covers or separators for various components. The riding lawn mower 5900 may additionally or alternatively include one or more micro-perforated footrests 5940 and foot-rest frames 5945. The riding lawn mower 5900 may additionally or alternatively include one or more micro-perforated blade covers 5950, which may protect a user from the blade of the lawn mower 5900. As another example, a micro-perforated covering may be positioned over belts or pulleys on a mower deck. The micro-perforated blade cover 5950 may have parameters that enable the micro-perforated blade cover 5950 to absorb or attenuate sound within typical noise ranges generated or otherwise present in or near the mower blade, such as between 120 and 500 Hz. Other variations are possible. As other examples, an ATV or a golf cart may include a micro-perforated hood, micro-perforated front, side, or back panels, micro-perforated seat components, micro-perforated mudflaps, or micro-perforated covers or separators for various components.

Figure 60:
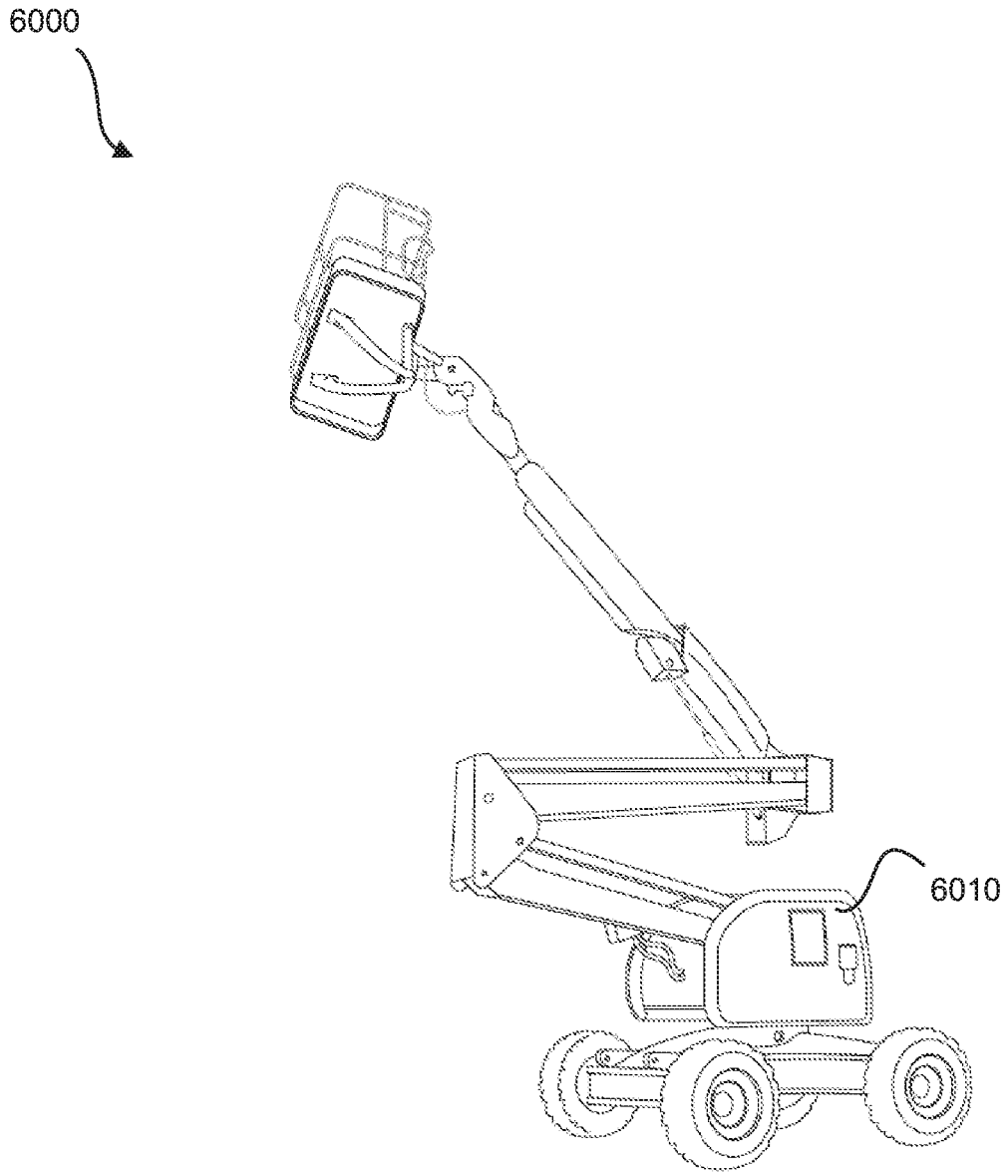
FIG. 60 shows an example lift.

FIG. 60 shows an example lift 6000 (or cherry picker). As with the tractor 5700, one or more micro-perforated components could be used with similar portions of the lift 6000. For example, the lift 6000 may include a micro-perforated engine shroud 6010 or micro-perforated engine enclosure. The micro-perforated engine shroud 6010 may be configured to partially or completely enclose the engine of a moveable or transportable hydraulic (or other) lift 6000. The parameters of the micro-perforated engine shroud 6010 may be set or controlled during manufacturing, or adjusted, to absorb or otherwise attenuate sound within the frequency ranges typically generated by the engine or lift components, or various other frequency ranges. The micro-perforated engine shroud 6010 may be a micro-perforated sheet or panel. Many other examples are possible.

Figure 61:
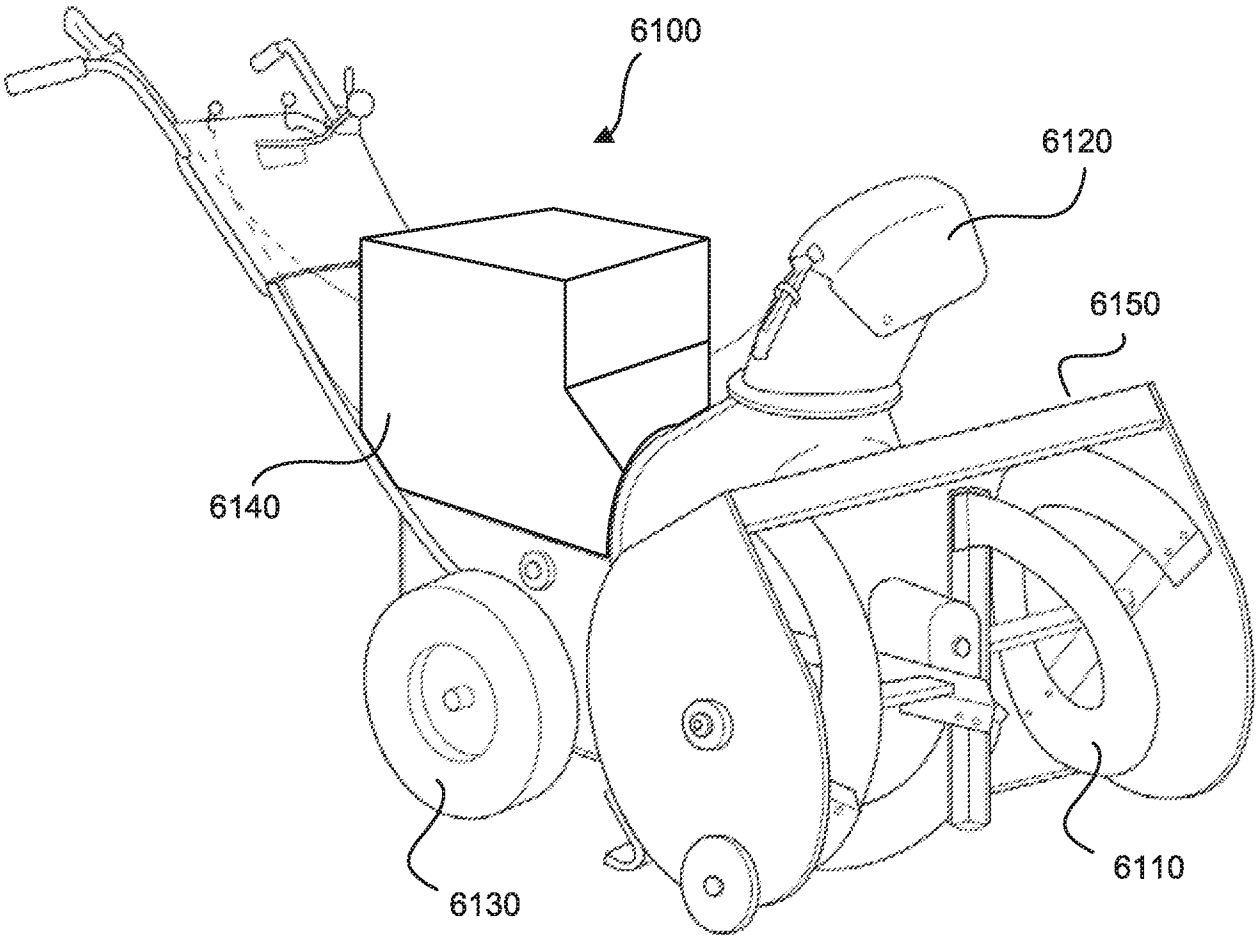
FIG. 61 shows an example snow thrower.

FIG. 61 shows an example snow thrower 6100. The snow thrower 6100 may include one or more of an engine, a rotating blade 6110, a snow discharge tube 6120, wheels 6130, and various other components that may generate or resonate noise.

The snow thrower 6100 may include one or more micro-perforated shrouds or other components. The snow thrower 6100 may, for example, include a micro-perforated engine shroud 6140. The shroud 6140 itself may be made entirely of a micro-perforated material, or alternatively may have a micro-perforated sheet or panel positioned adjacent to, an interior or exterior surface of the shroud.

The snow thrower 6100 may additionally or alternatively have micro-perforated components or barriers in other locations or positions. For example, the snow thrower 6100 may include a micro-perforated snow shield 6150. The micro-perforated snow shield 6150 may include micro-perforates with parameters calculated and/or implemented to absorb sound from the rotating blades 6110 of the snow thrower 6100 and/or the engine. As another example, the snow discharge tube 6120 of the snow thrower 6100 may include one or more micro-perforated sheets or panels to absorb sound from the rotating blades, thrown snow, or engine of the snow thrower 6100. Such micro-perforated sheets or panels of the snow discharge tube 6120 may be added to an interior or exterior portion of the structural wall of the snow discharge tube 6120, or may replace the structural wall. Various other examples are possible. Some or all of the micro-perforated components of the snow thrower 6100 may be a micro-perforated sheet. In other systems, some or all of the micro-perforated components of the snow thrower 6100 may be a micro-perforated panel, which may include a micro-perforated sheet and a boundary wall positioned a distance Dp from the micro-perforated sheet.

The parameters (d, b, Tp, Dp) of the micro-perforated engine shroud 6140, micro-perforated snow shield 6150, and micro-perforated snow discharge tube 6120 may be calculated to provide the micro-perforated components with the greatest absorption or attenuation capabilities or effect within the frequency ranges typically generated by components of the snow thrower 6100, such as the engine, rotating blade 6110, wheels 6130, or other snow thrower components. One or more manufacturing techniques may implement (or be used to implement) micro-perforations having the parameters (d, b) into a base material of a designated thickness (Tp). A micro-perforated component having parameters (d, b, Tp) may be positioned, attached, and/or secured a distance from a boundary, which may be part of the micro-perforated components where the components are micro-perforated panels, and which may be a separate boundary wall where the micro-perforated components are micro-perforated sheets. The positioning of the micro-perforated components may create a cavity of depth Dp corresponding to an appropriate cavity depth Dp that provides the micro-perforated component with the greatest sound absorption or attenuation capability or effect within the frequency ranges typically generated by components of the snow thrower 6100. As an example, the micro-perforated engine shroud 6140 may be configured with holes of a certain size, spacing, and depth so as to absorb significant noise in a frequency range that overlaps or includes the frequency range of normal operation for the engine at full throttle (or at various other modes of operation). As another example, the micro-perforated snow shield 6150 may be configured with holes of a certain size, spacing, and depth so as to absorb significant noise in a frequency range that overlaps or includes the frequency range of normal operation for the rotating blades 6110 or the engine at full throttle (or at various other modes of operation). In other systems, the parameters of the micro-perforates may be calculated, and/or micro-perforates with other parameters may be cut, manufactured, or otherwise implemented, to provide the micro-perforated components with sound absorption or attenuation of various other frequency ranges.

One or more of the micro-perforated components of the snow thrower 6100 may be sized differently so as to absorb sound at different frequencies. The micro-perforated components of the snow thrower 6100 may have parameters that change over the surface of the wall. Other variations are possible.

Figure 62:
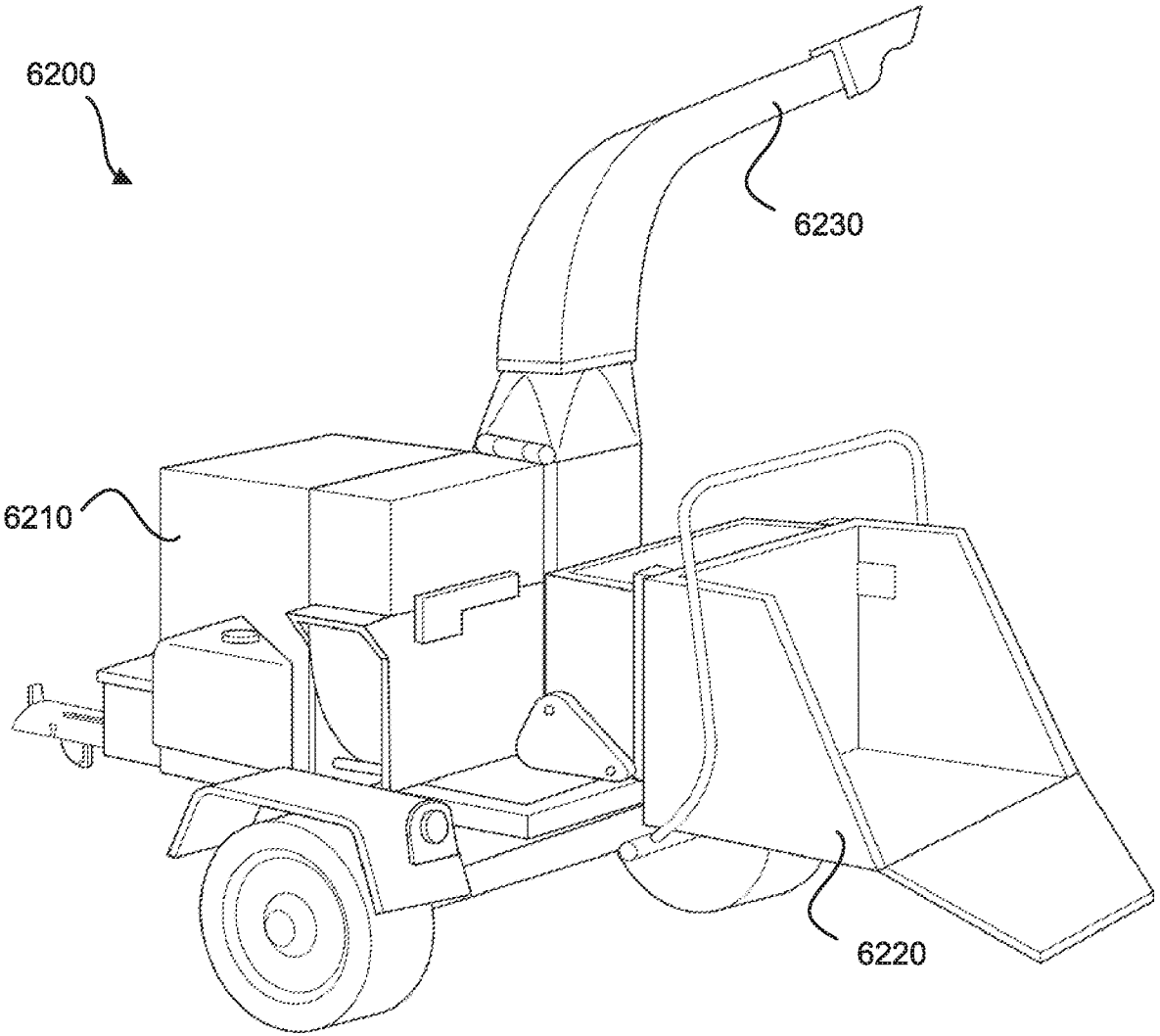
FIG. 62 shows an example wood chipper.

Many other machines may have micro-perforated components positioned near, or operating in a similar fashion, to those of the snow thrower 6100. For example, FIG. 62 shows an example wood-chipper 6200 that may include a micro-perforated engine shroud 6210. Alternatively, the wood-chipper 6200 may include a micro-perforated barrier, plate, or enclosure attached to and/or positioned a distance from an engine shroud such as on or near an interior or exterior surface of an engine shroud. The wood-chipper 6200 may additionally or alternatively include one or more micro-perforated receptacles 6220, and one or more micro-perforated wood-chip discharge tubes 6230.

The micro-perforated engine shroud 6210, micro-perforated receptacles 6220, and wood-chip discharge tubes 6230 (or panels attached to and/or positioned a distance from the shroud, receptacle, or discharge tube) may have micro-perforates that are calculated and/or implemented, such as during manufacturing or through adjustments, so that the micro-perforated components absorb or otherwise attenuate sound within the frequency ranges typically generated by the engine, the chipping blades, or various other frequency ranges. The micro-perforated components of the wood-chipper 6200 may be micro-perforated sheets positioned a distance Dp from a boundary wall, or may be micro-perforated panels. Similar micro-perforated sheets may additionally or alternatively be used in various stump grinders and similar devices. Other variations are possible.

Figure 63:
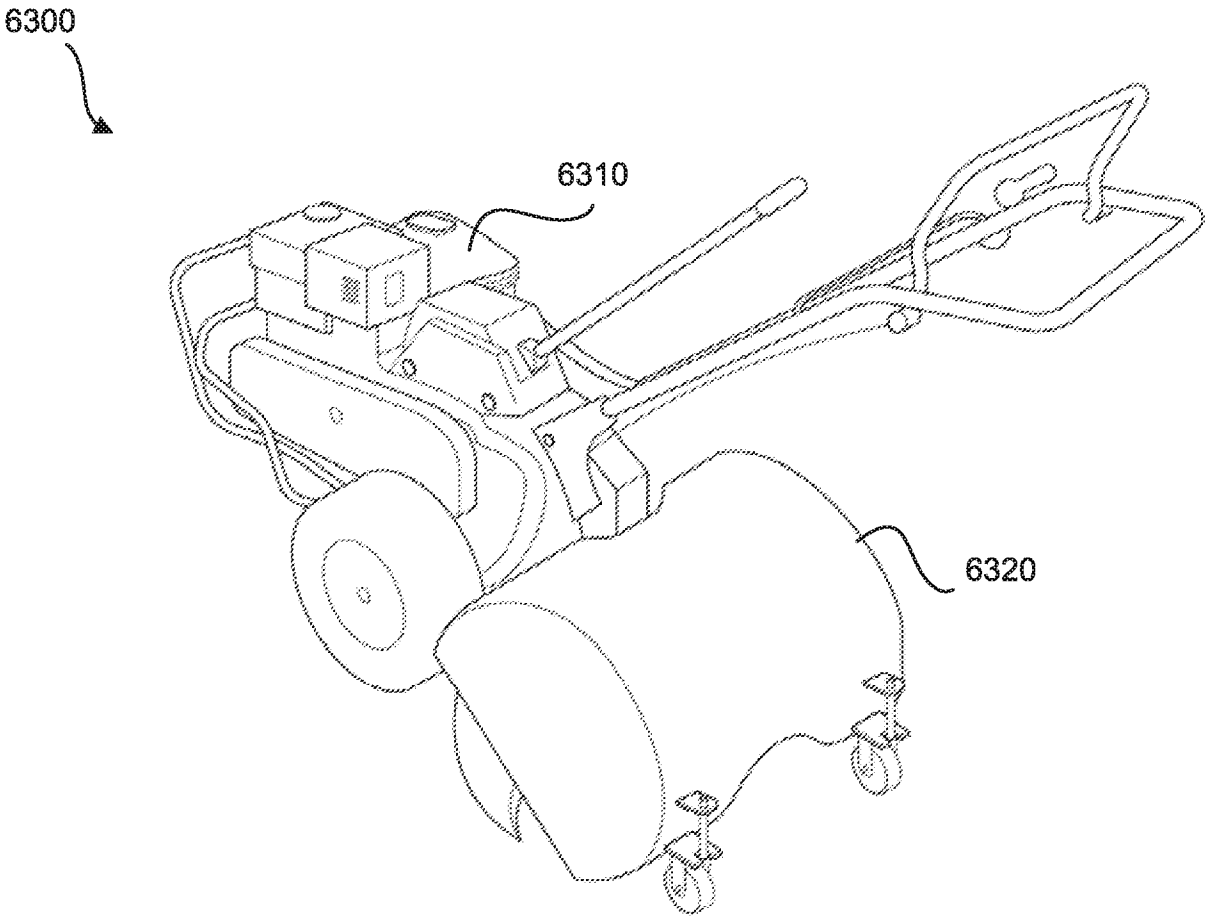
FIG. 63 shows an example tiller.

As another example, FIG. 63 shows an example tiller 6300. The tiller 6300 may include a micro-perforated engine shroud 6310. Alternatively, the tiller 6300 may include a micro-perforated barrier, plate, or enclosure attached to and/or positioned a distance from an engine shroud such as on or near an interior or exterior surface of an engine shroud. The tiller 6300 may additionally or alternatively include one or more micro-perforated ground shields 6320. The micro-perforated engine shroud 6310 and/or the micro-perforated ground shield 6320 may be calculated and/or implemented, such as during manufacturing or through adjustments, to absorb or otherwise attenuate sound within the frequency ranges typically generated by the engine, the tilling blade, or various other frequency ranges. The micro-perforated components of the tiller 6300 may be micro-perforated sheets positioned a distance Dp from a boundary wall, or may be micro-perforated panels. Many other variations are possible.

Figure 64:
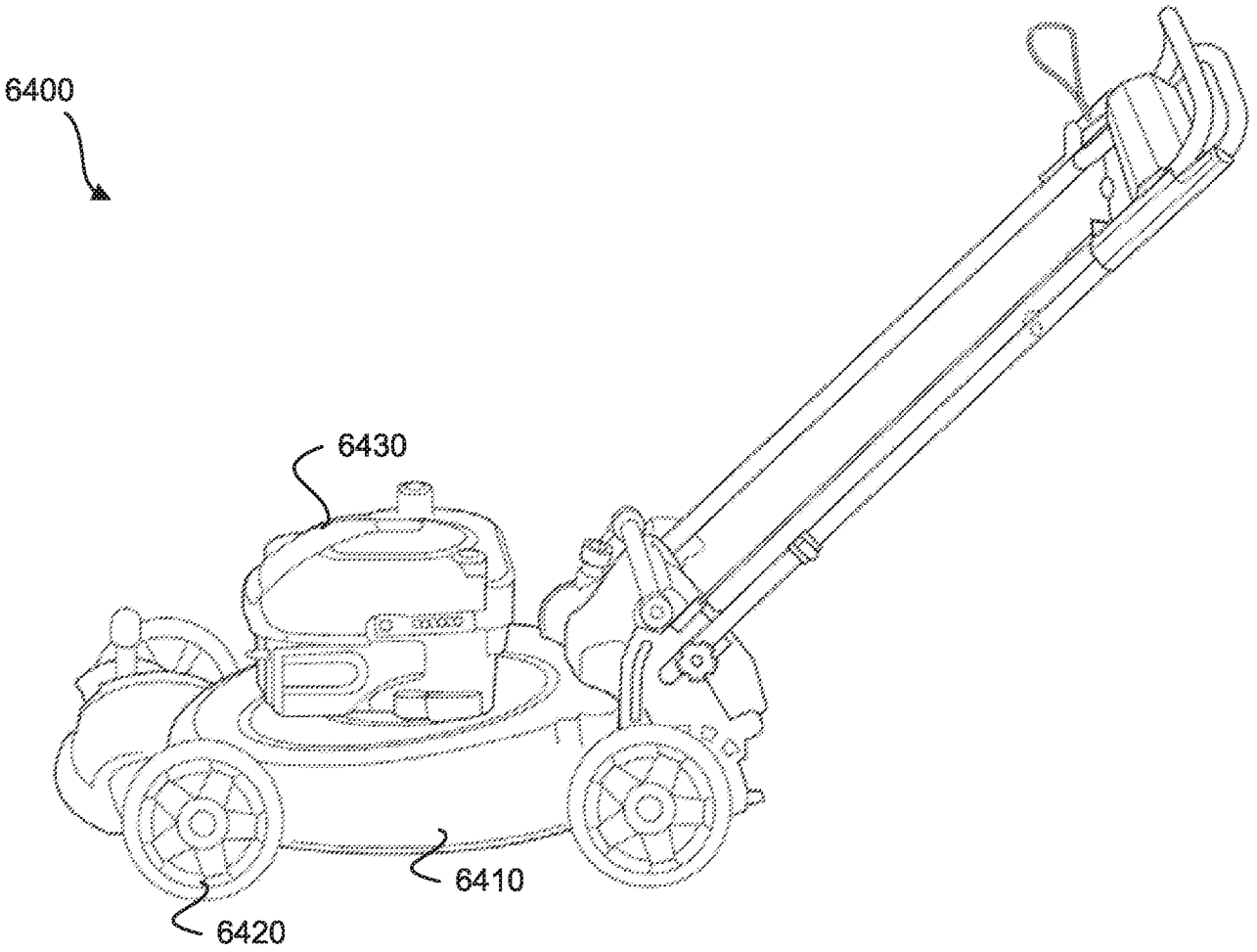
FIG. 64 shows an example push mower.

FIG. 64 shows an example of a push mower 6400 that may include one or more micro-perforated components. The push mower 6400 may include one or more of an engine, a rotating blade, a blade cover 6410, a blade discharge tube, wheels 6420, and various other components that may generate, reflect, or resonate noise. The push mower 6400 may include one or more micro-perforated shrouds, enclosures, or other components.

The push mower 6400 may, for example, include a micro-perforated engine shroud 6430. The engine shroud 6430 itself may be made entirely of a micro-perforated panel, or alternatively may have a micro-perforated sheet or panel positioned adjacent to, an interior or exterior surface of the shroud 6430.

The push mower 6400 may additionally or alternatively have micro-perforated components in other locations or positions. The push mower 6400 may, for example, include a micro-perforated blade cover 6410. The parameters of the micro-perforated blade cover 6410 may be set or adjusted to minimize noise from the rotating blade or engine of the push mower 6400. As another example, the push mower 6400 may include a micro-perforated discharge tube for discharging grass clippings. The micro-perforated discharge tube may be configured to absorb sound from the rotating blades of the push mower 6400 or the engine. One or more of the micro-perforated engine shroud 6430, micro-perforated blade cover 6410, or micro-perforated grass discharge tube of the push mower 6400 may be micro-perforated sheet positioned a distance Dp from a boundary wall, or may be a micro-perforated panel. Other variations are possible.

The parameters (d, b, Tp, Dp) of the micro-perforated engine shroud 6430, micro-perforated blade cover 6410, and micro-perforated grass discharge tube may be calculated to provide the micro-perforated components with the greatest absorption or attenuation capabilities or effect within the frequency ranges typically generated by components of the push mower 6400, such as the engine, rotating blade, wheels 6420, or other push mower components. One or more manufacturing techniques may implement (or be used to implement) micro-perforations having the parameters (d, b) into a base material of a designated thickness (Tp). A micro-perforated component having parameters (d, b, Tp) may be positioned, attached, and/or secured a distance from a boundary which may be part of the micro-perforated components where the components are micro-perforated panels, and which may be a separate boundary wall where the micro-perforated components are micro-perforated sheets. The positioning of the micro-perforated components may create a cavity of depth Dp corresponding to an appropriate cavity depth Dp that provides the micro-perforated component with the greatest sound absorption or attenuation capability or effect within the frequency ranges typically generated by components of the push mower 6400. As an example, the micro-perforated engine shroud 6430 may be configured with micro-perforations of a certain size, spacing, and depth in a material of a certain thickness so as to absorb significant noise in a frequency range that overlaps or includes the frequency range of normal operation for the engine at full throttle (such at 120 to 4000 Hz), or at various other modes of operation. As another example, the micro-perforated blade cover 6410 may be configured with micro-perforations of a certain size, spacing, and depth in a material of a certain thickness so as to absorb significant noise in a frequency range that overlaps or includes the frequency range of normal operation for the engine and/or for the rotating blade at full throttle (or at various other modes of operation). In other systems, the parameters of the micro-perforated components may be calculated, and/or micro-perforates with other sizes and spacings (and/or patterns) may be cut, manufactured, or otherwise implemented. These micro-perforated components may be positioned various distances from additional boundaries (Dp), to provide the micro-perforated components with sound absorption or attenuation of various other frequency ranges. One or more of the micro-perforated walls of the push mower 6400 may be sized differently so as to absorb sound at different frequencies. The micro-perforated components of the push mower 6400 may have parameters that change over the surface of the component. Other variations are possible.

Figure 65:
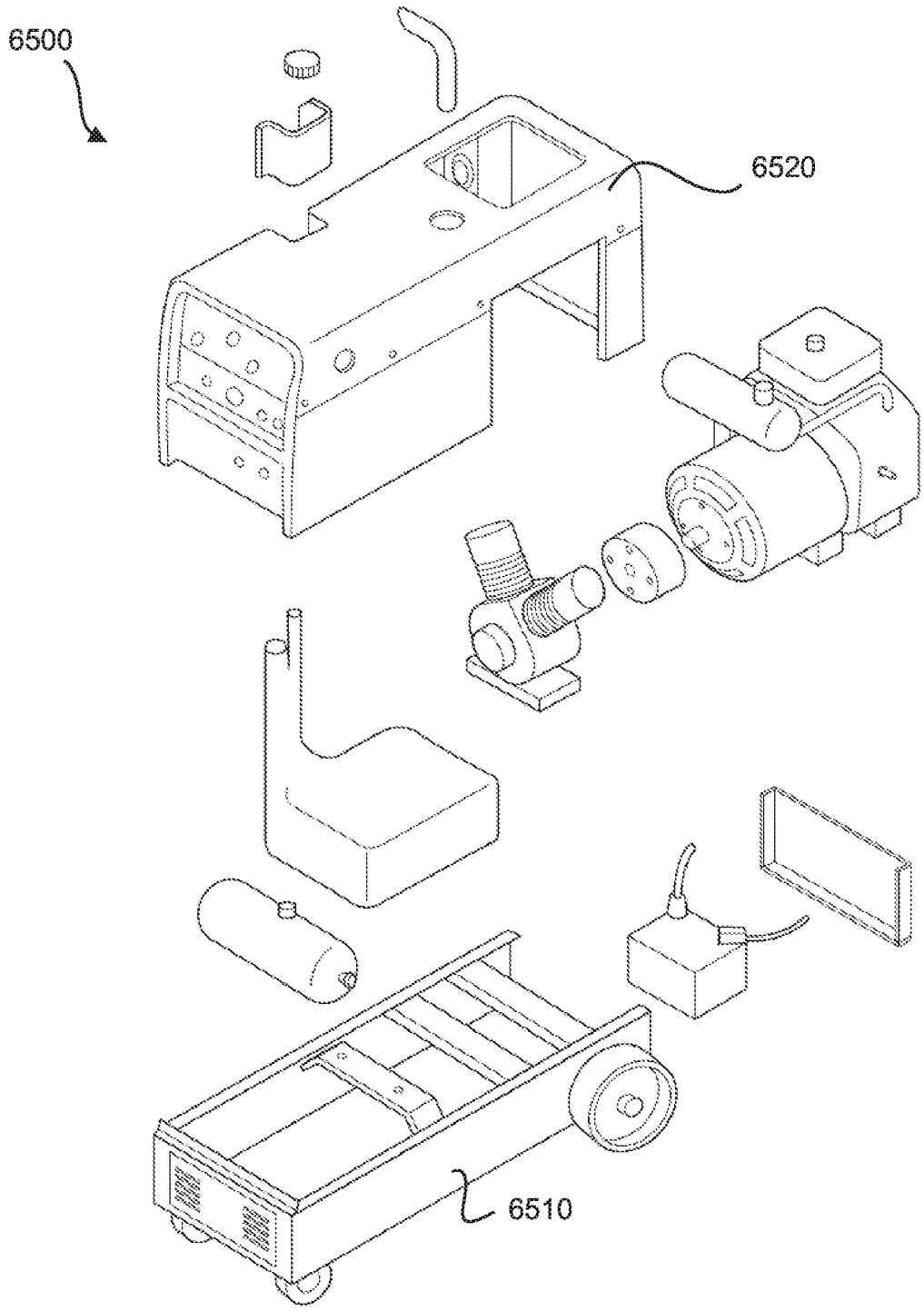
FIG. 65 shows an example welder/generator set.

FIG. 65 shows an example of a welder/generator set 6500. The welder/generator set 6500 may include welder/generator components, such as an engine, an alternator, a welder, and a fan, and a frame 6510 that may surround and/or attach to the welder/generator. In some example welder/generator sets 6500, the frame 6510 of the welder/generator may be composed of a micro-perforated material.

The welder/generator set 6500 may include one or more micro-perforated components. For example, one or more micro-perforated barriers 6520 may be part of, attached to, or placed within, the base or frame 6510 of the welder/generator set 6500. In some examples, the frame 6510 of the welder/generator set 6500 and/or the micro-perforated barriers may be configured to easily be connected (such as by snapping together) or disconnected as desired by the end user.

In some example welder/generator sets 6500, a micro-perforated barrier may be positioned between one or more components of the welder/generator. For example, in some welder/generator sets 6500, a micro-perforated barrier may be positioned between a fuel tank and an engine. In some example welder/generator sets 6500, a micro-perforated fuel tank wrap may be manufactured integrally with, or positioned around, part or all of a fuel tank of the welder/generator. The micro-perforated barrier 6520 may be micro-perforated sheet positioned a distance Dp from a boundary wall, or may be a micro-perforated panel. Many other variations are possible.

The parameters (d, b, Tp, Dp) of the micro-perforated walls 6520 may be calculated to provide the micro-perforated components with the greatest absorption or attenuation capabilities or effect within the frequency ranges typically generated by components of the welder/generator set 6500. One or more manufacturing techniques may implement (or be used to implement) micro-perforations having the parameters (d, b) into a base material of a designated thickness (Tp). A micro-perforated barrier 6520 having parameters (d, b, Tp) may be positioned, attached, and/or secured a distance from a boundary, which may be part of the micro-perforated barrier 6520 where the micro-perforated barrier 6520 is a micro-perforated panel, and which may be a separate boundary wall where the micro-perforated barrier 6520 is a micro-perforated sheets. The positioning of the micro-perforated barrier 6520 may create a cavity of depth Dp corresponding to an appropriate cavity depth Dp that provides the micro-perforated barrier 6520 with the greatest sound absorption or attenuation capability or effect within the frequency ranges typically generated by components of the welder/generator 6500. Many other variations are possible.

Figure 66:
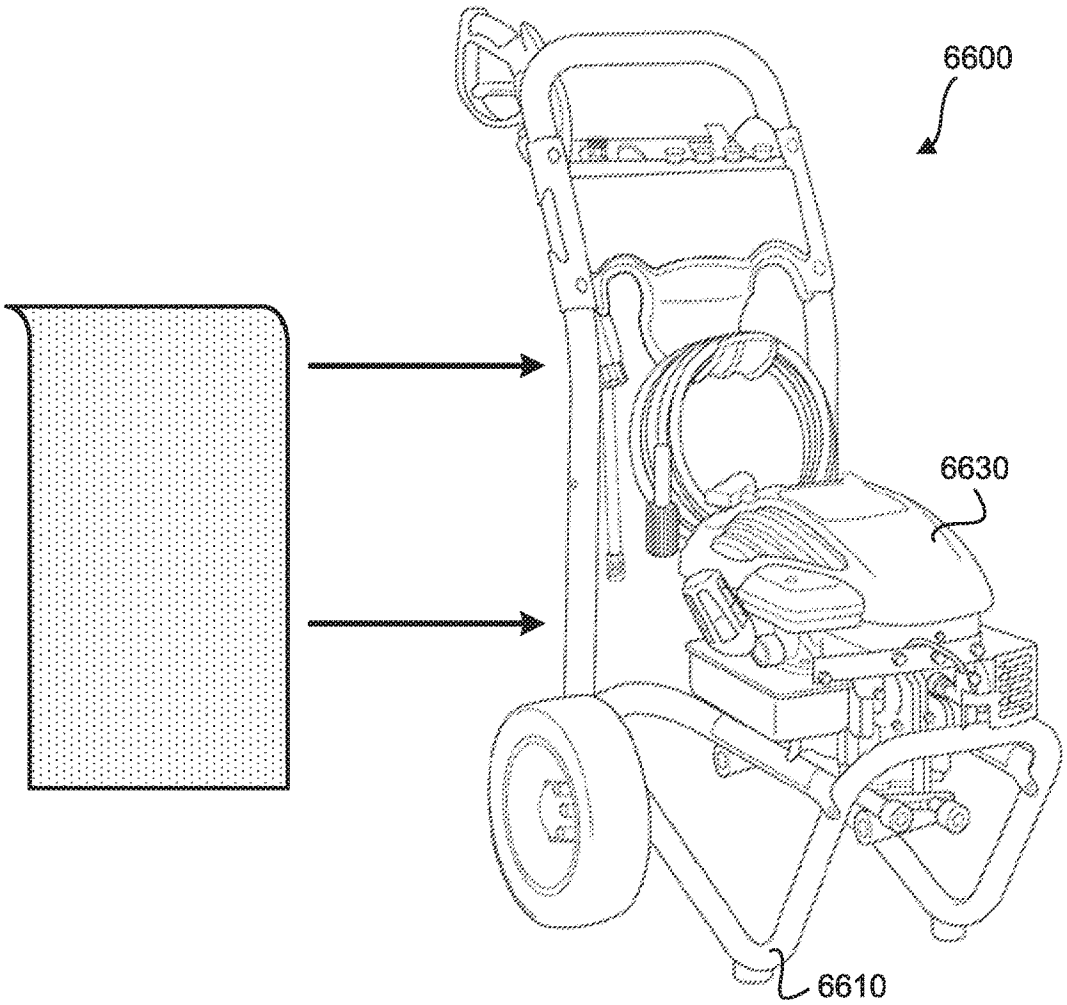
FIG. 66 shows an example pressure washer.
Figure 67:
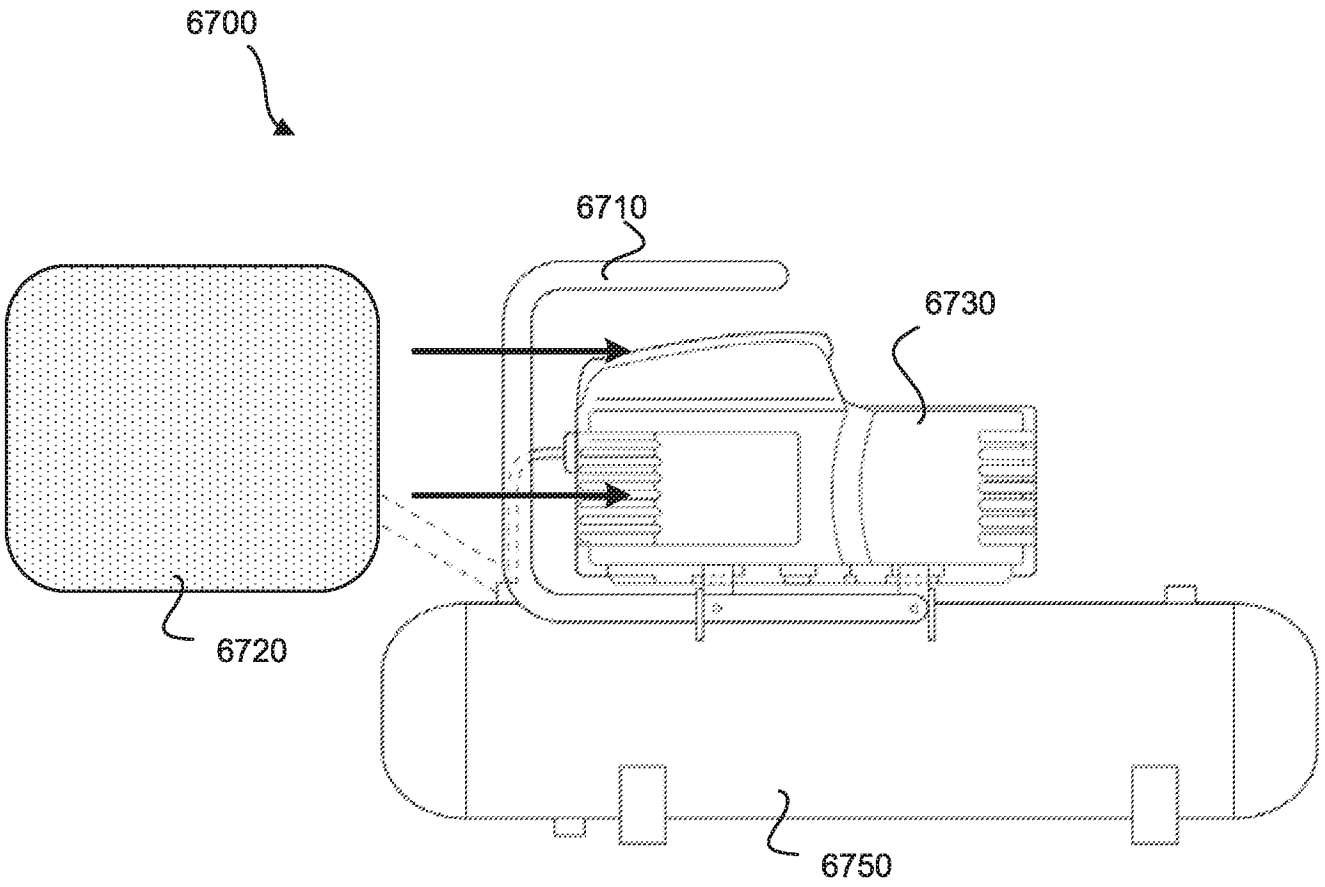
FIG. 67 shows an example air compressor.
Figure 68:
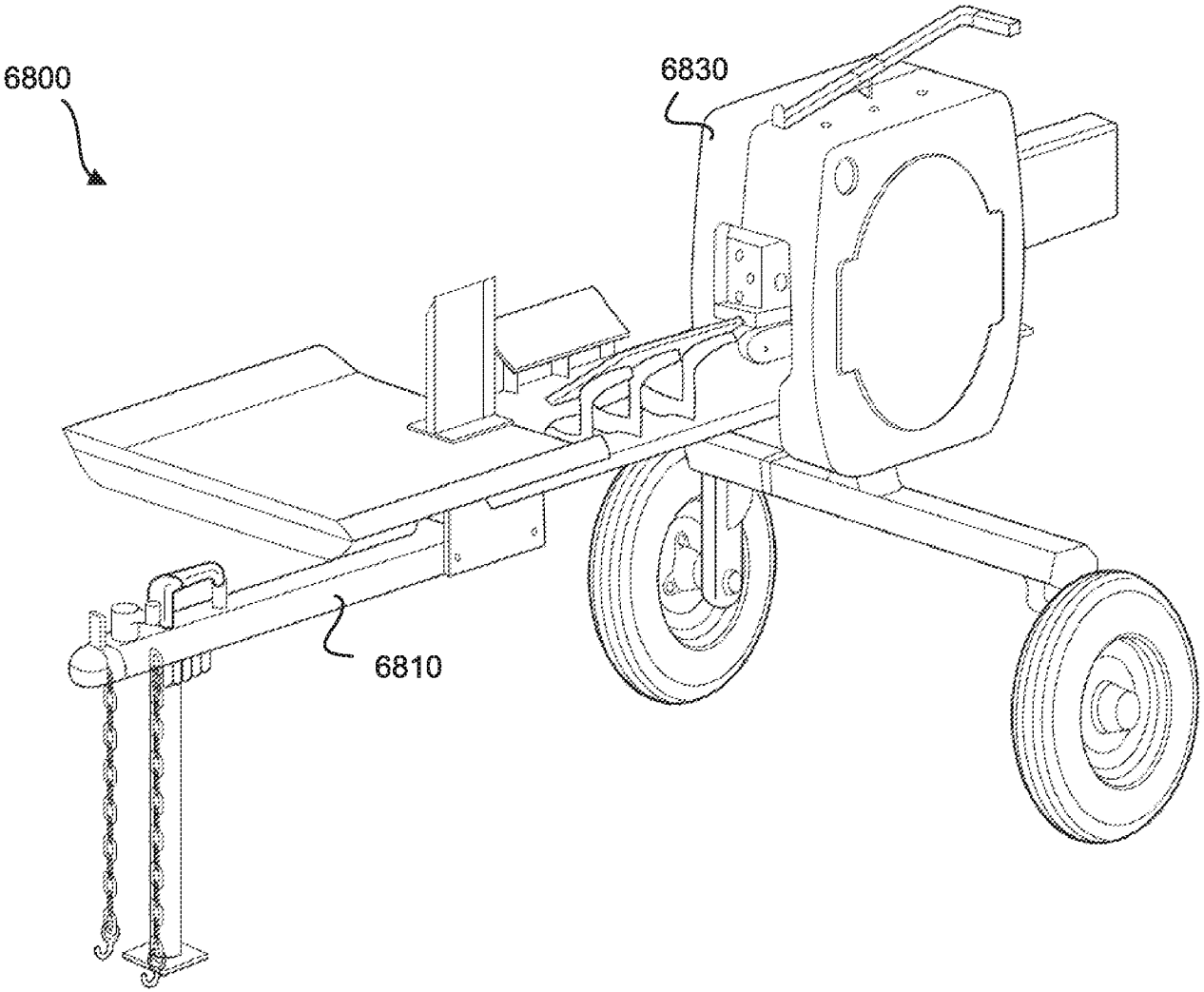
FIG. 68 shows an example log splitter.

FIG. 66 shows an example pressure washer 6600. FIG. 67 shows an example air compressor 6700. FIG. 68 shows an example log splitter 6800.

The pressure washer 6600, air compressor 6700, and log splitter 6800 may each include an engine. One or more of the pressure washer 6600, air compressor 6700, and log splitter 6800 may additionally include a frame or base (such as bases 6610, 6710, and 6810) that surrounds and/or attaches to the engine and other components (such as the compressor). In some examples, part or all of the frame may be composed of a micro-perforated material.

One or more of the pressure washer 6600, air compressor 6700, and log splitter 6800 may additionally include one or more micro-perforated shrouds, barriers, or other components. For example, one or more micro-perforated barriers 6620 may be attached to, or placed within, the frame of the pressure washer 6600. As other examples, one or more micro-perforated barriers 6720 may be attached to, or placed within, the frame of the air compressor 6700 and the log splitter 6800 respectively. In some systems, the micro-perforated barriers may form an enclosure around some or all components of the pressure washer 6600, air compressor 6700, and/or log splitter 6800. For example, each of the pressure washers 6600, air compressors 6700, and log splitters 6800 may include a micro-perforated engine shroud or engine enclosure (such as the micro-perforated engine shrouds 6630, 6730, and 6830 respectively). In some examples, a micro-perforated barrier may be positioned between one or more components. For example, in some systems, a micro-perforated barrier may be positioned between a fuel tank and an engine.

In some examples, one or more components of the pressure washer 6600, air compressor 6700, or log splitter 6800 may be made of, or wrapped in, a micro-perforated material. For example, the air tank 6750 of the air compressor 6700 may be surrounded by or wrapped in a micro-perforated sheet or panel. As another example, a micro-perforated shroud 6830 may be positioned to partially or completely enclose the engine of the log splitter 6800. Any of the micro-perforated components of the pressure washer 6600, the air compressor 6700, and the log splitter 6800 may be micro-perforated sheets positioned a distance Dp from a boundary wall, or may be micro-perforated panels. Many other variations are possible.

The micro-perforated components of the pressure washer 6600, air compressor 6700, and log splitter 6800 may be configured to absorb sound in frequency ranges that are normally produced by the pressure washer 6600, air compressor 6700, and log splitter 6800, or components thereof, such as the engines. For example, the parameters (d, b, Tp, Dp) of these micro-perforated components may be calculated to provide the micro-perforated components with the greatest absorption or attenuation capabilities or effect within the frequency ranges typically generated by the respective devices. One or more manufacturing techniques may implement (or be used to implement) micro-perforations having the parameters (d, b) into a base material of a designated thickness (Tp). A micro-perforated sheet having parameters (d, b, Tp) may be positioned, attached, and/or secured a distance from a boundary (such as a distance from the engine), creating a cavity of depth Dp corresponding to an appropriate cavity depth Dp that provides the micro-perforated component with the greatest sound absorption or attenuation capability or effect within the frequency ranges typically generated by the respective devices. Many other variations are possible.

Figure 69:
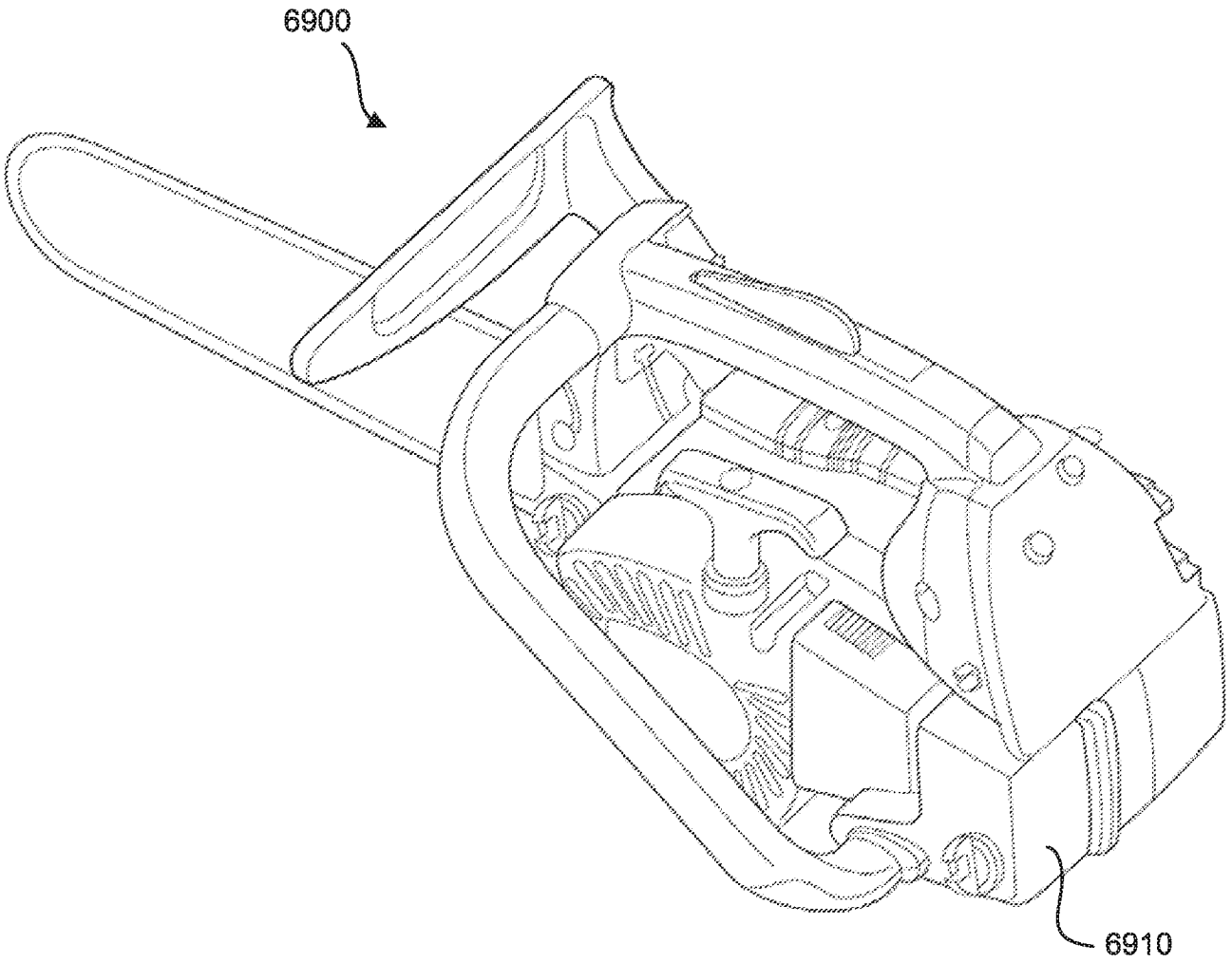
FIG. 69 shows an example chainsaw.

FIG. 69 shows an example chainsaw 6900 with an engine and a micro-perforated engine cover 6910.

The micro-perforated engine cover 6910 may cover and protect a user from the engine. The micro-perforated engine cover 6910 may be rectangular, box-shaped, or may be various other shapes. The micro-perforated engine cover 6910 may have one or more air-flow holes through which air may pass to cool the engine. The parameters of the micro-perforated engine cover 6910 may be set or controlled during manufacturing, or adjusted, to absorb or otherwise attenuate sound within the frequency ranges typically generated by the engine, or various other frequency ranges. In some examples, only part of the engine cover 6910 may be or include micro-perforated components, while the rest of the engine cover may not include micro-perforated components. The micro-perforated engine cover 6910 may be a micro-perforated sheet positioned a distance Dp from a boundary, or may be a micro-perforated panel. Other variations are possible.

Figure 70:
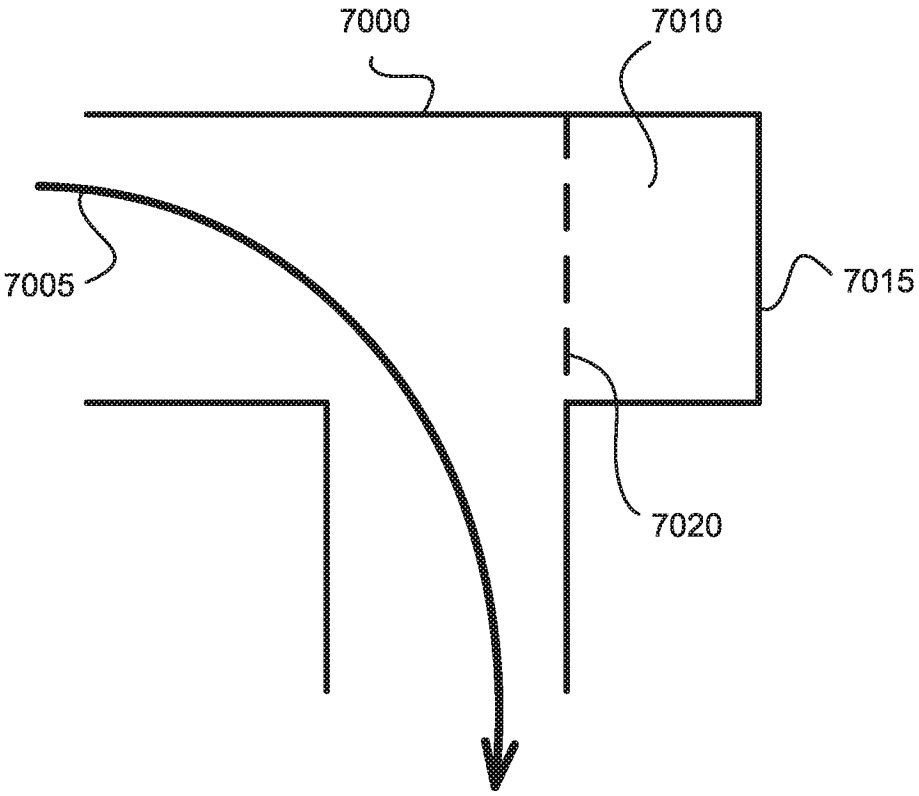
FIG. 70 shows a portion of an example air duct.

Air ducts may be used with many systems or machines, and may receive intake air (for cooling or combustion) and/or dispense exhaust or cooling air from the machine. For example, a generator set, a generator/welder, and/or a tractor may each include an air duct for receiving intake air. These and other air ducts in any of the machines mentioned herein may be constructed of micro-perforated walls. In some instances, the side walls of the air ducts may be made of or include micro-perforated sheets or panels. FIG. 70 shows an example of a corner segment 7000 of an air duct that may be configured to use with any of the machines described (such as with a generator set or a tractor).

The corner segment 7000 may include an overrun segment 7010 with an overflow wall 7015 that may be specifically constructed to have noise absorbing or attenuating properties. The corner segment 7000 may additionally include a micro-perforated sheet 7020 that may divide the overrun segment 7010 from the rest of the corner segment 7000. Air 7005 may flow through the air duct and turn at the corner segment 7000, changing directions. All (or most) of the air 7000 may move past sheet 7020 and the overrun segment 7010, and proceed down through the rest of the air duct. The parameters of the micro-perforated sheet 7020 in the corner segment 7000 of the air duct as well as the distance of the micro-perforated sheet 7020 from the overflow wall 7015, may be set or controlled during manufacturing, or adjusted, to absorb or otherwise attenuate sound within the frequency ranges typically reflected through the air duct and/or generated by the engine. The combination of the micro-perforated sheet 7030 and the overflow wall 7015 may form a micro-perforated panel.

Figure 71:
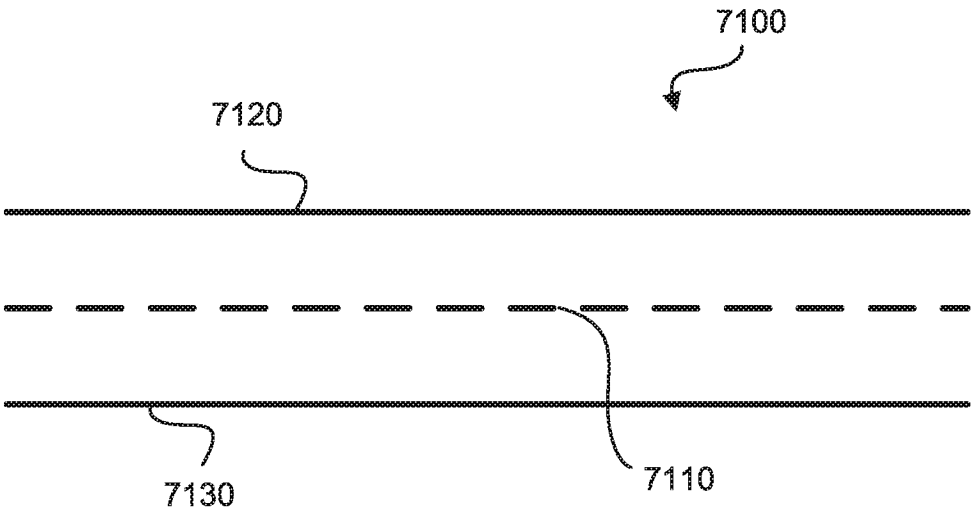
FIG. 71 shows a portion of an example air duct.

FIG. 71 shows another example air duct segment 7100 that may include one or more micro-perforated sheets 7110. The air duct segment 7100 may include two or more exterior walls 7120 and 7130. In some examples, the air duct segment 7100 may include four exterior walls that connect with each other to form a rectangular cross-section, through which air may flow.

One or more micro-perforated sheets 7110 may be positioned within the air duct segment 7100, such as along the path of air flow. Such micro-perforated sheets 7110 positioned along the path of air flow thus avoid impeding air flow. The micro-perforated sheets 7110 may bisect or otherwise divide the air duct segment 7100.

The parameters (d, b, Tp, Dp) of the micro-perforated sheets 7020 and 7110 may be calculated to provide the micro-perforated sheets 7020 and 7110 with the greatest absorption or attenuation capabilities or effect within the frequency ranges typically observed in the air ducts. One or more manufacturing techniques may implement (or be used to implement) micro-perforations having the parameters (d, b) into a base material of a designated thickness (Tp). A micro-perforated sheet 7020 or 7110 having parameters (d, b, Tp) may be positioned, attached, and/or secured a distance from a boundary (such as the overflow wall 7015 or one of the outer walls 7120 and 7130), creating a cavity of depth Dp corresponding to an appropriate cavity depth Dp that provides the micro-perforated sheet 7020 and 7110 with the greatest sound absorption or attenuation capability or effect within the frequency ranges typically observed in the air ducts. As another example, an air duct segment 7100 may include micro-perforated sheets 7020 and 7110 with parameters that enable the micro-perforated sheets 7020 and 7110 to absorb or attenuate sound within typical noise ranges generated or otherwise present in or near the air duct, such as between 800 and 4000 Hz. Such frequency ranges may depend on the type of air duct and/or the use of the air duct. Other variations are possible.

Various water transportation systems, such as various kitchen and bath devices and applications, may have or incorporate micro-perforated components which may reduce sound levels generated by or resonating near components thereof. For example, various toilets or waste-disposal units may include one or more micro-perforated components to absorb or attenuate noise produced by the toilet and/or automated or electronic components incorporated into the toilets.

Figure 72:
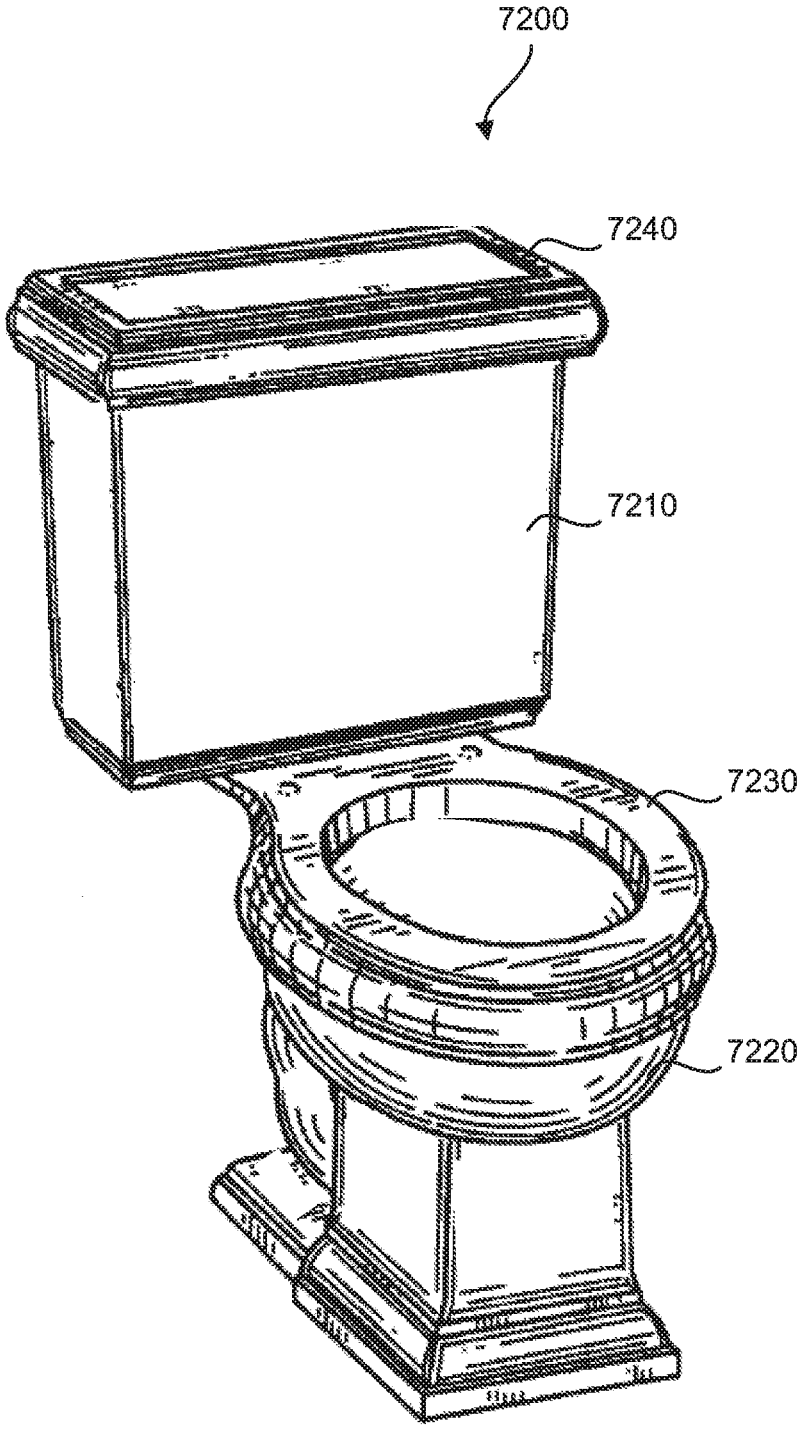
FIG. 72 shows an example toilet.
Figure 73:
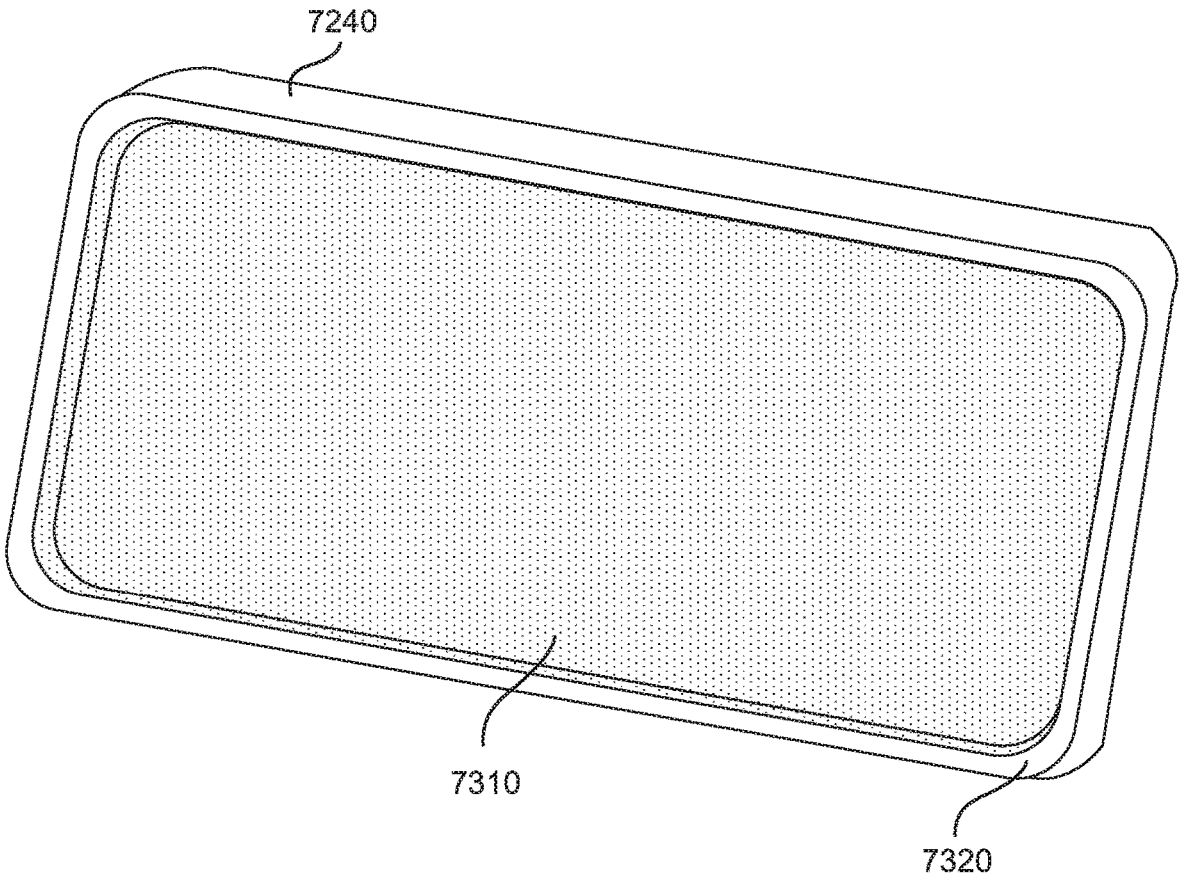
FIG. 73 shows an example water tank cover.
Figure 74:
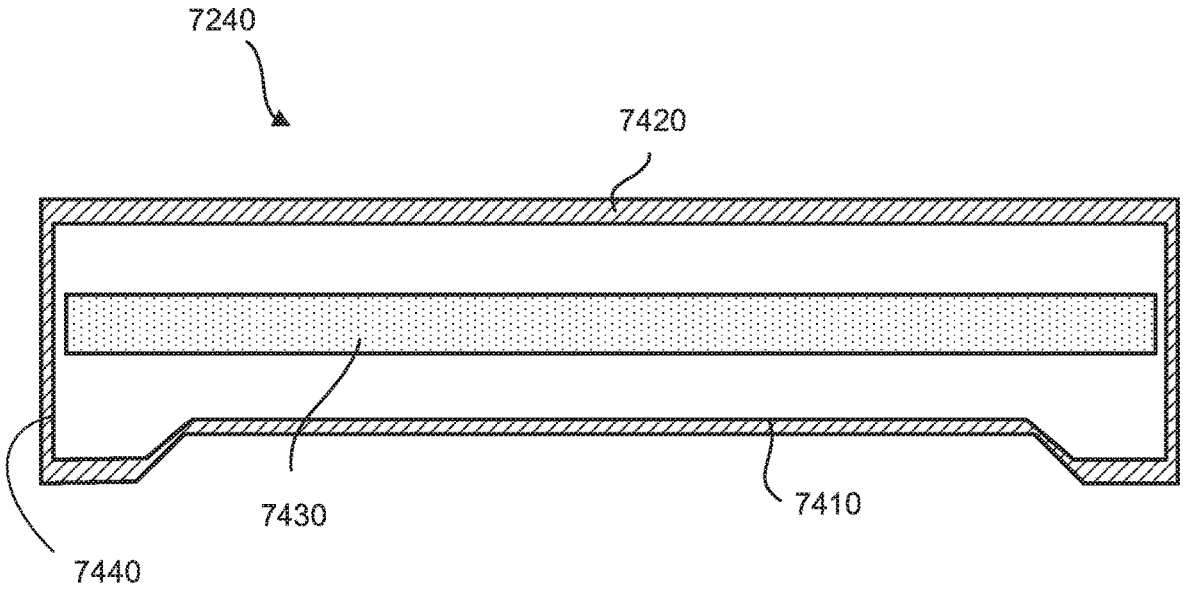
FIG. 74 shows an example toilet cover.

FIG. 72 shows an example toilet 7200. The toilet may include a tank 7210, a toilet bowl 7220, and a toilet seat 7230. The tank 7210 may include a tank cover 7240. The tank cover 7240 may include (or, in some instances, may be) a micro-perforated tank cover panel. The micro-perforated tank cover panel may be one or more micro-perforated panels or layers that may be incorporated into, or attached or positioned next to or a distance from, an interior or exterior surface of the toilet cover 7240. FIG. 73 shows an example of a toilet cover 7240 with a micro-perforated sheet 7310 positioned adjacent to a bottom, or interior, surface 7320 of the toilet cover 7240. FIG. 74 shows an example toilet cover 7240 that includes a solid bottom wall 7410, an exterior or top wall 7420, and a micro-perforated sheet 7430 positioned between the interior wall 7410 and the exterior wall 7420. In some systems, the top wall 7420 and the bottom wall 7410 may be joined (such as by side wall 7440) or may be integrally formed as part of the same wall. In other systems, the top wall 7420 and the bottom wall 7410 may not be connected by a side wall 7440. The combination of the micro-perforated sheets 7310 and 7430 spaced a distance Dp from a wall, such as the top wall 7240, may form a micro-perforated panel. Various other examples are possible.

The tank 7210 may additionally or alternatively include one or more micro-perforated sheets or panels attached or positioned near an interior or exterior surface of the side and bottom walls of the tank 7210. As an example, a micro-perforated tank wrap may be positioned around (next to or at a distance from) the tank 7210. As another example, the walls of the tank 7210 may include at least a solid interior wall, an exterior wall, and a micro-perforated panel positioned between the interior wall and the exterior wall, similar to the configuration shown in FIG. 74.

The parameters (d, b, Tp, Dp) of the micro-perforated sheets 7310 and 7430 (as well as any other micro-perforated components of the toilet 7200, such as a micro-perforated toilet bowl wrap) or other portion of the toilet 7200 may be calculated to provide the micro-perforated components with the greatest absorption or attenuation capabilities or effect within the frequency ranges typically generated by the toilet or its components. One or more manufacturing techniques may implement (or be used to implement) micro-perforations having the parameters (d, b) into a base material of a designated thickness (Tp). The micro-perforated sheets 7310 and 7430 (as well as any other micro-perforated components of the toilet 7200, such as a micro-perforated toilet bowl wrap) having parameters (d, b, Tp) may be positioned, attached, and/or secured a distance from a boundary (such as the interior wall 7410 or the exterior wall 7420), creating a cavity of depth Dp corresponding to an appropriate cavity depth Dp that provides the micro-perforated component with the greatest sound absorption or attenuation capability or effect within the frequency ranges typically generated by the toilet 7200 or toilet components. In other systems, the parameters (d, b, Tp, Dp) of the micro-perforated components may be calculated, and/or micro-perforations with other parameters may be cut, manufactured, or otherwise implemented, providing the micro-perforated component with sound absorption or attenuation of various other frequency ranges.

Figure 75:
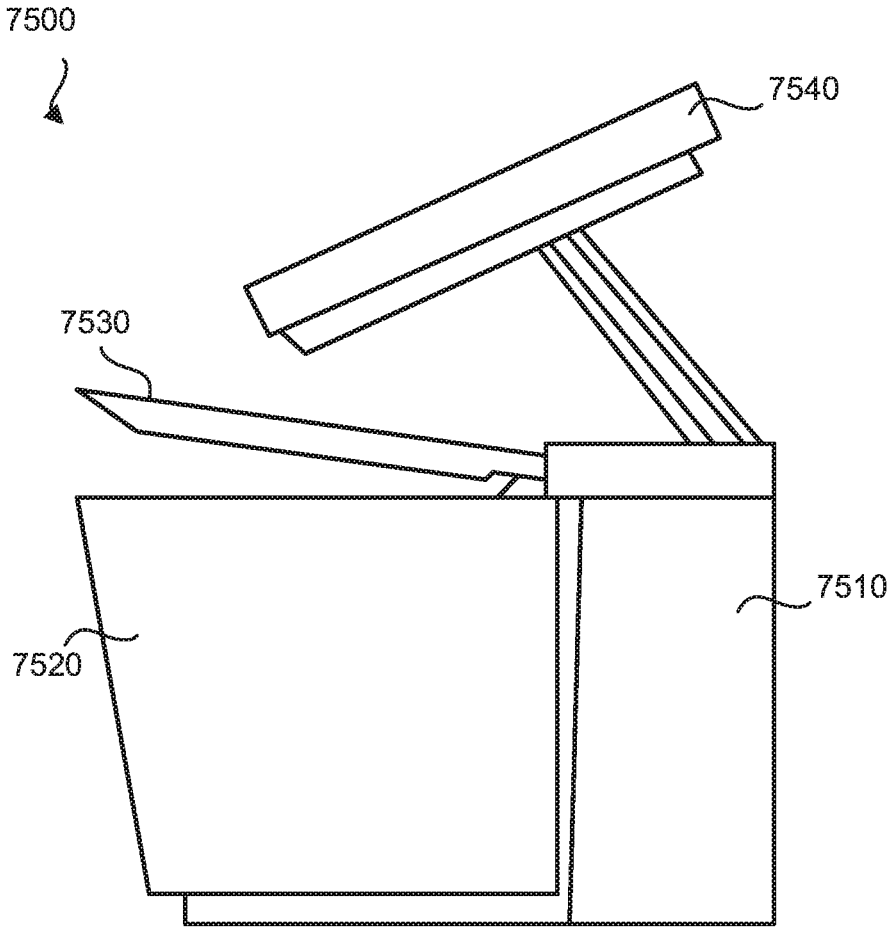
FIG. 75 shows an example toilet.

FIG. 75 shows an example of a toilet 7500. The toilet 7500 may include a tank 7510, a toilet bowl 7520, and a toilet seat 7530. The tank 7510 may include a tank cover 7540. The tank cover 7540 may be automated and/or electronic. The tank cover 7540 may include (or may be) a micro-perforated tank cover, similar to the tank cover 7240 in the toilet 7200. The tank 7510 may additionally or alternatively include one or more micro-perforated panels attached or positioned near an interior or exterior surface of the side and bottom walls of the tank 7510, similar to the tank 7210.

The toilet 7500 may include various electronic components. The electronic components may be housed in a micro-perforated enclosed portion of the toilet, such as in a micro-perforated base of the toilet (or a base with one or more micro-perforated panels positioned adjacent to a surface of the base) or in a micro-perforated electronics compartment (or an electronics compartment with one or more micro-perforated panels positioned adjacent to a surface of the electronics compartment). The micro-perforated components of the toilet 7500 may be micro-perforated sheets positioned a distance Dp from a boundary, or may be micro-perforated panels. Other variations are possible.

The parameters (d, b, Tp, Dp) of the micro-perforated components of the toilet 7500 (such as the micro-perforated tank cover 7540 or a micro-perforated electronics enclosure) may be calculated to provide the micro-perforated components with the greatest absorption or attenuation capabilities or effect within the frequency ranges typically generated by the toilet or its components. One or more manufacturing techniques may implement (or be used to implement) micro-perforations having the parameters (d, b) into a base material of a designated thickness (Tp). The micro-perforated components having parameters (d, b, Tp) may be positioned, attached, and/or secured a distance from a boundary, which may be part of the micro-perforated component where the micro-perforated component is a micro-perforated panel, and which may be a separate boundary wall where the micro-perforated component is a micro-perforated sheet. The positioning of the micro-perforated component may create a cavity of depth Dp corresponding to an appropriate cavity depth Dp that provides the micro-perforated component with the greatest sound absorption or attenuation capability or effect within the frequency ranges typically generated by the toilet 7500 or toilet components. In other systems, the parameters (d, b, Tp, Dp) of the micro-perforated components may be calculated, and/or micro-perforations with other parameters may be cut, manufactured, or otherwise implemented, providing the micro-perforated component with sound absorption or attenuation of various other frequency ranges. Other variations are possible.

Figure 76:
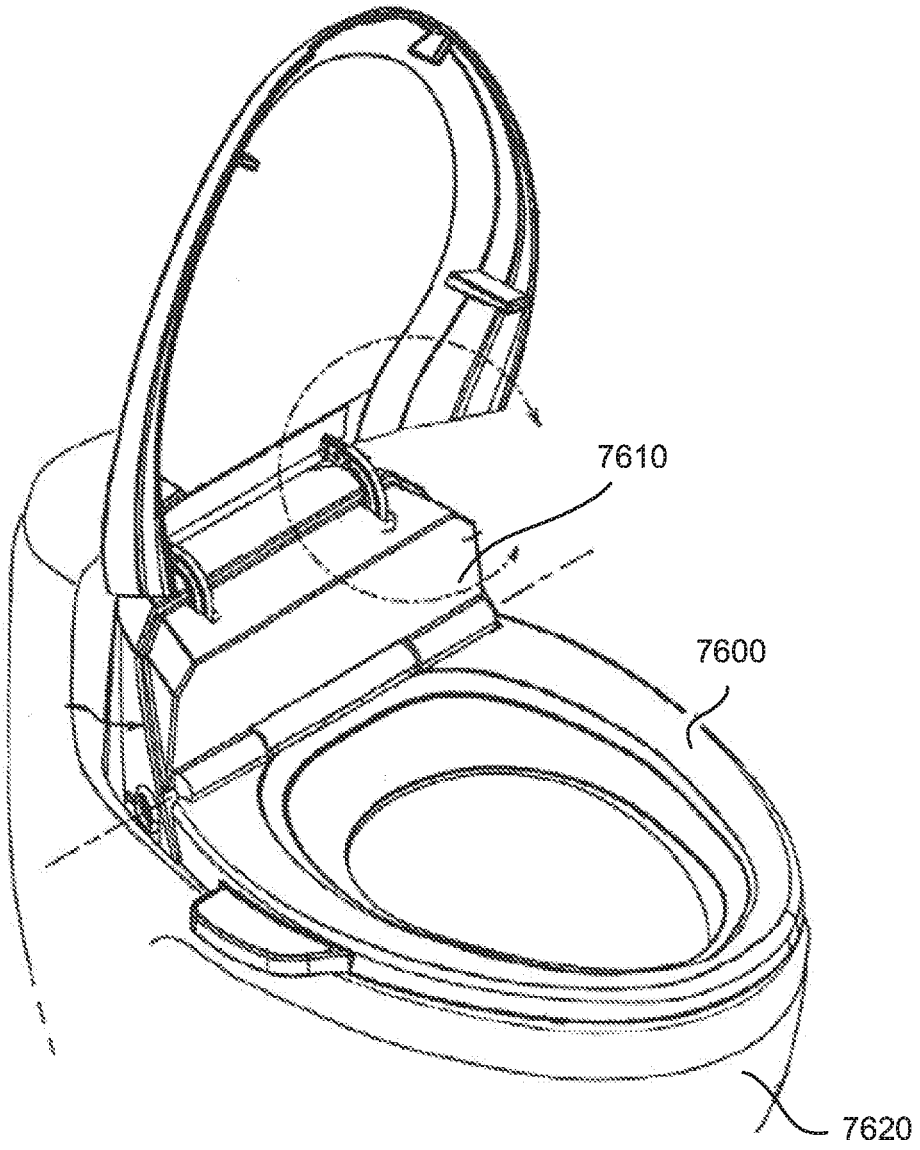
FIG. 76 shows an example bidet seat.

FIG. 76 shows an example bidet seat 7600 for use with a toilet 7620. The bidet seat 7600 may include various automated and/or electronic components, such as a water pump, water jets, seat heater, processor, or other components. Some or all of the automated and/or electronic components in the bidet seat 7600 may be bounded and/or enclosed by a micro-perforated enclosure 7610. The micro-perforated enclosure 7610 may be a micro-perforated sheet positioned a distance Dp from a boundary, or may be a micro-perforated panel. Other variations are possible.

The parameters (d, b, Tp, Dp) of the micro-perforated enclosure 7610 may be calculated to provide the micro-perforated enclosure 7610 with the greatest absorption or attenuation capabilities or effect within the frequency ranges typically generated by the automated and/or electronic components of the bidet seat 7600. One or more manufacturing techniques may implement (or be used to implement) micro-perforations having the parameters (d, b) into a base material of a designated thickness (Tp). The micro-perforated enclosure 7610 having parameters (d, b, Tp) may be positioned, attached, and/or secured a distance from a noise generating component or other boundary, which may be part of the micro-perforated enclosure 7610 where the micro-perforated enclosure 7610 is a micro-perforated panel, and which may be a separate boundary wall where the micro-perforated enclosure 7610 is a micro-perforated sheet. The positioning of the micro-perforated enclosure 7610 may (such as a pump), creating a cavity of depth Dp corresponding to an appropriate cavity depth Dp that provides the micro-perforated enclosure 7610 with the greatest sound absorption or attenuation capability or effect within the frequency ranges typically generated by the automated and/or electronic components of the bidet seat 7600. In other systems, the parameters (d, b, Tp, Dp) of the micro-perforated enclosure 7610 may be calculated, and/or micro-perforations with other parameters may be cut, manufactured, or otherwise implemented, providing the micro-perforated enclosure 7610 with sound absorption or attenuation of various other frequency ranges. Other variations are possible.

In addition to toilets, shower and bathing units may include one or more micro-perforated components to absorb or attenuate noise produced by other water transportation systems, such as the shower, bathing units, or electronic components incorporated into such units.

Figure 77:
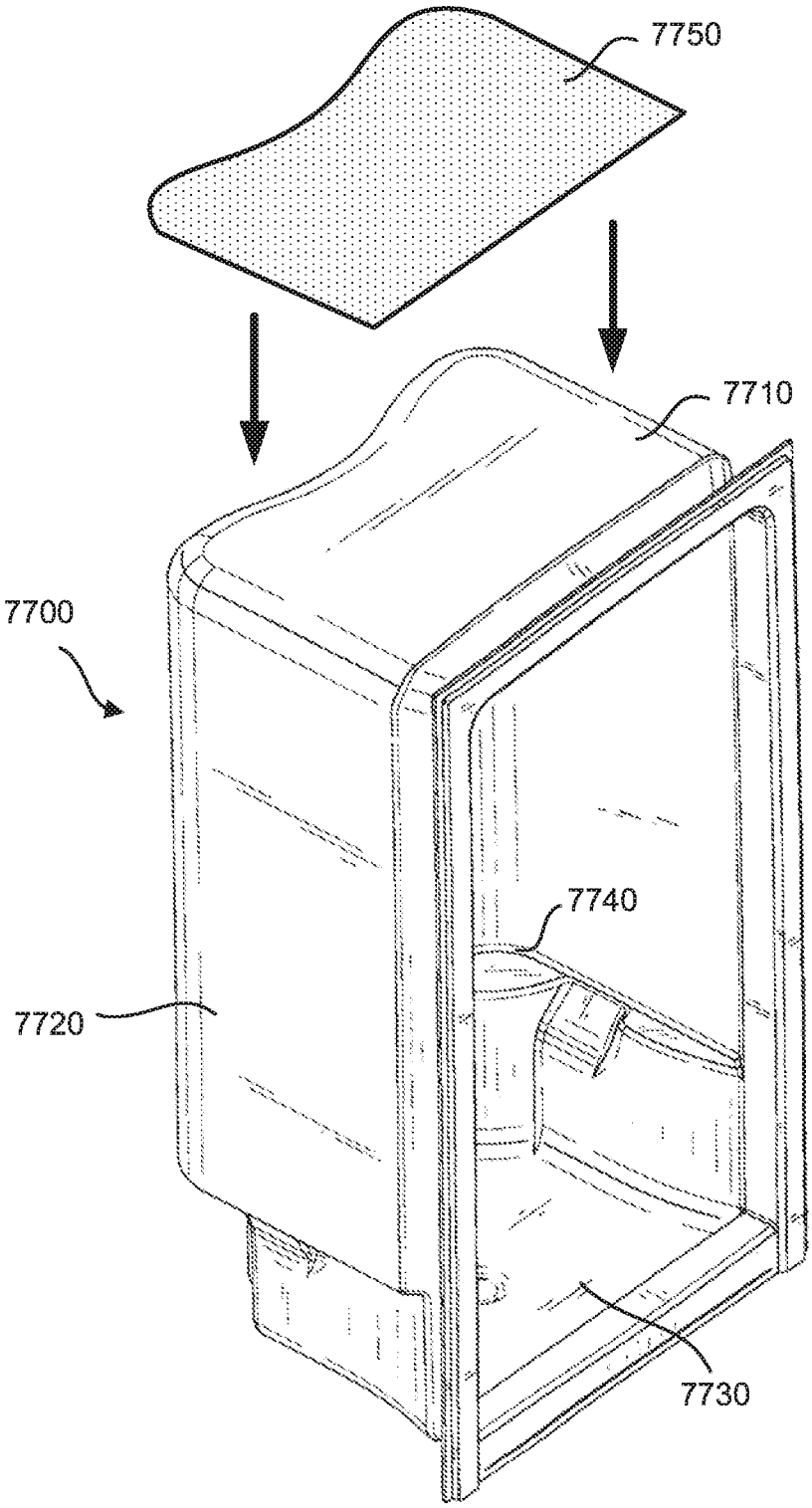
FIG. 77 shows an example shower.

FIG. 77 shows an example shower 7700. The shower 7700 may include a top wall 7710, side walls 7720, a floor or bottom wall 7730, and one or more recesses within the shower 7700, such as a seat recess 7740. The shower 7700 may, for example, be a one or two piece molded shower. In other examples, the shower 7700 may be manufactured or constructed in various ways and parts.

The shower 7700 may be installed in a wall in a home, and one or more bedrooms or living rooms may be positioned adjacent to a wall or backside of the shower 7700. In some configurations, the shower 7700 may be positioned below a bedroom (such as where the shower 7700 is in a finished basement of a home), or above a bedroom (such as where the shower 7700 is placed on a second floor of a two story home). In order to reduce or minimize noise from the shower 7700 experienced in surrounding rooms, the shower 7700 may include one or more micro-perforated walls or panels.

For example, in some configurations, a micro-perforated barrier 7750 may be positioned next to, around, or a distance from an exterior surface of the top wall 7710, or in various other positions. The micro-perforated barrier 7750 may be a micro-perforated panel formed integrally with, or as part of, the top wall 7710. In other examples, the micro-perforated panel 7750 may be a micro-perforated sheet attached separately to the top wall 7710. The micro-perforated barrier 7750 may have a same or similar general shape that conforms to part or all of the top wall 7710, or may be other shapes. The shower 7700 may additionally or alternatively include micro-perforated barriers 7750 that may be positioned next to, around, or a distance from an exterior surface of the other walls (such as the side wall 7720, floor 7730, or recess) of the shower 7700.

In some instances, the micro-perforated barrier 7750 may include separate micro-perforated components that may fit over part or all of each of the surfaces or walls of the shower 7700. In other instances, the micro-perforated barrier 7750 may be a unitary wrap that may cover one or multiple surfaces of the shower 7700. In still other instances, the walls themselves may be or integrally include a micro-perforated sheet or panel, which may provide both sound attenuation and structural support for the shower 7700. In some examples, the micro-perforated barrier 7750 may be positioned between an interior and exterior shower surface (such as in FIG. 74), forming a wall of the shower 7700. Many other variations are possible.

The parameters (d, b, Tp, Dp) of the micro-perforated barrier 7750 may be calculated to provide the micro-perforated barrier 7750 with the greatest absorption or attenuation capabilities or effect within the frequency ranges typically generated by the shower, water flow, or electronics of the shower. One or more manufacturing techniques may implement (or be used to implement) micro-perforations having the parameters (d, b) into a base material of a designated thickness (Tp). The micro-perforated barrier 7750 having parameters (d, b, Tp) may be positioned, attached, and/or secured a distance from a boundary, which may be part of the micro-perforated barrier 7750 where the micro-perforated barrier 7750 is a micro-perforated panel, and which may be a separate boundary wall where the micro-perforated barrier 7750 is a micro-perforated sheet. The positioning of the micro-perforated barrier 7750 may create a cavity of depth Dp corresponding to an appropriate cavity depth Dp that provides the micro-perforated component with the greatest sound absorption or attenuation capability or effect within the frequency ranges typically generated by the shower, water flow, or electronics of the shower. In other systems, the parameters (d, b, Tp, Dp) of the micro-perforated barrier 7750 may be calculated, and/or micro-perforations with other parameters may be cut, manufactured, or otherwise implemented, providing the micro-perforated component with sound absorption or attenuation of various other frequency ranges. Other variations are possible.

Figure 78:
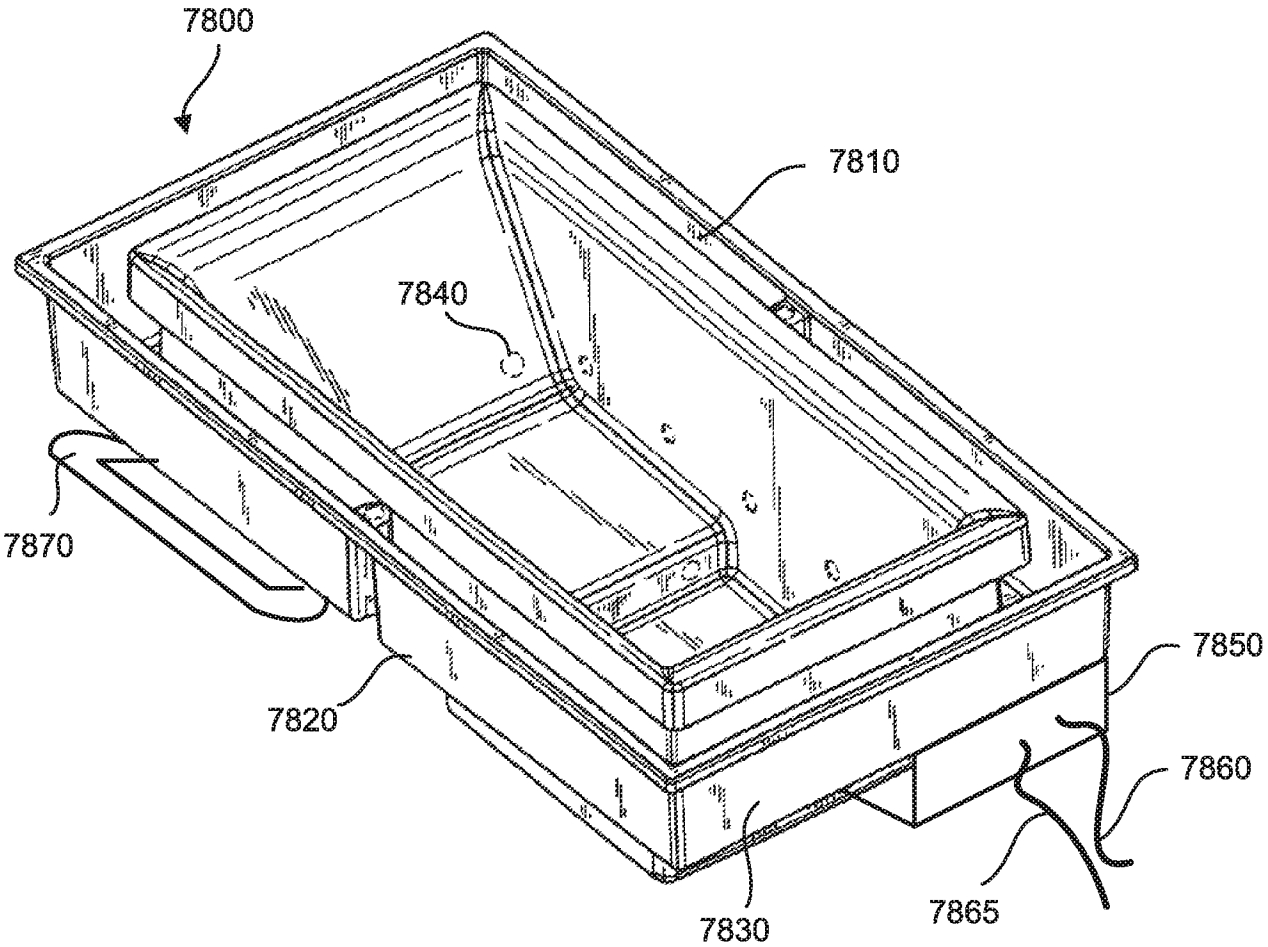
FIG. 78 shows an example whirlpool.

FIG. 78 shows an example whirlpool 7800. The whirlpool 7800 may include a tub 7810 which may be composed of and/or bounded by one or more side 7820 and 7830 and a bottom wall. As with the shower 7700, the whirlpool 7800 may be installed adjacent to surrounding living room or bedroom in a home, for example. In order to reduce or minimize noise from the whirlpool 7800 experienced in surrounding rooms, the whirlpool 7800 may include one or more micro-perforated sheets or panels.

For example, in some configurations, a micro-perforated sheet or panel may be positioned next to, around, or a distance from an exterior surface of the side wall 7820, or in various other positions. The micro-perforated sheet or panel may, in some examples, be formed integrally with, or be part of, the side wall 7820. In other examples, the micro-perforated panel may be attached separately to the side wall 7820. The micro-perforated panel may have a same or similar general shape that conforms to part or all of the side wall 7820, or may be other shapes. The whirlpool 7800 may additionally or alternatively include micro-perforated sheets or panels that may be positioned next to, around, or a distance from an exterior surface of the other walls (such as the side wall 7830 or the floor wall) of the whirlpool 7800. While a whirlpool 7800 is shown in FIG. 78, similar micro-perforated sheets or panels may be used in bathtubs of various shapes.

The whirlpool 7800 may additionally or alternatively include one or more jets 7840. The jets 7840 may be controlled and/or driven by whirlpool pumps and/or electronic controls, each of which may generate noise which may be a nuisance to the bather or people in a surrounding room. The control components (such as the pumps and/or electronic controls) may be positioned below or at a rear portion of the whirlpool 7800, such as in a micro-perforated enclosure 7850 (or an enclosure that includes one or more micro-perforated panels). The micro-perforated enclosure 7850 may enclose part or all of noise-generating pumps and/or electronic controls.

The whirlpool 7800 may additionally or alternatively include one or more water pipes 7870, such as drain pipes. The pipes 7870 may generate noise when water is rushing into or out of the pipes 7870, which may be a nuisance to the bather or people in a surrounding room. The pipe 7870 may be wrapped with, or made with, a micro-perforated pipe wrap. The micro-perforated pipe wrap may enclose part or all of noise-generating pipes. The micro-perforated pipe wrap may be configured with micro-perforates to enable the wrap to absorb sound in the frequency ranges typically generated by the pipes 7870. Similar micro-perforated pipe wraps may be used around various other pips in a house or building, such as water pipes in a wall or floor, or in other areas of the building.

Any of the micro-perforated components of the whirlpool 7800 may additionally be wrapped or covered with a one or more non-micro-perforated components, such as a baffle. Such an additional component may protect the micro-perforated components and preserve the sound attenuation qualities of those materials. Any of the micro-perforated components of the whirlpool 7800 may be micro-perforated sheets positioned a distance Dp from a boundary (such as the whirlpool walls), or may be micro-perforated panels. Other variations are possible.

The parameters (d, b, Tp, Dp) of any of the micro-perforated components in the whirlpool 7800 may be calculated to provide the micro-perforated components with the greatest absorption or attenuation capabilities or effect within the frequency ranges typically generated by the automated and/or electronic components of the whirlpool 7800. One or more manufacturing techniques may implement (or be used to implement) micro-perforations having the parameters (d, b) into a base material of a designated thickness (Tp). The micro-perforated components of the whirlpool 7700 having parameters (d, b, Tp) may be positioned, attached, and/or secured a distance from a noise generating component or boundary, which may be part of the micro-perforated component where the micro-perforated component is a micro-perforated panel, and which may be a separate boundary wall where the micro-perforated component is a micro-perforated sheet. The positioning of the micro-perforated component may create a cavity of depth Dp corresponding to an appropriate cavity depth Dp that provides the micro-perforated component with the greatest sound absorption or attenuation capability or effect within the frequency ranges typically generated by the automated and/or electronic components of the whirlpool 7800. In other systems, the parameters (d, b, Tp, Dp) of the micro-perforated components may be calculated, and/or micro-perforations with other parameters may be cut, manufactured, or otherwise implemented, providing the micro-perforated component with sound absorption or attenuation of various other frequency ranges. Other variations are possible.

Figure 79:
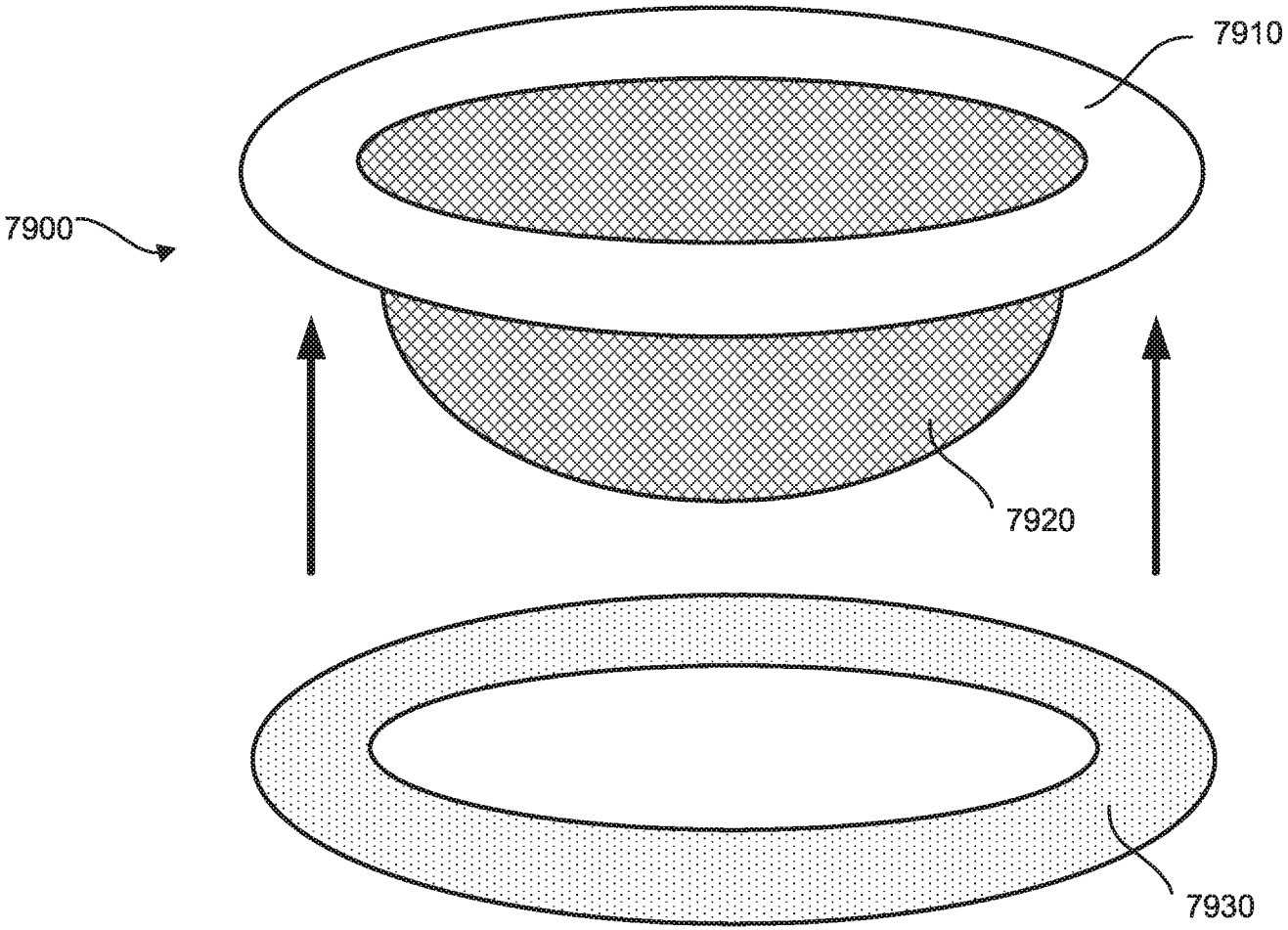
FIG. 79 shows an example drain cover.

Drains and drain covers may include one or more micro-perforated components to absorb or attenuate noise produced by sinks, garbage disposals, pipes, and other noise generating components. FIG. 79 shows an example drain cover 7900. The drain cover 7900 may include a rim 7910 and a filter 7920.

The drain cover 7900 may include one or more micro-perforated components. For example, one or more micro-perforated components 7930 may be part of, attached to, or placed next to a surface of the drain cover 7900, such as the rim 7910. In some examples, the micro-perforated component 7910 and/or the rim 7910 of the drain cover 7900 may be configured to easily be connected (such as by snapping together) or disconnected as desired by the end user. In other examples, the rim 7910 itself may be, or may include, a micro-perforated sheet or panel. In some systems, the filter 7920 may additionally or alternatively be made of, or include, a micro-perforated filter 7920. The micro-perforated panel 7930 and/or a micro-perforated filter may absorb or attenuate sound produced from various components positioned near the drain cover 7900, such as a garbage disposal positioned down a drain.

The micro-perforated components of the drain cover 7900 may be configured to absorb sound in frequency ranges that are normally produced by components near a sink or drain. The parameters (d, b, Tp, Dp) of any of the micro-perforated components of the drain cover 7900 may be calculated to provide the micro-perforated components with the greatest absorption or attenuation capabilities or effect within the frequency ranges typically generated by the sink, garbage disposal, or related components. One or more manufacturing techniques may implement (or be used to implement) micro-perforations having the parameters (d, b) into a base material of a designated thickness (Tp). The micro-perforated components of the drain cover 7900 having parameters (d, b, Tp) may be positioned, attached, and/or secured a distance from a boundary (such as the rim 7910) or noise generating component, creating a cavity of depth Dp corresponding to an appropriate cavity depth Dp that provides the micro-perforated component with the greatest sound absorption or attenuation capability or effect. In other systems, the parameters (d, b, Tp, Dp) of the micro-perforated components may be calculated, and/or micro-perforations with other parameters may be cut, manufactured, or otherwise implemented, providing the micro-perforated component with sound absorption or attenuation of various other frequency ranges. Other variations are possible.

The micro-perforated components described herein, such as the micro-perforated components shown in FIGS. 40-79, may, in some systems, be components made partially or entirely from micro-perforated material. In other systems, the components may include non-micro-perforated portion and at least one micro-perforated portion (or layer) that is wrapped around, secured to, or otherwise positioned next to or a distance from the non-micro-perforated portion. As one non-limiting example the micro-perforated blade cover on a push mower may include a non-micro-perforated outer surface or layer, as well as a micro-perforated inner layer secured to and/or positioned next to or a distance from the non-micro-perforated outer layer. For clarity, the parameters for the micro-perforated components described herein do not need to be calculated prior to each implementation. Rather, the parameters may be known, estimated, or not known prior to implementation without any actual calculations required.

Any of the micro-perforated components within these systems may be or include multiple micro-perforated sheets or micro-perforated panels. For example, two micro-perforated sheets may be placed together, or separated by a distance that correspond to a Dp for maximizing or increasing the sound absorption or attenuation properties of one or both of the micro-perforated sheets. Each of the multiple micro-perforated sheets or micro-perforated panels may have parameters which are similar or identical, to improve the absorption over a certain frequency range. For example, where a fan generates a significant level of noise over a small frequency range, the addition of an identical sheet of micro-perforated metal a determined distance from a first sheet of micro-perforated metal may provide additional absorption to reduce the noise of the fan over the small frequency range. Alternatively or additionally, one or more of the multiple micro-perforated sheets or micro-perforated panels may have parameters which are different to absorb noise at different frequency ranges. For example, where an engine generates noise over a wide frequency range, or in two (or more) frequency ranges, a micro-perforated component may include two (or more) sheets of micro-perforated metal, with each sheet configured to absorb noise over a different portion of the wide frequency range, or over different frequency ranges. Other variations are possible.

As mentioned, any of the micro-perforated components described herein may have micro-perforates that are set and/or positioned to maximize sound absorption or attenuation within various sound frequency ranges. As some examples, the hole diameter of the micro-perforates may be between 0.1 mm and 0.4 mm. In some instances, larger optimum hole diameters may correspond or lead to lower maximum absorption frequencies (and vice versa). As another example, the sheet thickness of the micro-perforated material may be between 0.1 mm and 0.4 mm. In some instances, thicker micro-perforated material (for example, sheet metal) may correspond or lead to lower maximum absorption frequencies (and vice versa). As another example, the hole spacing (center to center) of the perforates in the micro-perforated material may be between 1 and 10 mm. In some instances, larger (or more spread out) hole spacings may correspond or lead to lower maximum absorption frequencies (and vice versa). As yet another example, a cavity depth behind a micro-perforated material may be between 5 mm and 100 mm. In some instances larger cavity depths may correspond to or lead to lower maximum absorption frequencies (and vice versa).

Various algorithms may be used, and/or calculations conducted, such as by a processor or computer system associated with a micro-perforation creation device (such as a laser), to determine the appropriate size, thickness, spacing, and cavity depth to maximize sound absorption or attenuation for the various components and tasks discussed herein. For example, a processor may measure or receiving information about one or more of the following air properties:

T=Temperature [degrees Celsius]

$T_F$=Temperature [degrees Fahrenheit]

P=Atmospheric Pressure [kPa]

$R_H$=Relative Humidity [%]

η=Dynamic Viscosity [kg/m/s]

ρ=Air Density [kg/m$^3$]

c=Speed of Sound [m/s]

γ=Adiabatic index number

Figure 80:
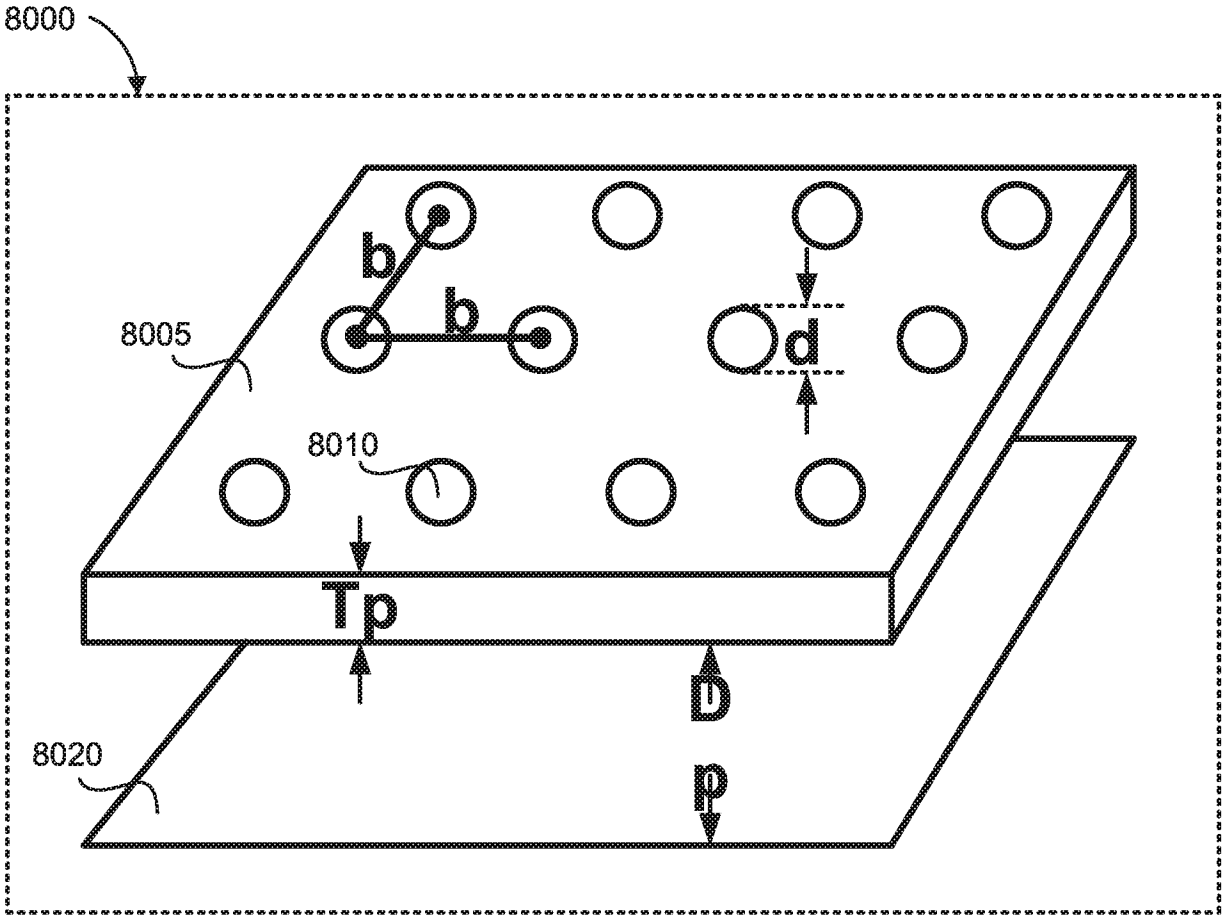
FIG. 80 shows an example micro-perforated panel.

FIG. 80 shows an example of a micro-perforated panel 8000. The micro-perforated panel may include one or more micro-perforated sheet 8005 and one or more additionally boundary walls or panels 8020. The micro-perforated sheet 8005 (not to scale) with various micro-perforations 8010 in a square pattern. Various other patterns (such as triangular, pentagonal, staggered, or random) of micro-perforations may be used or incorporated into the micro-perforated sheet 8005. FIG. 80 further identifies the following parameters of the micro-perforated sheet 8005, one or more of which may be set and controlled during a creation or manufacturing of the micro-perforated sheet 8005:

d=Micro-perforate hole diameter [m]

b=Micro-perforate hole spacing (center to center) [m]

Tp=Micro-perforated sheet thickness [m]

Dp=Cavity depth between micro-perforated sheet and additional wall 8020 [m]

The dimensions and sizing of the parameters of the micro-perforated panel 8000 may be set to maximize the sound absorption and/or attenuation properties of the panel 8000 at or near a target frequency f (in Hz). The following intermediate equations/calculations may be considered and/or performed as part of the dimension and sizing of the parameters of the micro-perforated sheet 8005 for a square pattern:

$$P_{V,sat}=0.61121*e^{((17.67*T)/(T+243.5))}$$

where $P_{V,sat}$ is a saturated vapor pressure [kPa]

$$P_V=((R_H/100)*P_{V,sat})/100$$

where $P_V$ is a vapor pressure [kPa]

$$R_{mix}=0.622*(P_V/(P-P_V))$$

where $R_{mix}$ is a mixture ratio $$p=*(1+R_{mix}))/((0.28703*(T+273.15))*(1+1.16078*R_{mix}))$$

$$\eta=((0.01827*(0.555*524.07+120))/((0.555*(T_F+459.67))+120))*((T_F+459.67)/524.07)^{3/2}*0.001$$

$$C=(((\gamma*8.31451*(T+273.15))/0.289645)^{1/2}$$

Using the measurable air properties and results of the intermediate calculations, dimensions and sizing of the parameters of the micro-perforated sheet 8005 for a square pattern may be determined and/or set to maximize the sound absorption and/or attenuation properties of the sheet 8005 at or near the target frequency f (in Hz). The following micro-perforate equations/calculations may be considered and/or performed to determine the appropriate parameters of the micro-perforated sheet 8005 for a square pattern to maximize the attenuation at the target frequency f:

$$\omega=2*\pi*f$$

where ω is an angular velocity [rad/s]

$$d_v=((2*\eta)/(\rho*\omega))^{1/2}$$

where $d_v$ is a surface energy dissipation [(m*s)$^{1/2}$]

$$k=d/((\sqrt{2})*d_v)$$

where k is a perforate constant [1/s]

$$k_r=((1+k^2)/32)^{1/2}+((\sqrt{2})/32)*k*(d/Tp)$$

where $k_r$ is a resistance coefficient $$k_m=1+(1+(k^2/2))^{-1/2}+0.85*(d/Tp)$$

where $k_m$ is a mass reactance coefficient $$\sigma=(\pi/4)*(d/b)^2$$

where σ is a perforation area ratio $$r=((32*\eta*Tp)/(\sigma*\rho*c*d^2))*k_r$$

where r is a real part of acoustic impedance $$\omega_m=(\omega*Tp)/(\sigma*c))*k_m$$

where $\omega_m$ is an imaginary part of acoustic impedance $$Z=r+(i*\omega_m)$$

where Z is an acoustic impedance $$\tau=(4*r)/((1+r)^2+(\omega_m-\cot(\omega*(Dp/c)))^2)$$

where τ is an absorption coefficient

Figure 81:
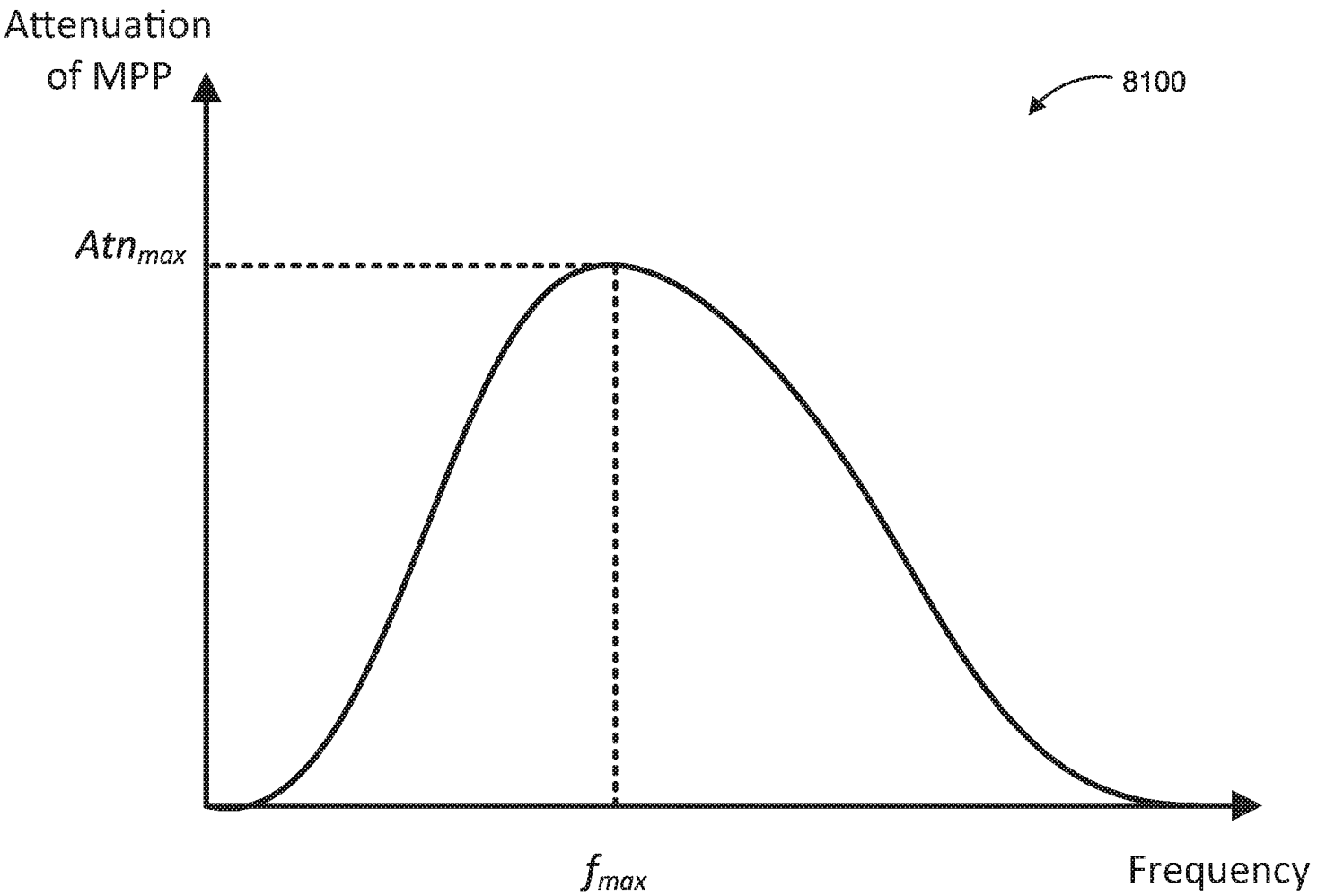
FIG. 81 shows an example graph showing sound attenuation levels over various frequencies.

FIG. 81 illustrates an example graph 8100 showing sound attenuation levels over various frequencies. The wavelength associated with a frequency $f_{max}$ at which maximum attenuation $Attn_{max}$ is achieved usually corresponds to between four and ten times the depth Dp of the air space C between the sheet 8005 and the additional wall 8020. Understanding this relationship and knowing a frequency of typical noise to be attenuated, the depth Dp of the air space C may be set to between 1/10 and 1/4 of the wavelength for sound at the frequency of typical noise to be attenuated. Other variations are possible.

The preceding are only some example calculations that may be performed to determine or set the parameters of a micro-perforated component having a square pattern of micro-perforates. Parameters of square-pattern micro-perforated components may be calculated or estimated in various other ways. Additionally, parameters of micro-perforated components having other patterns may be calculated in various other ways.

One or more of the micro-perforate hole diameter (d), the hole spacing (b), the sheet thickness (Tp), the cavity depth between the micro-perforated sheet 8005 and an additional wall 8020 (Dp), the positioning or pattern of the micro-perforated holes 8010, and/or the shape of the micro-perforated holes 8010 may vary within the same micro-perforated panel 8000. For example, the holes 8010 of a micro-perforated sheet 8005 may have the same diameter or may have non-uniform diameters, may be circular or various other shapes such as a slit, square, oval, or slot-shaped, and may have any other suitable configuration. As another example, the spacing of the holes 8010 in a micro-perforated sheet 8005 may vary at different points or positions on the sheet 8005. Holes do not need to be in a square or regular pattern, but may instead by staggered or any other configuration. As another example, the thickness Tp of the sheet 8005 may change at a point or throughout the span of the sheet 8005. As another example, the depth Dp of the air space C behind the sheet 8005 may not be the same at all points along the span of the sheet 8005.

Figure 82:
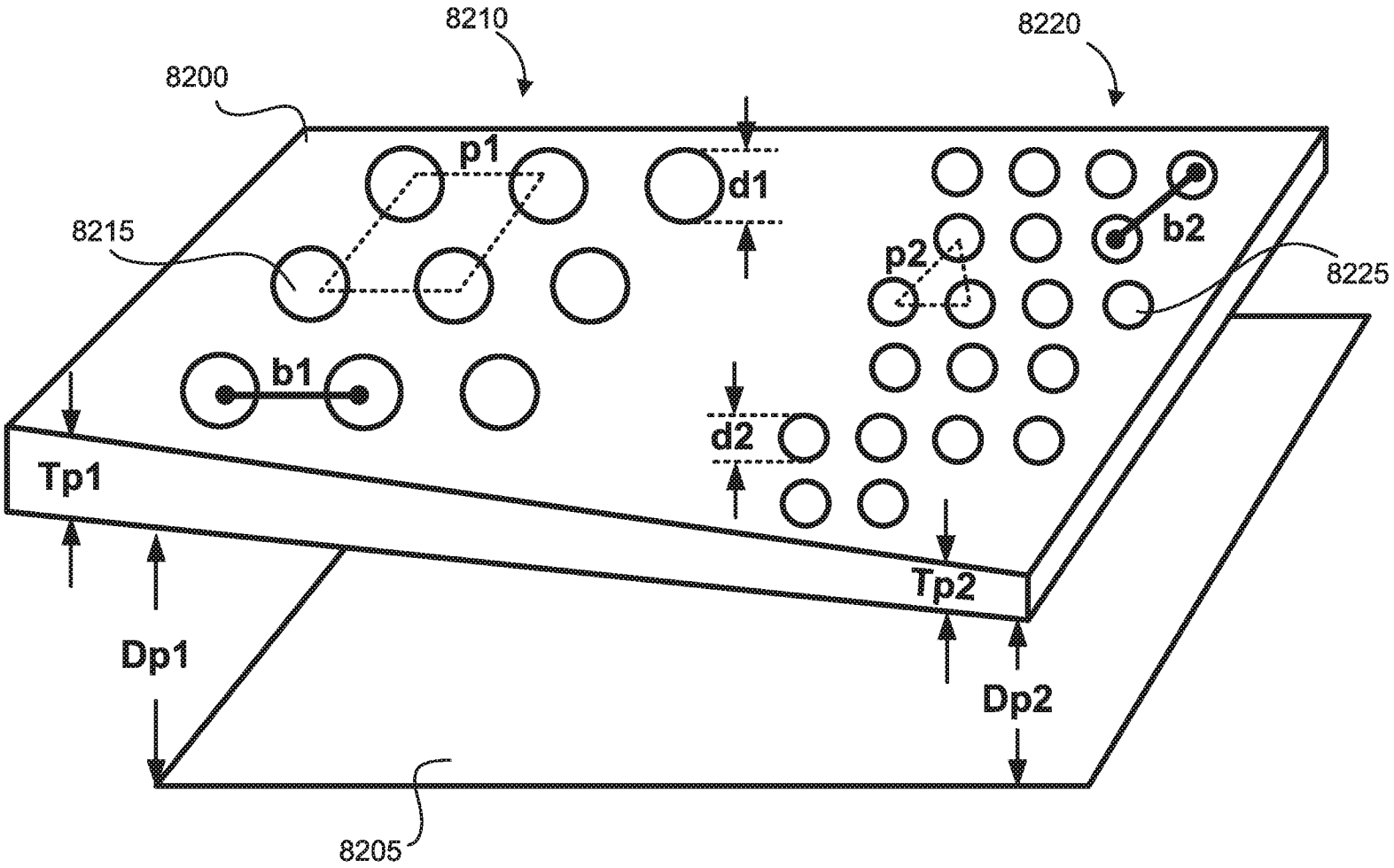
FIG. 82 shows an example micro-perforated sheet.

FIG. 82 shows an example micro-perforated sheet 8200 wherein each of the parameters d, b, Tp, Dp, and hole pattern change from a first portion 8210 of the micro-perforated sheet 8200 to a second portion 8220 of the micro-perforated sheet 8200. In a first portion 8210 of the micro-perforated sheet 8200, the micro-perforated holes 8215 may have a first hole diameter d1, a first hole spacing b1, a first sheet thickness Tp1, and a first cavity depth Dp1. The micro-perforated holes 8215 may additionally or alternatively be positioned in a first pattern p1, such as a square hole pattern. Given the parameters of the micro-perforations 8215 in the first portion 8210, the micro-perforated panel 8200 may be set and/or capable of absorbing or attenuating sound at a first set of frequencies or first frequency range.

At a second portion 8220, the micro-perforated holes 8225 may have different parameters from the micro-perforated holes 8215 in the first portion 8210. For example, the micro-perforated holes 8225 may have a second hole diameter d2, a second hole spacing b2, a second sheet thickness Tp2, and a second cavity depth Dp2. Additionally or alternatively, the micro-perforated holes 8225 may be positioned in a second pattern p2, such as a triangular hole pattern. The micro-perforations in the micro-perforated panel 8200 may gradually change from the parameters in the first portion 8210 to the parameters in the second portion 8220, or may change dramatically at a point or line. Given the parameters of the micro-perforations 8225 in the second portion 8220, the micro-perforated panel 8200 may be set and/or capable of absorbing or attenuating sound at a second set of frequencies or first frequency range. While only two portions are shown, a micro-perforated panel 8200 may include many different portions, each having the same, similar, or different parameter sets.

In various alternative systems, only one or some of the parameters d, b, Tp, Dp, and pattern of the micro-perforations 8215 and 8225 may be different between two portions 8210 and 8220 of a micro-perforated panel. For example, a micro-perforated panel 8200 may have a uniform thickness, but different micro-perforated hole sizes d, spacings b, or patterns. As another example, a micro-perforated panel 8200 may have uniform hole sizes d, spacings, b, and pattern, but may be curved or rounded over a boundary wall, creating a varying cavity depth Dp with the boundary wall. Many other variations are possible.

Figure 83:
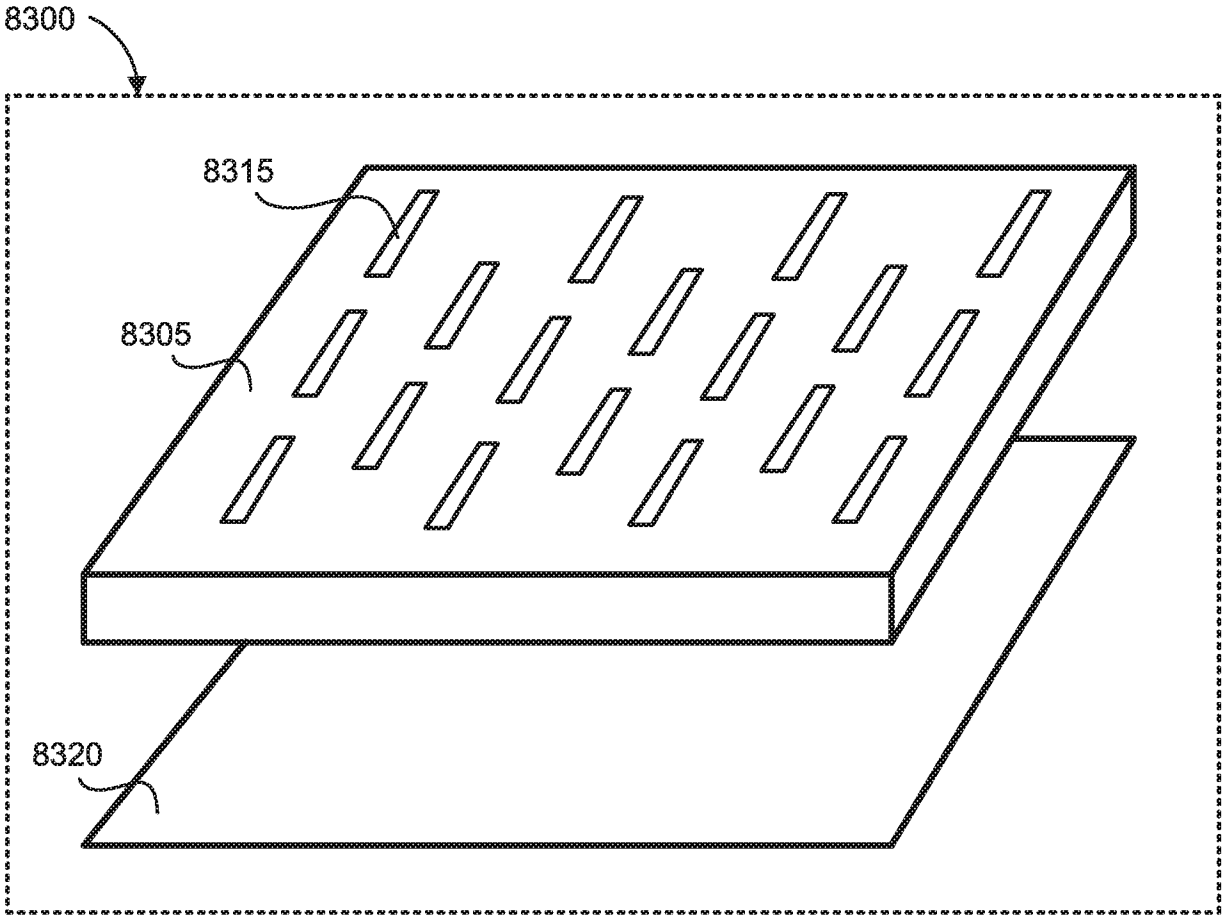
FIG. 83 shows an example micro-perforated panel.

As noted, the holes of a micro-perforated sheet may be various other shapes and diameters. FIG. 83 shows an example micro-perforated panel 8300 having a micro-perforated sheet 8305 and a boundary wall 8320. The micro-perforated sheet 8305 in FIG. 83 includes slot-shaped holes 8310. Other variations are possible.

Figure 84:
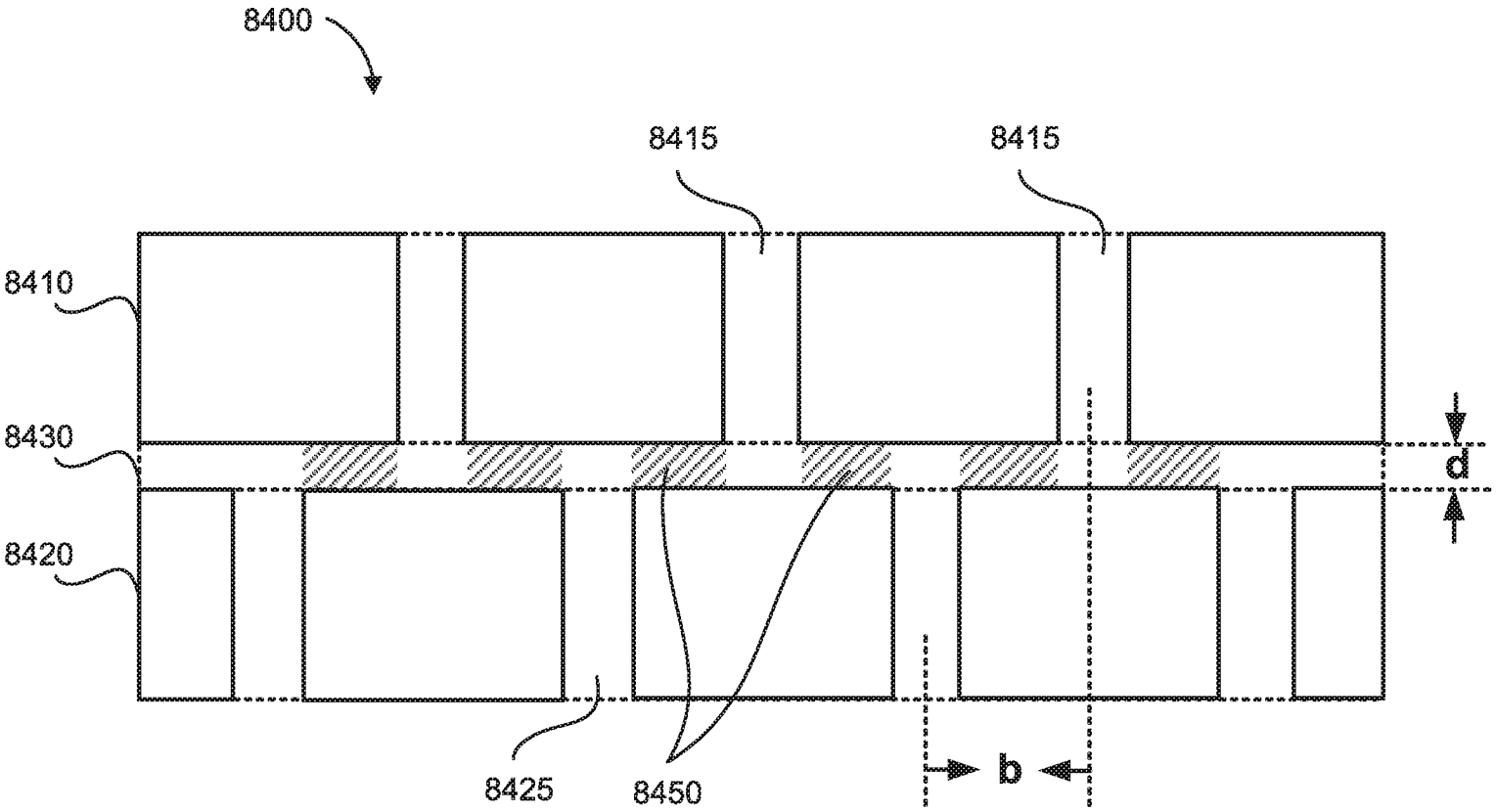
FIG. 84 shows an example micro-perforated sheet.

Micro-perforated sheets and panels may additionally or alternatively be formed in various other ways. FIG. 84 shows an alternative micro-perforated sheet 8400. The micro-perforated sheet 8400 includes a first perforated layer 8410 with holes 8415. The micro-perforated sheet 8400 may additionally or alternatively include a second perforated layer 8420 with holes 8420. The two layers 8410 and 8420 may be separated by a third layer 8430.

The micro-perforated sheet 8400 may attenuate sound in a different manner than the micro-perforated sheets 8005 and 8200. For example, the holes 8415 and 8420 do not need to be micro-perforates, but rather may be larger holes (such as 2 mm). The micro-perforates in the micro-perforated sheet 8400 may instead be represented by the portions 8450 of the third layer 8430 where the first layer 8410 and the second layer 8420 overlap. These micro-perforates 8450 may have a hole size d that may be or correspond to the thickness of the third layer 8430. The micro-perforates 8450 may additionally have a hole spacing b that may be set and correspond to the distance between the holes 8415 and 8425. The micro-perforated sheet 8400 may thus be constructed without requiring a laser or similar technique, as the micro size of the micro-perforate instead corresponds just to the thickness of the third layer 8430. The holes, spacing, and other parameters may be set, manufactured, and/or adjusted to meet the particular frequency and sound attenuation desires of the system. Many other variations and types of micro-perforated sheets and panels are possible.

While the foregoing description and drawings represent some example systems, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A generator set comprising:

an internal combustion engine;

an enclosure comprising a plurality of exterior side walls defining a perimeter and an internal space, the engine disposed in the internal space; and an openable cover attached to the enclosure that provides access to the internal space;

at least one exterior side wall of the plurality of exterior side walls comprises a micro-perforated exterior barrier;

wherein the micro-perforated exterior barrier of the at least one exterior side wall comprises a micro-perforated panel including a micro-perforated sheet and an outermost wall of the at least one exterior side wall defining a boundary wall spaced apart from the micro-perforated sheet by an empty gap.

2. The generator set according to claim 1, wherein the micro-perforated exterior barrier of the at least one exterior side wall comprises is a micro-perforated sheet positioned a distance from an inside of an outermost wall of the at least one exterior side wall.

3. The generator set according to claim 1, wherein the micro-perforated exterior barrier of the at least one exterior side wall comprises a micro-perforated sheet positioned adjacent to an outermost wall of the at least one exterior side wall.

4. The generator set according to claim 1, wherein all of the side exterior walls comprise a micro-perforated exterior barrier.

5. The generator set according to claim 1, further comprising a bottom exterior wall of the enclosure positioned beneath the engine, the bottom exterior wall comprising a micro-perforated exterior barrier.

6. The generator set according to claim 5, wherein all of the exterior walls comprise a micro-perforated exterior barrier.

7. The generator set according to claim 1, further comprising a micro-perforated interior cover barrier attached to an inside of the cover, the interior cover barrier comprising a first micro-perforated sheet having a plurality of micro-perforated holes configured to absorb sound within a first absorption frequency range based on parameters of the first micro-perforated sheet.

8. The generator set according to claim 7, wherein the cover is hingedly attached to the enclosure.

9. The generator set according to claim 1, further comprising a first micro-perforated interior barrier disposed in the enclosure between the engine and one of the exterior side walls of the enclosure.

10. The generator set according to claim 9, wherein the first micro-perforated interior barrier comprises a first micro-perforated sheet.

11. The generator set according to claim 10, wherein the first micro-perforated interior barrier is a micro-perforated panel comprising a combination of the first micro-perforated sheet and a separate boundary wall.

12. The generator set according to claim 10, further comprising a second micro-perforated interior barrier.

13. The generator set according to claim 12, wherein the second micro-perforated interior barrier is attached to an underside of the cover.

14. The generator set according to claim 12, wherein the first micro-perforated sheet of the first micro-perforated interior barrier has a plurality of micro-perforated holes configured to absorb sound within a first absorption frequency range, and the second micro-perforated interior barrier includes a second micro-perforated sheet having a plurality of micro-perforated holes configured to absorb sound within a second absorption frequency range different than the first absorption frequency range.

15. The generator set according to claim 9, wherein the first micro-perforated interior barrier separates the engine from other equipment inside the enclosure.

16. The generator set according to claim 1, further comprising an alternator junction box disposed in the enclosure, the alternator junction box comprising a micro-perforated sheet having a plurality of micro-perforated holes configured to absorb sound within an absorption frequency range.

17. The generator set according to claim 1, wherein the generator set is a fixed or variable speed generator set.

18. The generator set according to claim 1, wherein the engine of the generator set is a liquid-cooled engine comprising a radiator system including a radiator and a micro-perforated radiator shroud positioned around part or all of the radiator, the micro-perforated radiator shroud comprising a micro-perforated sheet having a plurality of micro-perforated holes configured to absorb sound within an absorption frequency range.

19. A generator set comprising:

an internal combustion engine;

an enclosure comprising a plurality of exterior side walls defining a perimeter and an internal space, the engine disposed in the internal space; and an openable cover attached to the enclosure that provides access to the internal space;

wherein the exterior side walls each comprise a micro-perforated exterior barrier including an outermost wall and a first micro-perforated sheet having a plurality of micro-perforated holes configured to absorb sound within a first absorption frequency range based on parameters of the micro-perforated sheet;

wherein each first micro-perforated sheet is spaced apart from its respective outermost wall by an empty gap.

20. The generator set according to claim 19, further comprising a micro-perforated interior cover barrier attached to an inside of the cover, the interior cover barrier comprising a second micro-perforated sheet having a plurality of micro-perforated holes configured to absorb sound within a second absorption frequency range based on parameters of the second micro-perforated sheet.

21. The generator set according to claim 20, wherein the second micro-perforated sheet is not in contact with the first micro-perforated sheet.

22. A generator set comprising:

an internal combustion engine;

an enclosure comprising a plurality of exterior side walls defining a perimeter and an internal space, the engine disposed in the internal space; and an openable cover attached to the enclosure that provides access to the internal space;

at least one exterior side wall of the plurality of exterior side walls comprises a micro-perforated exterior barrier;

wherein the micro-perforated exterior barrier of the at least one exterior side wall comprises a micro-perforated panel including a micro-perforated sheet and an outermost wall of the at least one exterior side wall defining a boundary wall spaced apart from the micro-perforated sheet by an empty gap;

wherein the micro-perforated exterior barrier includes a first portion having micro-perforate parameters tuned to absorb noise within a first frequency band and the same micro-perforated exterior barrier including a second portion having micro-perforate parameters tuned to absorb noise within a second frequency band.

* * * * *